US012742449B2

(12) United States Patent
McCarthy

(10) Patent No.: US 12,742,449 B2
(45) Date of Patent: Sep. 22, 2026

(54) MULTI-PHASE FLUID PUMP SYSTEM WITH DRIVING FLUID AND PUMP FLUID CYLINDERS AND BUFFER CHAMBERS

(71) Applicant: I-JACK TECHNOLOGIES INCORPORATED, Moosomin (CA)

(72) Inventor: Dan McCarthy, Moosomin (CA)

(73) Assignee: I-JACK TECHNOLOGIES INCORPORATED, Moosomin (CA)

( * ) Notice: Subject to any disclaimer, the term of this patent is extended or adjusted under 35 U.S.C. 154(b) by 0 days.

(21) Appl. No.: 18/388,629

(22) Filed: Nov. 10, 2023

(65) Prior Publication Data

US 2024/0263628 A1 Aug. 8, 2024

Related U.S. Application Data

(63) Continuation of application No. 16/930,932, filed on Jul. 16, 2020, now Pat. No. 11,952,995.

(30) Foreign Application Priority Data

Feb. 28, 2020 (CA) ..... 3074365

(51) Int. Cl.
*F04B 49/00* (2006.01)
*E21B 43/12* (2006.01)
(Continued)

(52) U.S. Cl.
CPC ..... *F04B 49/002* (2013.01); *E21B 43/126* (2013.01); *F04B 9/113* (2013.01); *F04B 27/02* (2013.01); *F04B 47/04* (2013.01)

(58) Field of Classification Search
CPC ..... F04B 49/002; F04B 9/113; F04B 27/02; F04B 35/008; F04B 47/04; F04B 49/12;
(Continued)

(56) References Cited

U.S. PATENT DOCUMENTS 1,619,475 A 3/1927 Hubbard
2,303,597 A 12/1942 Adelson
(Continued)

FOREIGN PATENT DOCUMENTS

CA 2165063 A1 3/1995
CA 2309970 C 7/1999
(Continued)

OTHER PUBLICATIONS

"Gas oil ratio as related to the decline of oil production, with notes on the effect of controlled pressure", CV Millikan, 1926 (Year: 1926).*

(Continued)

*Primary Examiner* — Nathan C Zollinger

(57) ABSTRACT

A method and system are disclosed for pumping a multi-phase fluid from an oil well. The method may comprise delivering a flow of a multi-phase fluid to a multi-phase fluid pumping system, wherein the multi-phase fluid has a gas/liquid ratio that varies during operation. The multi-phase fluid pumping system is operated to increase the pressure of the multi-phase fluid that is delivered thereto. Thereafter the flow of pressurized multi-phase fluid is delivered from the multi-phase fluid pumping system to one or more discharge conduits. The pump system may have a pump fluid chamber between opposed pairs of buffer chambers and driving fluid chambers. Seals may be provided to seal the respective chambers.

42 Claims, 55 Drawing Sheets

(51) Int. Cl.
*F04B 9/113* (2006.01)
*F04B 27/02* (2006.01)
*F04B 47/04* (2006.01)

(58) Field of Classification Search
CPC ..... F04B 2201/121; F04B 2203/09; E21B 43/126
See application file for complete search history.

(56) References Cited

U.S. PATENT DOCUMENTS

| | | | | |
|---|---|---|---|---|
| 2,946,316 | A | 7/1960 | Bruehl | |
| 3,632,234 | A | 1/1972 | Lake | |
| 3,801,230 | A | 4/1974 | Brown | |
| 4,008,012 | A | 2/1977 | Page | |
| 4,013,385 | A | 3/1977 | Peterson | |
| 4,380,150 | A | 4/1983 | Carlson | |
| 4,390,322 | A | 6/1983 | Budzich | |
| 4,512,151 | A | 4/1985 | Yamatani | |
| 4,515,516 | A | 5/1985 | Perrine et al. | |
| 4,516,473 | A | 5/1985 | Oneyama et al. | |
| 4,653,986 | A | 3/1987 | Ashton | |
| 4,761,118 | A | 8/1988 | Zanarini | |
| 4,861,239 | A | 8/1989 | Simmons et al. | |
| 4,949,805 | A | 8/1990 | Mather et al. | |
| 4,990,058 | A | 2/1991 | Eslinger | |
| 5,238,372 | A | 8/1993 | Morris | |
| 5,281,100 | A | 1/1994 | Diederich | |
| 5,450,901 | A | 9/1995 | Ellwood | |
| 5,481,873 | A | 1/1996 | Saruwatari et al. | |
| 5,584,664 | A | 12/1996 | Elliott et al. | |
| 5,622,478 | A | 4/1997 | Elliott et al. | |
| 5,743,716 | A | 4/1998 | Smith | |
| 5,782,612 | A | 7/1998 | Margardt | |
| 5,807,083 | A | 9/1998 | Tomoiu | |
| 5,868,122 | A | 2/1999 | Gram et al. | |
| 6,408,736 | B1 | 6/2002 | Holt et al. | |
| 6,422,313 | B1 | 7/2002 | Knight | |
| 6,435,843 | B1 | 8/2002 | Hur | |
| 6,568,911 | B1 | 5/2003 | Brightwell et al. | |
| 6,652,241 | B1 | 11/2003 | Alder | |
| 6,966,367 | B2 | 11/2005 | Butler et al. | |
| 7,074,020 | B2 | 7/2006 | Navarro | |
| 7,255,540 | B1 | 8/2007 | Cooper | |
| 7,527,482 | B2 | 5/2009 | Ursan et al. | |
| 7,604,064 | B2 * | 10/2009 | Irwin, Jr. ..... | F04B 25/00 417/403 |
| 7,730,939 | B2 | 6/2010 | Merrick, III | |
| 7,762,321 | B2 | 7/2010 | Fesi et al. | |
| 7,766,079 | B2 | 8/2010 | Hoffarth | |
| 8,046,990 | B2 | 11/2011 | Bollinger et al. | |
| 8,047,820 | B2 | 11/2011 | Merrick, III | |
| 8,066,496 | B2 | 11/2011 | Brown | |
| 8,136,586 | B2 | 3/2012 | Merrick, III | |
| 8,147,218 | B2 | 4/2012 | Thrasher et al. | |
| 8,161,741 | B2 | 4/2012 | Ingersoll et al. | |
| 8,226,370 | B2 | 7/2012 | Wu et al. | |
| 8,297,362 | B1 | 10/2012 | Strider et al. | |
| 8,387,375 | B2 | 3/2013 | Blieske | |
| 8,851,860 | B1 | 10/2014 | Mail | |
| 9,109,511 | B2 | 8/2015 | Ingersoll et al. | |
| 9,359,876 | B2 | 6/2016 | Fink | |
| 9,605,805 | B2 | 3/2017 | Calvin et al. | |
| 9,745,975 | B2 | 8/2017 | Dancek | |
| 9,816,497 | B2 | 11/2017 | Strickland et al. | |
| 10,072,487 | B2 | 9/2018 | McCarthy | |
| 10,087,924 | B2 | 10/2018 | McCarthy | |
| 10,167,857 | B2 | 1/2019 | McCarthy | |
| 10,544,783 | B2 | 1/2020 | McCarthy | |
| 10,876,523 | B2 * | 12/2020 | Bridges ..... | F04B 7/02 |
| 11,952,995 | B2 * | 4/2024 | McCarthy ..... | F04B 19/06 |
| 2004/0162658 | A1 | 8/2004 | Newman | |
| 2005/0103576 | A1 | 5/2005 | Engstrom | |
| 2005/0173019 | A1 | 8/2005 | Navarro | |
| 2005/0175476 | A1 | 8/2005 | Patterson | |
| 2005/0180864 | A1 | 8/2005 | Ursan et al. | |
| 2006/0175062 | A1 * | 8/2006 | Benson ..... | F17D 1/16 166/335 |
| 2007/0041847 | A1 | 2/2007 | Inoue et al. | |
| 2009/0194291 | A1 | 8/2009 | Fesi et al. | |
| 2009/0246049 | A1 | 10/2009 | Merrick, III | |
| 2010/0172771 | A1 | 7/2010 | Hoffarth | |
| 2012/0204548 | A1 | 8/2012 | Turnis et al. | |
| 2012/0224977 | A1 | 9/2012 | Sotz et al. | |
| 2012/0247785 | A1 | 10/2012 | Schmitt | |
| 2013/0094978 | A1 | 4/2013 | Hoffarth | |
| 2014/0093395 | A1 | 4/2014 | Leavy et al. | |
| 2014/0219830 | A1 | 8/2014 | Strickland et al. | |
| 2014/0231093 | A1 | 8/2014 | Hoell | |
| 2014/0294635 | A1 | 10/2014 | Rietkerk | |
| 2014/0353391 | A1 | 12/2014 | Burklin et al. | |
| 2014/0377081 | A1 | 12/2014 | Bagagli et al. | |
| 2015/0233368 | A1 | 8/2015 | Gallaway | |
| 2015/0240799 | A1 | 8/2015 | Obrejanu et al. | |
| 2015/0361970 | A1 | 12/2015 | White et al. | |
| 2016/0032911 | A1 | 2/2016 | McCoy | |
| 2016/0258426 | A1 | 9/2016 | Tao et al. | |
| 2017/0321526 | A1 | 11/2017 | McCarthy | |
| 2018/0030978 | A1 * | 2/2018 | McCarthy ..... | F04B 9/113 |
| 2018/0334894 | A1 * | 11/2018 | Arlandis ..... | F04B 47/02 |
| 2019/0257306 | A1 | 8/2019 | Blundell et al. | |
| 2020/0040882 | A1 | 2/2020 | Kalmari et al. | |

FOREIGN PATENT DOCUMENTS

| | | | | |
|---|---|---|---|---|
| CA | 2353391 | A1 | 6/2000 | |
| CA | 2331931 | A1 | 7/2002 | |
| CA | 2379766 | C | 10/2004 | |
| CA | 2644346 | A1 | 5/2010 | |
| CA | 2803208 | A1 | 2/2012 | |
| CA | 2891110 | A1 | 5/2013 | |
| CA | 2599447 | C | 7/2013 | |
| CA | 2843321 | C | 2/2015 | |
| CA | 2861781 | C | 3/2016 | |
| CN | 2445111 | Y | 8/2001 | |
| CN | 1326050 | A | 12/2001 | |
| CN | 201103527 | Y | 8/2008 | |
| CN | 201103528 | Y | 8/2008 | |
| CN | 201225264 | Y | 4/2009 | |
| CN | 202108682 | U | 1/2012 | |
| CN | 202360325 | U | 8/2012 | |
| CN | 202674817 | U | 1/2013 | |
| DE | 202012104058 | U1 * | 3/2014 | ..... F04B 15/02 |
| FR | 3003906 | A1 * | 10/2014 | ..... F04B 39/041 |
| WO | WO-9008897 | A1 * | 8/1990 | |
| WO | 2011/079267 | A1 | 6/2011 | |
| WO | 2011/079271 | A2 | 6/2011 | |
| WO | 2012/012896 | A1 | 2/2012 | |
| WO | 2013/064748 | A1 | 5/2013 | |
| WO | 2013/071134 | A1 | 5/2013 | |
| WO | 2013/177268 | A1 | 11/2013 | |
| WO | 2014/113545 | A1 | 7/2014 | |
| WO | 2016/037500 | A1 | 3/2016 | |

OTHER PUBLICATIONS

English Machine Translation of DE-202012104058-U1 (Year: 2014).*
Brahma Compression Ltd., "CGR50 Casing Gas Recovery Unit", www.gascompressors.ca, before Apr. 21, 2016, 8 pages.
Brittania Industries 2009 Inc., "Casing Gas Compressor Packages", www.brittaniaindustries.com, before Apr. 21, 2016, 2 pages.
Broadwind Energy and Safe North America, "CNG Boost™ (Hydraulic Compressor) System Operation and Technology Overview", www.bwen.com and www.safegas.it/en/, before Apr. 21, 2016, 3 pages.
Karl Bratt; Jonathan Haines; Andrew Hall; and Brandon Koster, "Project Proposal & Feasibility Study NaturaFill: Fuel for Thought", © 2013, Karl Bratt, Jonathan Haines, Andrew Hall, Brandon Koster, and Calvin College, Updated: Dec. 9, 2013, 59 pages.
Karl Bratt; Jonathan Haines; and Brandon Koster, "Final Design Report NaturaFill: Fuel for Thought", © 2014, Karl Bratt, Jonathan Haines, Brandon Koster, and Calvin College, Updated: May 15, 2014, 112 pages.

(56) References Cited

OTHER PUBLICATIONS

Chemac Inc., "Hofer Piston compressors with hydraulic drive unit", www.chemacinc.com, before Apr. 21, 2016, 4 pages.
Corken, Inc. (A Unit of IDEX Corporation), "Sour Gas Compressors Oil & Natural Gas Applications", http://www.corken.com, Jul. 2015, 8 pages.
Hans Turck GmbH & Co. KG, "Inductive sensor BI5-EM18-Y1X-H1141", www.turck.com, before Apr. 21, 2016, 4 pages.
Compact Compression Inc., "Casing Gas Compression", http://www.compactcompression.com, before Apr. 21, 2016, 32 pages.
Permian Production Equipment, Inc., "The Hydraulic Beam Gas Compressor ® Your Solution When More Production is the Question", www.hydraulic.beamgascompressor.com, before Apr. 21, 2016, 4 pages.
Linde Hydraulics GmbH & Co. KG, "HPV-02. Variable pumps for closed loop operation.", http://www.linde-hydraulics.com, before Apr. 21, 2016, 36 pages.
Hoerbiger, "Ring and packing Sealing systems for reciprocating compressors", http://www.hoerbiger.com, before Apr. 21, 2016, 24 pages.
Krzysztof Palka, "Understanding Sucker Rod Pump Operation with Hydraulic Jack", © Krzysztof Palka 2015, 27 pages.
Non-Final Office Action issued by the U.S. Patent and Trademark Office on Sep. 1, 2017 in connection with U.S. Appl. No. 15/656,252, 25 pages.
Final Office Action issued by the U.S. Patent and Trademark Office on Nov. 24, 2017 in connection with U.S. Appl. No. 15/656,252, 21 pages.
I-Jack Technologies Incorporated, "IJack DGAS Product Manual Publication No. 800-0030 Rev 2.1", before before May 31, 2017, 34 pages.
Non-Final Office Action issued by the U.S. Patent and Trademark Office on Feb. 20, 2018 in connection with U.S. Appl. No. 15/822,035, 27 pages.
Non-Final Office Action issued by the U.S. Patent and Trademark Office on Feb. 15, 2019 in connection with U.S. Appl. No. 15/659,229, 19 pages.
Non-Final Office Action issued by the U.S. Patent and Trademark Office on Oct. 18, 2018 in connection with U.S. Appl. No. 16/059,891, 8 pages.
Non-Final Office Action issued by the U.S. Patent and Trademark Office on Jan. 17, 2018 in connection with U.S. Appl. No. 15/786,369, 13 pages.
Non-Final Office Action issued by the U.S. Patent and Trademark Office on May 2, 2019 in connection with U.S. Appl. No. 16/147,188, 7 pages.

* cited by examiner

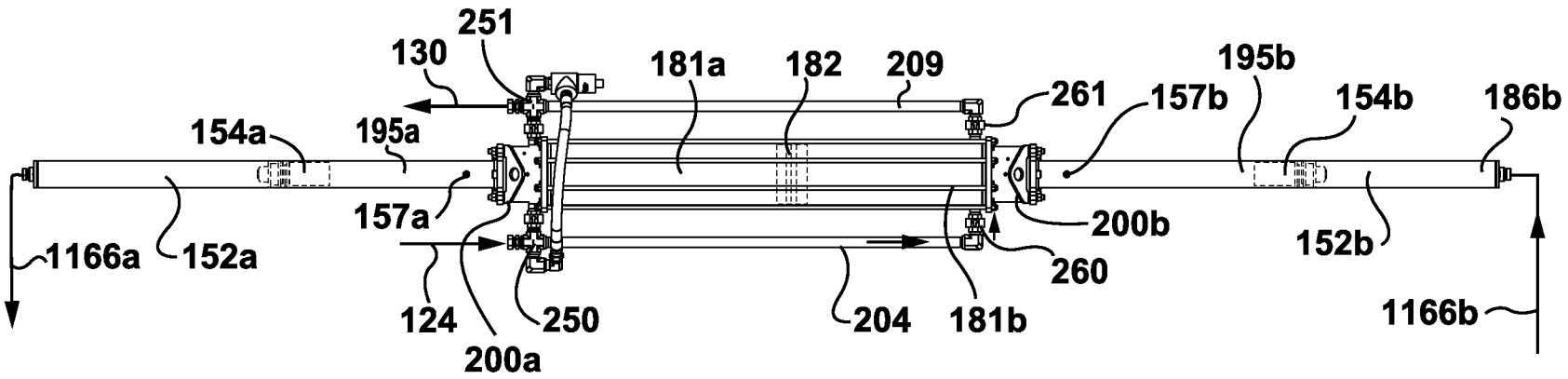
FIG. 3 (ii)

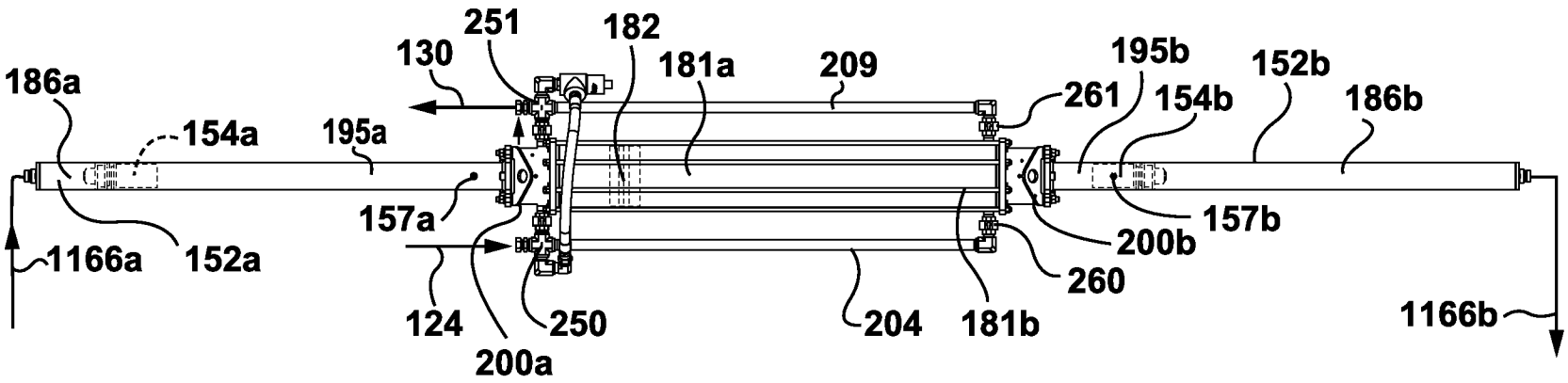
FIG. 3 (iii)

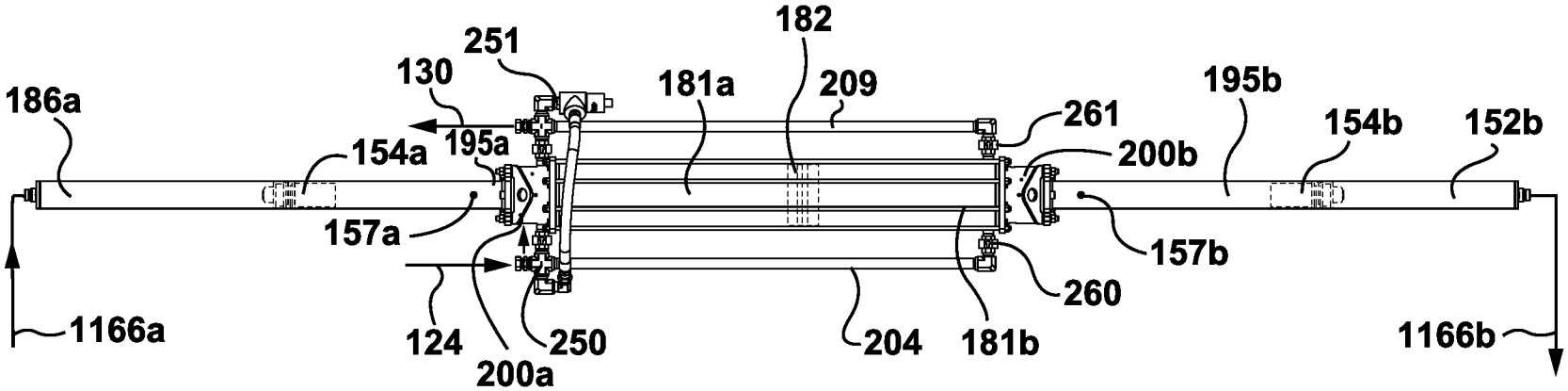
FIG. 3 (iv)

| IJACK XFER TRANSFER PUMP MODELS | | | | | | | |
|---|---|---|---|---|---|---|---|
| XFER MODELS | MAX △p | MAX GAS RATE e3m3/d @ | | | | | MAX LIQUID RATE m3/d |
| | | 10 PSI (68.9 kpa) | 15 PSI (103.4 kpa) | 20 PSI (137.9 kpa) | 30 PSI (206.8 kpa) | 50 PSI (344.7 kpa) | |
| 1235 75cc | 250 PSI / | 3.14 | 3.78 | 4.41 | 5.68 | 8.20 | 2040 |
| 1235D 75/75cc | 1723 kpa | 6.28 | 7.55 | 8.82 | 11.36 | 16.40 | 4070 |
| 1443 105cc | 250 PSI / | 4.32 | 5.20 | 6.07 | 7.85 | 11.38 | 2810 |
| 1443D 105/105cc | 1723 kpa | 8.64 | 10.40 | 12.14 | 15.70 | 22.76 | 5630 |
| 1645 135cc | 210 PSI / | 5.70 | 6.85 | 8.00 | 10.30 | 14.90 | 3700 |
| 1645D 135/135cc | 1448 kpa | 11.40 | 13.70 | 16.00 | 20.60 | 29.80 | 7410 |
| 1853 165cc | 210 PSI / | 7.25 | 8.70 | 10.20 | 13.15 | 19.00 | 4720 |
| 1853D 165/165cc | 1448 kpa | 14.50 | 17.40 | 20.40 | 26.30 | 38.00 | 9440 |
| 2060 210cc | 250 PSI / 1723 kpa | 8.95 | 10.80 | 12.60 | 16.20 | 23.50 | 5820 |

FIG. 25

MULTI-PHASE FLUID PUMP SYSTEM WITH DRIVING FLUID AND PUMP FLUID CYLINDERS AND BUFFER CHAMBERS

CROSS-REFERENCE TO RELATED APPLICATIONS

This application is a Continuation of U.S. patent application Ser. No. 16/930,932 filed on Jul. 16, 2020. This application also claims the foreign priority benefit of corresponding Canadian Patent Application Serial No. 3,074,365 filed on Feb. 28, 2020. The entire contents of the aforementioned applications are incorporated by reference herein.

This application is also related to each of U.S. patent application Ser. No. 16/147,188 filed on Sep. 28, 2018, which is a Continuation-in-part of U.S. patent application Ser. No. 15/786,369 filed on Oct. 17, 2017, which is a Continuation of U.S. patent application Ser. No. 15/659,229 filed on Jul. 25, 2017, which claims the benefit of, and priority from, U.S. Provisional Patent Application No. 62/513,182 filed on May 31, 2017, and U.S. Provisional Patent Application No. 62/421,558 filed on Nov. 14, 2016. The entire contents of each of the aforementioned applications are incorporated by reference herein.

TECHNICAL FIELD

The present disclosure relates to multi-phase fluid pumps and compression systems, methods for compressing and pumping of multi-phase fluids, driven by a driving fluid such as a hydraulic fluid, including hydraulic liquid/gas compressors and multi-phase fluid pumps driven by hydraulic fluid, including such pumps and compression systems that are used in oil and gas field applications and environments.

BACKGROUND

Various different types of gas compressors to compress a wide range of gases are known. Hydraulic gas compressors in particular are used in a number of different applications. One such category of, and application for, gas compressors is a gas compressor employed in connection with the operation of oil and gas producing well systems. When oil is extracted from a reservoir using a well and pumping system, it is common for natural gas, often in solution, to also be present within the reservoir. As oil flows out of the reservoir and into the well, a wellhead gas may be formed as it travels into the well and may collect within the well and/or travel within the casing of the well. The wellhead gas may be primarily natural gas and also includes impurities such as water, hydrogen sulphide, crude oil, and natural gas liquids (often referred to as condensate).

The presence of natural gas within the well can have negative impacts on the functioning of an oil and gas producing well system. It can for example create a back pressure on the reservoir at the bottom of the well shaft that inhibits or restricts the flow of oil to the well pump from the reservoir. Accordingly, it is often desirable to remove the natural gas from the well shaft to reduce the pressure at the bottom of the well shaft, particularly in the vicinity of the well pump. Natural gas that migrates into the casing of the well shaft may be drawn upwards—such as by venting to atmosphere or connecting the casing annulus to a pipe that allows for gas to flow out of the casing annulus. To further improve the flow of gas out of the casing annulus and reduce the pressure of the gas at the bottom of the well shaft, the natural gas flowing from the casing annulus may be compressed by a gas compressor and then may be utilized at the site of the well and/or transported for use elsewhere. The use of a gas compressor will further tend to create a lower pressure at the top of the well shaft compared to the bottom of the well shaft, assisting in the flow of natural gas upwards within the well bore and casing.

There are concerns in using hydraulic gas compressors in oil and gas field environments, relating to the potential contamination of the hydraulic fluid in the hydraulic cylinder of a gas compressor from components of the natural gas that is being compressed.

There are additional concerns in inefficient hydraulic gas compressor operation and increased costs associated with using such compressors.

Pumps for handling the movement/transfer of oil and other liquids in oilfield environments also have significant challenges. For example, often when extracting and then pumping oil from an oil well, a pump can have great difficulty in handling oil and gas mixtures, particularly in oilfield environments where during operation of the pump the ratio of oil/gas being supplied to the pump may change significantly over time during operation.

Improved fluid pumps and related control systems and methods are desirable, including multi-phase fluid pumps including employed in connection with oil and gas field operations including in connection with oil and gas producing wells.

SUMMARY

In accordance with one disclosed aspect there is provided a multi-phase fluid pump system operable to pump a multi-phase fluid received from a well head of an oil well, the multi-phase fluid including a varying mixture of oil and gas. The multi-phase fluid pump system includes a driving fluid system including a first driving fluid cylinder and a second driving fluid cylinder, the first driving fluid cylinder having a first driving fluid chamber adapted for containing a driving fluid therein, and a first driving fluid piston movable within the first driving fluid chamber. The system also includes a fluid pump cylinder having a fluid pump chamber having a first section adapted for pressurizing a multi-phase fluid therein and the fluid pump chamber having a second section adjacent the first section also adapted for pressurizing a multi-phase fluid therein. The fluid pump cylinder has a fluid pump piston movable within the fluid pump chamber and is operable to pressurize the multi-phase fluid located within the first section of the fluid pump chamber. The fluid pump piston is operable to pressurize the multi-phase fluid located within the second section of the fluid pump chamber, the second section of the fluid pump chamber being on an opposite side of the fluid pump piston to the first section of the fluid pump chamber in the fluid pump cylinder. The system also includes a second driving fluid cylinder having a second driving fluid chamber operable in use for containing a driving fluid and a second driving fluid piston movable within the second driving fluid chamber. The second driving fluid cylinder is located on an opposite side of the fluid pump cylinder as the first driving fluid cylinder. When in operation, fluid is located within the fluid pump chamber and is pressurized by the fluid pump piston, with the fluid pump piston being driven by the driving fluid system, the multi-phase fluid pump system being operable for communication of a supply of multi-phase fluid from the oil well to the first and second sections of the fluid pump chamber to pressurize the multi-phase fluid alternately within the first and second sections of the fluid pump chamber.

In accordance with another disclosed aspect there is provided a multi-phase fluid pump system operable to pump a multi-phase fluid delivered from an oil well. The multi-phase fluid pump system includes a driving fluid system including a first driving fluid cylinder and a second driving fluid cylinder, the first driving fluid cylinder having a first driving fluid chamber adapted for containing a driving fluid therein, and a first driving fluid piston movable within the first driving fluid chamber. The system also includes a fluid pump cylinder having a fluid pump chamber having a first section adapted for pressurizing a multi-phase fluid therein and the fluid pump chamber having a second section adjacent the first section also adapted for pressurizing a multi-phase fluid therein. The fluid pump cylinder has a fluid pump piston movable within the fluid pump chamber and is operable to pressurize the multi-phase fluid located within the first section of the fluid pump chamber. The fluid pump piston is operable to pressurize the multi-phase fluid located within the second section of the fluid pump chamber, the second section of the fluid pump chamber being on an opposite side of the fluid pump piston to the first section of the fluid pump chamber in the fluid pump cylinder. The system also includes a first buffer chamber located between the driving fluid chamber and the fluid pump chamber, the first buffer chamber providing a chamber that is sealed by one or more buffer chamber sealing devices, the first buffer chamber providing a chamber that is operable to inhibit movement of at least one non-driving fluid component accompanying fluid supplied to the first section of the fluid pump chamber, from being communicated from the first fluid chamber into the first driving fluid chamber. When in operation, a multi-phase fluid is located within the fluid pump chamber and is pressurized by the fluid pump piston with the first driving fluid piston being driven by the driving fluid system. The system further includes a second driving fluid cylinder having a second driving fluid chamber operable in use for containing a driving fluid and a second driving fluid piston movable within the second driving fluid chamber, the second driving fluid cylinder being located on an opposite side of the fluid pump cylinder as the first driving fluid cylinder. The system also includes a second buffer chamber located between the second driving fluid chamber and the fluid pump chamber, the second buffer chamber providing a chamber that is sealed by one or more buffer chamber sealing devices, the second buffer chamber providing a chamber that is operable to inhibit movement of at least one non-driving fluid component accompanying gas supplied to the second section of the fluid pump chamber, from being communicated from the fluid pump into the second driving fluid chamber. When in operation, fluid is located within the fluid pump chamber and is pressurized by the fluid pump piston, with the fluid pump piston being driven by the driving fluid system, the multi-phase fluid pump system being operable for communication of a supply of multi-phase fluid from the oil well to the first and second sections of the fluid pump chamber.

In accordance with another disclosed aspect there is provided an oil well producing system. The system includes a production tubing having a length extending along a well shaft that extends to an oil bearing formation, a passageway extending along at least the well shaft, the passageway operable to supply natural gas to a gas supply line, the gas supply line being in communication with a pump fluid chamber of a multi-phase fluid pump system. The system also includes a pipe connecting the production tubing operable to deliver oil from the oil bearing formation to the pump fluid chamber of the multi-phase fluid pump system.

In accordance with another disclosed aspect there is provided a multi-phase fluid pump system operable for use in an oil and gas well system. The system includes a driving fluid cylinder having driving fluid chamber with a varying volume that is adapted for receiving therein, containing and expelling therefrom, a driving fluid, and having a driving fluid piston movable within the driving fluid cylinder to vary the volume of the driving fluid chamber. The system also includes a fluid pump cylinder having a fluid pump chamber with a varying volume that is adapted for receiving therein, containing and expelling therefrom, a multi-phase fluid the oil to gas ratio of which varies over time during operation, and further including a fluid pump piston movable within the fluid pump cylinder to vary the volume of the fluid pump chamber, the fluid pump piston being operable to be driven by the driving fluid piston to pressurize a quantity of fluid located within the fluid pump chamber, the fluid pump system being operable for communication of a supply of multi-phase fluid from an oil and gas well to the fluid pump chamber, the oil to gas ratio of which varies over time during operation. The system further includes a buffer chamber located adjacent to the fluid pump chamber, the buffer chamber being sealed by one or more seal devices from the fluid pump chamber, and in operation of the pump system, the buffer chamber not receiving fluid from the oil and gas well, the buffer chamber providing a chamber that inhibits movement of at least one non-driving fluid component accompanying the multi-phase fluid supplied to the fluid pump chamber, from being communicated from the fluid pump chamber into the driving fluid chamber. When in operation fluid is located within the fluid pump chamber and is pressurized by the fluid pump piston.

In accordance with another disclosed aspect there is provided an oil well producing system including a multi-phase fluid pump system. The system includes a driving fluid cylinder having a driving fluid chamber operable for containing a driving fluid therein and a driving fluid piston movable within the driving fluid chamber. The system also includes a fluid pump cylinder having a fluid pump chamber operable for holding a multi-phase fluid therein and a fluid pump piston movable within the fluid pump chamber and operable to pressurize a quantity of fluid located within the fluid pump chamber, the fluid pump chamber being in communication with a supply of multi-phase fluid from an oil and gas well to the fluid pump chamber, the oil to gas ratio of which varies over time during operation. The system further includes a buffer chamber located adjacent the fluid pump chamber, the buffer chamber being sealed by one or more seal devices from the fluid chamber, and in operation of the fluid pump system, the buffer chamber receiving natural gas from the oil well, the buffer chamber providing a chamber that inhibits movement of at least one contaminant accompanying the multi-phase fluid supplied to the fluid pump chamber, from being communicated from the fluid pump chamber into the driving fluid chamber, in operation natural gas being located within the fluid pump chamber and being compressed by the fluid piston. The buffer chamber contains a buffer gas component maintained at a pressure that is during operation greater than the pressure of fluid in the fluid pump chamber to prevent migration of contaminants associated with the fluid from the fluid pump chamber into the buffer chamber so as to substantially prevent contamination by the contaminants of the driving fluid in the driving fluid chamber.

In accordance with another disclosed aspect there is provided a method of pumping a multi-phase fluid from an oil well. The method involves delivering a flow of a multiphase fluid to a multi-phase fluid pumping system, the multi-phase fluid having a gas/liquid ratio that varies during operation. The method also involves operating the multi-phase fluid pumping system to increase the pressure of the multi-phase fluid that is delivered thereto, and delivering the flow of pressurized multi-phase fluid from the multi-phase fluid pumping system to one or more discharge conduits.

In accordance with another disclosed aspect there is provided a method of pumping a multi-phase fluid from an oil well. The method involves delivering a flow of a multi-phase fluid through a pipe to a first multi-phase fluid pumping system, the multi-phase fluid having a gas/liquid ratio that varies during operation. The method also involves operating the first multi-phase fluid pumping system to increase the pressure of the multi-phase fluid that is delivered thereto, and delivering the flow of pressurized multi-phase fluid from the first multi-phase fluid pumping system to a second multi-phase fluid pumping system. The method further involves operating the second multi-phase fluid pumping system to further increase the pressure of the multi-phase fluid that is delivered thereto, and delivering the flow of pressurized multi-phase fluid from the second multi-phase fluid pumping system to a discharge pipe.

In accordance with another disclosed aspect there is provided a method of pumping a multi-phase fluid from an oil well. The method involves delivering a flow of a multi-phase fluid from a plurality of oil and gas producing oil wells to common header pipe, and delivering the flow from the common header pipe to a multi-phase fluid pumping system, the multi-phase fluid in the flow having a gas/liquid ratio that varies during operation. The method also involves operating the multi-phase fluid pumping system to increase the pressure of the multi-phase fluid that is delivered thereto, and delivering the flow of pressurized multi-phase fluid from the multi-phase fluid pumping system to one or more discharge pipes.

BRIEF DESCRIPTION OF THE DRAWINGS

In the figures, which illustrate example embodiments:

FIG. 25 is a table listing maximum gas and liquid rates for a model of the multiphase pump system of 19A;

DETAILED DESCRIPTION

Figure 1:
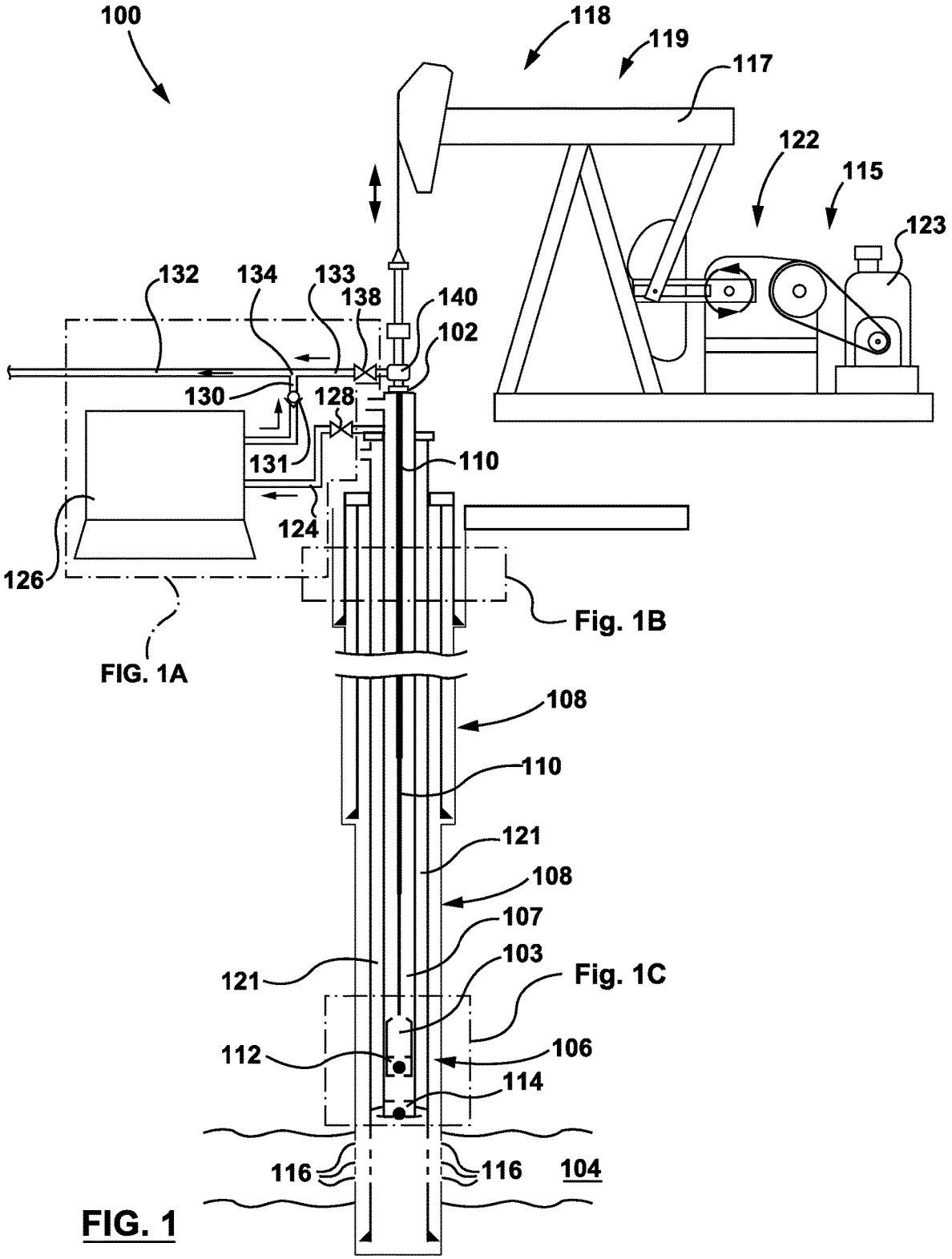
FIG. 1 is a schematic view of an oil and gas producing well system.
Figure 1A:
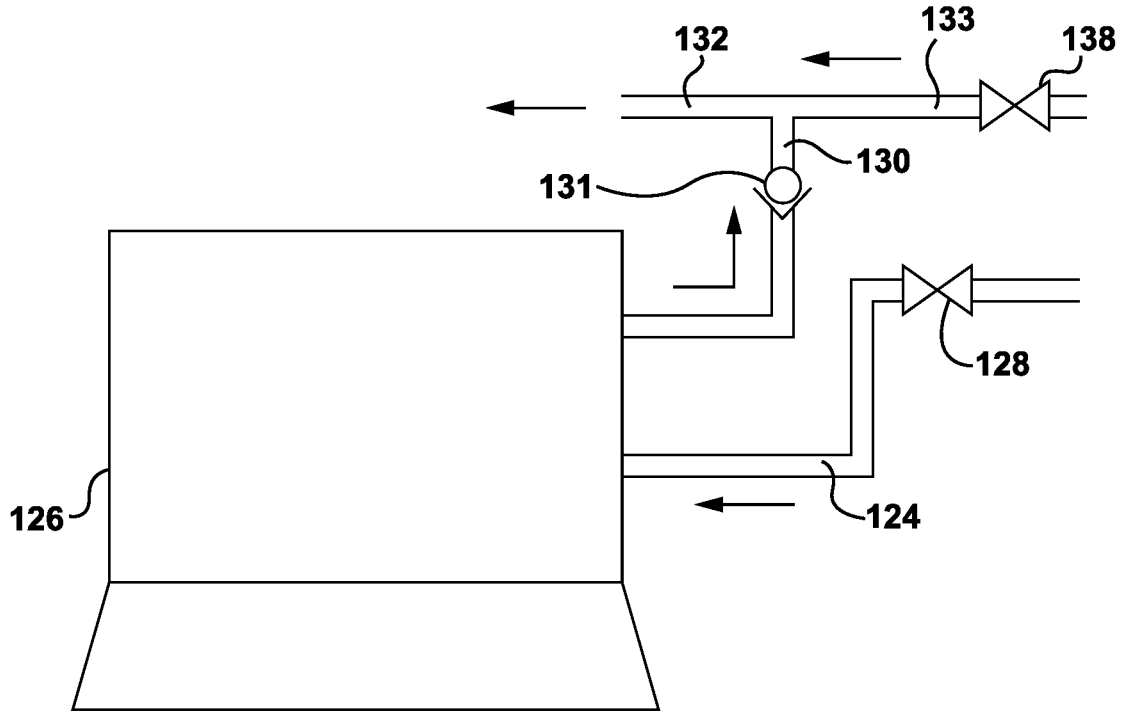
FIG. 1A is an enlarged schematic view of a portion of the system of FIG. 1.
Figure 1B:
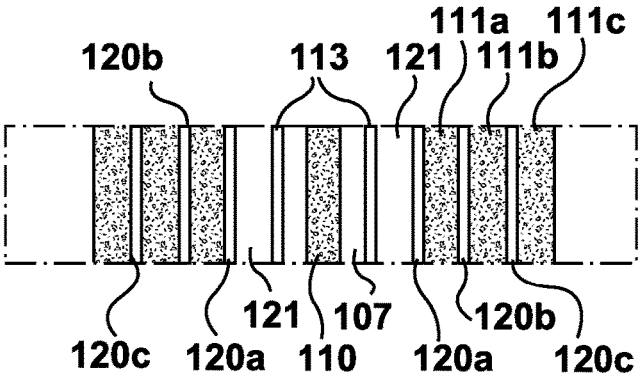
FIG. 1B is an enlarged view of part of the system of FIG. 1.

With reference to FIGS. 1, 1A, 1B and 1C, an example oil and gas producing well system 100 is illustrated schematically that may be installed at, and in, a well shaft (also referred to as a well bore) 108 and may be used for extracting liquid and/or gases (e.g. oil and/or natural gas) from an oil and gas bearing reservoir 104.

Extraction of liquids including oil as well as other liquids such as water from reservoir 104 may be achieved by operation of a down-well pump 106 positioned at the bottom of well shaft 108. For extracting oil from reservoir 104, down-well pump 106 may be operated by the up-and-down reciprocating motion of a sucker rod 110 that extends through the well shaft 108 to and out of a well head 102. It should be noted that in some applications, well shaft 108 may not be oriented entirely vertically, but may have horizontal components and/or portions to its path.

Well shaft 108 may have along its length, one or more generally hollow cylindrical tubular, concentrically positioned, well casings 120*a*, 120*b*, 120*c*, including an innermost production casing 120*a* that may extend for substantially the entire length of the well shaft 108. Intermediate casing 120*b* may extend concentrically outside of production casing 120*a* for a substantial length of the well shaft 108, but not to the same depth as production casing 120*a*. Surface casing 120*c* may extend concentrically around both production casing 120*a* and intermediate casing 120*b*, but may only extend from proximate the surface of the ground level, down a relatively short distance of the well shaft 108. The casings 120*a*, 120*b*, 120*c* may be made from one or more suitable materials such as for example steel. Casings 120*a*, 120*b*, 120*c* may function to hold back the surrounding earth/other material in the sub-surface to maintain a generally cylindrical tubular channel through the sub-surface into the oil/natural gas bearing formation 104. Casings 120*a*, 120*b*, 120*c* may each be secured and sealed by a respective outer cylindrical layer of material such as layers of cement 111*a*, 111*b*, 111*c* which may be formed to surround casings 120*a*-120*c* in concentric tubes that extend substantially along the length of the respective casing 120*a*-120*c*. Production tubing 113 may be received inside production casing 120*a* and may be generally of a constant diameter along its length and have an inner tubing passageway/annulus to facilitate the communication of liquids (e.g. oil) from the bottom region of well shaft 108 to the surface region. Casings 120*a*-120*c* generally, and casing 120*a* in particular, can protect production tubing 120 from corrosion, wear/damage from use. Along with other components that constitute a production string, a continuous passageway (a tubing annulus) 107 from the region of pump 106 within the reservoir 104 to well head 102 is provided by production tubing 113. Tubing annulus 107 provides a passageway for sucker rod 110 to extend and within which to move and provides a channel for the flow of liquid (oil) from the bottom region of the well shaft 108 to the region of the surface.

An annular casing passageway or gap 121 (referred to herein as a casing annulus) is typically provided between the inward facing generally cylindrical surface of the production casing 120*a* and the outward facing generally cylindrical surface of production tubing 113. Casing annulus 121 typically extends along the co-extensive length of inner casing 120*a* and production tubing 113 and thus provides a passageway/channel that extends from the bottom region of well shaft 108 proximate the oil/gas bearing formation 104 to the ground surface region proximate the top of the well shaft 108. Natural gas (that may be in liquid form in the reservoir 104) may flow from reservoir 104 into the well shaft 108 and may be, or transform into, a gaseous state and then flow upwards through casing annulus 121 towards well head 102. In some situations, such as with a newly formed well shaft 108, the level of the liquid (mainly oil and natural gas in solution) may actually extend a significant way from the bottom/end of the well shaft 108 to close to the surface in both the tubing annulus 107 and the casing annulus 121, due to relatively high downhole pressures.

Down-well pump 106 may have a plunger 103 that is attached to the bottom end region of sucker rod 110 and plunger 103 may be moved downwardly and upwardly within a pump chamber by sucker rod 110. Down well pump 106 may include a one way travelling valve 112 which is a mobile check valve which is interconnected with plunger 103 and which moves in up and down reciprocating motion with the movement of sucker rod 110. Down well pump 106 may also include a one way standing intake valve 114 that is stationary and attached to the bottom of the barrel of pump 106/production tubing 113. Travelling valve 112 keeps the liquid (oil) in the channel 107 of production tubing 113 during the upstroke of the sucker rod 110. Standing valve 114 keeps the fluid (oil) in the channel 107 of the production tubing 113 during the downstroke of sucker rod 110. During a downstroke of sucker rod 110 and plunger 103, travelling valve 112 opens, admitting liquid (oil) from reservoir 104 into the annulus of production tubing 113 of down-well pump 106. During this downstroke, one-way standing valve 114 at the bottom of well shaft 108 is closed, preventing liquid (oil) from escaping.

During each upstroke of sucker rod 110, plunger 103 of down-well pump 106 is drawn upwardly and travelling valve 112 is closed. Thus, liquid (oil) drawn in through one-way valve 112 during the prior downstroke can be raised. And as standing valve 114 opens during the upstroke, liquid (oil) can enter production tubing 113 below plunger 103 through perforations 116 in production casing 120*a* and cement layer 111*a*, and past standing valve 114. Successive upstrokes of down-well pump 106 form a column of liquid/oil in well shaft 108 above down-well pump 106. Once this column of liquid/oil is formed, each upstroke pushes a volume of oil toward the surface and well head 102. The liquid/oil, eventually reaches a T-junction device 140 which has connected thereto an oil flow line 133. Oil flow line 133 may contain a valve device 138 that is configured to permit oil to flow only towards a T-junction interconnection 134 to be mixed with compressed natural gas from piping 130 that is delivered from a gas compressor system 126 and then together both flow way in a main oil/gas output flow line 132.

Sucker rod 110 may be actuated by a suitable lift system 118 that may for example as illustrated schematically in FIG. 1, be a pump jack system 119 that may include a walking beam mechanism 117 driven by a pump jack drive mechanism 120 (often referred to as a prime mover). Prime mover 120 may include a motor 123 that is powered for example by electricity or a supply of natural gas, such as for example, natural gas produced by oil and gas producing well system 100. Prime mover 120 may be interconnected to and drive a rotating counter weigh device 122 that may cause the pivoting movement of the walking beam mechanism 120 that causes the reciprocating upward and downward movement of sucker rod 110.

Figure 1C:
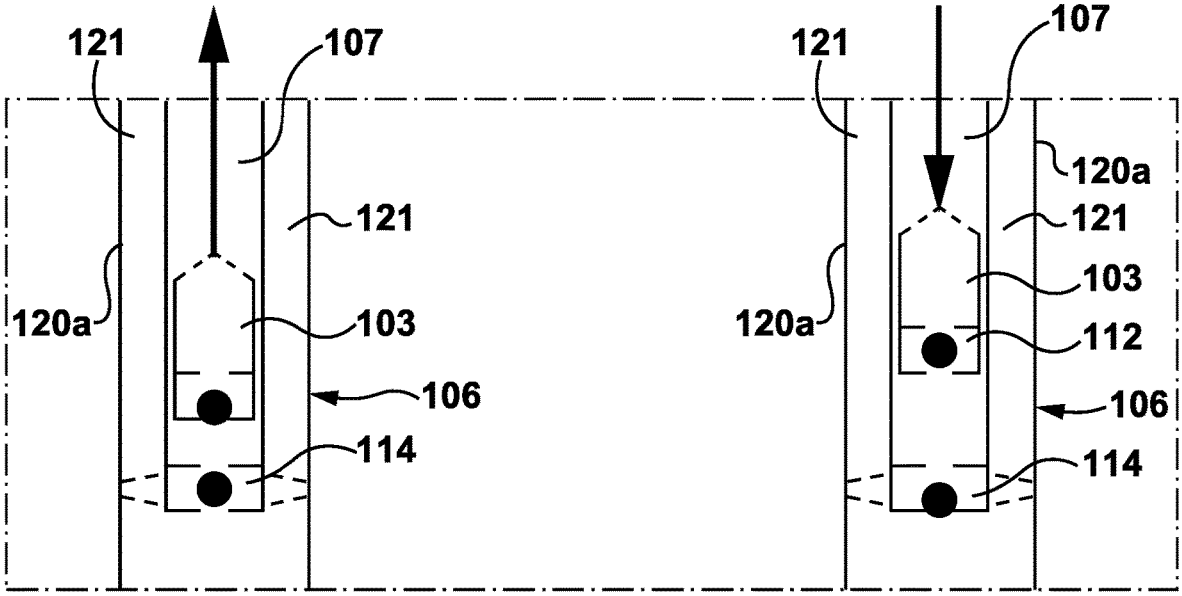
FIG. 1C is an enlarged view of another part of the system of FIG. 1.
Figure 1D:
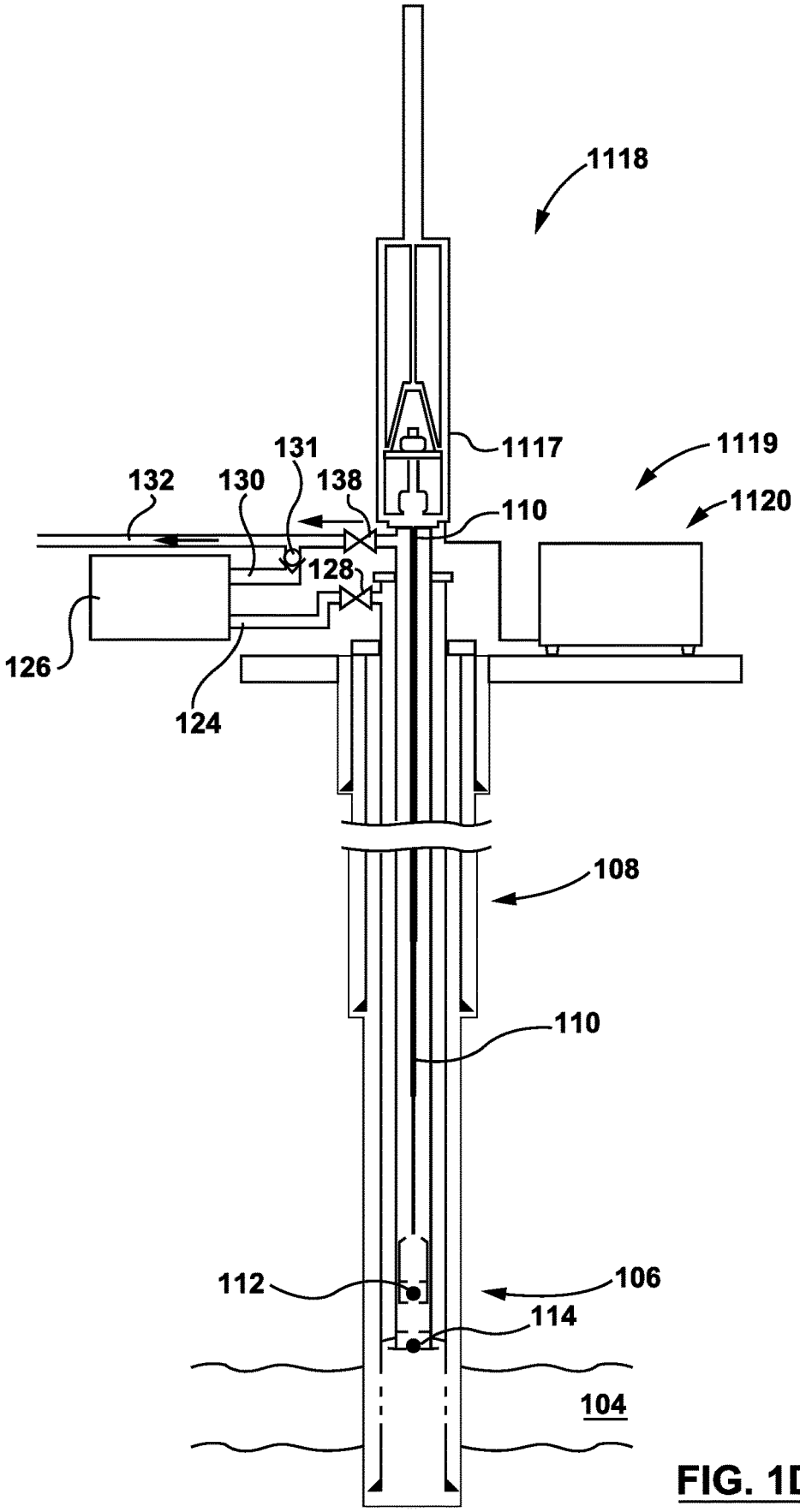
FIG. 1D is a schematic view of an oil and gas well producing system like the system of FIG. 1 but with an alternate lift system.

As shown in FIG. 1D, lift mechanism 1118 may in other embodiments be a hydraulic lift system 1119 that includes a hydraulic fluid based power unit 1120 that supplies hydraulic fluid through a fluid supply circuit to a master cylinder apparatus 1117 to controllably raise and lower the sucker rod 110. The power unit 1120 may include a suitable controller to control the operation of the hydraulic lift system 1119.

With reference to FIGS. 1 to 1C, natural gas exiting from annulus 121 of casing 120 may be fed by suitable piping 124 through valve device 128 to interconnected gas compressor system 126. Piping 124 may be made of any suitable material(s) such as steel pipe or flexible hose such as Aeroquip FC 300 AOP elastomer tubing made by Eaton Aeroquip LLC. In normal operation of system 100, the flow of natural gas communicated through piping 124 to gas compressor system 126 is not restricted by valve device 128 and the natural gas will flow there through. Valve 128 may be closed (e.g. manually) if for some reason it is desired to shut off the flow of natural gas from annulus 121.

Compressed natural gas that has been compressed by gas compressor system 126 may be communicated via piping 130 through a one way check valve device 131 to interconnect with oil flow line 133 to form a combined oil and gas flow line 132 which can deliver the oil and gas therein to a destination for processing and/or use. Piping 130 may be made of any suitable material(s) such as steel pipe or flexible hose such as Aeroquip FC 300 AOP elastomer tubing made by Eaton Aeroquip LLC.

Gas compressor system 126 may include a gas compressor 150 that is driven by a driving fluid. As indicated above, natural gas from casing annulus 121 of well shaft 108 may be supplied by piping 124 to gas compressor system 126. Natural gas may be compressed by gas compressor 150 and then communicated via piping 130 through a one way check valve device 131 to interconnect with oil flow line 133 to form combined oil and gas flow line 132.

The driving fluid for driving gas compressor 150 may be any suitable fluid such as a fluid that is substantially incompressible, and may contain anti-wear additives or constituents. The driving fluid may, for example, be a suitable hydraulic fluid. For example, the hydraulic fluid may be SKYDROL™ aviation fluid manufactured by Solutia Inc. The hydraulic fluid may for example be a fluid suitable as an automatic transmission fluid, a mineral oil, a bio-degradable hydraulic oil, or other suitable synthetic or semi-synthetic hydraulic fluid.

Figure 10A:
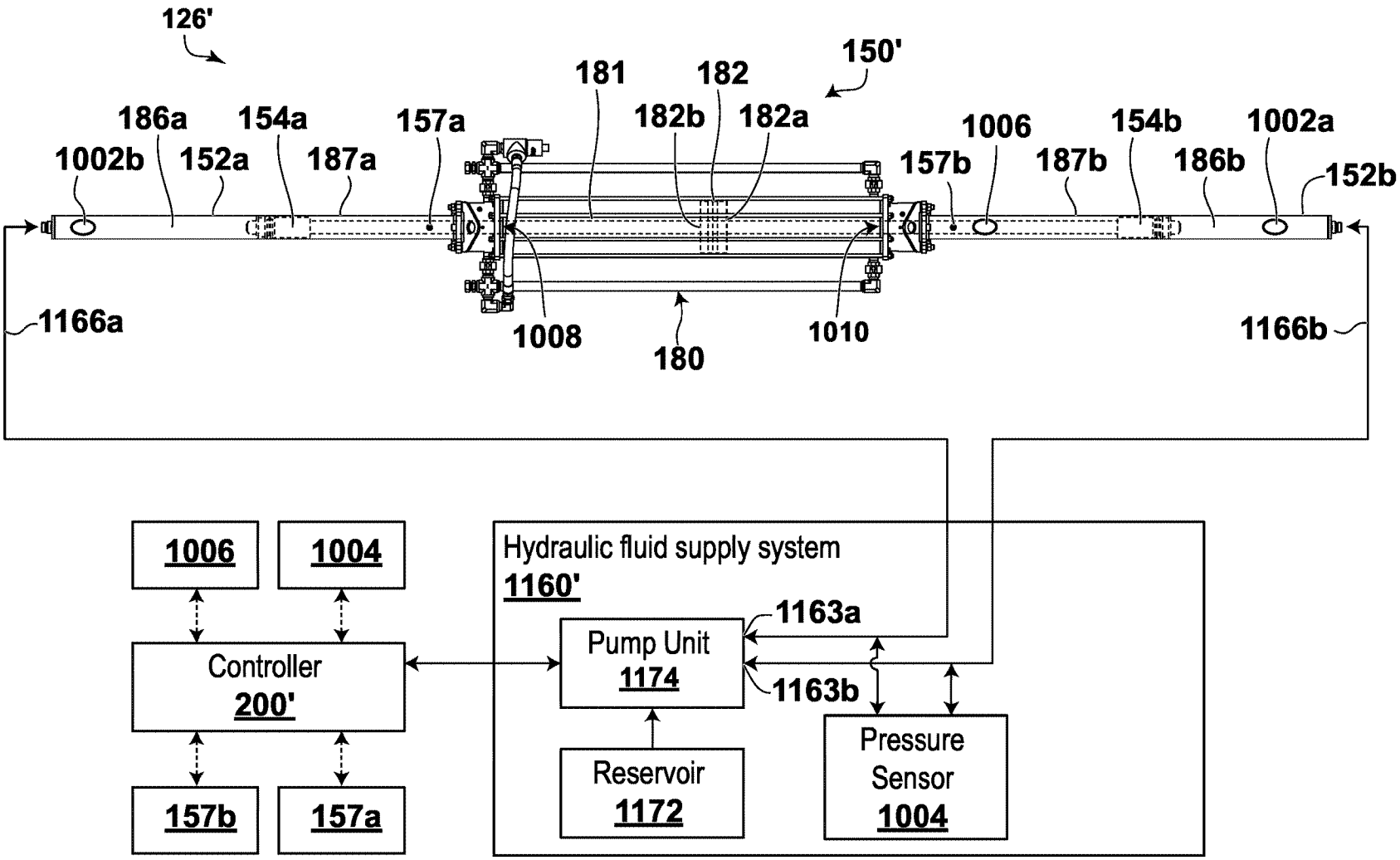
FIG. 10A is a schematic diagram of an gas compressor system.

Hydraulic gas compressor 150 may be in hydraulic fluid communication with a hydraulic fluid supply system which may provide an open loop or closed loop hydraulic fluid supply circuit. For example gas compressor 150 may be in hydraulic fluid communication with a hydraulic fluid supply system 1160 as depicted in FIG. 10A.

Figure 2:
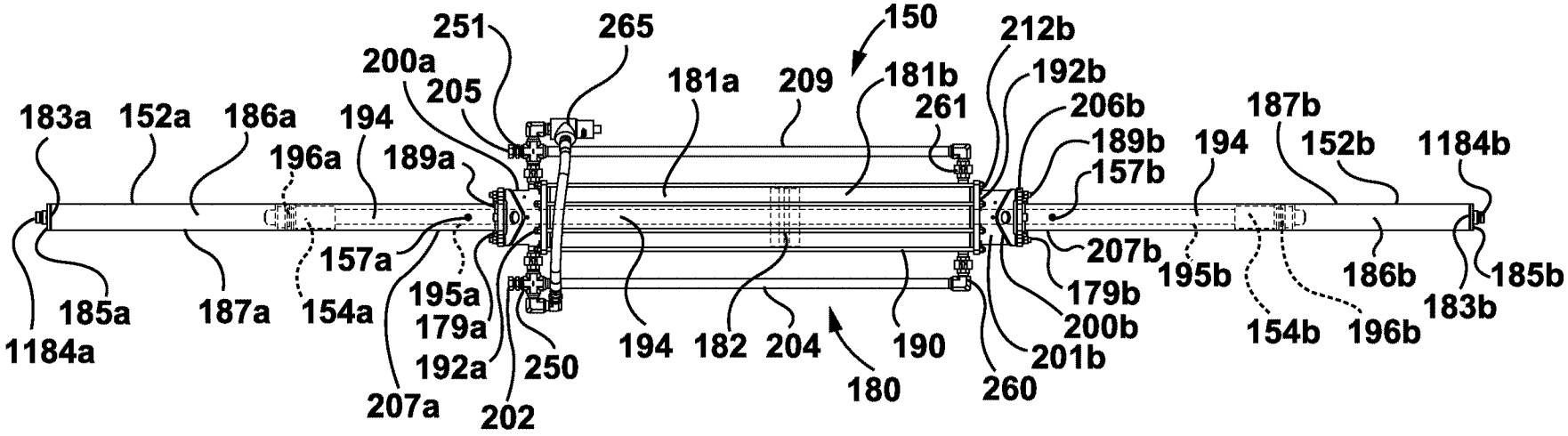
FIG. 2 is a side view of a gas compressor forming part of the system of FIG. 1.
Figure 7:
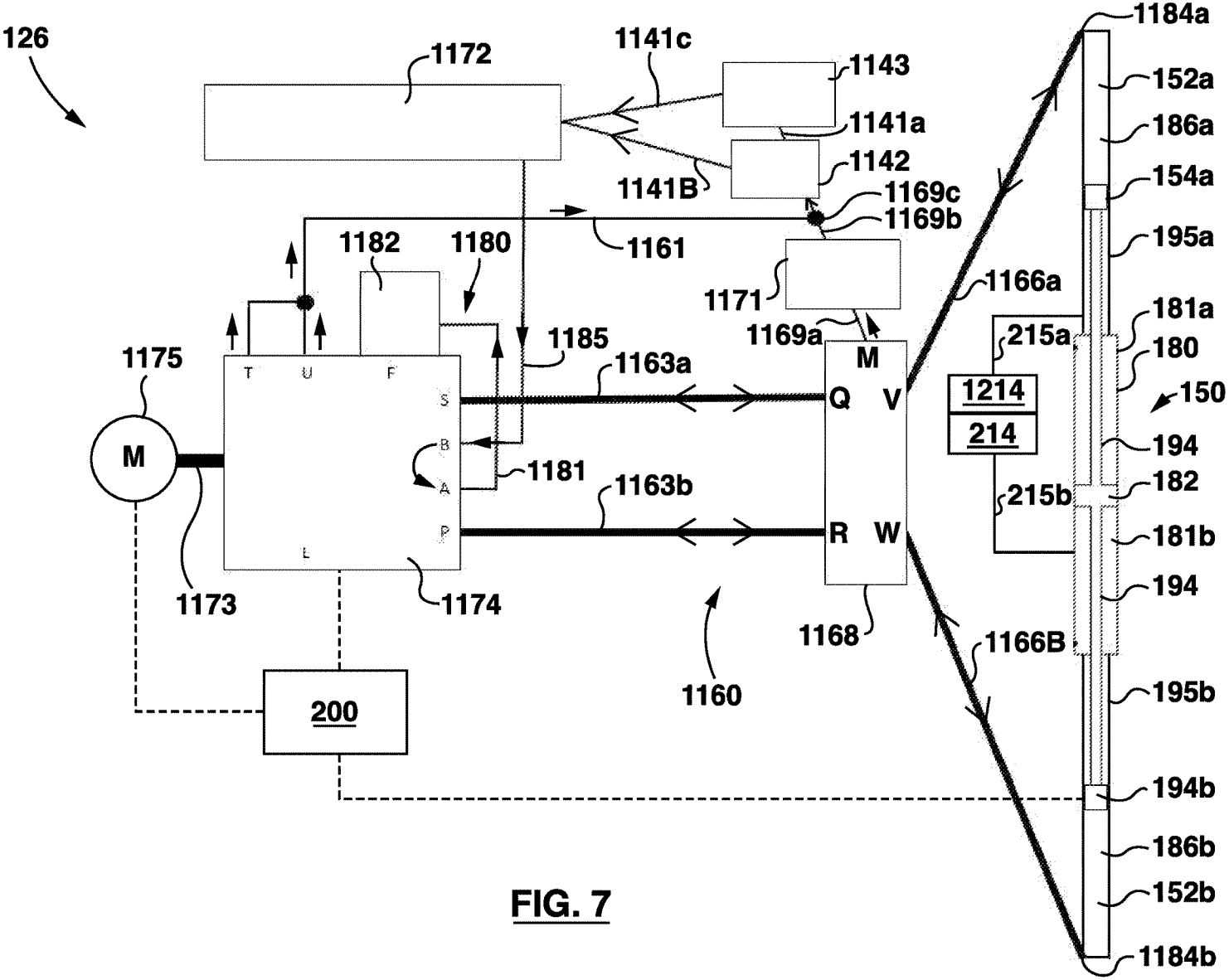
FIG. 7 is a schematic diagram a gas compressor system including the gas compressor of FIG. 2.

Turning now to FIGS. 2 and 7, hydraulic gas compressor 150 may have first and second, one-way acting, hydraulic cylinders 152*a*, 152*b* positioned at opposite ends of hydraulic gas compressor 150. Cylinders 152*a*, 152*b* are each configured to provide a driving force that acts in an opposite direction to each other, both acting inwardly towards each other and towards a gas compression cylinder 180. Thus, positioned generally inwardly between hydraulic cylinders 152*a*, 152*b* is gas compression cylinder 180. Gas compression cylinder 180 may be divided into two gas compression chamber sections 181*a*, 181*b* by a gas piston 182. In this way, gas such as natural gas in each of the gas chamber sections 181*a*, 181*b*, may be alternately compressed by alternating, inwardly directed driving forces of the hydraulic cylinders 152*a*, 152*b* driving the reciprocal movement of gas piston 182 and piston rod 194

Gas compression cylinder 180 and hydraulic cylinders 152*a*, 152*b* may have generally circular cross-sections although alternately shaped cross sections are possible in some embodiments.

Hydraulic cylinder 152*a* may have a hydraulic cylinder base 183*a* at an outer end thereof. A first hydraulic fluid chamber 186*a* may thus be formed between a cylinder barrel/tubular wall 187*a*, hydraulic cylinder base 183*a* and hydraulic piston 154*a*. Hydraulic cylinder base 183*a* may have a hydraulic input/output fluid connector 1184*a* that is adapted for connection to hydraulic fluid communication line 1166*a*. Thus hydraulic fluid can be communicated into and out of first hydraulic fluid chamber 186*a*.

At the opposite end of gas compressor 150, is a similar arrangement. Hydraulic cylinder 152*b* has a hydraulic cylinder base 183*b* at an outer end thereof. A second hydraulic fluid chamber 186*b* may thus be formed between a cylinder barrel/tubular wall 187*b*, hydraulic cylinder base 183*b* and hydraulic piston 154*b*. Hydraulic cylinder base 183*b* may have an input/output fluid connector 1184*b* that is adapted for connection to a hydraulic fluid communication line 1166*b*. Thus hydraulic fluid can be communicated into and out of second hydraulic fluid chamber 186*b*.

In embodiments such as is illustrated in FIG. 7, the driving fluid connectors 1184*a*, 1184*b* may each connect to a single hydraulic line 1166*a*, 1166*b* that may, depending upon the operational configuration of the system, either be communicating hydraulic fluid to, or communicating hydraulic fluid away from, each of hydraulic fluid chamber 186*a* and hydraulic fluid chamber 186*b*, respectively. However, other configurations for communicating hydraulic fluid to and from hydraulic fluid chambers 186*a*, 186*b* are possible.

As indicated above, gas compression cylinder 180 is located generally between the two hydraulic cylinders 152*a*, 152*b*. Gas compression cylinder 180 may be divided into the two adjacent gas chamber sections 181*a*, 181*b* by gas piston 182. First gas chamber section 1814*a* may thus be defined by the cylinder barrel/tubular wall 190, gas piston 182 and first gas cylinder head 192*a*. The second gas chamber section 181*b* may thus be defined by the cylinder barrel/tubular wall 190, gas piston 182 and second gas cylinder head 192*b* and formed on the opposite side of gas piston 182 to first gas chamber section 181*a*.

The components forming hydraulic cylinders 154*a*, 154*b* and gas compression cylinder 180 may be made from any one or more suitable materials. By way of example, barrel 190 of gas compression cylinder 180 may be formed from chrome plated steel; the barrel of hydraulic cylinders 152*a*, 152*b*, may be made from a suitable steel; gas piston 182 may be made from T6061 aluminum; the hydraulic pistons 154*a*, 154*b* may be made generally from ductile iron; and piston rod 194 may be made from induction hardened chrome plated steel.

The diameter of hydraulic pistons 154*a*, 154*b* may be selected dependent upon the required output gas pressure to be produced by gas compressor 150 and a diameter (for example about 3 inches) that is suitable to maintain a desired pressure of hydraulic fluid in the hydraulic fluid chambers 186*a*, 186*b* (for example—a maximum pressure of about 2800 psi).

Hydraulic pistons 154*a*, 154*b* may also include seal devices 196*a*, 196*b* respectively at their outer circumferential surface areas to provide fluid/gas seals with the inner wall surfaces of respective hydraulic cylinder barrels 187*a*, 187*b* respectively. Seal devices 196*a*, 196*b*, may substantially prevent or inhibit movement of hydraulic fluid out of hydraulic fluid chambers 186*a*, 186*b* during operation of hydraulic gas compressor 150 and may prevent or at least inhibit the migration of any gas/liquid that may be in respective adjacent buffer chambers 195*a*, 195*b* (as described further hereafter) into hydraulic fluid chambers 186*a*, 186*b*.

Figure 8:
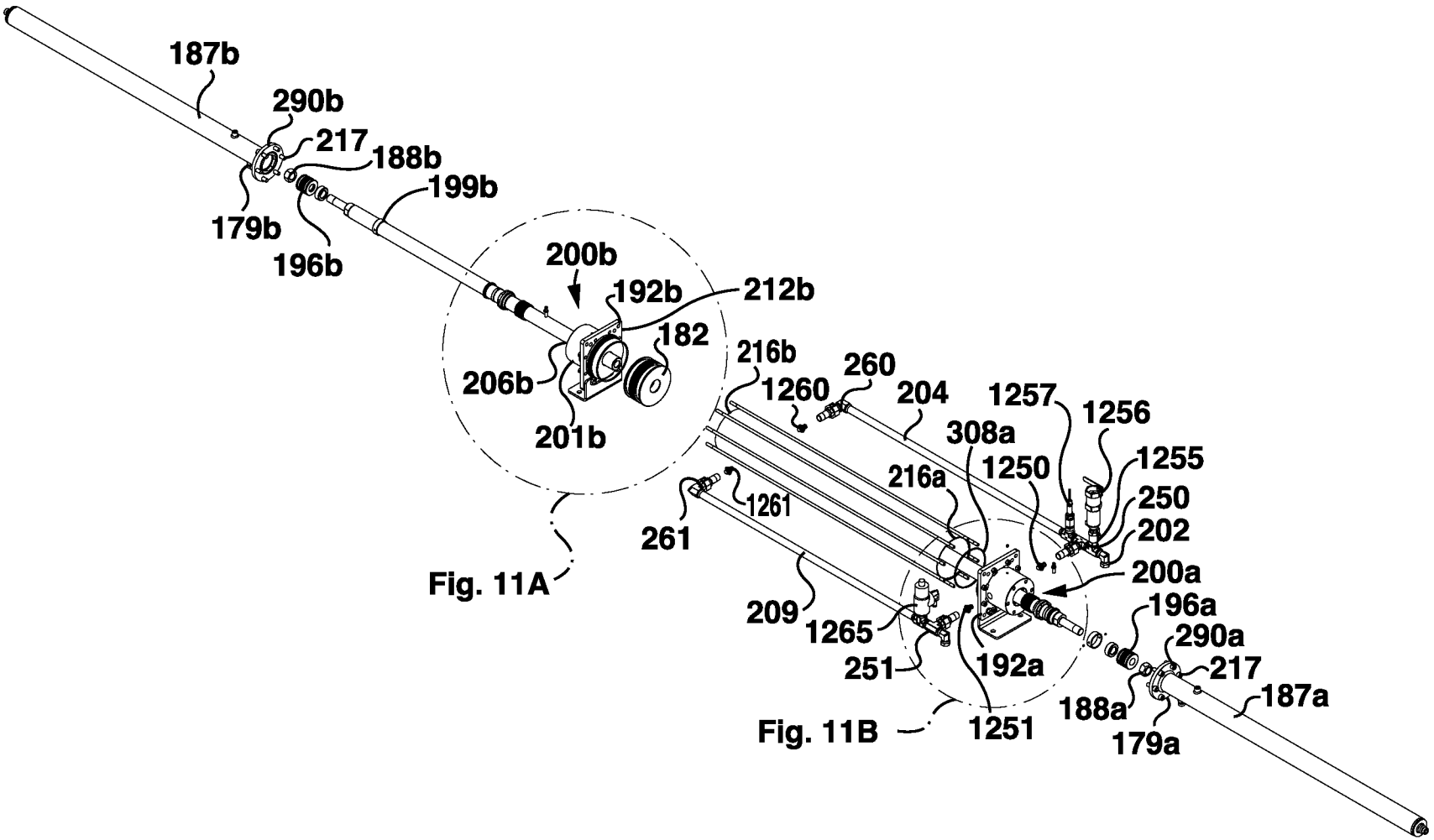
FIG. 8 is a perspective exploded view of a gas compressor substantially like the gas compressor of FIG. 2.
Figure 8A:
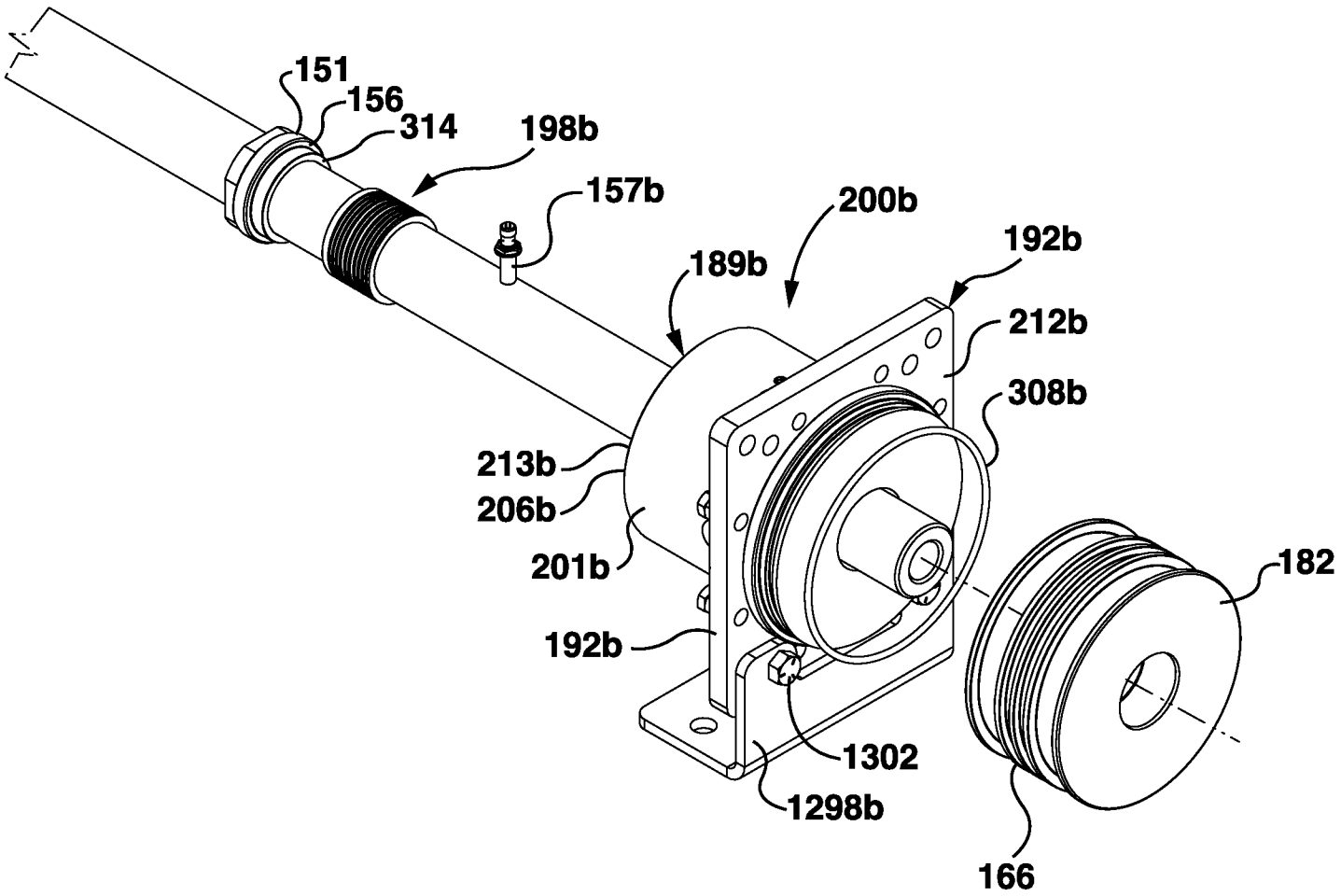
FIG. 8A is enlarged view of the portion marked FIG. 8A in FIG. 8.
Figure 8B:
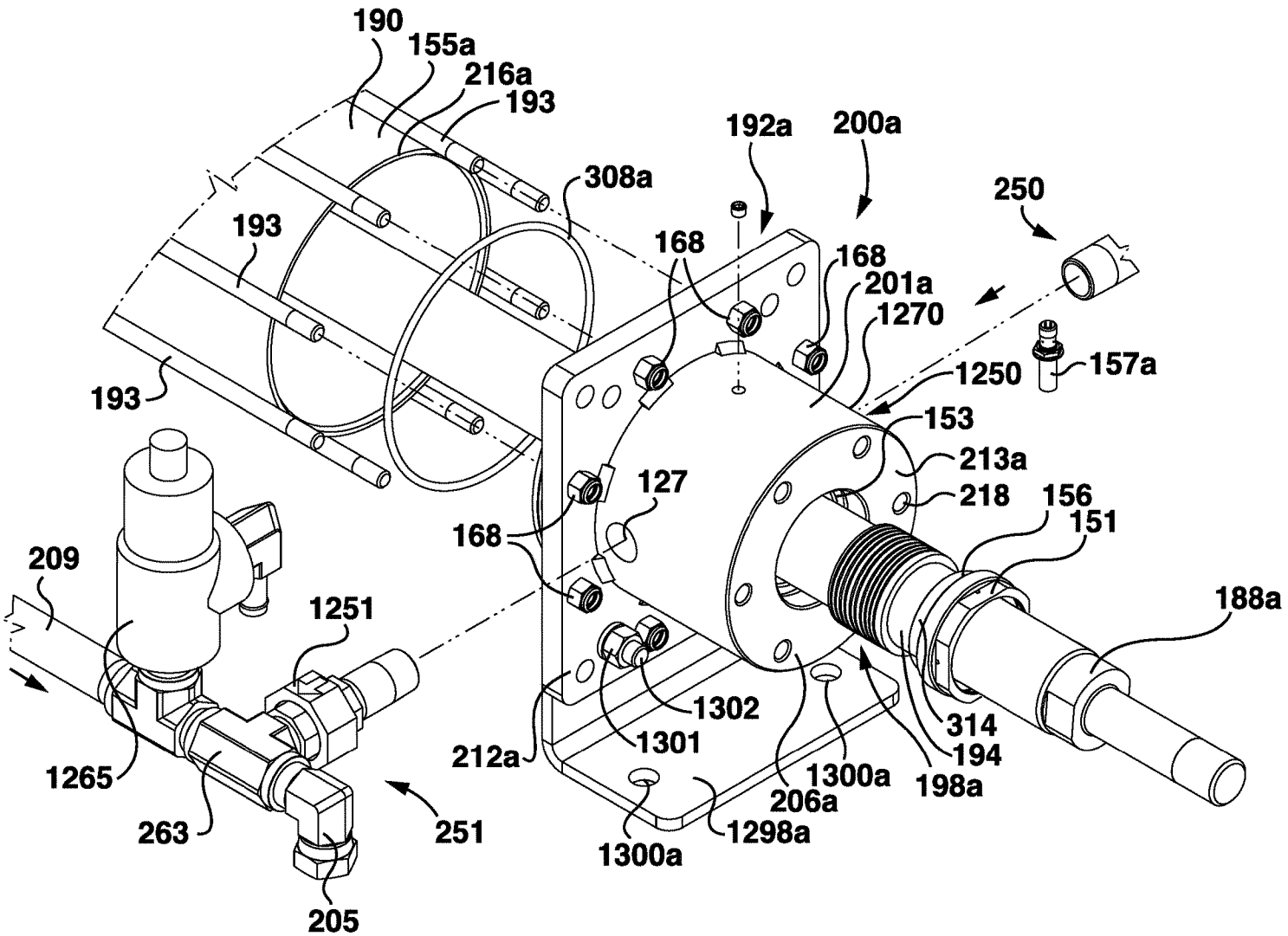
FIG. 8B is enlarged view of the portion marked FIG. 8B in FIG. 8.

Also with reference now to FIGS. 8, 8A and 8B, hydraulic piston seal devices 196*a*, 196*b* may include a plurality of polytetrafluoroethylene (PTFE) (e.g. Teflon™ seal rings and may also include Hydrogenated nitrile butadiene rubber (HNBR) energizers/energizing rings for the seal rings. A mounting nut 188*a*, 188*b* may be threadably secured to the opposite ends of piston rod 194 and may function to secure the respective hydraulic pistons 154*a*, 154*b* onto the end of piston rod 194.

The diameter of the gas piston 182 and corresponding inner surface of gas cylinder barrel 190 will vary depending upon the required volume of gas and may vary widely (e.g. from about 6 inches to 12 inches or more). In one example embodiment, hydraulic pistons 154*a*, 154*b* have a diameter of 3 inches; piston rod 194 has a diameter or 2.5 inches and gas piston 182 has a diameter of 8 inches.

Gas piston 182 may also include a conventional gas compression piston seal device at its outer circumferential surfaces to provide a seal with the inner wall surface of gas cylinder barrel 190 to substantially prevent or inhibit movement of natural gas and any additional components associated with the natural gas, between gas compression cylinder sections 181*a*, 181*b*. Gas piston seal device may also assist in maintaining the gas pressure differences between the adjacent gas compression cylinder sections 181*a*, 181*b*, during operation of hydraulic gas compressor 150.

As noted above, hydraulic pistons 154*a*, 154*b* may be formed at opposite ends of a piston rod 194. Piston rod 194 may pass through gas compression cylinder sections 181*a*, 181*b* and pass through a sealed (e.g. by welding) central axial opening 191 through gas piston 182 and be configured and adapted so that gas piston 182 is fixedly and sealably mounted to piston rod 194.

Piston rod 194 may also pass through axially oriented openings in head assemblies 200*a*, 200*b* that may be located at opposite ends of gas cylinder barrel 190. Thus, reciprocating axial/longitudinal movement of piston rod 194 will result in reciprocating synchronous axial/longitudinal movement of each of hydraulic pistons 154*a*, 154*b* in respective hydraulic fluid chambers 186*a*, 186*b*, and of gas piston 182 within gas compression chamber sections 181*a*, 181*b* of gas compression cylinder 180.

Located on the inward side of hydraulic piston 154*a*, within hydraulic cylinder 154*a*, between hydraulic fluid chamber 186*a* and gas compression cylinder section 181*a*, may be located first buffer chamber 195*a*. Buffer chamber 195*a* may be defined by an inner surface of hydraulic piston 154*a*, the cylindrical inner wall surface of hydraulic cylinder barrel 187*a*, and hydraulic cylinder head 189*a*.

Similarly, located on the inward side of hydraulic piston 154*b*, within hydraulic cylinder 154*b*, between hydraulic fluid chamber 186*b* and gas compression cylinder section 181*b*, may be located second buffer chamber 195*b*. Buffer chamber 195*b* may be defined by an inner surface of hydraulic piston 154*b*, the cylindrical inner wall surface of cylinder barrel 187*b*, and hydraulic cylinder head 189*b*.

As hydraulic pistons 154*a*, 154*b* are mounted at opposite ends of piston rod 194, piston rod 194 also passes through buffer chambers 195*a*, 195*b*.

With particular reference now to FIGS. 2, 6, 8, 8A-C, and 9A-C and 13A-C, head assembly 200*a* may include hydraulic cylinder head 189*a* and gas cylinder head 192*a* and a hollow tubular casing 201*a*. Hydraulic cylinder head 189*a* may have a generally circular hydraulic cylinder head plate 206*a* formed or mounted within casing 201*a* (FIG. 8B).

A barrel flange plate 290*a* (FIG. 9A), hydraulic cylinder head plate 206*a* (FIG. 8B) and a gas cylinder head plate 212*a* may have casing 201*a* disposed there between. Gas cylinder head plate 212*a* may be interconnected to an inward end of hollow tubular casing 201*a* for example by welds or the two parts may be integrally formed together. In other embodiments, hollow tubular casing 201*a* may be integrally formed with both hydraulic cylinder head plate 206*a* and gas cylinder head plate 212*a*.

Hydraulic cylinder barrel 187*a* may have an inward end 179*a*, interconnected such as by welding to the outward facing edge surface of a barrel flange plate 290*a*. Barrel flange plate 290*a* may be configured as shown in FIGS. 2, 8, 8A-C, and 9A-C.

Barrel flange plate 290*a* may be connected to the hydraulic cylinder head plate 206*a* by bolts 217 (FIG. 8) received in threaded openings 218 of outward facing surface 213*a* of hydraulic head plate 206*a* (FIGS. 8 and 8B). A gas and liquid seal may be created between the mating surfaces of hydraulic head plate 206*a* and barrel flange plate 290*a*. A sealing device may be provided between these plate surfaces such as TEFLON hydraulic seals and buffers.

Gas cylinder barrel 190 may have an end 155*a* (FIG. 8B) interconnected to the inward facing surface of gas cylinder head plate 212*a* such as by passing first threaded ends of each of the plurality of tie rods 193 through openings in head plate 212*a* and securing them with nuts 168.

Piston rod 194 may have a portion that moves longitudinally within the inner cavity formed through openings within barrel flange plate 290*a*, hydraulic cylinder head plate 206*a* and gas cylinder head plate 212*a* and within tubular casing 210*a*.

A structure and functionality corresponding to the structure and functionality just described in relation to hydraulic cylinder 152*a*, buffer chamber 195*a*, and gas compression cylinder section 181*a*, may be provided on the opposite side of hydraulic gas compression cylinder 150 in relation to hydraulic cylinder 152*b*, buffer chamber 195*b*, and gas compression cylinder section 181*b*.

Thus with particular reference to FIGS. 8, 8A and 8B, head assembly 200*b* may include hydraulic cylinder head 189*b*, gas cylinder head 192*b* and a hollow tubular casing 201*b*. Hydraulic cylinder head 189*b* may have a hydraulic cylinder head plate 206*b* formed or mounted within casing 201*b* (FIG. 8A)

A barrel flange plate 290*b*/hydraulic cylinder head plate 206*b* and a gas cylinder head plate 212*b* (FIGS. 8 and 8A) may have casing 201*b* generally disposed there between. Gas cylinder head plate 212*b* may be interconnected to hollow tubular casing 201*b* for example by welds or the two parts may be integrally formed together. In other embodiments, hollow tubular casing 201*b* may be integrally formed with hydraulic cylinder head plate 206*b* and gas cylinder head plate 212*b*.

Hydraulic cylinder barrel 187*b* (FIG. 9A) may have an inward end 179*b*, interconnected such as by welding to the outward facing edge surface of a barrel flange plate 290*b*. Barrel flange plate 290*b* may also be configured as shown in FIGS. 2, 8, 8A-C, and FIGS. 9A-C.

Figure 9A:
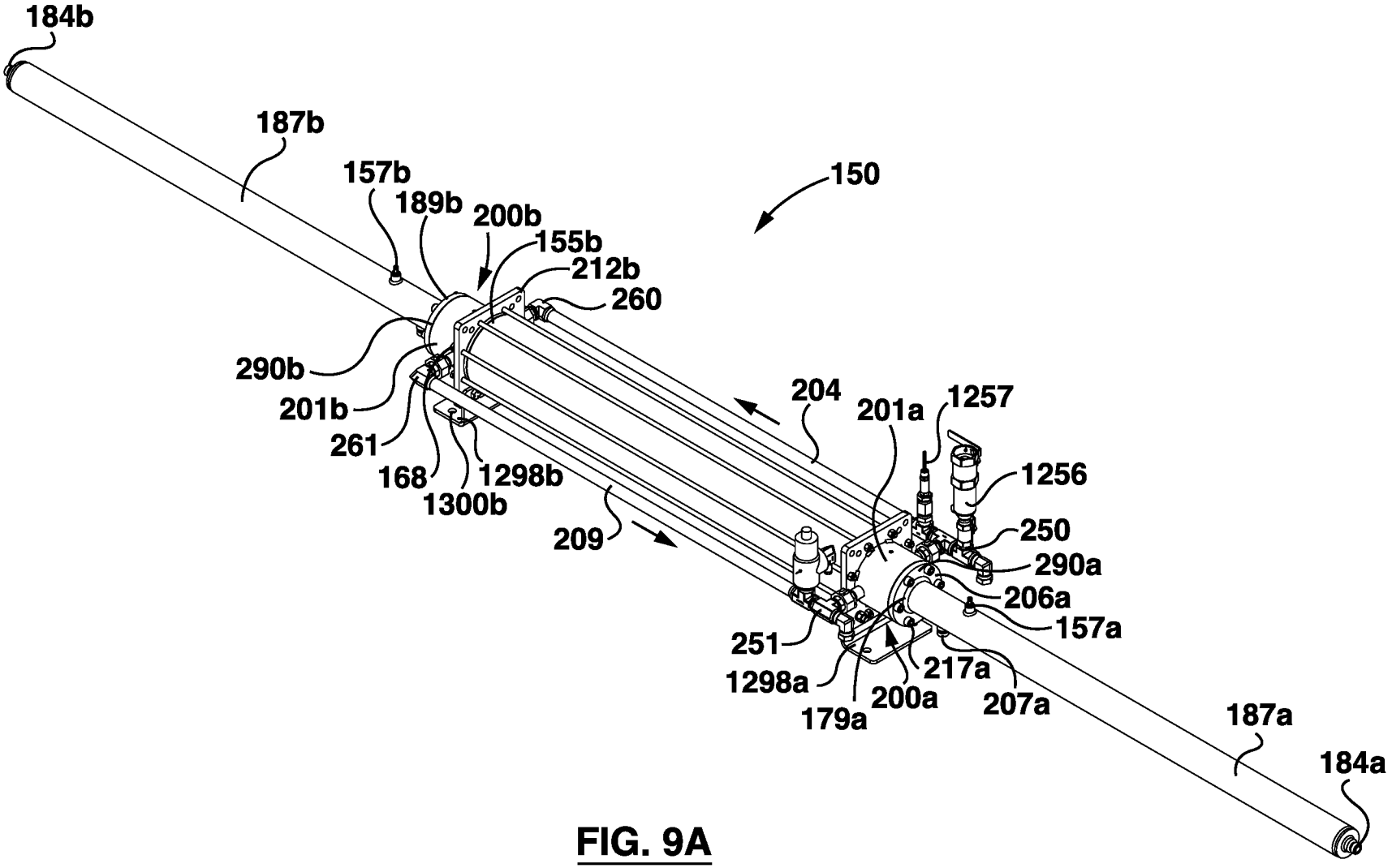
FIG. 9A is a perspective view of the gas compressor of FIG. 2.
Figure 9B:
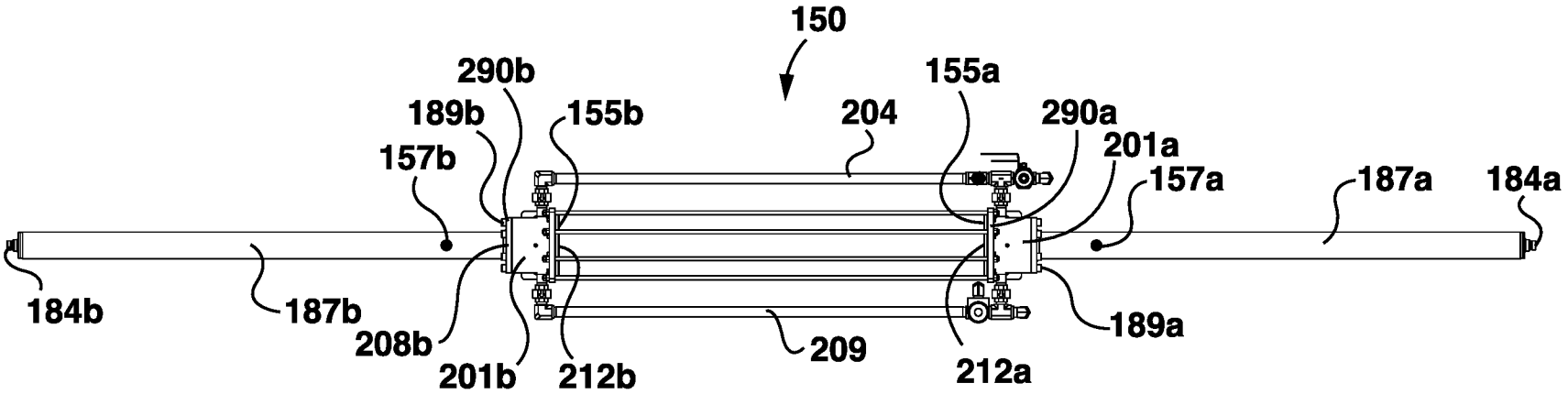
FIG. 9B is a top view of the gas compressor of FIG. 2.

Barrel flange plate 290*b* may be connected to the hydraulic cylinder head plate 206*b* by bolts 217 received in threaded openings 218*b* of outward facing surface 213*b* of hydraulic head plate 206*b* (FIG. 9B). A gas and liquid seal may be created between the mating surfaces of hydraulic head plate 206*b* and barrel flange plate 290*b*. A sealing device may be provided between these plate surfaces such as TEFLON hydraulic seals and buffers.

Gas cylinder barrel 190 may have an end 155*b* (FIG. 9A) interconnected to the inward facing surface of gas cylinder head plate 212*b* such as by passing first threaded ends of each of the plurality of tie rods 193 through openings in head plate 212*b* and securing them with nuts 168.

Piston rod 194 may have a portion that moves longitudinally within the inner cavity formed through openings within hydraulic cylinder head plate 206*b* and gas cylinder head plate 212*b* and within tubular casing 210*b*.

With particular reference now to FIGS. 8, 8A and 8B, two head sealing O-rings 308*a*, 308*b* may be provided and which may be made from highly saturated nitrile-butadiene rubber (HNBR). One O-ring 308*a* may be located between a first circular edge groove 216*a* at end 155*a* of gas cylinder barrel 190 and the inward facing surface of gas cylinder head plate 212*a*. O-ring 308*a* may be retained in a groove in the inward facing surface of gas cylinder head plate 212*a*. O-ring 308*b* may be located between a second opposite circular edge groove 216*b* of at the opposite end of gas cylinder barrel 190 and the inward facing surface of gas cylinder head plate 212*b*. O-ring 308*b* may be retained in a groove in the inward facing surface of gas cylinder head plate 212*b*. In this way gas seals are provided between gas compression chamber sections 181*a*, 181*b* and their respective gas cylinder head plates 212*a*, 212*b*.

By securing threaded both opposite ends of each of the plurality of tie rods 193 through openings in gas cylinder head plates 212*a*, 212*b* and securing them with nuts 168, tie rods 193 will function to tie together the head plates 212*a* and 212*b* with gas cylinder barrel 190 and O-rings 308*a*, 308*b* securely held there between and providing a sealed connection between cylinder barrel 190 and head plates 212*a*, 212*b*.

Seal/wear devices 198*a*, 198*b* may be provided within casing 201*a* to provide a seal around piston rod 194 and with an inner surface of casing 201*a* to prevent or limit the movement of natural gas out of gas compression cylinder section 181*a*, into buffer chamber 195*a*. Corresponding seal/wear devices may be provided within casing 201*b* to provide a seal around piston rod 194 and with an inner surface of casing 201*b* to prevent or limit the movement of natural gas out of gas compression cylinder section 181*b*, into buffer chamber 195*b*. These seal devices 198*a*, 198*b* may also prevent or at least limit/inhibit the movement of other components (such as contaminants) that have been transported with the natural gas from well shaft 108 into gas compression cylinder sections 181*a*, 181*b*, from migrating into respective buffer chambers 195*a*, 195*b*.

While in some embodiments, the gas pressure in gas compression chamber sections 181*a*, 181*b* will remain generally, if not always, above the pressure in the adjacent respective buffer chambers 195*a*, 195*b*, the seal/wear devices 198*a*, 198*b* may in some situations prevent migration of gas and/or liquid that may be in buffer chambers 195*a*, 195*b* from migrating into respective gas compression chamber sections 181*a*, 181*b*. The seal/wear devices 198*a*, 198*b* may also assist to guide piston rod 194 and keep piston rod 194 centred in the casings 201*a*, 201*b* and absorb transverse forces exerted upon piston rod 194.

Also, with particular reference to FIGS. 8, 8A and 8B, each seal device 198*a*, 198*b* may be mounted in a respective casing 201*a*, 201*b*. Associated with each head assembly 200*a*, 200*b* may also be a rod seal retaining nut 151 which may be made from any suitable material, such as for example aluminium bronze. A rod seal retaining nut 151 may be axially mounted around piston rod 194. Rod seal retaining nut 151 may be provided with inwardly directed threads 156. The threads 156 of rod sealing nut 151 may engage with internal mating threads in opening 153 of the respective casing 201*a*, 201*b*. By tightening rod sealing nut 151, components of sealing devices 198*a*, 198*b* may be axially compressed within casing 201*a*, 201*b*. The compression causes components of the sealing devices 198*a*, 1987*b* to be pushed radially outwards to engage an inner cylindrical surface of the respective casings 201*a*, 201*b* and radially inwards to engage the piston rod 194. Thus seal devices 198*a*, 198*b* are provided to function as described above in providing a sealing mechanism.

As each rod seal retaining nut 151 can be relatively easily unthreaded from engagement with its respective casing 201*a*, 201*b*, maintenance and/or replacement of one or more components of seal devices 198*a*, 198*b* is made easier. Additionally, by turning a rod seal retaining nut 151 may be engaged to thread the rod seal retaining nut further into opening 153 of the casing, adjustments can be made to increase the compressive load on the components of the sealing devices 198*a*, 198*b* to cause them to be being pushed radially further outwards into further and stronger engagement with an inner cylindrical surface of the respective casings 201*a*, 201*b* and further inwards to engage with the piston rod 194. Thus the level of sealing action/force provided by each seal device 198*a*, 198*b* may be adjusted.

However, even with an effective seal provided by the sealing devices 198*a*, 198*b*, it is possible that small amounts of natural gas, and/or other components such as hydrogen sulphide, water, oil may still at least in some circumstances be able to travel past the sealing devices 198*a*, 198*b* into respective buffer chambers 195*a*, 195*b*. For example, oil may be adhered to the surface of piston rod 194 and during reciprocating movement of piston rod 194, it may carry such other components from the gas compression cylinder section 181*a*, 181*b* past sealing devices 198*a*, 198*b*, into an area of respective cylinder barrels 187*a*, 187*b* that provide respective buffer chambers 195*a*, 195*b*. High temperatures that typically occur within gas compression chamber sections 181*a*, 181*b* may increase the risk of contaminants being able to pass seal devices 198*a*, 198*b*. However buffer chambers 195*a*, 195*b* each provide an area that may tend to hold any contaminants that move from respective gas compression chamber sections 181*a*, 181*b* and restrict the movement of such contaminants into the areas of cylinder barrels that provide hydraulic cylinder fluid chambers 186*a*, 186*b*.

Mounted on and extending within cylinder barrel 187*a* close to hydraulic cylinder head 189*a*, is a proximity sensor 157*a*. Proximity sensor 157*a* is operable such that during operation of gas compressor 150, as piston 154*a* is moving from left to right, just before piston 154*a* reaches the position shown in FIG. 3(*i*), proximity sensor 157*a* will detect the presence of hydraulic piston 154*a* within hydraulic cylinder 152*a* at a longitudinal position that is shortly before the end of the stroke. Sensor 157*a* will then send a signal to controller 200, in response to which controller 200 can take steps to change the operational mode of hydraulic fluid supply system 1160 (FIG. 7).

Similarly, mounted on and extending within cylinder barrel 187*b* close to hydraulic cylinder head 189*b*, is another proximity sensor 157*b*. Proximity sensor 157*b* is operable such that during operation of gas compressor 150, as piston 154*b* is moving from right to left, just before piston 154*b* reaches the position shown in FIG. 5(*iii*), proximity sensor 157*b* will detect the presence of hydraulic piston 154*b* within hydraulic cylinder 152*b* at a longitudinal position that is shortly before the end of the stroke. Proximity sensor 157*b* will then send a signal to controller 200, in response to which controller 200 can take steps to change the operational mode of hydraulic fluid supply system 1160.

Proximity sensors 157*a*, 157*b* may be in communication with controller 200. In some embodiments, proximity sensors 157*a*, 157*b* may be implemented using inductive proximity sensors, such as model BI 2-M12-Y1X-H1141 sensors manufactured by Turck, Inc. These inductive sensors are operable to generate proximity signals responsive to the proximity of a metal portion of piston rod 194 proximate to each of hydraulic piston 154*a*, 154*b*. For example sensor rings may be attached around piston rod 194 at suitable positions towards, but spaced from, hydraulic pistons 154*a*, 154*b* respectively such as annular collar 199*b* in relation to hydraulic piston 154*b*—FIGS. 6 and 8. Proximity sensors 157*a*, 157*b* may detect when collars 199*a*, 199*b* on piston rod 194 pass by. Steel annular collars 199*a*, 199*b* may be mounted to piston rod 194 and may be held on piston rod 194 with set screws and a LOCTITE™ adhesive made by Henkel Corporation.

It is possible for controller 200 (FIG. 7) to be programmed in such manner to control the hydraulic fluid supply system 1160 in such a manner as to provide for a relatively smooth slowing down, a stop, reversal in direction and speeding up of piston rod 194 along with the hydraulic pistons 154*a*, 154*b* and gas piston 182 as the piston rod 194, hydraulic pistons 154*a*, 154*b* and gas piston 182 transition between a drive stroke providing movement to the right to a drive stroke providing the stroke to the left and back to a stroke providing movement to the right.

An example hydraulic fluid supply system 1160 for driving hydraulic pistons 154*a*, 154*b* of hydraulic cylinders 152*a*, 152*b* of hydraulic gas compressor 150 in reciprocating movement is illustrated in FIG. 7. Hydraulic fluid supply subsystem 1160 may be a closed loop system and may include a pump unit 1174, hydraulic fluid communication lines 1163*a*, 1163*b*, 1166*a*, 1166*b*, and a hot oil shuttle valve device 1168. Shuttle valve device 1168 may be for example a hot oil shuttle valve device made by Sun Hydraulics Corporation under model XRDCLNN-AL.

Fluid communication line 1163*a* fluidly connects a port S of pump unit 1174 to a port Q of shuttle valve 1168. Fluid communication line 1163*b* fluidly connects a port P of pump 1174 to a port R of shuttle valve 1168. Fluid communication line 1166*a* fluidly connects a port V of shuttle valve 1168 to a port 1184*a* of hydraulic cylinder 152*a*. Fluid communication line 1166*b* fluidly connects a port W of shuttle valve 1168 to a port 1184*b* of hydraulic cylinder 152*b*.

An output port M of shuttle valve 1168 may be connected to an upstream end of a bypass fluid communication line 1169 having a first portion 1169*a*, a second portion 1169*b* and a third portion 1169*c* that are arranged in series. A filter 1171 may be interposed in bypass line 1169 between portions 1169*a* and 1169*b*. Filter 1171 may be operable to remove contaminants from hydraulic fluid flowing from shuttle valve device 1168 before it is returned to reservoir 1172. Filter 1171 may for example include a type HMK05/25 5 micro-m filter device made by Donaldson Company, Inc. The downstream end of line portion 1169*b* joins with the upstream end of line portion 1169*c* at a T-junction where a downstream end of a pump case drain line 1161 is also fluidly connected. Case drain line 1161 may drain hydraulic fluid leaking within pump unit 1174. Fluid communication line portion 1169*c* is connected at an opposite end to an input port of a thermal valve device 1142. Depending upon the temperature of the hydraulic fluid flowing into thermal valve device 1142 from communication line portion 1169*c* of bypass line 1169, thermal valve device 1142 directs the hydraulic fluid to either fluid communication line 1141*a* or 1141*b*. If the temperature of the hydraulic fluid flowing into thermal valve device 1142 is greater than a set threshold level, valve device 1142 will direct the hydraulic fluid through fluid communication line 1141*a* to a cooling device 1143 where hydraulic fluid can be cooled before being passed through fluid communication line 1141*c* to reservoir 1172. If the hydraulic fluid entering fluid valve device 1142 does not require cooling, then thermal valve 1142 will direct the hydraulic fluid received therein from communication line portion 1169*c* to communication line 1141*b* which leads directly to reservoir 1172. An example of a suitable thermal valve device 1142 is a model 67365-110F made by TTP (formerly Thermal Transfer Products). An example of a suitable cooler 1143 is a model BOL-16-216943 also made by TTP.

Drain line 1161 connects output case drain ports U and T of pump unit 1174 to a T-connection in communication line 1169*b* at a location after filter 1171. Thus any hydraulic fluid directed out of case drain ports U/T of pump unit 1174 can pass through drain line 1161 to the T-connection of communication line portions 1169*b*, 1169*c*, (without going through the filter device 1171) where it can mix with any hydraulic fluid flowing from filter 1171 and then flow to thermal valve device 1142 where it can either be directed to cooler 1143 before flowing to reservoir 1172 or be directed directly to reservoir 1172. By not passing hydraulic fluid from case drain 1161 through relatively fine filter 1171, the risk of filter 1171 being clogged can be reduced. It will be noted that filter 1182 provides a secondary filter for fluid that is re-charging pump unit 1174 from reservoir 1172.

Hydraulic fluid supply system 1160 may include a reservoir 1172 may utilize any suitable driving fluid, which may be any suitable hydraulic fluid that is suitable for driving the hydraulic cylinders 152*a*, 152*b*.

Cooler 1143 may be operable to maintain the hydraulic fluid within a desired temperature range, thus maintaining a desired viscosity. For example, in some embodiments, cooler 1143 may be operable to cool the hydraulic fluid when the temperature goes above about 50° C. and to stop cooling when the temperature falls below about 45° C. In some applications such as where the ambient temperature of the environment can become very cold, cooler 1143 may be a combined heater and cooler and may further be operable to heat the hydraulic fluid when the temperature reduces below for example about −10° C. The hydraulic fluid may be selected to maintain a viscosity generally in hydraulic fluid supply system 1160 of between about 20 and about 40 $mm^2s^{-1}$ over this temperature range.

Hydraulic pump unit 1174 is generally part of a closed loop hydraulic fluid supply system 1160. Pump unit 1174 includes outlet ports S and P for selectively and alternately delivering a pressurized flow of hydraulic fluid to fluid communication lines 1163*a* and 1163*b* respectively, and for allowing hydraulic fluid to be returned to pump unit 1174 at ports S and P. Thus hydraulic fluid supply system 1160 may be part of a closed loop hydraulic circuit, except to the extent described hereinafter. Pump unit 1174 may be implemented using a variable-displacement hydraulic pump capable of producing a controlled flow hydraulic fluid alternately at the outlets S and P. In one embodiment, pump unit 1174 may be an axial piston pump having a swashplate that is configurable at a varying angle α. For example, pump unit 1174 may be a HPV-02 variable pump manufactured by Linde Hydraulics GmBH & Co. KG of Germany, a model that is operable to deliver displacement of hydraulic fluid of up to about 55 cubic centimeters per revolution at pressures in the range of 300-3000 psi. In other embodiments, the pump unit 1174 may be other suitable variable displacement pump, such as a variable piston pump or a rotary vane pump, for example. For the Linde HPV-02 variable pump, the angle α of the swashplate may be adjusted from a maximum negative angle of about −21°, which may correspond to a maximum flow rate condition at the outlet S, to about 0°, corresponding to a substantially no flow condition from either port S or P, and a maximum positive angle of about +21°, which corresponds to a maximum flow rate condition at the outlet P.

In this embodiment the pump unit 1174 may include an electrical input for receiving a displacement control signal from controller 200. The displacement control signal at the input is operable to drive a coil of a solenoid (not shown) for controlling the displacement of the pump unit 1174 and thus a hydraulic fluid flow rate produced alternately at the outlets P and S. The electrical input is connected to a 24 VDC coil within the hydraulic pump 1174, which is actuated in response to a controlled pulse width modulated (PWM) excitation current of between about 232 mA ($i_{0u}$) for a no flow condition and about 425 mA ($i_U$) for a maximum flow condition.

For the Linde HPV-02 variable pump unit 1174, the swashplate is actuated to move to an angle α either +21° or −21°, only when a signal is received from controller 200. Controller 200 will provide such a signal to pump unit 1174 based on the position of the hydraulic pistons 154*a*, 154*b* as detected by proximity sensors 157*a*, 157*b* as described above, which provide a signal to the controller 200 when the gas compressor 150 is approaching the end of a drive stroke in one direction, and commencement of a drive stroke in the opposite direction is required.

Pump unit 1174 may also be part of a fluid charge system 1180. Fluid charge system 1180 is operable to maintain sufficient hydraulic fluid within pump unit 1174 and may maintain/hold fluid pressure of for example at least 300 psi at both ports S and P so as to be able to control and maintain the operation of the main pump so it can function to supply a flow of hydraulic fluid under pressure alternately at ports S and P.

Fluid charge system 1180 may include a charge pump that may be a 16 cc charge pump supplying for example 6-7 gpm and it may be incorporated as part of pump unit 1174. Charge system 1180 functions to supply hydraulic fluid as may be required by pump unit 1174, to replace any hydraulic fluid that may be directed from port M of shuttle valve device 1168 through a relief valve associated with shuttle valve device 1168 to reservoir 1172 and to address any internal hydraulic fluid leakage associated with pump unit 1174. The shuttle valve device 1168 may for example redirect in the range of 3-4 gpm from the hydraulic fluid circuit. The charge pump will then replace the redirected hydraulic fluid 1:1 by maintaining a low side loop pressure.

The relief valve associated with shuttle valve device 1168 will typically only divert to port M a very small proportion of the total amount of hydraulic fluid circulating in the fluid circuit and which passes through shuttle valve device 1168 into and out of hydraulic cylinders 152*a*, 152*b*. For example, the relief valve associated with shuttle valve device may only divert approximately 3 to 4 gallons per minute of hydraulic fluid at 200 psi, accounting for example for only about 1% of the hydraulic fluid in the substantially closed loop the hydraulic fluid circuit. This allows at least a portion of the hydraulic fluid being circulated to gas compressor 150 on each cycle to be cooled and filtered.

The charge pump may draw hydraulic fluid from reservoir 1172 on a fluid communication line 1185 that connects reservoir 1172 with an input port B of pump unit 1174. The charge pump of pump unit 1174 then directs and forces that fluid to port A where it is then communicated on fluid communication line 1181 to a filter device 1182 (which may for example be a 10 micro-m filter made by Linde.

Upon passing through filter device 1182 the hydraulic fluid may then enter port F of pump unit 1174 where it will be directed to the fluid circuit that supplies hydraulic fluid at ports S and P. In this way a minimum of 300 psi of pressure of the hydraulic fluid may be maintained during operation at ports S and P. The charge pressure gear pump may be mounted on the rear of the main pump and driven through a common internal shaft.

In a swashplate pump, rotation of the swashplate drives a set of axially oriented pistons (not shown) to generate fluid flow. In an embodiment of FIG. 7, the swashplate of the pump unit 1174 is driven by a rotating shaft 1173 that is coupled to a prime mover 1175 for receiving a drive torque. In some embodiments, prime mover 1175 is an electric motor but in other embodiments, the prime mover may be implemented in other ways such as for example by using a diesel engine, gasoline engine, or a gas driven turbine.

Prime mover 1175 is responsive to a control signal received from controller 200 at a control input to deliver a controlled substantially constant rotational speed and torque at the shaft 1173. While there may be some minor variations in rotational speed, the shaft 1173 may be driven at a speed that is substantially constant and can for a period of time required, produce a substantially constant flow of fluid alternately at the outlet ports S and P. In one embodiment the prime mover 256 is selected and configured to deliver a rotational speed of about 1750 rpm which is controlled to be substantially constant within about ±1%.

To alternately drive the hydraulic cylinders 152*a*, 152*b* to provide the reciprocating axial motion of the hydraulic pistons 154*a*, 154*b* and thus reciprocating motion of gas piston 182, a displacement control signal is sent from controller 200 to pump unit 1174 and a signal is also provided by controller to prime mover 1175. In response, prime mover 1175 drives rotating shaft 1173, to drive the swashplate in rotation. The displacement control signal at the input of pump unit 1174 drives a coil of a solenoid (not shown) to cause the angle α of the swashplate to be adjusted to desired angle such as a maximum negative angle of about −21°, which may correspond to a maximum flow rate condition at the outlet S and no flow at outlet P. The result is that pressurized hydraulic fluid is driven from port S of pump unit 1174 along fluid communication line 1163*a* to input port Q of shuttle valve device 1168. The shuttle valve device 1168 with the lower pressure hydraulic fluid at port R will be configured such that the pressurized hydraulic fluid flows into port Q and will flow out of port V of shuttle valve device 1168 and into and along fluid communication line 1166*a* and then will enter hydraulic fluid chamber 186*a* of hydraulic cylinder 152*a*. The flow of hydraulic fluid into hydraulic fluid chamber 186*a* will cause hydraulic piston 154*a* to be driven axially in a manner which expands hydraulic fluid chamber 186*a*, thus resulting in movement in one direction of piston rod 194, hydraulic pistons 154*a*, 154*b* and gas piston 182.

During the expansion of hydraulic fluid chamber 186*a* as piston 154*a* moves within cylinder barrel 187*a*, there will be a corresponding contraction in size of hydraulic fluid chamber 186*b* of hydraulic cylinder 152*b* within cylinder barrel 187*b*. This results in hydraulic fluid being driven out of hydraulic fluid chamber 186*b* through port 1184*b* and into and along fluid communication line 1166*b*. The configuration of shuttle valve device 1168 will be such that on this relatively low pressure side, hydraulic fluid can flow into port W and out of port R of shuttle valve device 1168, then along fluid communication line 1163*b* to port P of pump unit 1174. However, the relief valve associated with shuttle valve device 1168 may, in this operational configuration, direct a small portion of the hydraulic fluid flowing along line 1166*b* to port M for communication to reservoir 1172, as discussed above. However, most (e.g. about 99%) of the hydraulic fluid flowing in communication line 1166*b* will be directed to communication line 1163*b* for return to pump unit 1174 and enter at port P.

When the hydraulic piston 154*a* approaches the end of its drive stroke, a signal is sent by proximity sensor 157*a* to controller 200 which causes controller 200 to send a displacement control signal to pump unit 1174. In response to receiving the displacement control signal at the input of pump unit 1174, a coil of the solenoid (not shown) is driven to cause the angle α of the swashplate of pump unit 1174 to be altered such as to be set at a maximum negative angle of about +21°, which may correspond to a maximum flow rate condition at the outlet P and no flow at outlet S. The result is that pressurized hydraulic fluid is driven from port P of pump unit 1174 along fluid communication line 1163*b* to port R of shuttle valve device 1168. The configuration of shuttle valve device 1168 will have been adjusted due to the change in relative pressures of hydraulic fluid in lines 1163*a* and 1163*b*, such that on this relatively high pressure side, hydraulic fluid can flow into port R and out of port W of shuttle valve device 1168, then along fluid communication line 1166*b* to port 1184*b*. Pressurized hydraulic fluid will then enter hydraulic fluid chamber 186*b* of hydraulic cylinder 152*b*. This will cause hydraulic piston 154*b* to be driven in an opposite axial direction in a manner which expands hydraulic fluid chamber 186*b*, thus resulting in synchronized movement in an opposite direction of hydraulic cylinders 154*a*, 154*b* and gas piston 182.

During the expansion of hydraulic fluid chamber 186*b*, there will be a corresponding contraction of hydraulic fluid chamber 186*a* of hydraulic cylinder 152*a*. This results in hydraulic fluid being driven out of hydraulic fluid chamber 186*a* through port 1184*a* and into and along fluid communication line 1166*a*. The configuration of shuttle valve device 1168 will be such that on what is now a relatively low pressure side, hydraulic fluid can now flow into port V and out of port Q of shuttle valve device 1168, then along fluid communication line 1163*a* to port S of pump unit 1174. However, the relief valve associated with shuttle valve device 1168 may in this operational configuration, direct as small portion of the hydraulic fluid flowing along line 1166*a* to port M for communication to reservoir 1172, as discussed above. Again most of the hydraulic fluid flowing in communication line 1166*a* will be directed to communication line 1163*a* for return to pump unit 1174 at port S but a small portion (e.g. 1%) may be directed by shuttle valve device 1168 to port M for communication to reservoir 1172, as discussed above. However, most (e.g. about 99%) of the hydraulic fluid flowing in communication line 1166*a* will be directed to communication line 1163*a* for return to pump unit 1174 and enter at port S.

The foregoing describes one cycle which can be repeated continuously for multiple cycles, as may be required during operation of gas compressor system 126. If a change in flow rate/fluid pressure is required in hydraulic fluid supply system 1160, to change the speed of movement and increase the frequency of the cycles, controller 200 may send an appropriate signal to prime mover 1175 to vary the output to vary the rotational speed of shaft 1173. Alternately and/or additionally, controller 200 may send a displacement control signal to the input of pump unit 1174 to drives the solenoid (not shown) to cause a different angle α of the swashplate to provide different flow rate conditions at the port P and no flow at outlet S or to provide different flow rate conditions at the port S and no flow at outlet P. If zero flow is required, the swash plate may be moved to an angle of zero degrees.

Controller 200 may also include an input for receiving a start signal operable to cause the controller 200 to start operation of gas compressor system 126 and outputs for producing a control signal for controlling operation of the prime mover 1175 and pump unit 1174. The start signal may be provided by a start button within an enclosure that is depressed by an operator on site to commence operation. Alternatively, the start signal may be received from a remotely located controller, which may be communication with the controller via a wireless or wired connection. The controller 200 may be implemented using a microcontroller circuit although in other embodiments, the controller may be implemented as an application specific integrated circuit (ASIC) or other integrated circuit, a digital signal processor, an analog controller, a hardwired electronic or logic circuit, or using a programmable logic device or gate array, for example.

Figure 4:
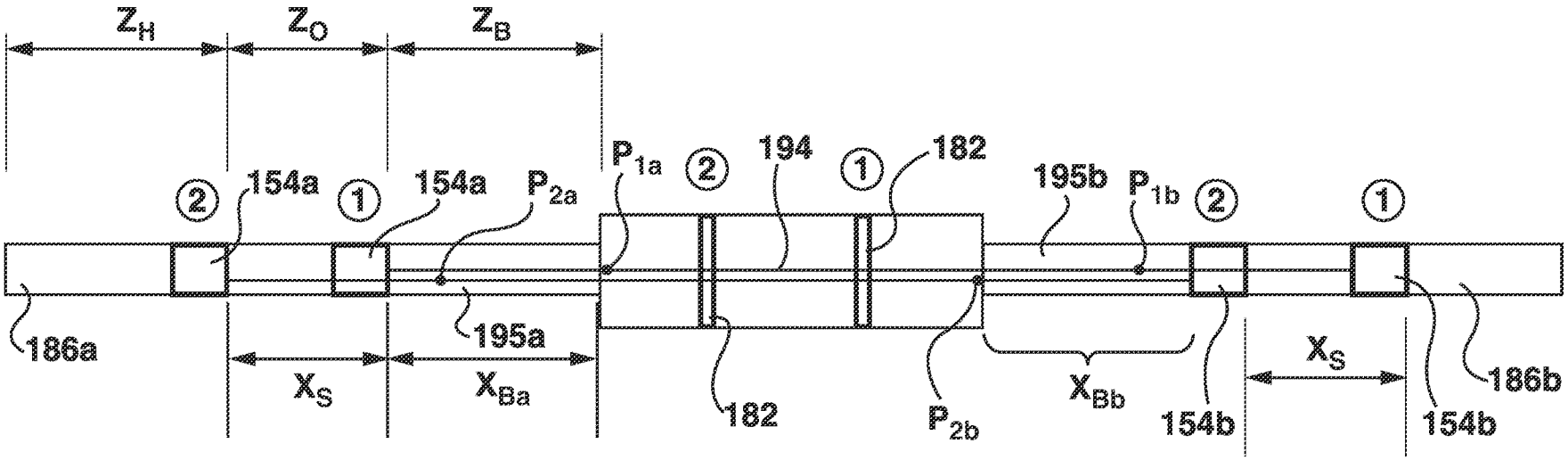
FIG. 4 is a schematic side view of the gas compressor of FIG. 2.

With reference now to FIG. 4, it may be appreciated that hydraulic cylinder barrel 187*a* may be divided into three zones: (i) a zone ZH dedicated exclusively to holding hydraulic fluid; (ii) a zone ZB dedicated exclusively for the buffer area and (iii) an overlap zone, Zo, that which, depending upon where the hydraulic piston 154*a* is in the stroke cycle, will vary between an area holding hydraulic fluid and an area providing part of the buffer chamber. Hydraulic cylinder barrel 187*b* may be divided into a corresponding set of three zones in the same manner with reference to the movement of hydraulic piston 154*b*.

If the length XBa (which is the length of the cylinder barrel from gas cylinder head 192*a* to the inward facing surface of hydraulic piston 154*a* at its full right position) is greater than the stroke length Xs, then any point P1*a* on piston rod 194 on the piston rod 194 that is at least for part of the stroke within gas compression chamber section 181*a*, will not move beyond the distance XBa when the gas piston 182 and the hydraulic piston 154*a* move from the farthermost right positions of the stroke position (1) to the farthermost left positions of the stroke position (2). Thus, any materials/contaminants carried on piston rod 194 starting at P1*a* will not move beyond the area of the hydraulic cylinder barrel 187*a* that is dedicated to providing buffer chamber 195*a*. Thus, any such contaminants travelling on piston rod 194 will be prevented, or at least inhibited, from moving into the zones ZH and Zo of hydraulic cylinder barrel 187*a* that hold hydraulic fluid. Thus any point P1*a* on piston rod 194 that passes into the gas compression chamber will not pass into an area of the hydraulic cylinder barrel 187*a* that will encounter hydraulic fluid (i.e. It will not pass into ZH or Zo). Thus, all portions of piston rod 194 that encounter gas, will not be exposed to an area that is directly exposed to hydraulic fluid. Thus cross contamination of contaminants that may be present with the natural gas in the gas compression cylinder 180 may be prevented or inhibited from migrating into the hydraulic fluid that is in that areas of hydraulic cylinder barrel 187*a* adapted for holding hydraulic fluid. It may be appreciated, that since there is an overlap zone, the hydraulic pistons do move from a zone where there should never be anything but hydraulic fluid to a zone which transitions between hydraulic fluid and the contents (e.g. air) of the buffer zone. Therefore, contaminants on the inner surface wall of the cylinder barrel 187*a*, 187*b* in the overlap zone could theoretically get transferred to the edge surface of the piston. However, the presence of buffer zone significantly reduces the level of risk of cross contamination of contaminants into the hydraulic fluid.

With reference continuing to FIG. 4, it may be appreciated that hydraulic cylinder barrel 187*b* may also be divided into three zones—like hydraulic cylinder barrel 187*a*, namely: (i) a zone ZH dedicated exclusively to holding hydraulic fluid; (ii) a zone ZB dedicated exclusively for the buffer area and (iii) an overlap zone that which, depending upon where the device is in the stroke cycle, will vary between an area holding hydraulic fluid and an area providing part of the buffer chamber.

If the length XBb (which is the length of the cylinder barrel from gas cylinder head 192*b* to the inward facing surface of hydraulic piston 154*b* at its full left position) is greater than the stroke length Xs, then any point P2*b* on piston rod 194 will not move beyond the distance XBb when the gas piston 182 and the hydraulic piston 154*b* move from the farthermost left positions of the stroke (2) to the farthermost right positions of the stroke (1). Thus any materials/contaminants on piston rod 194 starting at P2*b* will be prevented or at least inhibited from moving beyond the area of the hydraulic cylinder barrel 187*b* that provides buffer chamber 195*b*. Thus, any such contaminants travelling on piston rod 194 will be prevented, or at least inhibited, from moving into the zones ZH and Zo of hydraulic cylinder barrel 187*b* that hold hydraulic fluid. Thus any point P2*b* on piston rod 194 that passes into the gas compression chamber will not pass into an area of the hydraulic cylinder barrel 187*b* that will encounter hydraulic fluid (i.e. It will not pass into Zh or Zo). Thus, all portions of piston rod 194 that encounter gas, will not be exposed to an area that is directly exposed to hydraulic fluid. Thus cross contamination of contaminants that may be present with the natural gas in the gas compression cylinder 180 may be prevented or inhibited from migrating into the hydraulic fluid that is in that areas of hydraulic cylinder barrel 187*b* adapted for holding hydraulic fluid. Thus, any such contaminants travelling on piston rod 194 will be prevented or a least inhibited from moving into the area of hydraulic cylinder barrel 187*b* that in operation, holds hydraulic fluid. Thus cross contamination of contaminants that may be present with the natural gas in the gas compression cylinder 180 may be prevented or at least inhibited from migrating into the hydraulic fluid that is in that area of hydraulic cylinder barrel 187*b* that is used to hold hydraulic fluid.

In some embodiments, during operation of hydraulic gas compressor 150, buffer chambers 195*a*, 195*b* may each be separately open to ambient air, such that air within buffer chamber may be exchanged with the external environment (e.g. air at ambient pressure and temperature). However, it may not desirable for the air in buffer chambers 195*a*, 195*b* to be discharged into the environment and possibly other components to be discharged directly into the environment, due to the potential for other components that are not environmentally friendly also being present with the air. Thus a closed system may be highly undesirable such that for example buffer chambers 195*a*, 195*b* may be in communication with each such that a substantially constant amount of gas (e.g. such as air) can be shuttled back and forth through communication lines—such as communication lines 215*a*, 215*b* in FIG. 7.

Buffer chambers 195*a* and/or 195*b* may in some embodiments be adapted to function as a purge region. For example, buffer chambers 195*a*, 195*b* may be fluidly interconnected to each other, and may also in some embodiments, be in fluid communication with a common pressurized gas regulator system 214 (FIG. 7), through gas lines 215*a*, 215*b* respectively. Pressurized gas regulator system 214 may for example maintain a gas at a desired gas pressure within buffer chambers 195*a*, 195*b* that is always above the pressure of the compressed natural gas and/or other gases that are communicated into and compressed in gas compression cylinder chamber sections 181*a*, 181*b* respectively. For example, pressurized gas regulator system 214 may provide a buffer gas such as purified natural gas, air, or purified nitrogen gas, or another inert gas, within buffer chambers 195*a*, 195*b*. This may then prevent or substantially restrict natural gas and any contaminants contained in gas compression cylinder sections 181*a*, 181*b* migrating into buffer chambers 195*a*, 195*b*. The high pressure buffer gas in buffer chambers 195*a*, 195*b* may prevent movement of natural gas and possibly contaminants into the buffer chambers 195*a*, 195*b*. Furthermore if the buffer gas is inert, any gas that seeps into the gas compression cylinder chamber sections 181*a*, 181*b* will not react with the natural gas and/or contaminants. This can be particularly beneficial if for example the contaminants include hydrogen sulphide gas which may be present in one or both of gas compression cylinder chamber sections 181*a*, 181*b*.

In some embodiments, gas lines 215*a*, 215*b* (FIG. 7) may not be in fluid communication with a pressurized gas regulator system 214—but instead may be interconnected directly with each other to provide a substantially unobstructed communication channel for whatever gas is in buffer chambers 195*a*, 195*b*. Thus during operation of gas compressor 150, as hydraulic pistons 154*a*, 154*b* move right and then left (and/or upwards downwards) in unison, as one buffer chamber (e.g. buffer chamber 195*a*) increases in size, the other buffer chamber (e.g. buffer chamber 195*b*) will decrease in size. So instead of gas in each buffer chamber 195*a*, 195*b* being alternately compressed and then decompressed, a fixed total volume of gas at a substantially constant pressure may permit gas thereof to shuttle between the buffer chambers 195*a*, 195*b* in a buffer chamber circuit.

Also, instead of being directly connected with each other, buffer chambers 195*a*, 195*b* may be both in communication with a common holding tank 1214 (FIG. 7) that may provide a source of gas that may be communicated between buffer chambers 195*a*, 195*b*. The gas in the buffer chamber gas circuit may be at ambient pressure in some embodiments and pressurized in other embodiments. The holding tank 1214 may in some embodiments also serve as a separation tank whereby any liquids being transferred with the gas in the buffer chamber system can be drained off.

In the embodiment of FIGS. 2, and 9A-9C, a drainage port 207*a* for buffer chamber 195*a* may be provided on an underside surface of hydraulic cylinder barrel 187*a*. A corresponding drainage port 207*b* may be provided for buffer chamber 195*b*. Drainage ports 207*a*, 207*b* may allow drainage of any liquids that may have accumulated in each of buffer chambers 195*a*, 195*b* respectively. Alternately or additionally such liquids may be able to be drained from an outlet in a holding tank 1214.

Figure 5:
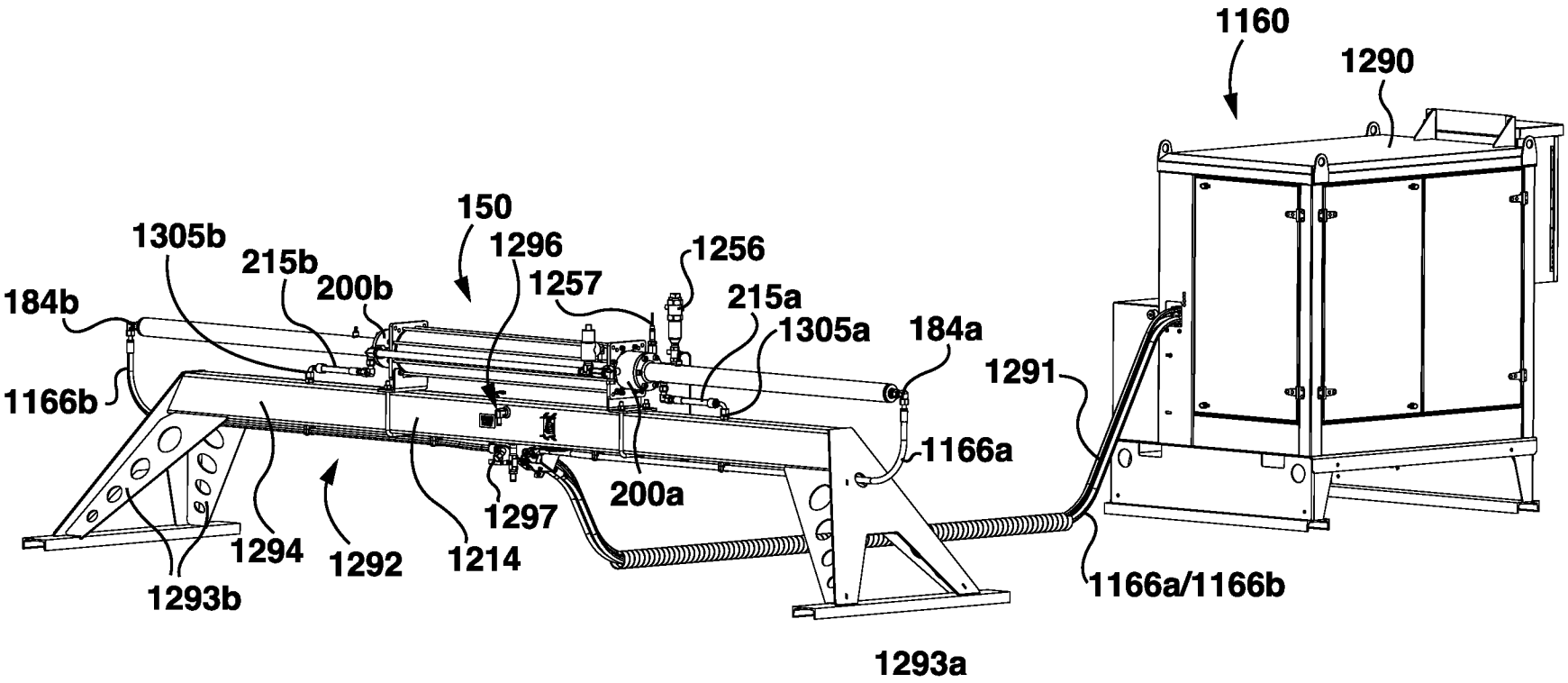
FIG. 5 is a perspective view of a gas compressor system including the gas compressor of FIG. 2 forming part of an oil and gas producing well systems of FIG. 1 or 1D.
Figure 6:
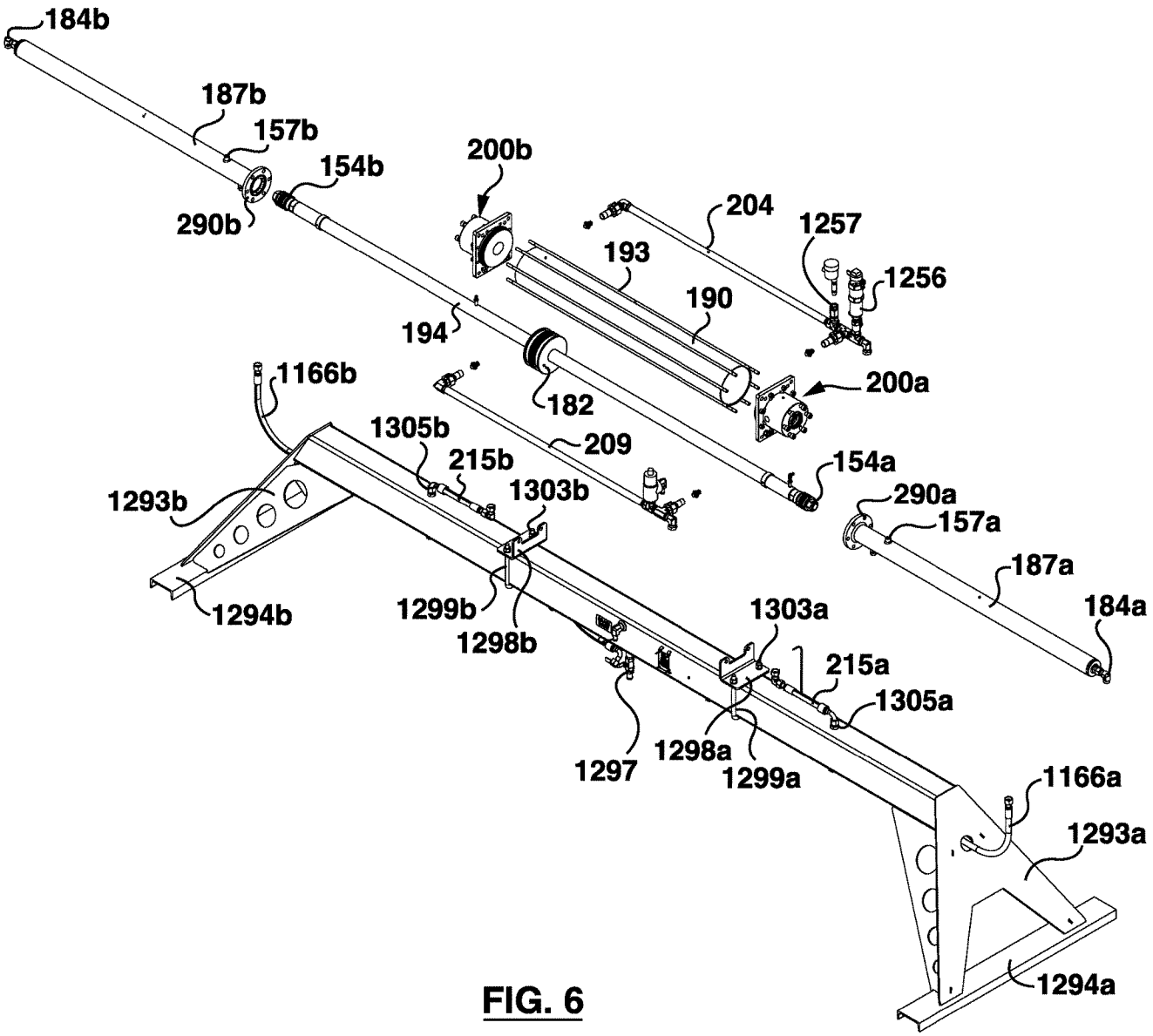
FIG. 6 is a perspective view of a portion of the gas compressor system of FIG. 5 with some parts thereof exploded.

As illustrated in FIGS. 5 and 6, gas compressor system 126 may include a cabinet enclosure 1290 for holding components of hydraulic fluid supply system 1160 including pump unit 1174, prime mover 1175, reservoir 1172, shuttle device 1168, filters 1182 and 1171, thermal valve device 1142 and cooler 1143. Controller 200 may also be held in cabinet enclosure 1290. One or more electrical cables 1291 may be provided to provide power and communication pathways with the components of gas compressor system 126 that are mounted on a support frame 1292. Additionally, piping 124 (FIG. 1) carrying natural gas to compressor 150 may be connected to connector 250 when gas compressor 150 is mounted on support frame 1292 to provide a supply of natural gas to gas compressor 150.

Gas compressor system 126 may thus also include a support frame 1292. Support frame 1292 may be generally configured to support gas compressor 150 in a generally horizontal orientation. Support frame 1292 may include a longitudinally extending hollow tubular beam member 1295 which may be made from any suitable material such as steel or aluminium. Beam member 1295 may be supported proximate each longitudinal end by pairs of support legs 1293*a*, 1293*b* which may be attached to beam member 1295 such as by welding. Pairs of support legs 1293*a*, 1293*b* may be transversely braced by transversely braced support members 1294*a*, 1294*b* respectively that are attached thereto such as by welding. Support legs 1293*a*, 1293*b* and brace members 1294*a*, 1294*b* may also be made from any suitable material such as steel or aluminium.

Figure 9C:
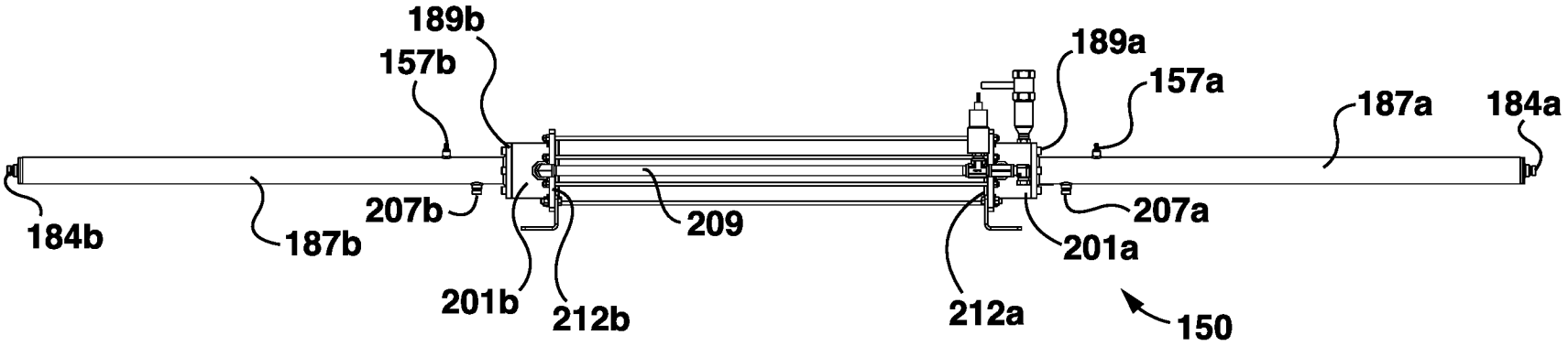
FIG. 9C is a side view of the gas compressor of FIG. 2.

Mounted to an upper surface of beam member 1295 may be L-shaped, transversely oriented support brackets 1298*a*, 1298*b* that may be appropriately longitudinally spaced from each other (see also FIGS. 8 to 9C). Support brackets 1298*a*, 1298*b* may be secured to beam member 1295 by U-members 1299*a*, 1299*b* respectively that are secured around the outer surface of beam member 1295 and then secured to support brackets 1298*a*, 1298*b* by passing threaded ends through openings 1300*a*, 1300*b* and securing the ends with pairs of nuts 1303*a*, 1303*b* (FIG. 6). Support bracket 1298*a* may be secured to gas cylinder head plate 212*a* by bolts received through aligned openings in support bracket 1298*a* and gas cylinder head plate 212*a*, secured by nuts 1303*a*. Similarly, support bracket 1298*b* may be secured to gas cylinder head plate 212*b* by bolts received through aligned openings in support bracket 1298*b* and gas cylinder head plate 212, secured by nuts 1303*b*. In this way, gas compressor 150 may be securely mounted to and supported by support frame 1292.

Hydraulic fluid communication lines 1166*a*, 1166*b* extend from ports 184*a*, 184*b* respectively to opposite ends of support frame 1294 and may extend under a lower surface of beam member 1295 to a common central location where they may then extend together to enclosure cabinet 1290 housing shuttle valve device 1168.

Tubular beam member 1295 may be hollow and may be configured to act as, or to hold a separate tank such as, holding tank 1214. Thus beam member 1285 may serve to act as a gas/liquid separation and holding tank and may serve to provide a gas reservoir for gas for buffer chamber system of buffer chambers 195*a*, 195*b*. Lines 215*a*, 215*b* may lead from ports of buffer chambers 195*a*, 195*b* into ports 1305*a*, 1305*b* into holding tank 1214 within tubular member 1295.

Holding tank 1214 within beam member 1295 may also have an externally accessible tank vent 1296 that allow for gas in holding tank 1214 to be vented out. Also, holding tank 1214 may have a manual drain device 1297 that is also externally accessible and may be manually operable by an operator to permit liquids that may accumulate in holding tank 1214 to be removed.

In operation of gas compressor system 126, including hydraulic gas compressor 150, the reciprocal movement of the hydraulic pistons 152*a*, 152*b*, can be driven by a hydraulic fluid supply system such as for example hydraulic fluid supply system 1160 as described above. The reciprocal movement of hydraulic pistons 154*a*, 154*b* will cause the size of the buffer chambers 195*a*, 195*b* to grow smaller and larger, with the change in size of the two buffer chambers 195*a*, 195*b* being for example 180 degrees out of phase with each other. Thus, as hydraulic piston 154*b* moves from position 1 to position 2 in FIG. 6 driven by hydraulic fluid forced into hydraulic fluid chamber 186*b*, some of the gas (e.g. air) in buffer chamber 195*b* will be forced into gas line(s) 215*a*, 215*b* (FIG. 7) that interconnect chambers 195*a*, 195*b*, and flow through holding tank 1214 towards and into buffer chamber 195*a*. In the reverse direction, as hydraulic piston 154*a* moves from position 2 to position 1 in FIG. 4 driven by hydraulic fluid forced into hydraulic fluid chamber 186*a*, some of the gas (e.g. air) in buffer chamber 195*a* will be forced into gas lines 215*a*, 215*b* and flow through holding tank 1214 towards and into buffer chamber 195*b*. In this way, the gas in the system of buffer chambers 195*a*, 195*b* can be part of a closed loop system, and gas may simply shuttle between the two buffer chambers 195*a*, 195*b*, (and optionally through holding tank 1214) thus preventing contaminants that may move into buffer chambers 195*a*, 195*b* from gas cylinder sections 181*a*, 181*b* respectively, from contaminating the outside environment. Additionally, such a closed loop system can prevent any contaminants in the outside environment from entering the buffer chambers 195*a*, 195*b* and thus potentially migrating into the hydraulic fluid chambers 186*a*, 186*b* respectively.

Gas compressor system 126 may also include a natural gas communication system to allow natural gas to be delivered from piping 124 (FIG. 1) to the two gas compression chamber sections 181*a*, 181*b* of gas compression cylinder 180 of gas compressor 150, and then communicate the compressed natural gas from the sections 181*a*, 181*b* to piping 130 for delivery to oil and gas flow line 133.

With reference to FIG. 2 in particular, the natural gas communication system may include a first input valve and connector device 250, a second input valve and connector device 260, a first output valve and connector device 261 and a second output valve and connector device 251. A gas input suction distribution line 204 fluidly interconnects input valve and connector device 250 with input valve and connector device 260. A gas output pressure distribution line 209 fluidly interconnects output valve and connector device 261 with valve and connector device 251.

Figure 3:
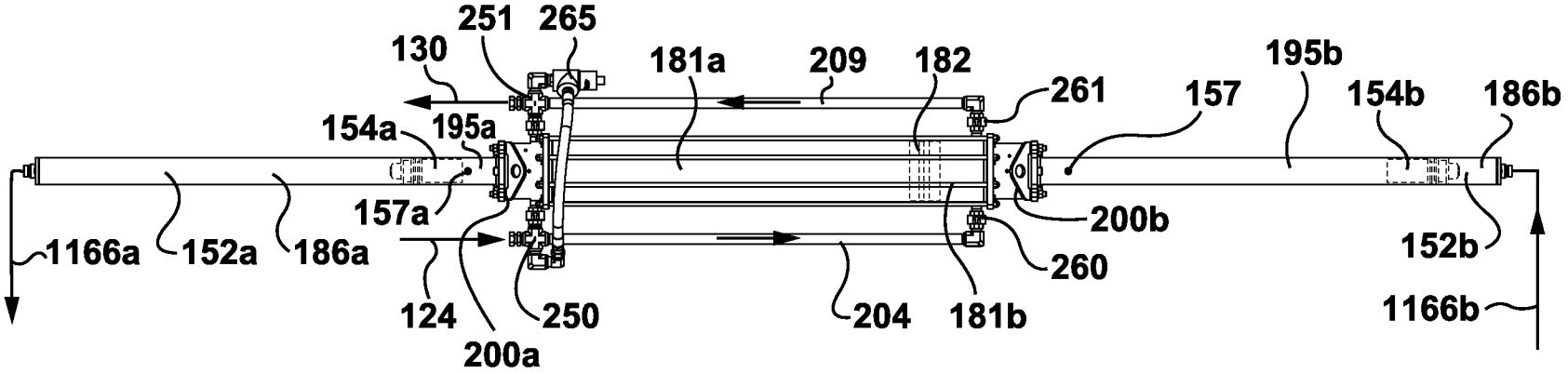
FIG. 3(*i*) to (*iv*) are side views of the gas compressor or FIG. 2 showing a cycle of operation.

With reference also to FIGS. 8, 8A and 8B, input valve and connector device 250 may include a gas compression chamber section valve and connector, a gas pipe input connector, and a gas suction distribution line connector. In an embodiment as shown in FIGS. 2 and 3(*i*) to (*iv*) an excess pressure valve and bypass connector is also provided. In an alternate embodiment as shown in FIGS. 8 to 9C, there is no bypass connector. However, in this latter embodiment there is a lubrication connector 1255 to which is attached in series to an input port of a lubrication device 1256 comprising suitable fittings and valves. Lubrication device 1256 allows a lubricant such as a lubricating oil (like WD-40 oil) to be injected into the passageway where the natural gas passes though connector device 250. The WD40 can be used to dissolve hydrocarbon sludges and soots to keep seals functional.

An electronic gas pressure sensing/transducer device 1257 may also be provided which may for example be a model AST46HAP00300PGT1L000 made by American Sensor technologies. This sensor reads the casing gas pressure.

Gas pressure sensing device/transducer 1257 may be in electronic communication with controller 200 and may provide signals to controller 200 indicative of the pressure of the gas in the casing/gas distribution line 204. In response to such signal, controller 200 may modify the operation of system 100 and in particular the operation of hydraulic fluid supply system 1160. For example, if the pressure in gas suction distribution line 204 descends to a first threshold level (e.g. 8 psi), controller 200 can control the operation of hydraulic fluid supply system 170 to slow down the reciprocating motion of gas compressor 150, which should allow the pressure of the gas that is being fed to connector device 250 and gas suction distribution line 204 to increase. If the pressure measured by sensing device 1257 reaches a second lower threshold—such that it may be getting close to zero or negative pressure (e.g. 3 psi) controller 200 may cause hydraulic fluid supply system 1160 to cease the operation of gas compressor 150.

Hydraulic fluid supply system 1160 may then be re-started by controller 200, if and when the pressure measured by gas pressure sensing device/transducer 1257 again rises to an acceptable threshold level as detected by a signal received by controller 200.

The output port of gas pressure sensing device 1257 may be connected to an input connector of gas suction distribution line 204.

With reference to FIGS. 8A and 8B, output valve and connector device 251 may include a gas compression chamber section valve, gas pipe output connector 205 and a gas pressure distribution line connector 263. In an embodiment as shown in FIG. 2, an excess pressure valve and bypass connector is also provided. In an alternate embodiment as shown in FIGS. 8 to 9C, there is no bypass connector.

With reference to the embodiment of FIGS. 2 and 3(*i*) to 3(*iv*), a pressure relief valve 265 is provided limit the gas discharge pressure. In some embodiments, relief valve 265 may discharge pressurized gas to the environment. However, in this illustrated embodiment, the relieved gas can be sent back through a bypass hose 266 to the suction side of the gas compressor 150 to limit environmental discharge. One end of a bypass hose 266 may be connected for communication of natural gas from a port of an excess gas pressure bypass valve 265 (FIG. 2). The opposite end of bypass port may be connected to an input port of connector 250. The output port from bypass valve 265 may provide one way fluid communication through bypass hose 266 of excessively pressured gas in for example gas output distribution line 209, to connector 250 and back to the gas input side of gas compressor 150. Thus, once the pressure is reduced to a level that is suitable for transmission in piping 120 (FIG. 2A), gas pressure relief valve will close.

With reference to FIGS. 8 and 8B, installed within connector 250 is a one way check valve device 1250. When connector 250 is received in an opening 1270 on the inward seal side of casing 201*a*, gas may flow through connector 250 and its check valve device 1250, through casing 201*a* into gas compression chamber section 181*a*. Similarly within connector 251 is a one way check valve device 1251. When connector 262 is received in an opening 1271 on the inward seal side of casing 201*b*, gas may flow out of gas compression chamber section 181*a* through casing 201*a*, and then through one-way valve device 1251 of connector 251 where gas can then flow through output connector 205 (FIG. 2) into piping 130 (FIG. 1).

The check valve device 1250 associated with connector 250 is operable to allow gas to flow into casing 201*a* and gas compression chamber section 181*a*, if the gas pressure at connector 250 is higher than the gas pressure on the inward side of the check valve device 1250. This will occur for example when gas compression chamber section 181*a* is undergoing expansion in size as gas piston 182 moves away from head assembly 200*a* resulting in a drop in pressure within compression chamber section 181*a*. Check valve device 1251 is operable to allow gas to flow out of casing 201*a* and gas compression chamber section 181*a*, if the gas pressure in gas compression chamber section 181*a* and casing 201*a* is higher than the gas pressure on the outward side of check valve device 1251 of connector 251, and when the gas pressure reaches a certain minimum threshold pressure that allows it to open. The check valve device 1251 may be operable to be adjusted to set the threshold opening pressure difference that causes/allows the one way valve to open. The increase in pressure gas compression chamber section 181*a* and casing 201*a* will occur for example when gas compression chamber section 181*a* is undergoing reduction in size as gas piston 182 moves towards from head assembly 200*a* resulting in an increase in pressure within compression chamber section 181*a*.

With reference to FIG. 8, at the opposite end of gas suction distribution line 204 to the end connected to gas pressure sensing device 1257, is a second input connector 260. Installed within connector 260 is a one way check valve device 1260. When connector 260 is received in an opening on the inward seal side of casing 201*b*, gas may flow from gas distribution line 204 through connector 260 and valve device 1260, through casing 201*b* into gas compression chamber section 181*b*.

Similarly at the opposite end of gas pressure distribution line 209 to the end connected to connector 210, is an output connector 261. Installed within connector 261 is a one way check valve device 1261. When connector 261 is received in an opening on the inward seal side of casing 201*b*, gas may flow out of gas compression chamber section 181*b* through casing 201*b* and then through valve device 1261 and connector 261 where pressurized gas can then flow through gas pressure distribution line 209 to output connector 205 and into piping 130 (FIG. 1).

One way check valve device 1260 is operable to allow gas to flow into casing 201*b* and gas compression chamber section 181*b*, if the gas pressure at connector 260 is higher than the gas pressure on the inward side of check valve device 1260. This will occur for example when gas compression chamber section 181*b* is undergoing expansion in size as gas piston 182 moves away from head assembly 200*b* resulting in a drop in pressure within compression chamber section 181*b*. One way check valve device 1261 is operable to allow gas to flow out of casing 201*b* and gas compression chamber section 181*b*, if the gas pressure in gas compression chamber section 181*b* and casing 201*b* is higher than the gas pressure on the outward side of check valve device 1261 of connector 261, and when the gas pressure reaches a certain minimum threshold pressure that allows it to open. The check valve device 1261 may be operable to be adjusted to set the threshold opening pressure difference that causes/allows the one way valve to open. The increase in pressure gas compression chamber section 181*b* and casing 201*b* will occur for example when gas compression chamber section 181*b* is undergoing reduction in size as gas piston 182 moves towards from head assembly 200*b* resulting in an increase in pressure within compression chamber section 181*b*.

With particular reference to FIG. 8B, interposed between an output end of gas pressure distribution line 209 and valve and connector 251 may be a bypass valve 1265. If the gas pressure in gas pressure distribution line 209 and/or in connector 250, reaches or exceeds a pre-determined upper pressure threshold level, excess pressure valve 1265 will open to relieve the pressure and reduce the pressure to a level that is suitable for transmission into piping 130 (FIG. 1).

In operation of gas compressor 150, hydraulic pistons 154*a*, 154*b* may be driven in reciprocating longitudinal movement for example by hydraulic fluid supply system 1160 as described above, thus driving gas piston 182 as well. The following describes the operation of the gas flow and gas compression in gas compressor system 126.

With hydraulic pistons 154*a*, 154*b* and gas piston 182 in the positions shown in FIG. 3(*i*) natural gas will be already located in gas cylinder compression section 181*a*, having been previously drawn into gas cylinder compression section 181*a* during the previous stroke due to pressure the differential that develops between the outer side of one way valve device 1250 and the inner side of valve device 1250 as piston 182 moved from left to right. During that previous stroke, natural gas will have been drawn from pipe 124 through connector 202 and connector device 250 and its check valve device 1250 into gas compression chamber section 181*a*, with check valve 1251 of connector device 251 being closed due to the pressure differential between the inner side of check valve device 1251 and the outer side of check valve device 1251 thus allowing gas compression cylinder section 181*a* to be filled with natural gas at a lower pressure than the gas on the outside of connector device 251.

Thus, with the pistons in the positions shown in FIG. 3(*i*), hydraulic cylinder chamber 186*b* is supplied with pressurized hydraulic fluid in a manner such as is described above, thus driving hydraulic piston 154*b*, along with piston rod 194, gas piston 182 and hydraulic piston 154*a* attached to piston rod 194, from the position shown in FIG. 3(*i*) to the position shown in FIG. 3(*ii*). As this is occurring, hydraulic fluid in hydraulic cylinder chamber 186*a* will be forced out of chamber 186*a*, and flow as described above.

As hydraulic piston 154*b*, along with piston rod 194, gas piston 182 and hydraulic piston 154*a* attached to piston rod 194, move from the position shown in FIG. 3(*i*) to the position shown in FIG. 3(*ii*), natural gas will be drawn from supply line 124, through connector device 250 into gas suction distribution line 204, and then pass through input valve connector 260 and one way valve device 1260 and into gas compression section 181*b*. Natural gas will flow in such a manner because as gas piston 182 moves to the left as shown in FIGS. 3(*i*) to (*ii*), the pressure in gas compression chamber 181*b* will drop, which will create a suction that will cause the natural gas in pipe 124 to flow.

Simultaneously, the movement of gas piston 182 to the left will compress the natural gas that is already present in gas compression chamber section 181*a*. As the pressure rises in gas chamber section 181*a*, gas flowing into connector 250 from pipe 124 will not enter chamber section 181*a*. Additionally, gas being compressed in gas compression chamber section 181*a* will stay in gas compression chamber section 181*a* until the pressure therein reaches the threshold level of gas pressure that is provided by one way check valve device 1251. Gas being compressed in chamber section 181*a* can't flow out of chamber section 181*a* into connector 250 because of the orientation of check valve device 1250.

The foregoing movement and compression of natural gas and movement of hydraulic fluid will continue as the pistons continue to move from the positions shown in FIG. 3(*ii*) to the position shown in FIG. 3(*iii*). During that time, dependent upon the pressure in gas compression chamber section 181*a*, gas will be allowed to pass out of gas compression chamber section 181*a* through connector 251 and will pass into piping 130 once the pressure is high enough to activate one way valve device 1251.

Just before hydraulic piston 154*b* reaches the position shown in FIG. 3(*iii*), proximity sensor 157*b* will detect the presence of hydraulic piston 154*b* within hydraulic cylinder 152*b* at a longitudinal position that is a short distance before the end of the stroke within hydraulic cylinder 152*b*. Proximity sensor 157*b* will then send a signal to controller 200, in response to which controller 200 will change the operational configuration of hydraulic fluid supply system 1160, as described above. This will result in hydraulic piston 154*b* not being driven any further to the left in hydraulic cylinder 152*b* than the position shown in FIG. 3(*iii*).

Once hydraulic piston 154*b*, along with piston rod 194, gas piston 182 and hydraulic piston 154*a* attached to piston rod 194, are in the position shown in FIG. 3(*iii*), natural gas will have been drawn through connector 260 and one way valve device 1260 again due to the pressure differential that is developed between gas compression chamber section 181*b* and gas suction distribution pipe 204, so that gas compression chamber section 181*b* is filled with natural gas. Much of the gas in gas compression chamber 181*a* that has been compressed by the movement of gas piston 182 from the position shown in FIG. 3(*i*) to the position shown in FIG. 3(*iii*), will, once compressed sufficiently to exceed the threshold level of valve device 1251, have exited gas compression chamber 181*a* and pass from gas pipeline output connector 205 into piping 130 (FIG. 1) for delivery to oil and gas pipeline 133. If the gas pressure is too high to be received in piping 130, excess valve and bypass connector 265/1265 will be opened to allow excess gas to exit to reduce the pressure.

Next, gas compressor system 126, including hydraulic fluid supply system 1160 is reconfigured for the return drive stroke. As natural gas has been drawn into gas compression cylinder section 181*b* it is ready to be compressed by gas piston 182. With hydraulic pistons 154*a*, 154*b* and gas piston 182 in the positions shown in FIG. 3(*iii*), hydraulic cylinder chamber 186*a* is supplied with pressurized hydraulic fluid by hydraulic fluid supply system 1160 for example as described above. This movement drives hydraulic piston 154*a*, along with piston rod 194, gas piston 182 and hydraulic piston 154*a* attached to piston rod 194, from the position shown in FIG. 3(*iii*) to the position shown in FIG. 3(*iv*). As this is occurring, hydraulic fluid in hydraulic cylinder chamber 186*b* will be forced out of the hydraulic fluid chamber 186*a* and may be handled by hydraulic fluid supply system 1160 as described above.

As hydraulic piston 154*a*, along with piston rod 194, gas piston 182 and hydraulic piston 154*b* attached to piston rod 194, move from the position shown in FIG. 5(*iii*) to the position shown in FIG. 3(*iv*), natural gas will be drawn from supply line 124, through connector 253 of valve and connector device 250 into gas compression section 181*a* due the drop in pressure of gas in gas compression section 181*a*, relative to the gas pressure in supply line 124 and the outside of connector 250. Simultaneously, the movement of gas piston 182 will compress the natural gas that is already present in gas compression section 181*b*. As the gas in gas compression chamber 181*b* is being compressed by the movement of gas piston 182, once the gas pressure reaches the threshold level of valve device 1261 to be activated, gas will be able to exit gas compression chamber 181*b* and pass through connector 261, into gas pressure distribution line 209 and then pass through output connector 205 into piping 130 (FIG. 3) for delivery to oil and gas pipeline 133. Again, if the gas pressure is too high to be received in piping 130, excess valve and bypass connector 265/1265 will be opened to allow excess gas to exit to reduce the gas pressure in gas pressure distribution line 209 and piping 130.

The foregoing movement and compression of natural gas and hydraulic fluid will continue as the pistons continue to move from the positions shown in FIG. 3(*iv*) to return to the position shown in FIG. 3(*i*). Just before piston 154*a* reaches the position shown in FIG. 3(*i*), proximity sensor 157*a* will detect the presence of hydraulic piston 154*a* within hydraulic cylinder 152*a* at a longitudinal position that is shortly before the end of the stroke within hydraulic cylinder 152*a*. Proximity sensor 157*a* will then send a signal to controller 200, in response to which controller 200 will reconfigure the operational mode of hydraulic fluid supply system 1160 as described above. This will result in hydraulic piston 154*a* not be driven any further to the right than the position shown in FIG. 3(*i*).

Once hydraulic piston 154*a*, along with piston rod 194, gas piston 182 and hydraulic piston 154*b* attached to piston rod 194, are in the position shown in FIG. 3(*i*), natural gas will have been drawn through valve and connector 253 so that gas compression chamber section 181*a* is once again filled and controller 200 will send a signal to the hydraulic fluid supply system 1160 so that gas compressor system 126 is ready to commence another cycle of operation.

During the operation of the gas compressor 150 as described above, any contaminants that may be carried with the natural gas from supply pipe 124 will enter into gas compression chamber sections 181*a*, 181*b*. However, the components of seal devices 198*a*, 198*b* associated with casings 201*a*, 201*b*, as described above, will provide a barrier preventing, or at least significantly limiting, the migration of any contaminants out of gas compression chamber sections 181*a*, 181*b*. However, any contaminants that do pass seal devices 198*a*, 198*b* are likely to be held in respective buffer chambers 195*a*, 195*b* and in combination with seal devices 196*a*, 196*b* of hydraulic pistons 154*a*, 154*b* respectively, may prevent contaminants from entering into the respective hydraulic cylinder chambers 186*a*, 186*b*. Particularly if buffer chambers 195*a*, 195*b* are pressurized, such as with pressurized air or a pressurized inert gas, then this should greatly restrict or inhibit the movement of contaminants in the natural gas in gas compression chamber sections 181*a*, 181*b* from migrating into buffer chambers 195*a*, 195*b*, thus further protecting the hydraulic fluid in hydraulic cylinder chambers 186*a*, 186*b*.

It should be noted that in use, hydraulic gas compressor 150 may be oriented generally horizontally, generally vertically, or at an angle to both vertical and horizontal directions.

While the gas compressor system 126 that is illustrated in FIGS. 1 to 9C discloses a single buffer chamber 195*a*, 195*b* on each side of the gas compressor 150 between the gas compression cylinder 180 and the hydraulic fluid chambers 186*a*, 186*b*, in other embodiments more than one buffer chamber may be configured on one or both sides of gas compression cylinder 180. Also, the buffer cavities may be pressurized with an inert gas to a pressure that is always greater than the pressure of the gas in the gas compression chambers so that if there is any gas leakage through the gas piston rod seals, that leakage is directed from the buffer chamber(s) toward the gas compression chamber(s) and not in the opposite direction. This may ensure that no dangerous gases such as hydrogen sulfide ($H_2S$) are leaked from the gas compressor system.

Adaptive Control System for Hydraulic Gas Compressor

As one skilled in the art will appreciate, it is desirable to provide efficient gas compression when operating a gas compressor as disclosed herein. Ideally, the maximum gas compression can be achieved if the gas piston in the gas compression chamber, such as gas piston 182 in gas compressor 150, is driven to reach and contact the end of the gas compression chamber at the end of each stroke. In fact, in some conventional hydraulic gas compression systems, the gas piston is driven in each direction until a face of the gas piston hits an end of the gas compression chamber (referred to as "physical end of stroke") before the hydraulic driving pressure is reversed in direction to drive the gas piston in the opposite direction. However, the impact of the physical contact between the faces of the gas piston and the ends of the gas compression chamber can produce loud noises and cause wear and tear of components in the gas compressor, thus reducing their useful lifetime.

To avoid such impact, in some existing gas compressing systems, the hydraulic pump used to apply hydraulic pressure on the gas piston is controlled to reverse the direction of the applied pressure before the gas piston contacts each end of the gas compressor chamber, based on, for example, the measured position and speed of the gas piston. However, as it is difficult to predict precisely when the piston will hit the physical end of stroke, many systems overcompensate by reversing the applied driving pressure when the piston is still a large distance away from the physical end. As a result, the gas compression efficiency is significantly reduced.

Some techniques exist to provide more precise measurement of the piston position and speed but such techniques typically require expensive sensing and control equipment, and the sensors used also take up large physical space. For example, in some existing systems full length position sensors are used along the entire length of the gas compressor in order to determine the position of the piston during the entire stroke length in real time, so that the transition between strokes can be controlled to avoid physical end of stroke. However, such a technique requires precise and fast position detection along the full-length of the cylinder and suitable sensors for such detection can be expensive, and with the added sensors and related equipment the gas compressor can become bulky.

It has been recognized that an adaptive control method based on detected speed of the gas piston, the temperature of the hydraulic driving fluid, and the load pressure applied on the piston at certain piston position can provide effective control of the movement of the gas piston using relatively inexpensive proximity sensors, temperature sensors and pressure sensors.

In an embodiment, the adaptive control may be implemented as illustrated in FIG. 10A for controlling a gas compressor 150' which is modified from gas compressor 150 as explained below.

A hydraulic fluid supply system 1160', which may be similar to the supply system 1160, is provided to supply a hydraulic driving fluid for applying a driving force on gas piston 182.

As discussed with reference to gas compressor 150, the driving force (or pressure) is cyclically reversed between left and right directions in the view as illustrated in FIG. 10A to cause gas piston 182 to reciprocate in strokes. As in gas compressor 150, two proximity sensors 157*a* and 157*b* are provided and positioned to provide timing and position signals for monitoring the position and speed of travel of gas piston 182 during each stroke. For example, proximity sensor 157*b* may be positioned to detect whether gas piston 182 is at or near a predefined end of stroke positon on the left hand side, near chamber end 1008, as shown in FIG. 10A (this position is referred to as "Position 1" for ease of reference), and proximity sensor 157*a* may be positioned to detect whether gas piston 182 is at or near a predefined end of stroke positon on the right hand side (this position is referred to as "Position 2"), near chamber end 1010. In some embodiments, gas compressor 150 and proximity sensors 157*a* and 157*b* may be configured so that proximity sensor 157*b* is in an "on" state when gas piston 182 is at or near Position 1, and is in an "off" state when gas piston 182 is not at or near Position 1; and proximity sensor 157*a* is in an "on" state when gas piston 182 is at or near Position 2, and is in an "off" state when gas piston 182 is not at or near Position 2.

As in system 1160, a pressure sensor 1004 may be provided at each of ports P and S respectively and the pressure sensors 1004 are used to detect the fluid pressures applied by the pump unit 1174 to the respective hydraulic pistons 154*a*, 154*b*, which can be used to calculate the load pressure applied on gas piston 182.

In addition, a temperature sensor 1006 is also provided for controlling the pump unit 1174 in system 1160'. The temperature sensor 1006 is positioned and configured to detect the temperature of the hydraulic driving fluid in the hydraulic fluid chambers 186*a*, 186*b*. The temperature sensor 1006 may be placed at any suitable location along the hydraulic fluid loop. For example, in an embodiment, the temperature sensor 1006 may be positioned at a fluid port.

Controller 200' may include hardware and software as discussed earlier, including hardware and software configured to receive and process signals from proximity sensors 157*a*, 157*b* and for controlling the operation of pump unit 1174, but is modified to also receive signals from pressure sensors 1004 and temperature sensor 1006 and processing these signals, and the signals form the proximity sensors 157*a*, 157*b* for controlling the pump unit 1174.

Optionally, end-of-stroke indicators 1002*a*, 1002*b* may be provided and positioned relative to the respective hydraulic fluid chambers 186*a*, 186*b* to provide signals to controller 200' when the terminal ends of hydraulic pistons 154*a*, 154*b* reach preselected positions which are referred to as the "pre-defined end of stroke position" in the respective stroke direction. The pre-defined end of stroke positions are selected such that when the corresponding terminal end of the corresponding hydraulic piston 154*a*, 154*b* is at the corresponding pre-defined end of stroke position, the gas piston is almost at the physical end of stroke but is not yet in contact with the corresponding chamber wall in the gas chamber. For example, in an embodiment, a pre-defined end of stroke position may be 0.5" away from a terminal end wall of the hydraulic fluid chamber 186*a*, 186*b*. When end-of-stroke indicators 1002*a*, 1002*b* are provided, controller 200' is configured to receive signals from the end-of-stroke indicators 1002*a*, 1002*b* and process these signals to determine whether an end of stroke has been reached during each stroke.

During operation, controller 200' receives signals from the proximity sensors 157*a*, 157*b*, pressure sensor(s) 1004, temperature sensor 1006, and optionally end of stroke indicators 1002*a*, 1002*b*, during each stroke. Controller 200' then determines a time interval for operating pump unit 1174 to pump in a reversed direction based on the received signal, or determines a next reversal time $T_r$ for reversing the pumping direction. Controller 200' controls pump unit 1174 to reverse the pump's pumping direction at the determined time $T_r$, for the determined time interval, which is referred to as the "lag time" (LP) for each pump cycle.

It may be appreciated that time $T_r$ is not the time when the gas piston 182 is at the end of stroke, which can be either the physical end of stroke or the pre-defined end of stroke position. There may be a time lag between the reversal of the pumping direction and the actual end of stroke due to movement inertia. That is, a pump cycle does not completely overlap in time with the piston stroke cycle due to movement inertia as the piston may still move some distance in the original direction after the pumping direction has been reversed.

Thus, a control algorithm may be provided to predict when to reverse the pumping direction so that the gas piston 182 will be very close to the physical end of stroke at the actual end of each stroke but will not actually contact the gas chamber end walls during operation.

Figure 10B:
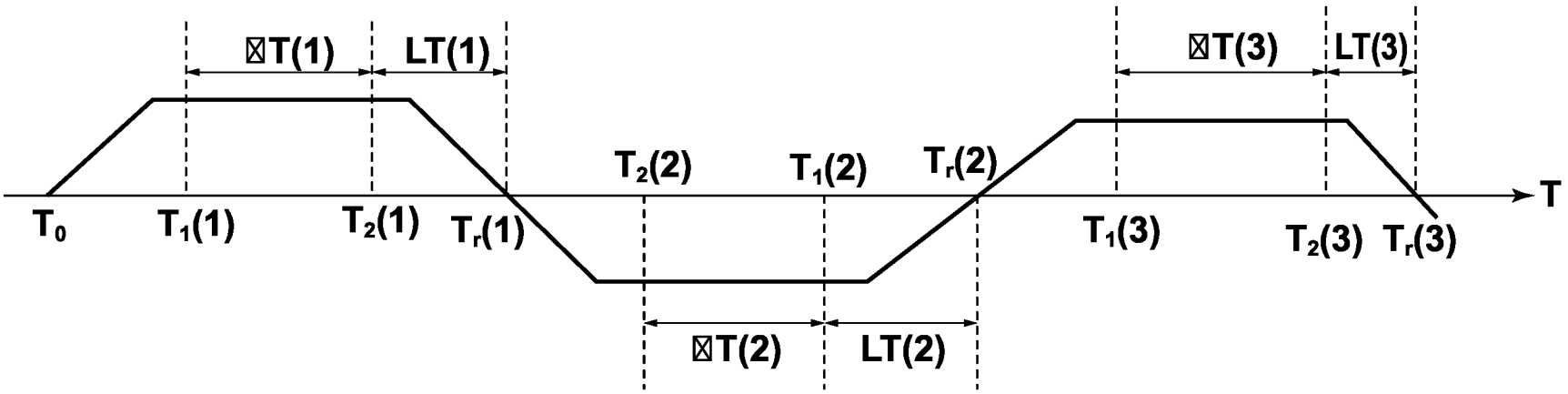
FIG. 10B is a diagram illustrating the pressure profile in different pump cycles during use of the pump unit shown in FIG. 10A.

In an embodiment, $T_r$ or LT may be determined as follows, as illustrated in FIG. 10B. For clarity, it is noted that FIG. 10B illustrates the pump cycle. As can be appreciated, pump unit 1174 is typically operated to apply the driving force on gas piston 182 cyclically in opposite directions, where the pump pressure is ramped up or down at the beginning and end of each pump cycle. An illustrative driving force profile over time (which may be similar to the pump control signal profile) is shown in FIG. 10B. It is noted that the numbers in parentheses, e.g. "(1)", "(2)", "(3)", etc., in FIG. 10B indicate the pump cycle number for identification purposes only.

Assuming pump Cycle 1 starts at time $T_0$, when the hydraulic pump in pump unit 1174 starts to ramp up to a set pumping speed to provide a selected driving force or pressure (referred to as +P for ease of discussion) applied on gas piston 182, the gas piston 182 is driven by the driving force to move towards one end (e.g. the end on the right hand side in FIG. 10B) of the gas chamber in a first direction (e.g. the right direction).

In this regard, the pump output flow rate may be controlled based on a fixed input electrical signal. The pump may have an internal mechanism to provide the required flow rate precisely using internal mechanical feedback to self-compensate. This is helpful in a compression system where the load pressure may be constantly changing and a constant output flow rate is desirable.

Assuming gas piston 182 is initially at Position 1, or reaches Position 1 sometime after $T_0$, gas piston 182 will leave Position 1 at some point in time, T1(1), and this can be determined by controller 200' based on a signal received from proximity sensor 157*b* (such as when proximity sensor 157*b* turns off from an "on" state). Thus, proximity sensor 157*b* can be used to detect the time, T1(1), at which time gas piston 182 leaves Position 1. As gas piston 182 continues to move right and reaches Position 2, at time T2(1), proximity sensor 157*a* detects that gas piston 182 has reached Position 2 and sends a signal to controller 200' to indicate that gas piston 182 has reached Position 2 at time T2(1). At this time, controller 200' receives, or may have received, signals from pressure sensor(s) 1104 and temperature sensor 1106 for determining a load pressure, LP(1), applied on gas piston 182 at time T2(1) and a fluid temperature of the hydraulic driving fluid, FT(1).

At time T2(1), or very shortly thereafter, controller 200' calculates, according to a pre-defined algorithm, as will be further discussed below, a lag time or the reversal time for the next pump cycle. The relationship between LT(1) and Tr(1) is Tr(1)=T2(1)+LT(1). That is, once LT(1) is determined, the pump reversal time Tr(1) for reversing the pumping direction of the hydraulic pump and thus the direction of the hydraulic driving pressure (driving force) on gas piston 182 can be determined. The hydraulic pump may be operated to ramp down at a selected time interval before Tr(1), as illustrated in FIG. 10B.

In a particular embodiment, the lag time LT for each pump cycle may be calculated based on three contribution factors, denoted as f(V), f(LP), and f(FT) for ease of reference.

V is the average speed of gas piston 182 during a piston stroke, and can be calculated as V=D/ΔT, where D is the distance travelled by gas piston 182 between times T1 and T2 and ΔT (=|T2−T1|) is the corresponding travel time. The lag time contribution f(V) may be determined based on a pre-stored mapping table or a predetermined formula. The mapping table or formula may be based on empirical data, and may be updated during operation based on further data collected during operation. For example, the values in the mapping table may be initially set at values lower than the expected values for safety, such as by −50 milliseconds (ms), and be updated during operation so that each value in the mapping table is incremented by 1 ms in the required speed range until an end of stroke flag is detected. The values in the mapping table may be subtracted by 25 ms every time a physical end of stroke has occurred. The mapping table may include different tables for different speed ranges so that closer mapping over each range can be achieved. In some embodiments, reduction of the values in the mapping tables may be limited to a maximum reduction of 250 ms below the expected or initial values.

As noted above, LP is the Load Pressure experienced by gas piston 182, and can be calculated as the pressure differential between the fluid pressures applied at the opposite ends of gas compressor 150', or the pressure difference between the fluid pressures in hydraulic fluid lines 1163*a* and 1163*b*. The lag time contribution f(LP) may be determined based on an empirical formula, such as $$f(LP) = a \times LP + b, \text{ or } f(LP) = a \times (b - LP),$$

where parameters "a" and "b" may be determined or selected based on empirical data obtained on the same or similar systems.

The lag time contribution factor f(FT) may also be determined based on an empirical formula, such as $$f(FT) = d \times FT + e, \text{ or } f(FT) = d \times (e - FT)$$

where parameters "d" and "e" may be determined or selected based on empirical data obtained on the same or similar systems.

In selected embodiments, the total lag time may be a simple sum of f(V), f(LP), and f(FT), i.e., LT=f(V)+f(LP)+f(FT). In other embodiments, the overall lag time may be a weighted sum or another function of the three contributing factors.

The lag time LT may be calculated in a suitable time unit that provides effective and adequate pump control. It has been found that for some applications, millisecond (ms) is a suitable time unit.

Assuming LT is calculated as a simple sum of the three contributing factors, the LT for pump Cycle 1 is:

$$LT(1) = f(V(1)) + f(LP(1)) + f(FT(1)).$$

Tr(1) can then be determined as Tr(1)=T2(1)+LT(1). Pump unit 1174 is controlled by controller 200' to reverse pumping direction at Tr(1).

As can be appreciated, controller 200' may control the operation of pump unit 1174 in a number of different manners to achieve the same reversal timing. For example, instead of deterring the reversal timing directly, controller 200' may be configured to determine the time for commencing the ramp down, and adjust or calibrate this time. For a fixed ramp down interval (e.g. 300 ms), this would be equivalent to determining and adjusting the reversal timing. Further, the reversal time Tr(1) may also be calculated from the ramp down start time if the ramp down interval is known.

In any event, at Tr(1), pump Cycle 1 ends and the next cycle, pump Cycle 2 starts. In pump Cycle 2, pump unit 1174 is controlled by controller 200' to pump in the opposite direction as compared to Cycle 1 to drive gas piston in the second direction (e.g. in this example, the left direction as shown in FIG. 10A).

As the hydraulic pump ramps up in the opposite direction, to apply a driving force or pressure (−P) to drive gas piston towards the left direction, gas piston 182 will leave Position 2, which can be detected using proximity sensor 157*a* when it turns from the "on" state to the "off" state, and controller 200' can determine the time T2(2) at which gas piston 182 leaves Position 2 based on the signal received from proximity sensor 157*a*. When gas piston 182 returns to Position 1, proximity sensor 157*b* turns from off to on and produces and sends a signal to controller 200' to indicate that Position 1 is reached in Cycle 2 at time T1(2).

At time T1(2), controller 200' also receives, or may have received, signals from pressure sensor(s) 1104 and temperature sensor 1106 for determining a load pressure, LP(2) applied on gas piston 182 at time T1(2) and a fluid temperature of the hydraulic driving fluid, FT(2).

At time T1(2), or very shortly thereafter, controller 200' calculates a lag time for Cycle 2, LT(2), as: LT(2)=f(V(2))+f(LP(2))+f(FT(2)).

The next pump reversal time Tr(2) may be calculated Tr(2)=T1(2)+LT(2).

Controller 200' then controls pump unit 1174 to reverse pumping direction for the next cycle at time Tr(2), or to pump in the current direction for a time interval of LT(2) before reversing the pumping direction.

At Tr(2), the next pump cycle, Cycle 3 starts. The process continues similar to Cycle 1.

It may be appreciated that, LT(1), LT(2), and lag times for other pump cycles, may or may not be the same. The lag times can be conveniently adjusted in real time to account for changes in environment and operating conditions.

To provide improved efficiency, each lag time may also be adjusted based on other factors or events. For example, when end of stroke indicators 1002*a*, 1002*b* are provided, the signals received from the end of stroke indicators 1002*a*, 1002*b* may be taken into account. For instance, for pump Cycle 1 in the example of FIG. 10B, if controller 200' has not received a signal from end of stroke indicator 1002*a* to indicate that gas piston 182 has reached the predefined end of stroke position after Cycle 2, which means that the calculated value for LT(1) was not long enough, then the initially calculated LT(3) value may be increased by a pre-selected increment, such as 1 ms. This value should be sufficiently small to avoid possible physical end of stroke.

In another example, if a calculated LT is too long, a physical end of stroke will occur, which may be detected by monitoring any spike in the detected load pressure LP. When a physical end of stroke is detected, which may be considered as an "end of stroke event", the initially calculated LT for a subsequent pump cycle may be reduced by a selected amount, such as 25 ms. This reduction time should be sufficiently large to avoid a possible further physical end of stroke. This reduction may be implemented by reducing the values in the mapping table for speed contribution by 25 ms per occurrence of an end of stroke event, up to a maximum of 250 ms. The maximum may be selected to prevent run away adjustment, particularly when the physical end of stroke events are due to some other reasons instead of over-determined lag time.

As now can be appreciated, the above control process can take into account of the changes in environment and operation conditions in real time, and provide efficient gas compression while reducing the risks of physical end of stroke.

Figure 17:
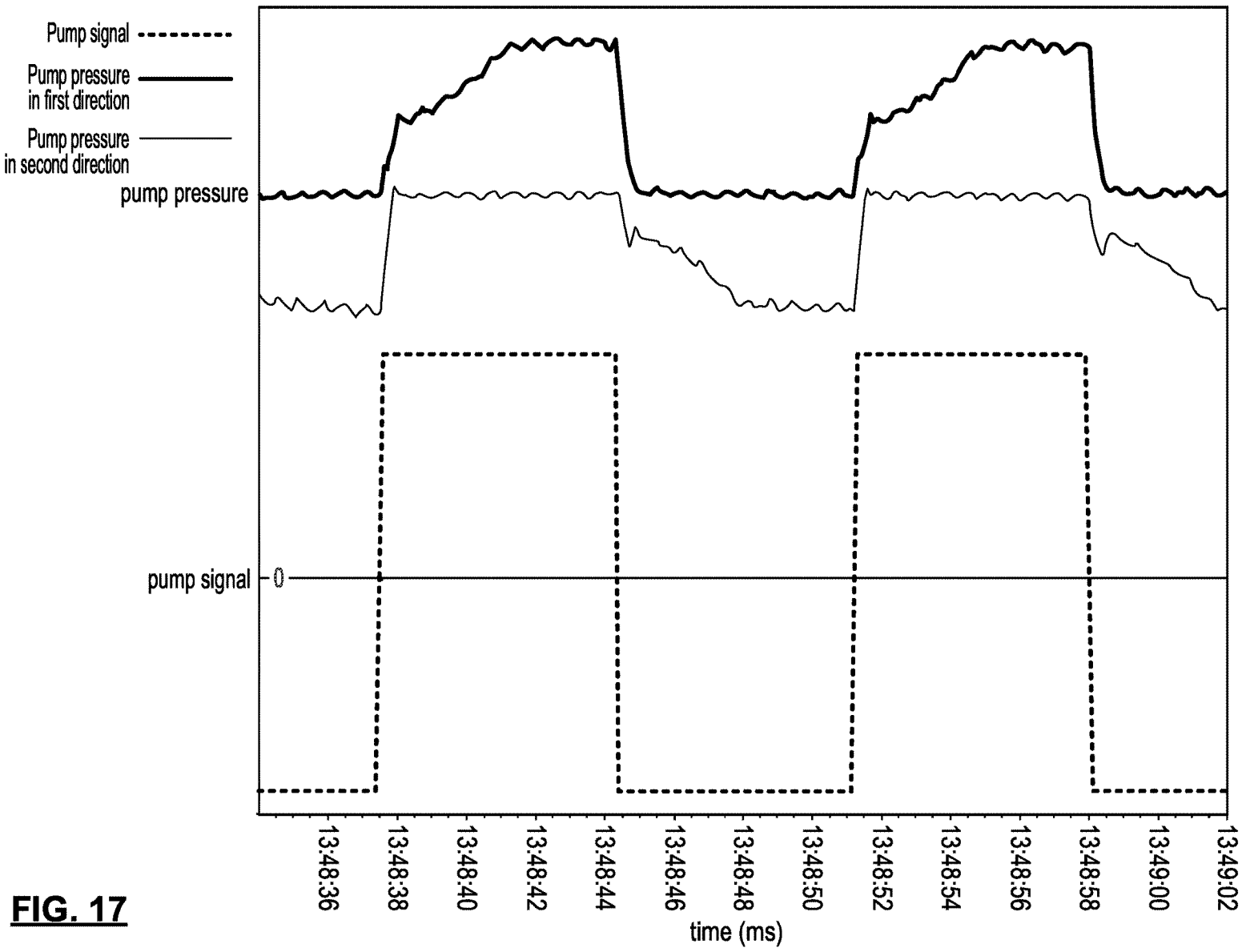
FIG. 17 is a line graph showing a realistic control (pump) signal applied to a hydraulic pump for driving a gas compressor and the corresponding pressure responses at the output ports of the pump.

A more realistic control signal (labelled as pump signal) profile applied to a pump for driving a gas compressor is shown in FIG. 17, with the corresponding pump pressure responses. The control signal is shown in the dash line, where the positive portions of the signal correspond to pump signals applied for driving the gas piston in a first direction and the negative portions correspond to pump signals applied for driving the piston in the opposite, second direction. The solid lines in FIG. 17 represent the corresponding pump pressures at the respective output ports of the pump, which may be measured at lines 1163*a* and 1163*b* (P and Sports) respectively as illustrated in FIG. 10A. The thicker solid line corresponds to the pump pressure applied in the first direction, in response to the positive portions of the pump signal. The thinner solid line corresponds to the pump pressure applied in the second direction, in response to the negative portions of the pump signal.

The system shown in FIG. 10A is described in further details below.

In FIG. 10A, self-calibrating gas compressor system 126' may be modified from gas compressor system 126 illustrated in FIG. 7. Gas compressor 150' may be modified from gas compressor 150 illustrated in FIG. 2 and FIG. 3(*i*)-3(*iv*)). Generally, gas compressor system 126' adaptively controls the operation of gas compressor 150' to provide improved gas compression therein via controller 200'. Gas compressor system 126' may be a closed loop system as illustrated, or may be an open loop system as can be understood by those skilled in the art. In an embodiment, an open loop system (not shown) may use a pump unit similar to the pump unit 1174 combined with a 4-way valve to drive the reciprocal movement of the gas compressor piston, as can be understood by those skilled in the art. In some embodiments, the buffer chamber may be omitted. The piston stroke length for gas piston 182 can be controlled such that gas piston 182 driven by hydraulic fluid supply system 1160' and controller 200' can travel nearly the full length gas compression chamber in gas cylinder 180 with reduced risks of physical end of stroke.

As illustrated, gas compressor 150' is in hydraulic fluid communication with hydraulic fluid supply system 1160'. Controller 200' is in electronic communication with the illustrated sensors, either by wired communication or wireless communication. Hydraulic fluid supply system 1160' is controlled by controller 200'. In particular, controller 200' may be configured and programed for controlling the operation of pump unit 1174. Pump unit 1174 can receive a control signal from controller 200' and adjust its pumping speed and pumping direction based on the control signal, to apply the driving fluid provided by reservoir 1172 to alternately drive hydraulic pistons 154*a*, 154*b*, and thus gas piston 182.

As discussed above, pump unit 1174 includes outlet ports S and P for selectively and alternately delivering a pressurized hydraulic fluid to each of fluid communication line 1163*a* or 1163*b* respectively. Pressure sensors 1004 may be electrically connected to each of the output ports S and P to provide sensed pressure signals to controller 200' for determining a load pressure applied to piston 182.

One or more temperature sensors 1006 may be electrically connected to at least one of hydraulic cylinders 152*a* or 152*b* for sensing a temperature of the driving fluid contained therein during movement of pistons 182, 154*a*, and 154*b*. Temperature sensor 1006 may be in electrical communication with controller 200' for providing a sensed temperature signal to the controller 200'.

Gas compressor system 126' can self-calibrate the operation of the pump unit to control the movement of piston 182 based on V, LP and FT, as described herein.

Stroke Movement of Piston

A "stroke" refers to the movement of a piston, such as piston 182, within a gas compression chamber, such as chamber 181, in each direction from the beginning to the end during the piston's reciprocal linear movement in the chamber.

To achieve optimal gas compression, it is desirable for gas piston 182 to travel nearly the entire length between the end walls at ends 1008 and 1010. However, to avoid possible physical end of stroke, piston 182 may be controlled to travel between pre-defined end of stroke positions which may be at a distance of 0.5" from the respective end wall at ends 1008 and 1010.

In an embodiment, gas compressor 150' is driven by a controlled hydraulic fluid supply system 1160' and controller 200' to provide smooth transition between strokes of gas piston 182 and efficient gas compression. Controller 200' may be used to re-calibrate piston 182 displacement parameters to improve stroke efficiency during subsequent strokes based on data or signals indicative of the driving fluid temperature, piston speed, load pressure and stroke length information acquired during a prior stroke. As discussed herein, these signals can be derived from the pressure sensor 1004, the temperature sensor 1006, and proximity sensors 157*a* and 157*b*.

As noted above, sensors 1004, 1006, 157*a* and 157*b* may be electrically coupled to controller 200' or wirelessly coupled (e.g. across a network).

Gas compressor system 126' may generally operate in a similar manner as discussed with reference to gas compressor 126 of FIG. 7 but performs additional control actions and calculations as described above.

In an embodiment, controller 200' of FIG. 10A may be further programmed to use additional sensor data obtained from gas compressor 150' to improve stroke displacement of gas piston 182 during operation of gas compressor 150'. Controller 200' is configured for controlling driving fluid supply system 1160' to provide smooth transitions between strokes while maximize or optimize gas compression efficiency.

For example, controller 200' may be programmed in such a manner to control hydraulic fluid supply system 1160' to ensure a smooth transition between strokes.

Figure 13:
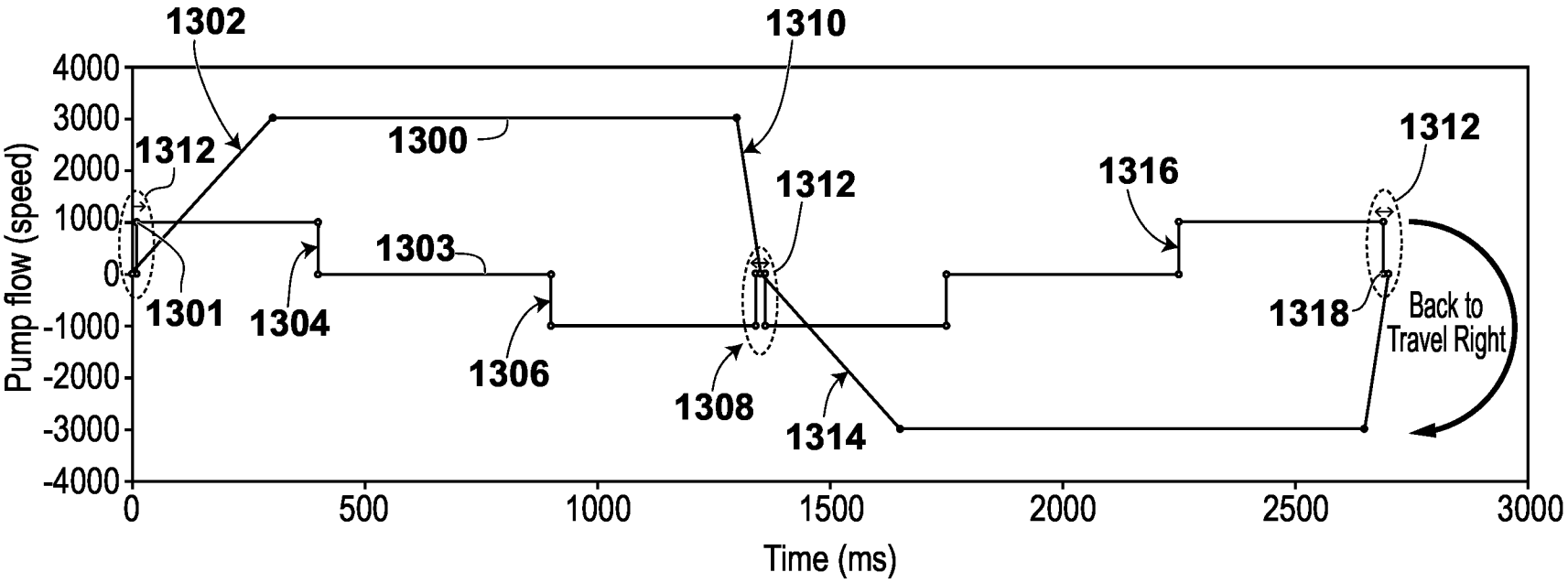
FIG. 13 is a graphical depiction of waveforms for controlling operation of components of the compressor shown in FIG. 10A.

Further details of the operation of controller 200' and pump unit 1174 are discussed below with reference to FIG. 13. In FIG. 13, the line indicated by 1300, 1302, 1310, and 1314 represents the pump flow speed and direction, and the middle line labelled by 1301, 1304, 1303, 1306, 1308, 1312, 1316, and 1318 indicates the sensor on-off states of proximity sensors 157*a*, 157*b*. For the sensor states, a positive value indicates that the right proximity sensor 157*b* is on, a negative value indicates that the left proximity sensor 157*a* is on, and a zero value indicates that both sensors are off. FIG. 13 shows the pump speed in a full stroke cycle, where the fluid pressure is applied to drive the pistons towards the right when the speed is above zero and the fluid pressure is applied to drive the pistons toward left when the speed is below zero. As can be seen in FIG. 13, for each half cycle, the pump speed may be ramped up to the selected top speed within about 300 ms, and held constant over an extended period and then ramped down to zero within about 50 ms.

In some embodiments, proximity sensor 157*a* is mounted on and extending within cylinder barrel 187*a*. Proximity sensor 157*a* is operable such that during operation of gas compressor 150', as piston 154*a* is moving from left to right, just before piston 154*a* reaches the position shown in FIG. 3(*i*), proximity sensor 157*a* will detect the presence of a portion of the hydraulic piston 154*a* within hydraulic cylinder 152*a*. Proximity sensor 157*b* may be similarly mounted cylinder barrel 187*b* and used to detect the presence of another portion on piston 154*b*. Based on such detections, the relative position of a piston face 182*a*, 182*b* (as shown in FIG. 10A) near an end of the cylinder (end 1008, 1010) can be derived.

End of stroke indicators 1002*a*, 1002*b* may be omitted in some embodiments, in which case piston positions detected by proximity sensors 157*a*, 157*b* may be used to indicate the pre-defined end of stroke positons.

Sensor 157*a* may send a signal to controller 200' indicating that the sensor 157*a* is on, in response to which controller 200' can take steps to change the operational mode of hydraulic fluid supply system 1160'.

Proximity sensor 157*b* may operate in a similar manner as described with reference to sensor 157*a*.

Controller 200' may be programmed to control hydraulic fluid supply system 1160 in such a manner as to provide for a relatively smooth slowing down, a stop, reversal in direction and speeding up of piston rod 194 along with hydraulic pistons 154*a*, 154*b* and gas piston 182 as piston rod 194, hydraulic pistons 154*a*, 154*b* and gas piston 182 transition between a drive stroke to the right to a drive stroke to the left, and so on.

In some embodiments, proximity sensors 157'*a*, 157'*b* may be implemented using inductive proximity sensors, such as model BI 2-M12-Y1X-H1141 sensors manufactured by Turck, Inc. Inductive sensors are operable to generate proximity signals in response to a portion of piston rod 194 and/or hydraulic pistons 154*a*, 154*b* being proximate to the respective proximity sensors 157*a* or 157*b*. In an embodiment, the proximity sensors may be configured so that the sensor turns on when the sensor is in the proximity of a cut-out section of the piston rod so the sensor does not sense the presence of any piston material (e.g. steel) in its proximity, and turn off when an uncut section of the piston rod or an end of stroke indicator attached to the piston rod is within the proximity of the sensor so the sensor can sense the presence of the uncut section or the end of stroke indicator. The proximity threshold may be about 5 mm. That is, for example, if the end of indicator is within a 5 mm distance from the sensor, the sensor turns off. If there is no piston material (steel) within the 5 mm range, the sensor turns on.

Signals from proximity sensors 157*a*, 157*b* may be used to initiate capture of sensor measurements at other sensors, such as pressure and temperature sensors 1004, 1006.

Referring to FIGS. 11A to 11E, an example of gas piston 182 and hydraulic pistons 154*a*, 154*b*, and corresponding operation of proximity sensors 157*a* and 157*b*, is illustrated, for a period in a stroke of the gas piston 182, showing displacement of hydraulic pistons 154*a* and 154*b* and gas piston 182 of gas compressor 150'. For easy understanding, the pistons and the gas compressor cylinder 180 are separated in FIGS. 11A-11E to better show the relative axial positions of the pistons 182 and 154*a*, 154*b* with regard to cylinder 180 during a stroke.

To provide position indications and trigger state transitions of the proximity sensor 157*a* or 157*b* when the gas piston 182 reaches a respective pre-defined position, an axially extending groove 158*a* is provided near the terminal end of hydraulic piston 154*a* and an axially extending groove 158*b* is provided near the terminal end of hydraulic piston 154*b* (grooves 158*a*, 158*b* are also individually or collectively referred to as groove 158 or grooves 158). Each groove 158 has a near end 159 close to the gas piston 182, which is denoted as 159*a* on hydraulic piston 154*a* and as 159*b* on hydraulic piston 154*b*. Each groove 158 also has a far end 160 away from the gas piston 182, which is denoted as 160*a* on hydraulic piston 154*a* and as 160*b* on hydraulic piston 154*b*. As can be seen, grooves 158*a* and 158*b* are spaced apart, by a selected distance suitable for measuring the piston speed. The grooves 158, including their end positions and the distance between each pair of ends 159 and 160 (i.e. the axial length of the axially extending grooves 158), are configured and positioned to cause the proximity sensors 157 to detect a position of the gas piston 182, such as an end of stroke position, when the far end 160 (e.g. end 160*a*) is in proximity of the corresponding proximity sensor 157 (e.g. sensor 157*a*), and to detect another position of the gas piston 182 when the near end 159 (e.g. end 159*a*) is in proximity of the corresponding proximity sensor 157 (e.g. sensor 157*a*). The position at which the near end 159 is in proximity of the corresponding proximity sensor 157, may represent a transition position to trigger the counting of the lag time, for the purpose to reverse the driving direction of the driving fluid so as to, in time, reverse the direction of travel of the gas piston 182 after the lag time. In other words, this second position may indicate the start of the lag time.

Figures 11A, 11B, 11C, 11D, 11E:
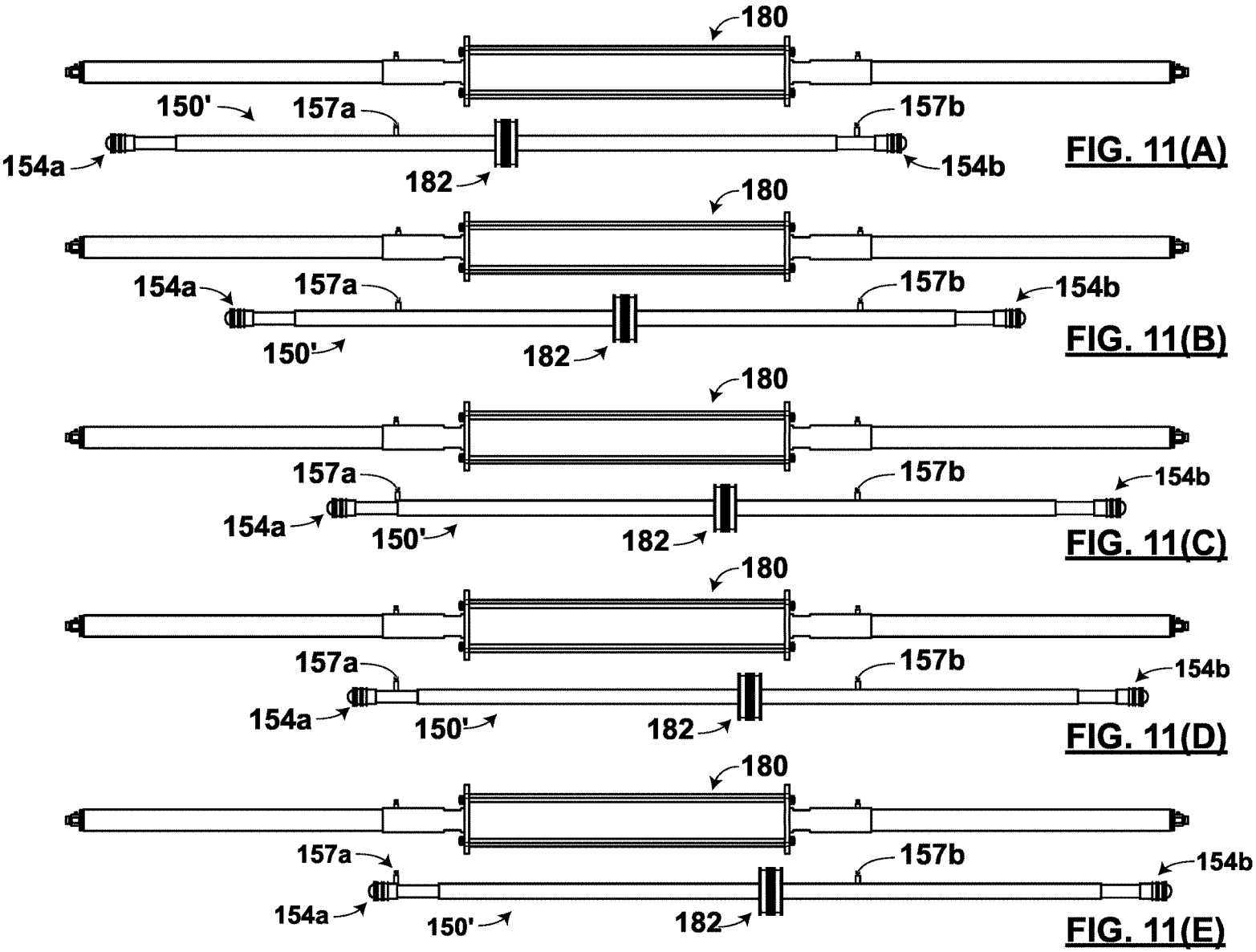
FIGS. 11A, 11B, 11C, 11D, and 11E are schematic views of the gas compressor of FIG. 10A during various stages of a stroke cycle in operation.

As illustrated in FIG. 11A, gas piston 182 and hydraulic pistons 154*a*, 154*b* all travel to the right from an end of stroke position where the far end 160*b* of groove 158*b* is in proximity of proximity sensor 157*b*. The time of this end of stroke position is indicated as 1301 in FIG. 13. At the time shown in FIG. 11B, the proximity sensor 157*b* is in an on-state. At this time, the driving fluid pump is applying a fluid pressure to drive the pistons towards the right as illustrated in FIG. 13 between points 1301 and 1304. As the gas piston 182 and hydraulic pistons 154 continue to travel to the right, and near end 159*b* of groove 158*b* passes proximity sensor 157*b*, and proximity sensor 157*b* transitions from the on-state to the off-state (i.e. turns off). The time of this transition is indicated as 1304 in FIG. 13. This time of transition may also be considered as the (right direction) start time T1 for calculating the piston speed and lag time. Time T1 may be recorded based on an internal clock in the controller 200'. The position of the gas piston 182 at this time T1 may be considered as Position 1 discussed above. In FIG. 11B, gas piston 182 has travelled further right and passed Position 1.

As hydraulic pistons 154*a* and 154*b* and gas piston 182 continue to travel to the right from the position shown in FIG. 11B to the position shown in FIG. 11C, and the near end 159*a* of the groove 158*a* on piston 154*a* reaches a position proximate the left proximity sensor 157*a*, proximity sensor 157*a* senses the physical change and turns on. This transition time is indicated as 1306 in FIG. 13, and may be recorded as T2 and provided to controller 200' for calculating piston speed and lag time. The position of the gas piston 182 at time T2 may be considered as Position 2 discussed above. Time T2 may be considered the (right direction) stop time. As can be appreciated, the distance of travel of gas piston 182 between time T1 and time T2 (or from Position 1 to Position 2) can be calculated based on the distance between near ends 159*a* and 159*b* and the distance between sensors 157*a* and 157*b*, and is a constant. The value of this distance may be stored in controller 200'. Thus, controller 200' can calculate the average travel speed of gas piston 182 based on T1, T2 and the stored distance of travel. At this time, the hydraulic fluid pressure may be measured and stored and the temperature may also be measured and stored. These stored values may be used to calculate the lag time as discussed elsewhere herein.

As can be appreciated, for more accurate determination of the piston speed, the near ends 159 of grooves 158 should be positioned such that T1 and T2 are both within the time period when the pump unit is operating at a constant speed (see 1300 in FIG. 13), so that the pump speed does not change between time T1 and time T2. Conveniently, the groove length of grooves 158 can be adjusted based on the given compressor to meet this condition.

As hydraulic pistons 154*a*, 154*b* and gas piston 182 continue to travel to the right, as shown in FIG. 11D and FIG. 11E, the gas piston eventually reaches a desired end of stroke position, which may be indicated by the far end 160*a* reaching a position in proximity of proximity sensor 157*a*, and triggering a transition of proximity sensor 157*a* from the on-state to the off-state, as illustrated in FIG. 11E. At this time, gas piston 182 is located proximal to the right end of gas compression cylinder 180. After the desired end of stroke position is reached, both sensors 157*a* and 157*b* may be in the off-state for a short period of time (indicated at 1308 in FIG. 13).

After the end of stroke is detected, the pump unit is continued to be operated at the same direction for the duration of the determined lag time (see 1300 in FIG. 13) before ramping down (see 1310 in FIG. 13) and reversing the pumping direction (see 1314 in FIG. 13) to move hydraulic pistons 154*a*, 154*b* and gas piston 182 in an opposite (left in this case) direction. The reversal of the pumping direction may include a deceleration phase in the same direction (e.g. from +X to 0 in 50 ms) and an acceleration phase in the opposite direction (e.g. from 0 to −X in 300 ms).

The actual time of the pump reversal (or end of stroke) may be stored and used to compare to the target time for the end of stroke for determining if the lag time for the next stroke should be extended or shortened.

While not expressly illustrated, the second half cycle of the piston stroke towards the left is similar to the half cycle to the right, but with the direction reversed.

Figure 15A:
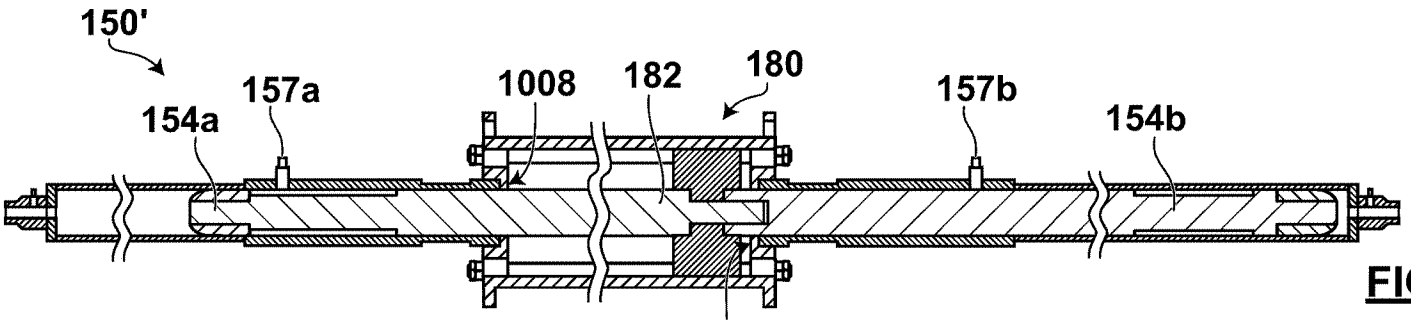
FIGS. 15A, 15B, and 15C are side views of the gas compressor shown in FIG. 10A, during various stages of movement of the gas piston and hydraulic pistons of FIG. 10A.
Figure 15B:
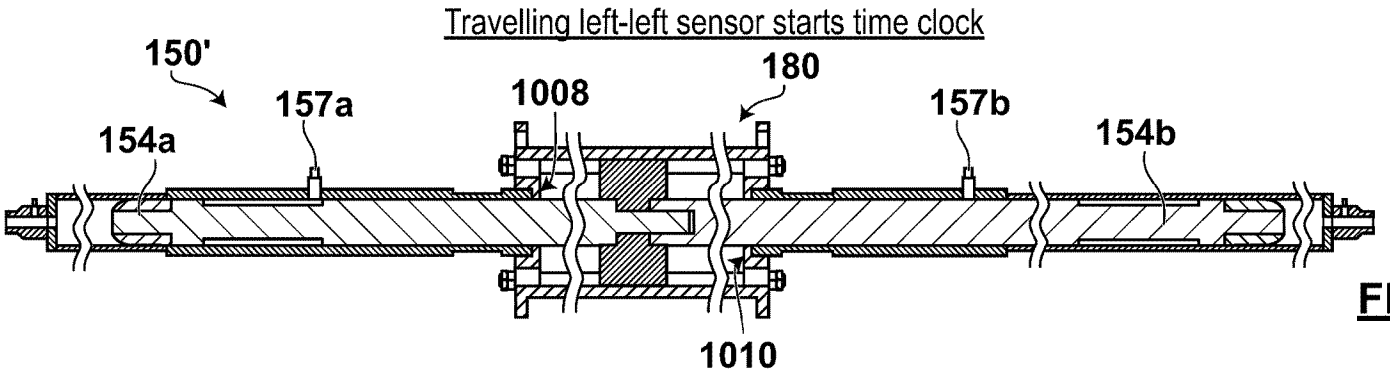
Figure 15C:
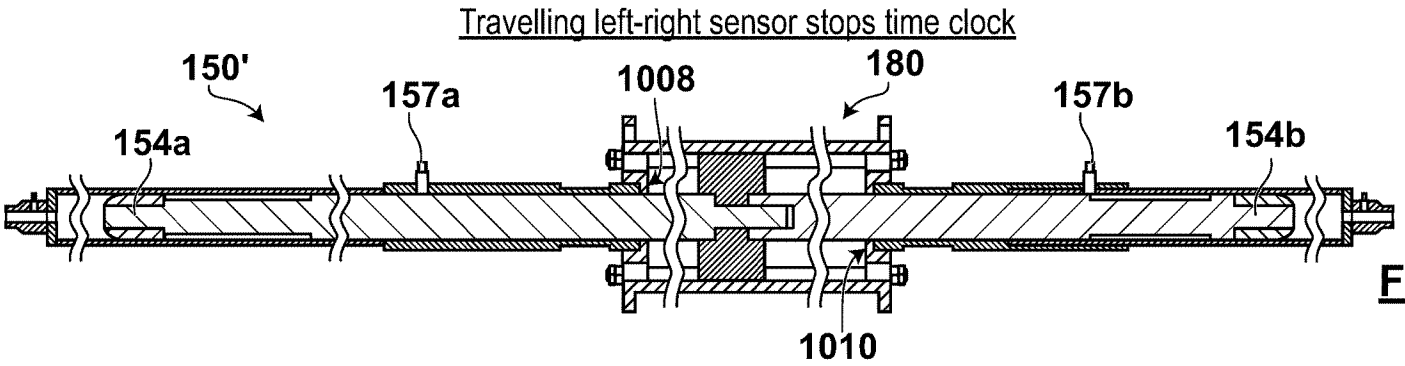

FIGS. 15A, 15B and 15C show schematic side views of gas compressor 150' during an example cycle of operation of hydraulic pistons 154*a*, 154*b* and gas piston 182. In FIG. 15A, the right end of stroke of hydraulic piston 154*b* has been confirmed. As can be seen, gas piston 182 positioned within gas compression cylinder 180 has reached a pre-defined distance from a second end 1010 of the gas compression cylinder (e.g. ⅝"). Subsequently, controller 200' generates a control signal to provide driving fluid to gas compressor 150' as discussed above to cause gas piston 182 to travel to the left. Once left proximity sensor 157*a* detects hydraulic piston 154*a*, proximity sensor 157*a* then turns on (see FIG. 15B). As pistons 182, 154*a*, and 154*b* travel to the left as shown in FIG. 15C, right proximity sensor 157*b* then senses an end portion of hydraulic piston 154*b* and turns on. Controller 200' is configured to capture the time for left sensor 157*a* turning on in FIG. 15B as t1 and the time for right sensor 157*b* turning on in FIG. 15C as t2 such that the difference in time between t1 and t2 is used to calculate the speed of piston 182 as further discussed below.

Figure 16:
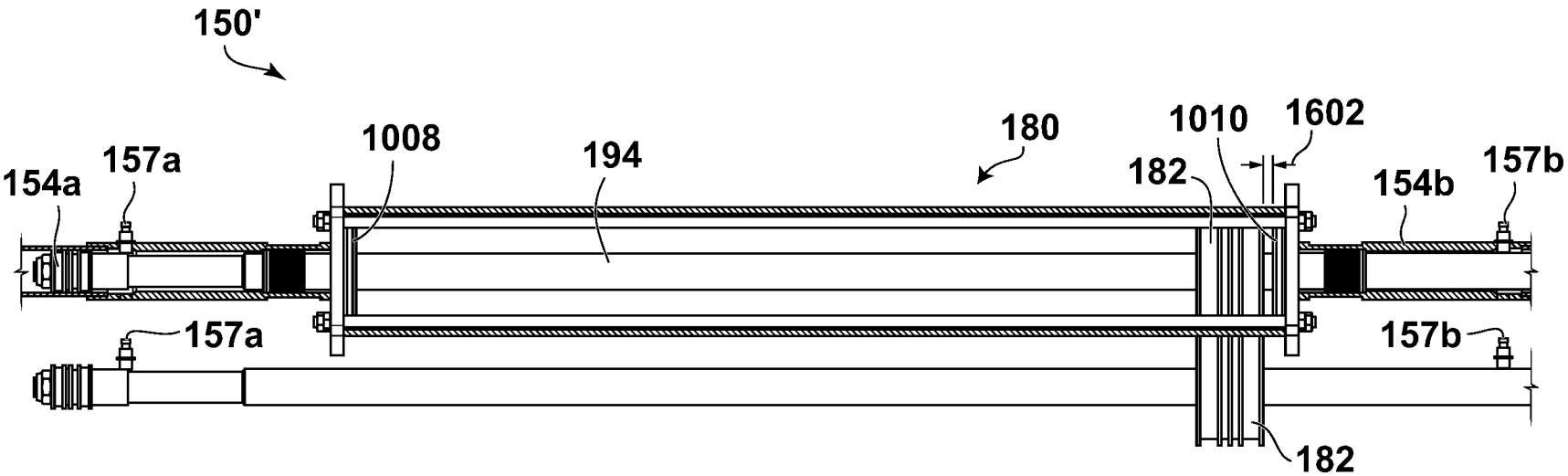
FIG. 16 is a schematic view of the gas compressor of FIG. 10A during one stage of operation.

FIG. 16 shows a schematic side view of the interior of the gas compressor 150'. As shown in FIG. 16, once gas piston 182 reaches a pre-defined desired distance (e.g. 0.5") shown at element 1602 from an end of gas compression cylinder 180, both proximity sensors 157*a* and 157*b* are turned off and piston rod 194 has stopped moving, this is considered as the end of a stroke in one direction such that piston rod 194 will start to move in an opposite direction for the next stroke.

As will be discussed below with respect to FIG. 10A and FIG. 14, proximity sensors 157*a*, 157*b* are used to indicate the times at which a particular part of gas piston 182 arrives at a position proximate the respective proximity sensor during a stroke and the sensed signal from proximity sensors 157*a*, 157*b* can be used to determine the (average) speed of the piston during a stroke and the time when piston 182 reached a predefined end position at or near the end of stroke. Additionally, as will be discussed with reference to FIG. 14, when proximity sensors 157*a*, 157*b* are triggered at different times, additional measurements may be taken (e.g.

temperature and pressure signals may be detected and recorded) for adjusting the lag time values. The additional measurements are provided to controller 200' to modify the operation of hydraulic fluid supply system 1160' and thus gas compressor 150' for subsequent strokes to account for changes in temperature, and load pressure.

The following provides a description of the values captured by gas compressor 150' via end of stroke indicators 1002*a*, 1002*b*; proximity sensors 157*a*, 157*b*; pressure sensor 1004 and temperature sensor 1006 (FIG. 10A) in order to calculate corresponding lag time values via controller 200' (FIG. 10A) and modify the operation of gas compressor 150' for subsequent strokes based on the overall lag time determined from the corresponding lag time values.

Lag Time Calculation

The total lag time calculation, as discussed herein, may be used to determine a time delay after an indicated end of stroke of a first hydraulic piston (e.g. 154*b*) in one direction (e.g. after both proximity sensors 157*a*, 157*b* have experienced a state transition before initiating a displacement signal from controller 200' to supply driving fluid to one of hydraulic fluid cylinders 152*a*, 152*b* such as to cause the transition of movement of a piston (e.g. piston 154*a*) in an opposite direction. A state transition of the sensor may be from OFF to ON or from ON to OFF. The ON or OFF information of each sensor may also be used by controller 200' to determine or process control signals. Examples of the time delay are shown at 1308 and 1318 in FIG. 13 such that after end of a stroke of the piston 182, once the previously determined lag time expires, pump 1174 signal is ramped in the reverse direction of the previous stroke. Ideally, it is desirable to start ramping up pump unit 1174 before gas piston 182 reaching the physical end of stroke.

For example, by using the lag time, controller 200' may cause hydraulic piston 154*b* to traverse past the respective proximity sensor 157*b* by a pre-defined distance in order to achieve a full stroke for the gas compressor 150', such that gas piston 182 is located proximal to one end of gas compression cylinder 180 (see FIG. 16).

As will be described below, controller 200' is programmed to calculate speed, pressure and temperature measurements (from sensed position information received from proximity sensors 157*a*, 157*b*, pressure sensor information from pressure sensor 1004 and temperature sensor information from temperature sensor 1006) from for gas compressor 150' in order to determine the lag time calibration parameters.

End of stroke indicators (1002*a*, 1002*b*) shown in FIG. 10A may also be communication with controller 200' to provide additional flags. For example, end of stroke indicators 1002*a*, 1002*b* provide signals indicating a piston end for hydraulic pistons 154*a*, 154*b* has reached a desired end of stroke position (e.g. a position located about half inch from the end of stroke of hydraulic piston 154*a*, 154*b*).

For example, if end of stroke indicators 1002*a*, 1002*b* indicate that a desired end of stroke has been reached in a previous stroke, then no adjustment is made to the lag time. Conversely, if a physical end of stroke is reached (e.g. such that a piston face 182*a* or 182*b* hits a respective end 1010 or 1008 of gas compression cylinder 180) then the overall lag time calibration is adjusted such that a second fixed predetermined value (e.g. 25 ms) is deducted from the previously defined lag time value so that on the next stroke, hydraulic pistons 154*a* and 154*b* do not travel as far. Similarly, on a subsequent stroke if the end of stroke indicator indicates that it has not been activated (e.g. a desired end of stroke has not been reached), then the lag time is increased by the first pre-defined amount of time (e.g. 1 ms) until the end of stroke is reached. In this manner, controller 200' allows automated self-calibration of the lag time.

In at least some embodiments, proximity sensors 157*a*, 157*b* may be used to determine when a desired end of stroke for piston 182 has been reached such that end of stroke indicators 1002*a* and 1002*b* are not used.

In addition to the end of stroke indicators, speed, pressure and temperature measurements (as obtained from sensors 1004, 1006 and based on proximity sensors 157*a*, 157*b*) are calculated and used to tailor the lag time at the end of each stroke to ensure that a full stroke is obtained for maximum gas compression of gas compressor 150'.

Speed Measurements

Figure 12:
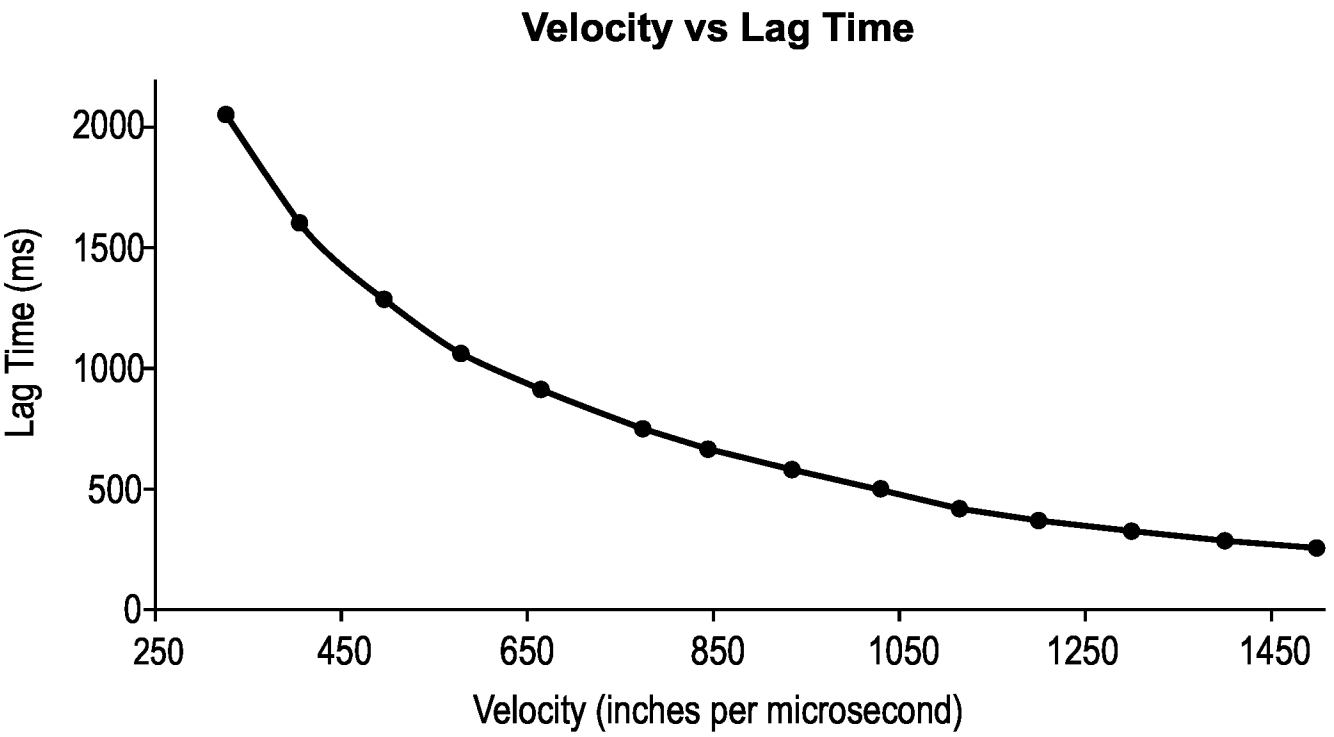
FIG. 12 is a graph illustrating a lag time factor associated with changes in velocity of a piston stroke in the gas compressor of FIG. 10A.

Referring to FIGS. 10A, 13 and 15A-15C, to calculate speed, controller 200' may be configured to capture a first time value for the start time (1301, FIG. 13) that a first sensor 157*a* is turned on (e.g. a negative transition, see FIG. 15B) and then capture a second value for the time that second sensor 157*b* (see FIG. 15C) is turned on (see 1306, FIG. 13). The speed is calculated as the difference between the first and second time values divided by a fixed distance between first proximity sensor 157*a* and second proximity sensor 157*b* (e.g. 35" distance). This result provides the average speed for a particular stroke and is calculated by controller 200'. The average speed is then mapped to predefined values for lag time associated with the speed (see FIG. 12) and used to calculate a first lag time value based on the mapping (e.g. Lag (V)).

Hydraulic Pressure Measurements

Referring to FIG. 10A, a hydraulic gas pressure transducer 1004 may be located on each of the P port and the S port of the pump unit 1174. Each of gas pressure sensor/transducers 1004 may be in electronic communication with controller 200' and provide a signal to controller 200' for calculating the driving pressure (or load pressure) based on the pressure differential between the pressures at the P and S port (or in lines 1163*a* and 1163*b*) respectively. In response to receiving such signals, the controller 200' calculates the hydraulic pressure difference as: Load Pressure=Absolute value of (Pressure P−Pressure S). The pressure values P and S are measured at the time that the second proximity sensor is turned on (e.g. sensor 157'*a* when piston 182 stroke is moving to the right). For example, the calculated pressure difference may provide an indication of the amount of work being performed by gas compressor system 100 with gas compressor 150'. The absolute load pressure value is then used by controller 200' to calculate a second lag time value (e.g. Lag(LP)) based on a previously determined relationship between pressure values and lag times for gas compressor 150'. This second lag time value is then used by controller 200' to modify the operation of gas compressor 150' for subsequent strokes as discussed below in calculating the overall lag time value. Generally speaking, the higher the load pressure, the harder compressor 150' is operating (e.g. hydraulic pistons 154*a*, 154*b* run slower). Thus, the higher the measured hydraulic pressure difference (between lines 1163*a* and 1163*b*), the higher the lag time value (e.g. Lag (LP)) associated with the pressure measurement in order to achieve a full stroke of hydraulic piston (e.g. 154*a*, 154*b*).

In alternative embodiments, it may not be necessary to measure the absolute pressure differential between the two ports P and S. For example, in a different embodiment, the driving fluid may be provided with an open fluid circuit, and a directional valve may be used to alternately apply a positive pressure on one or the other of the two hydraulic pistons 154*a* or 154*b*. In this case, a single pressure sensor in the fluid supply line upstream of the directional valve may be sufficient to provide the pressure load measurement.

Driving Fluid Temperature Measurement

Gas compressor 150' further comprises at least one temperature sensor 1006 (FIG. 10A) for measuring the temperature of the hydraulic driving fluid contained therein (e.g. within chambers 152*a*, 152*b*) on a continuous basis. An example of a suitable temperature sensor may be Parker IQAN 20073658.

Generally speaking, based on prior experimental data, the hydraulic fluid temperature may typically range from 15° C. to 35° C. Therefore, in one embodiment, 35° C. may be used as a base reference point, where the lag adjustment is set at Oms. The output lag time associated with the temperature (e.g. the lag time contribution from the temperature value) may be −125 ms at 15° C. Lag times at other temperatures may be extrapolated based on linear relationship from these two points.

Without being limited to any particular theory, it is expected that when the driving fluid is cooler, its viscosity increases and provides more resistance to movement of hydraulic piston 182. As a result, hydraulic piston 154*a*, 154*b* moves slower at lower temperatures. The lag time variable associated with the temperature is used to account for such change. Based on the sensed temperature (as provided by temperature sensor 1006), a third lag time value (e.g. Lag(FT)) may be determined as described above. This third lag time value (e.g. Lag (FT)) is then used by controller 200' to modify the operation of hydraulic fluid supply system 1160' or hydraulic pump unit 1174 for supplying the driving fluid to drive subsequent strokes as discussed below in calculating the overall lag time value.

Total Lag Time (LT)

As noted above, during a stroke, the lag time values may be calculated for each of the first, second and third lag time values (associated respectively with the speed of the gas piston (V), the load pressure applied to the gas piston (LP), and the temperature of the driving fluid (FT)) and are then used to calculate an overall lag time value as discussed above and further illustrated below.

For example, when the gas piston 182 is in a stroke moving towards the right hand side as shown in FIG. 11(A)-11(E), the overall lag time provides a delay time between the time (T2) when the second proximity sensor 157*a* is turned on (which indicates gas piston 182 has reached a predefined position, Position 2, in the stroke path) and the time to start ramping up hydraulic pump unit 1174 to apply a driving force in the opposite direction to drive gas piston 182 towards the left hand side. It is expected that after the lag time has elapsed, the speed of gas piston 182 will decelerate down to zero.

Conceptually, as shown in FIG. 13, when travelling in one direction, after the second proximity sensor turns on (see 1306 in FIG. 13), then both sensors turn off for a brief period of time (see 1308 in FIG. 13). Hydraulic fluid supply system 1160' is configured to delay for a period of time (lag time) which is equivalent to $LT_V+LT_{FT}+LT_{LP}$, where, using the notations above, $LT_V$=f(V), $LT_{FT}$=f(FT), and $LT_{LP}$=f(LP). As discussed above, $LT_V$ may be determined based on the average speed of piston 182 during the previous stroke.

An example calculation of the lag time (LT) is provided below for illustration purposes.

Lag Time Contribution for Speed (V)

In this example, the average speed of piston 182, which may be indicated by V (=D/ΔT) as discussed above, or by corresponding values of stroke per minute, is mapped to predetermined lag time values based empirical data and adjusted during operation, as illustrated in Table I.

Table I is an example mapping table for illustrating the relationship between the average stroke speed of gas piston 182 (e.g. in strokes per minute), the average speed (V) of gas piston 182 (in inch/μs), and the lag time contribution $LT_V$ or f(V) in ms. The data listed in Table I correspond to the data points shown in FIG. 12.

TABLE I

| Strokes per minute | V (inch/μs) | $LT_V$ (ms) |
|---|---|---|
| 8.5 | 1500 | 255 |
| 8.0 | 1400 | 290 |
| 7.5 | 1300 | 330 |
| 7.0 | 1200 | 375 |
| 6.5 | 1115 | 425 |
| 6.0 | 1030 | 500 |
| 5.5 | 935 | 585 |
| 5.0 | 845 | 670 |
| 4.5 | 775 | 750 |
| 4.0 | 665 | 915 |
| 3.5 | 580 | 1060 |
| 3.0 | 495 | 1283 |
| 2.5 | 405 | 1600 |
| 2.0 | 325 | 2050 |
| **1.5** | **0** | **2050** |
| **1.0** | **0** | **2050** |

For the example in Table I, D=35 inches and ΔT is the time period between the triggering signals from the two proximity sensors in each stroke cycle. For each given V, the corresponding $LT_V$ or f(V)) can be directly determined from Table I. A similar mapping table may be stored in a storage media accessible by controller 200'. In some embodiments, during practical implementation, it may be desirable to maintain a minimum stroke speed, such as a minimum of 2 stroke/min (spm). For this reason, the mapping may be adjusted such that the lag time contribution f(V) remains constant for piston speed below a certain threshold so that a minimum average speed of gas piston 182 is maintained, to result in 2 spm. In this case, there may be a wait time so that the net value of piston speed and wait time results in an overall lower speed for gas piston 182, as illustrated in the last two rows (in bold) in Table I. For example, when V=935 in/μs (or 5.5 spm), $LT_V$ is 595 ms from Table I.

Lag Time Contribution for Load Pressure (LP)

In this example, the lag time contribution associated with the load pressure f(LP) may be calculated as:

$$f(LP) = a \times LP + b,$$

where a=0.116959, b=−16.9591, the unit for the lag time is millisecond (ms), and the unit for LP is psi. This formula may be applied in a predefined pressure range, such as from 145 to 1000 psi, within which, the lag time contribution f(LP) changes linearly from 0 ms to 100 ms. As an example, when the LP is 500 psi, the $LT_{LP}$ from this equation is 42 ms.

Lag Time Contribution for Temperature (FT)

In this example, the lag time contribution associated with the fluid temperature f(FT) may be calculated as:

$$f(FT) = d \times FT + e,$$

where d=6.25 and e=−218.75, FT is in C, and the lag time is in ms. This formula may be applied in a predefined temperature range, such as from 15° C. to 35° C., with the lag time contribution changing from −125 ms to Oms. As an example, when the FT is 30° C., the $LT_{FT}$ from this equation is −31 ms.

Total Lag Time

In the above example, with V=935 in/μs (or 5.5 spm), LP=500 psi, and FT=30° C., the total lag time LT=595+42−31=596 ms.

End of Stroke Indicators

In one embodiment, each end of stroke indicator 1002*a*, 1002*b* may be located at one end of gas compressor 150' and is configured to provide a signal to controller 200' as to whether hydraulic piston 154*a*, 154*b* has travelled to a predefined distance to the terminal end wall of the respective cylinder, e.g. half an inch, which indicates a pre-defined end of stroke position. During operation, if a pre-defined end of stroke position (the desired full stroke) has not been reached, controller 200' performs calibrations to adjust the mapping or algorithm for determining the speed contribution to the lag time in subsequent strokes of gas piston 182 such that the pre-defined end of stroke position is more likely to be reached in the next stroke. For example, an additional lag increment of 1 ms may be added to the next total lag time, and the lag time function for the piston speed may be adjusted so that future lag time calculation for the speed contribution will take this information into account. When the speed contribution is determined based on a mapping table, the values in the table may be adjusted.

Figure 14:
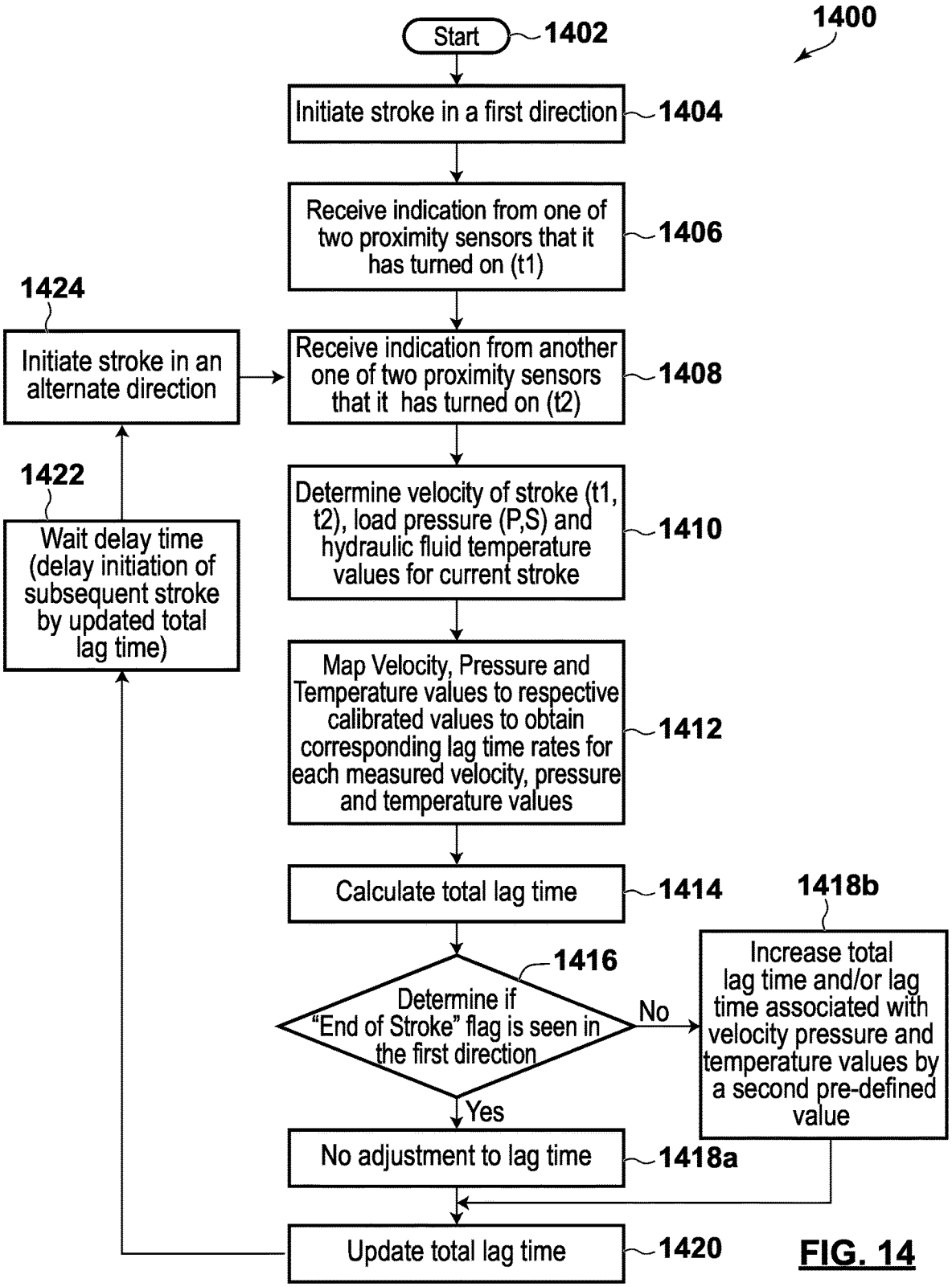
FIG. 14 is a process flowchart showing blocks of code for directing the controller of FIG. 10A to control the operation of the piston strokes of the gas compressor shown in FIG. 10A.

Referring to FIGS. 10A and 14, a process for self-calibrating gas compressor 150' to achieve full longitudinal strokes of gas piston 182 and hydraulic pistons 154*a* and 154*b* is shown at 1400. The process 1400 begins at block 1402 when an operator causes gas compressor 150' to start operation in response to receiving the start signal at an input. As shown at block 1404, controller 200' performs a startup process. In one embodiment, the startup process involves controller 200' producing a displacement control signal which causes movement of the gas piston 182, hydraulic pistons 154*a* and 154*b* in a first direction (e.g. to the right). As shown at 1406, the time that an indication is received from a first proximity sensor (e.g. 157*b*) that it has turned on is recorded as t1 (e.g. in response to sensing proximity of a portion of hydraulic piston 154*b*) and the time that a second proximity sensor (e.g. 157*a*) indicates that it has turned on is recorded as t2 (e.g. in response to sensing hydraulic piston 154*a*). Times t1 and t2 are stored by controller 200' (e.g. in a data store, not shown). At block 1410, the speed of a stroke is calculated as discussed above based on t1 and t2 measurements and a fixed distance between the two sensors 157*a* and 157*b*. Additionally, at block 1410, a measurement for pressure is captured by pressure sensor 1004 and provided to controller 200' in order to calculate the absolute pressure calculation noted above. Furthermore, at block 1410, a temperature measurement is captured by temperature sensor 1006 and provided to controller 200'. At block 1412, controller 200' then uses the calculated speed, load pressure and fluid temperature values to map to lag time values associated with each value (e.g. Lag (speed), Lag (pressure), and Lag(temperature). At block 1414, the total lag time value is then calculated by controller 200' as the sum of the lag time values (e.g. Total lag time=Lag (speed)+Lag(pressure)+Lag(temperature)). At block 1416, controller 200' monitors the end of stroke indicators (e.g. 1002*a*, 1002*b*) to determine whether the end of stroke has been reached within a stroke. If yes, then at block 1418*a*, the total lag time remains the same. Further alternately (not illustrated), if a physical end of stroke is reached as determined by a pressure spike in the gas compressor 150', then controller 200' reduces the total lag time is by a first pre-defined value. If no end of stroke flag is detected at 1416, then at block 1418*b*, controller 200' increases the total lag time is by a second pre-defined value. At block 1420, controller 200' updates the total lag time based on the end of stroke indicator. At block 1422, controller 200' implements a delay time equivalent to the determined total lag time at block 1420. This delay is the amount of time it takes to maintain speed and then decelerate piston 182 stroke initiated at block 1404 to a speed of zero. Subsequent to the delay, controller 200' then proceeds to initiate the stroke (movement of hydraulic pistons 154*a*, 154*b* and gas piston 182) in the opposite direction at block 1424.

In one embodiment, the displacement control signal produced by controller 200' (FIG. 10A) for controlling the stroke of piston 182 and hydraulic pistons 154*a*, 154*b* of gas compressor 150' (FIG. 10A) is shown as waveform 1300 in FIG. 13. As shown on waveform 1300, controller 200' generates a first ramped portion 1302 in which the pump control signal is ramped from 0 to +X (pump speed) in 300 ms. As shown on waveform 1303, the movement of hydraulic piston 154*b* to the right causes right proximity sensor 157*b* to turn on.

At time 1304, the movement of piston 154*b* to the right causes right proximity sensor 157*b* to turn off and left proximity sensor 157*a* is triggered on by the movement of hydraulic piston 154*a* to the right at time 1306. At event 1304, a right START time (t1) value is saved.

At time 1306, a right STOP time (t2) value is saved. As noted above, the time values t1 and t2 are used by controller 200' to calculate the speed of piston 182 during movement to the right. Additionally, at time 1306, the hydraulic pressure is captured by pressure sensor 1004 and provided to controller 200'. Further, the temperature of hydraulic fluid flowing through gas compressor 150' is captured by temperature sensor 1006 and provided to controller 200' at time 1306. As discussed above, based on the speed, temperature, and pressure values, controller 200' calculates the total lag time. The total lag time calculated may be associated with movement of piston 182 to the right for use in modifying subsequent strokes to the right and stored within a data store for access by controller 200'.

At time 1308, both left and right proximity sensors 157*a* and 157*b* turn off for a very brief period of time and controller 200' recognizes that the end of stroke (e.g. for the movement of the hydraulic piston 154*b*) has been reached since both sensors are off. At time 1308, controller 200' waits for a previously defined amount of lag time and once the right lag time has expired, the pump control signal causes hydraulic piston 154*b* to decelerate from X to zero, shown as the ramp down portion at 1310, in for example 50 ms. Thus, during this right stroke movement of hydraulic piston 154*b*, the lag time is calculated for the next stroke by controller 200'. If the end of stroke was not reached as determined by end of stroke indicator 1002*a*, then the lag time value is increased by a first pre-defined value. Conversely, the calculated lag time value is decreased by a second pre-defined value if the physical end of stroke is hit which is seen as a hydraulic pressure spike in gas compressor 150'. Controller 200' subsequently generates a negative displacement signal and accelerates hydraulic pistons 154*a*, 154*b* and gas piston 182 to the left such that the pump speed is ramped (accelerated) in the opposite direction from 0 to −X in 300 ms. Left proximity sensor 157*a* turns on with the movement and proximity of hydraulic piston 154*a* and at time 1316, right proximity sensor 157*b* turns on with the movement and proximity of hydraulic piston 154*b*. Also, at time 1316, speed of the left stroke is calculated along with pressure and temperature values respectively received from pressure sensor 1004 and temperature sensor 1006. At time 1318, both proximity sensors 157*a* and 157*b* are off and deceleration of the displacement control signal provided by controller 200' occurs after the previously defined lag time expires. It is noted that time portion 1312 indicates a short time period that both proximity sensors 157*a* and 157*b* are off and thus controller 200' determines that the end of stroke has been reached.

In a modified embodiment, when an end of stroke event, such as a physical end of stroke, has been detected during a stroke, instead of reducing the lag time (LT) by a large value (such as 25 ms) for the next stroke, the LT may be reduced by 1 ms (i.e., −1 ms) in each subsequent stroke until an end of stroke event is no longer detected. Such reduced decrease of LT after detection of end of stroke events may be used throughout the entire operation, or may be used during a selected period of operation. For example, when a physical end of stroke is expected to have occurred due to significant change in operation conditions or other external factors, a larger deduction in LT may be helpful. When an end of stroke event is expected to have occurred due to slight over-adjustment of the LT in the previous stroke, a smaller reduction in LT for the next stroke may provide a more smooth operation and quicker return to optimal operation. In further embodiments, an automatic reduction of 1 ms from the LT may also be implemented as long as the end of stroke positon is reached during a previous stroke. If in the subsequent stroke, the end of stroke position is again reached, the LT is reduced further by 1 ms. However, if in the subsequent stroke, the end of stroke position is not reached, the LT may be then increased by 1 ms. In this manner, a more smooth operation may be achieved in at least some applications, and possible physical end of strokes due to slow drifting operating conditions may be avoided.

Various other variations to the foregoing are possible. By way of example only—instead of having two opposed hydraulic cylinders each being single acting but in opposite directions to provide a combined double acting hydraulic cylinder powered gas compressor:

- a single but double acting hydraulic cylinder with two adjacent hydraulic fluid chambers may be provided with a single buffer chamber located between the innermost hydraulic fluid chamber and the gas compression cylinder;
- a single, one way acting hydraulic cylinder with one hydraulic fluid chamber may be provided with a single buffer chamber located between the hydraulic fluid chamber and the gas compression cylinder, in which gas in only compressed in one gas compression chamber when the hydraulic piston of the hydraulic cylinder is moving on a drive stroke.

In alternative embodiments, the grooves 158 on hydraulic pistons 154 as illustrated in FIGS. 11A-11E may be used to provide signals for controlling the reversal of the gas piston 182 without measuring or calculating some or all of the speed of travel of gas piston 182, the load pressure on the hydraulic pistons, and the temperature of the driving fluid. Instead, respective ends of the grooves 158 may be used in combination with the corresponding proximity sensors 157 to set a reversal time when a first end of the grooves 158 is within proximity of the corresponding proximity sensor 157, with a selected lag time or ramp time. The lag time may be initially set for a default value, and is increased or decreased incrementally in subsequent strokes depending on whether in the previous stroke, the other proximity sensor 157 detects the presence of the other end of the groove within its proximity. In this sense, the first end of the groove may be considered an reversal or turnaround indicator, and the second end of the groove may be considered an end-of-stroke indicator.

In further alternative embodiments, the hydraulic pistons 154 as illustrated in FIGS. 11A-11E may be modified to provide more than two grooves, or multiple grooves on each hydraulic piston, which are axially aligned along the piston axis. When multiple grooves are provided, one or two ends of different grooves may be used to provide the reversal and end-of-stroke signals. For example, the particular ends (active ends) of the grooves that are selected to provide or calculate the reversal time may be determined based on the operation speed of the gas piston, such as the number of strokes per minute. For instance, when the operation speed is higher, the selected active ends may be separated by more grooves in between; and when the operation speed is lower, fewer grooves are between the selected active ends. In an example embodiment, the reversal or turnaround time may be determined by counting the number grooves that pass by a particular proximity sensor during a stroke. To illustrate, assuming there are N grooves on a hydraulic cylinder, when the compressor is operated at the full speed, the piston reversal or turnaround time may be triggered or determined once (N-M) grooves have passed the proximity sensor and have been counted by the controller, where M is less or equal to N. That is, M grooves have been skipped at full speed. At half speed, the reversal or turnaround may be triggered when (N−M/2) grooves have been counted (with M/2 grooves being skipped). At the minimum speed, all N grooves may be counted before the reversal or turnaround. The number of skipped grooves may be reduced gradually or incrementally as the operation speed decreases, and may be proportional to the operation speed.

In an embodiment, a method of adaptively controlling a hydraulic fluid supply to supply a driving fluid for applying a driving force on a piston in a gas compressor is provided. The driving force is cyclically reversed between a first direction and a second direction to cause the piston to reciprocate in strokes. The method includes monitoring, during a first stroke of the piston, a speed of the piston, a temperature of the driving fluid, and a load pressure applied to the piston; and controlling reversal of the driving force after the first stroke based on the speed, load pressure, and temperature, wherein controlling reversal of the driving force comprises determining a lag time before reversing the direction of the driving force, and delaying reversal of the driving force by the lag time; monitoring whether the piston has or has not reached a predefined end position during a previous stroke; and in response to the piston not reaching the predefined end position during the previous stroke, increasing the lag time by a pre-selected increment. The speed of the piston may be monitored using proximity sensors. The pre-selected increment may be 1 millisecond. The method may further include monitoring an end of stroke event; and in response to occurrence of the end of stroke event, decreasing the lag time by a sufficient amount to avoid recurrence of the end of stroke event in subsequent strokes. The lag time may be decreased as the temperature decreases below a temperature threshold. The lag time may be increased as the load pressure increases. The lag time may be increased by an amount linearly proportional to the load pressure. The gas compressor may be a double-acting gas compressor. The gas compressor may comprise a gas cylinder and first and second hydraulic cylinders; wherein the gas cylinder comprises a gas chamber for receiving a gas to be compressed and having a first end and a second end, and each of the first and second hydraulic cylinders comprises a driving fluid chamber for receiving the driving fluid; and wherein the piston comprises a gas piston reciprocally moveable within the gas chamber for compressing the gas received in the gas chamber towards the first or second end; and a hydraulic piston moveably disposed in each driving fluid chamber and coupled to the gas piston such that reciprocal movement of the hydraulic piston causes corresponding reciprocal movement of the gas piston. The speed of the piston may be monitored using first and second proximity sensors positioned and configured to respectively generate a first signal indicative of a first time (T1) when a first part of the piston is in a proximity of the first proximity sensor, and a second signal indicative of a second time (T2) when a second part of the piston is in a proximity of the second proximity sensor, whereby the speed of the piston may be calculable based on T1, T2 and a distance between the first and second proximity sensors, and wherein the load pressure may be measured at T1 or T2. The temperature of the driving fluid may be monitored using a temperature sensor mounted in the gas compressor or in the hydraulic fluid supply. The hydraulic fluid supply may include a hydraulic pump having first and second ports for supplying the driving fluid and applying the driving force, and wherein the load pressure may be monitored by monitoring a fluid pressure differential between the first and second ports.

In various other variations a buffer chamber may be provided adjacent to a gas compression chamber but a driving fluid chamber may be not immediately adjacent to the buffer chamber; one or more other chambers may be interposed between the driving fluid chamber and the buffer chamber—but the buffer chamber still functions to inhibit movement of contaminants out of the gas compression chamber and in some embodiments may also protect a driving fluid chamber.

In other embodiments, more than one separate buffer chamber may be located in series to inhibit gas and contaminants migrating from the gas compression chamber.

One or more buffer chambers may also be used to ensure that a common piston rod through a gas compression chamber and hydraulic fluid chamber, which may contain adhered contamination from the gas compressor, is not transported into any hydraulic fluid chamber where the hydraulic oil may clean the rod. Accumulation of contamination over time into the hydraulic system is detrimental and thus employment of one or more buffer chambers may assist in reducing or substantially eliminating such accumulation.

Multi-Phase Fluid Pump

Figure 19A:
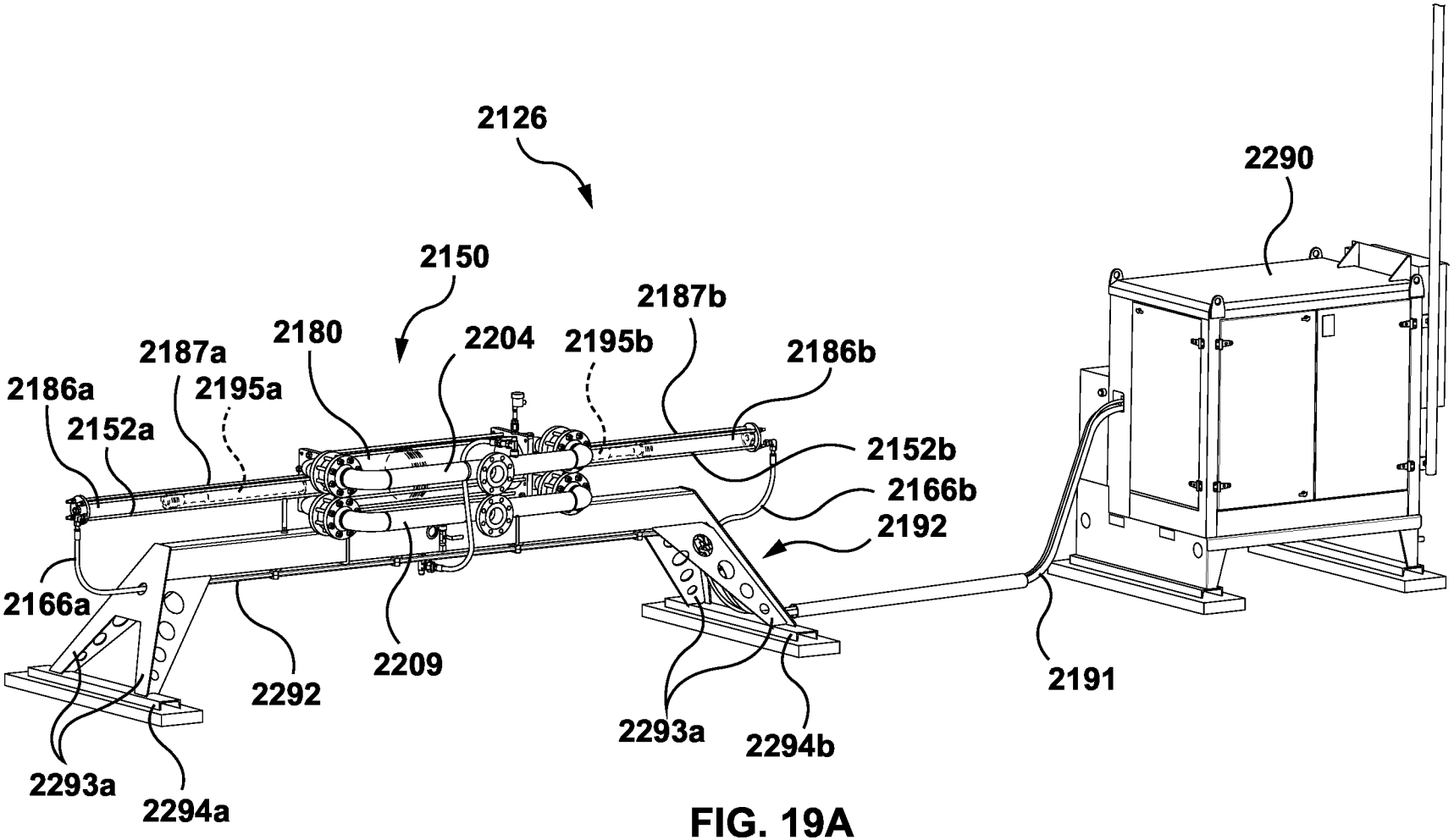
FIG. 19A is a perspective view of a multi-phase pump system comprising part of the oil and gas producing well system of FIG. 19.
Figure 19B:
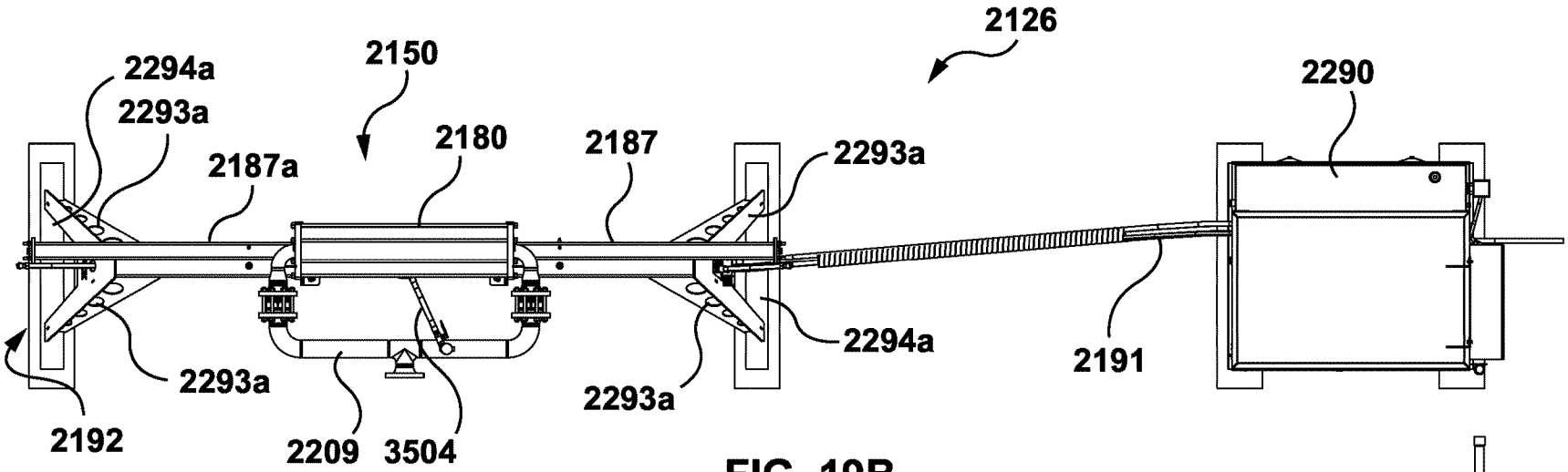
FIG. 19B is a top plan view of the pump system of FIG. 19A.

It will be appreciated from the foregoing, gas compressor system 126 is primarily intended for receiving a gas such as natural gas from a gas source such as from an oil well, compressing the gas and then moving the gas to another location (eg. to main oil/gas output flow line 132). However, a multi-phase fluid transfer/pump system 2126 (see FIGS. 19A-C) has been conceived which is similar in construction to gas compressor system 126, but which is capable of pressurizing and moving from one location to another multi-phase mixtures of fluids (gases and liquids), wherein during operation of the pump, fluids with gas to liquid ratios that vary over time during operation, can be processed. In many conventional oilwell environments using conventional production equipment, this variation in the ratio of oil/gas being produced may result in significant difficulties in the operation of the oil well and may result in some oil wells being or becoming unprofitable and/or inefficient in their operation. However, multi-phase fluid pump system 2126 can handle fluid that range from a substantially 100% liquid and substantially no gas, to a substantially 100% gas and substantially no liquid type of fluid, and all ratios of gas/liquid therebetween. Such multi-phase mixtures of fluids may include substances and solid materials derived from oil well production, such as oil, gases including natural gas, water (and may also include one or more of sand, paraffin, and/or other solids carried therein or therewith). Thus, a multi-phase fluid pump system 2126 may be configured to be operable to transfer multi-phase mixtures of substances that comprise 100% gas, 100% liquid, or any proportion of gas/liquid there between, wherein during operation of the multi-phase pump system 2126, the ratio of gas/liquid is changing, either intermittently, periodically, or substantially continuously. Multi-phase fluid pump system 2126 can also handle fluids that may also carry abrasive solid materials such as sand without damaging important components of the pump system such as the surfaces of various cylinders and pistons. It should also be noted that the formation of foam is a significant challenge when pumping fluid in an oil/gas well environment, particularly where the fluid has a gas/liquid ratio that is changing during operation. Gas may come out of solution in the liquid during the extraction process and create a foam substance. Also, gas being transported with a liquid such as oil, may during the movement, mix together and tend to form a foam substance, particularly if the oil has a high viscosity. Multi-phase fluid pump system 2126 can minimizes the tendency of foam forming during the pumping operation, and also handle the pumping of any foam that is formed.

Figure 18:
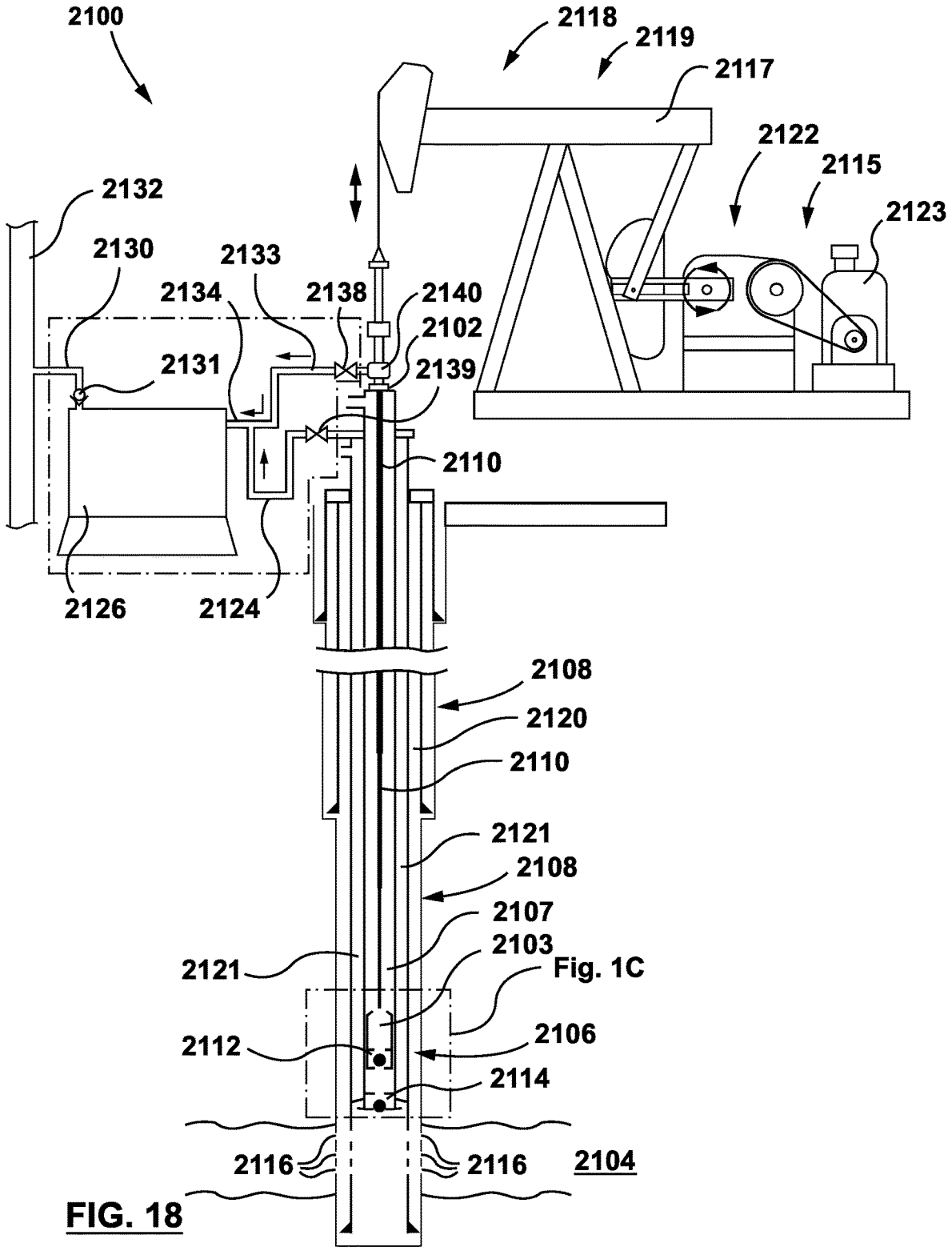
FIG. 18 is a schematic view of an alternate oil and gas producing well system.

With reference to FIG. 18, an example oil and gas producing well system 2100 is illustrated schematically that may be installed at, and in, a well shaft 2108 and may be used for extracting liquid and gases (e.g. oil and/or natural gas) from an oil and gas bearing reservoir 2104. In this disclosure the term "fluid" per se, will refer to any of liquids, gases and mixtures of the same, that are movable through multi-phase fluid pump system 2126. Fluids extracted from the well shaft 2108 may be forced by fluid pump system 2126 into a main oil/gas flow line 2132. Such fluid may include oil, water, natural gas, $H_2S$, $CO_2$ and production/stimulation chemicals or a mixture thereof.

Extraction of oil and other liquids, such as water, from reservoir 2104 may be achieved by operation of a down-well pump 2106 positioned at the bottom of well shaft 2108. Also, as referenced above, natural gas may also be extracted from reservoir 2104. For extracting oil from reservoir 2104, down-well pump 2106 may be operated by the up-and-down reciprocating motion of a sucker rod 2110 that extends through the well shaft 2108 to and out of a well head 2102.

As in the embodiment described above, well shaft 2108 may have along its length, one or more generally hollow cylindrical tubular, concentrically positioned, well casings generally designated 2120 (FIG. 18), including an innermost production casing that may extend for substantially the entire length of the well shaft 2108, and intermediate casing and a surface casing. These casings 2120 may be made from one or more suitable materials and may be secured, sealed and function, like casings 120*a-c* described above. Production tubing may be received inside a production casing and may be generally of a constant diameter along its length and have an inner tubing passageway/annulus to facilitate the communication of liquids (e.g. oil) from the bottom region of well shaft 2108 to the surface region. Along with other components that constitute a production string, a continuous passageway (a tubing annulus) 2107 from the region of pump 2106 within the reservoir 2104 to well head 2102 is provided by the production tubing. Tubing annulus 2107 provides a passageway for sucker rod 2110 to extend and within which to move and provides a channel for the flow of liquid (eg. oil) from the bottom region of the well shaft 2108 to the region of the surface.

Also in a manner similar to that described above, an annular casing annulus 2121 may be provided between the inward facing generally cylindrical surface of the production casing and the outward facing generally cylindrical surface of the production tubing and may extend along the co-extensive length of inner casing and the production tubing and thus provides a passageway/channel that extends from the bottom region of well shaft 2108 proximate the oil/gas bearing formation 2104 to the ground surface region proximate the top of the well shaft 2108.

Natural gas (that may be in liquid form in the reservoir 2104) and/or oil may flow from reservoir 2104 into the well shaft 2108 and may flow through the production tubing. Other gases and liquids such as water, as well as impurities such as sand, may be carried with the flow of natural gas and oil, towards the surface and well head 2102. This mixture may also include waxes and asphaltenes which begin to precipitate due to pressure and temperature decreases as the fluid flows towards the surface. Also, natural gas may flow through tubing annulus 2107, towards the surface and well head 2102.

Down-well pump 2106 may operate like down-well pump 106 described above and may have a plunger 2103 that is attached to the bottom end region of sucker rod 2110. Down well pump 2106 may include a one-way travelling valve 2112 and a one-way standing intake valve 2114 that is stationary and attached to the bottom of the barrel of pump 2106/the production tubing. Travelling valve 2112 keeps the liquid (eg. oil) in the channel 2107 of the production tubing during the upstroke of the sucker rod 2110. Standing valve 2114 keeps the fluid in the channel 2107 of the production tubing during the downstroke of sucker rod 2110. During a downstroke of sucker rod 2110 and plunger 2103, travelling valve 2112 opens, admitting liquid from reservoir 2104 into the annulus of the production tubing. During this downstroke, one-way standing valve 2114 at the bottom of well shaft 2108 is closed, preventing liquid from escaping.

Successive upstrokes of down-well pump 2106 form a column of liquid (eg. oil) in well shaft 2108 above down-well pump 2106. Once this column of liquid is formed, each upstroke pushes a volume of liquid toward the surface and well head 2102. Gas entrained in the liquid and/or solid materials entrained in the liquid, may also be pushed to well head 2102. The liquid/gas eventually reaches a T-junction device 2140 which has connected thereto liquid/gas flow line 2133. Liquid/gas flow line 2133 may include an input supply pipe 2134 supplying liquid/gas with ration that vary widely and frequently over time, during operation, to fluid pump system 2126 from well head 2102, and an outlet pipe 2130 delivering liquid/gas from fluid pump system 2126 to main oil/gas output flow line 2132.

Liquid/gas flow line 2133 may have interposed therein a valve device 2138 that is operable to permit liquid/gas flow only forward through liquid/gas flow line 2133 into fluid supply pipe 2134, to multi-phase fluid pump system 2126. Output pipe 2130 from fluid pump system 2126 may have a one-way check valve device 2131 to permit liquid/gas flow only forward through outlet pipe 2130 to main oil/gas output flow line 2132.

Sucker rod 2110 may be actuated by a suitable lift system 2118 that may be like lift system 118 described above.

In normal operation of system 2100, the flow of oil, natural gas and other fluids from the production tubing is communicated through fluid supply pipe 2133 and into fluid supply pipe 2134 and then to fluid pump system 2126, and such flow is not restricted by valve device 2138 and the fluid (which at any time during operation, may be a mixture of gas and liquid, or 100% gas or 100% liquid) will flow there through. Some solid impurities such as sands may be carried with the liquid-gas flow. Valve 2138 may be closed (e.g. manually) if for some reason it is desired to shut off the flow of liquid/gas from the production tubing. Also, piping 2124 (FIG. 18) may carry natural gas from the annulus 2121 of casing 2120 through a valve device 2139 to inter-connect with fluid supply pipe 2134 and thus provide a fluid that is typically is a varying mixture of liquid and gas, to fluid pump system 2126.

Liquid/gas that has been pumped and compressed by fluid pump system 2126 may be communicated via fluid delivery piping 2130 through one way check valve device 2131 to interconnect with main oil and gas flow line 2132 which can deliver the oil and gas therein to a destination for processing and/or use. Piping 2130, 2124 and 2134 may be made of any suitable material(s) such as welded steel pipe tested for sour service. All such piping may be pressure welded, x-rayed and pressure tested.

The ratio of oil to gas being delivered to the surface and thus to multi-phase fluid pump system 2126 may vary significantly over time during the operation of down-well pump 2106. Fluid pump system 2126 is, however, able to accommodate the wide variations in liquid/gas ratios delivered from the oil well over time during normal operation.

Multi-phase fluid pump system 2126 may include a pump 2150 (see FIGS. 19A, 19B and 19C) that is driven by a driving fluid. The driving fluid for pump 2150 may be any suitable fluid such as a fluid that is substantially incompressible and may contain anti-wear additives or constituents. The driving fluid may be a suitable hydraulic fluid like that referenced above.

Pump 2150 may be in hydraulic fluid communication with a hydraulic fluid supply system which may provide an open loop or closed loop hydraulic fluid supply circuit. For example, pump 2150 may be in hydraulic fluid communication with a hydraulic fluid supply system that may be substantially functionally the same as hydraulic fluid supply system 1160 as depicted in FIGS. 7 and 10A—such as for example fluid supply system 2160 shown in FIG. 28. Fluid supply system 2160 may be adaptable for supplying hydraulic fluid to different sizes of pump 2150.

Figure 28:
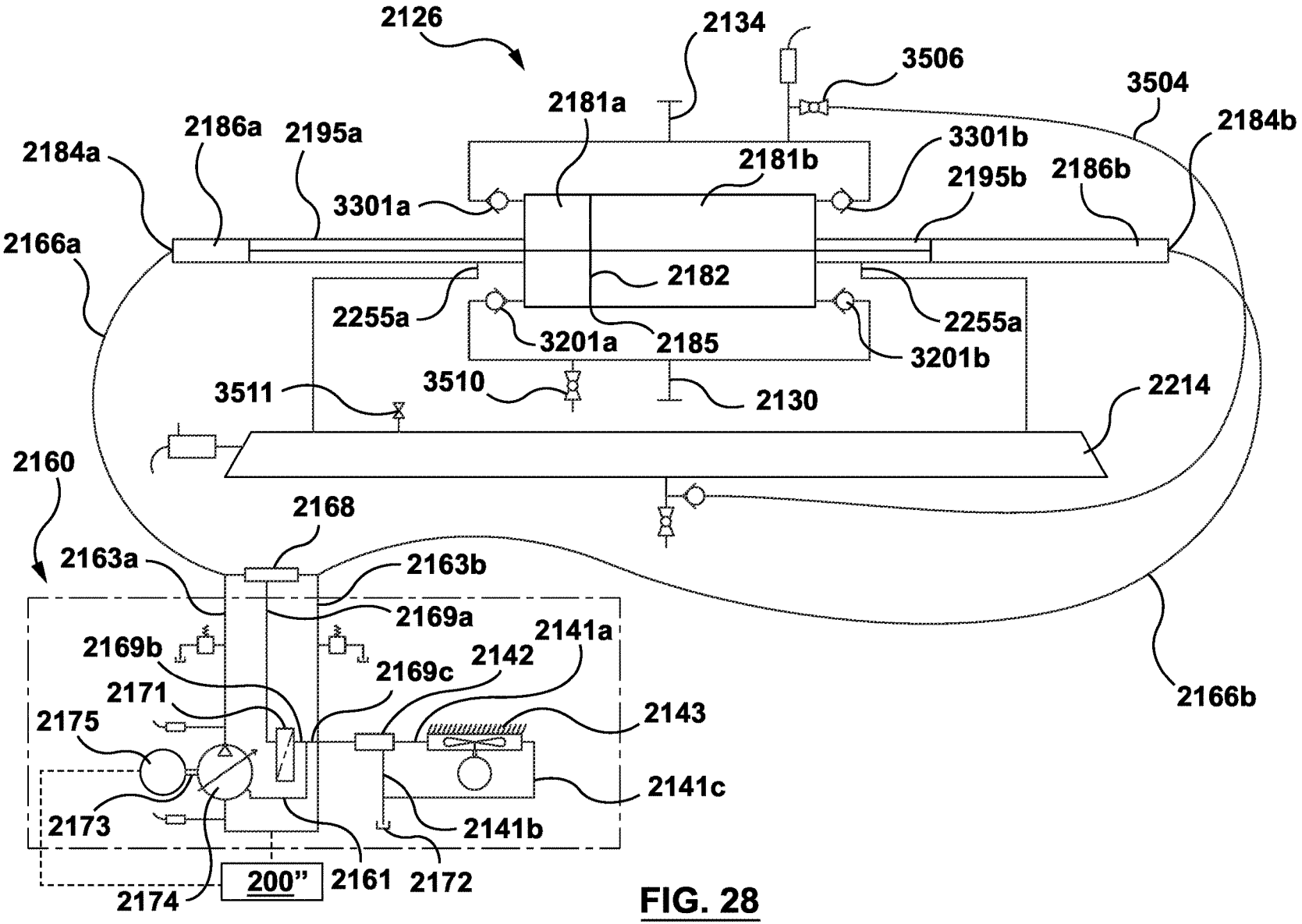
FIG. 28 is a schematic diagram a multiphase pump system including pump system of FIG. 19A.

With reference to FIG. 28, hydraulic fluid supply subsystem 2160 may be a closed loop system and may include a pump unit 2174, hydraulic fluid communication lines 2163*a*, 2163*b*, 2166*a*, 2166*b*, and a hot oil shuttle valve device 2168. Shuttle valve device 2168 may be for example a hot oil shuttle valve device made by Sun Hydraulics Corporation under model XRDCLNN-AL.

Shuttle valve 2168 may be connected to an upstream end of a bypass fluid communication line 2169 having a first portion 2169*a*, a second portion 2169*b* and a third portion 2169*c* that are arranged in series. A filter 2171 may be interposed in bypass line 2169 between portions 2169*a* and 2169*b*. Filter 2171 may be operable to remove contaminants from hydraulic fluid flowing from shuttle valve device 2168 before it is returned to reservoir 2172. Filter 2171 may for example include a type HMK05/25 5 micro-m filter device made by Donaldson Company, Inc. The downstream end of line portion 2169*b* joins with the upstream end of line portion 2169*c* at a T-junction where a downstream end of a pump case drain line 2161 is also fluidly connected. Case drain line 2161 may drain hydraulic fluid leaking within pump unit 2174. Fluid communication line portion 2169*c* is connected at an opposite end to an input port of a thermal valve device 2142. Depending upon the temperature of the hydraulic fluid flowing into thermal valve device 2142 from communication line portion 2169*c* of bypass line 2169, thermal valve device 2142 directs the hydraulic fluid to either fluid communication line 2141*a* or 2141*b*. If the temperature of the hydraulic fluid flowing into thermal valve device 1142 is greater than a set threshold level, valve device 2142 will direct the hydraulic fluid through fluid communication line 2141*a* to a cooling device 2143 where hydraulic fluid can be cooled before being passed through fluid communication line 2141*c* to reservoir 2172. If the hydraulic fluid entering fluid valve device 2142 does not require cooling, then thermal valve 2142 will direct the hydraulic fluid received therein from communication line portion 2169*c* to communication line 2141*b* which leads directly to reservoir 2172. An example of a suitable thermal valve device 2142 is a model 67365-110F made by TTP (formerly Thermal Transfer Products). An example of a suitable cooler 2143 is a model BOL-16-216943 also made by TTP.

Drain line 2161 connects pump unit 2174 to a T-connection in communication line 2169*b* at a location after filter 2171. Thus hydraulic fluid directed out of pump unit 2174 can pass through drain line 2161 to the T-connection of communication line portions 2169*b*, 2169*c*, (without going through the filter device 2171) where it can mix with any hydraulic fluid flowing from filter 2171 and then flow to thermal valve device 2142 where it can either be directed to cooler 2143 before flowing to reservoir 2172 or be directed directly to reservoir 2172. By not passing hydraulic fluid from case drain 2161 through relatively fine filter 2171, the risk of filter 2171 being clogged can be reduced.

Hydraulic fluid supply system 2160 may include a reservoir 2172 which may utilize any suitable driving fluid, which may be any suitable hydraulic fluid that is suitable for driving the hydraulic cylinders 2152*a*, 2152*b*.

Cooler 2143 may be operable to maintain the hydraulic fluid within a desired temperature range, thus maintaining a desired viscosity. For example, in some embodiments, cooler 1243 may be operable to cool the hydraulic fluid when the temperature goes above about 50° C. and to stop cooling when the temperature falls below about 45° C. In some applications such as where the ambient temperature of the environment can become very cold, cooler 2143 may be a combined heater and cooler and may further be operable to heat the hydraulic fluid when the temperature reduces below for example about −10° C. The hydraulic fluid may be selected to maintain a viscosity generally in hydraulic fluid supply system 2160 of between about 20 and about 40 $mm^2s^{-1}$ over this temperature range.

Hydraulic pump unit 2174 may be generally part of a closed loop hydraulic fluid supply system 2160. Pump unit 2174 may alternately deliver a pressurized flow of hydraulic fluid to fluid communication lines 2163*a* and 2163*b* respectively, allowing hydraulic fluid to be returned to pump unit 2174. Thus, hydraulic fluid supply system 2160 may be part of a closed loop hydraulic circuit, except to the extent described hereinafter. Pump unit 2174 may be implemented using a variable-displacement hydraulic pump capable of producing a controlled flow hydraulic fluid alternately. In one embodiment, pump unit 2174 may be an axial piston pump having a swashplate that is configurable at a varying angle α. For example, pump unit 2174 may be selected from the range of HPV-02 variable pumps manufactured by Linde Hydraulics GMBH & Co. KG of Germany. For example, depending upon the particular specifications of the fluid pump 2150, models may utilized that are operable to deliver displacement of hydraulic fluid of any of about 55, 75, 105, 135, 165, 210 or 280 cubic centimeters per revolution at pressures at pressure ranges in the range of for example 300-3000 psi. In other embodiments, the pump unit 2174 may be other suitable variable displacement pump, such as a variable piston pump or a rotary vane pump, for example.

In this embodiment the pump unit 2174 may include an electrical input for receiving a displacement control signal from controller 200. The displacement control signal at the input is operable to drive a coil of a solenoid (not shown) for controlling the displacement of the pump unit 2174 and thus a hydraulic fluid flow rate produced alternately. The electrical input is connected to a 24 VDC coil within the hydraulic pump 2174, which is actuated in response to a controlled pulse width modulated (PWM) excitation current of between about 232 mA ($i_{0U}$) for a no flow condition and about 425 mA ($i_U$) for a maximum flow condition.

Figure 18A:
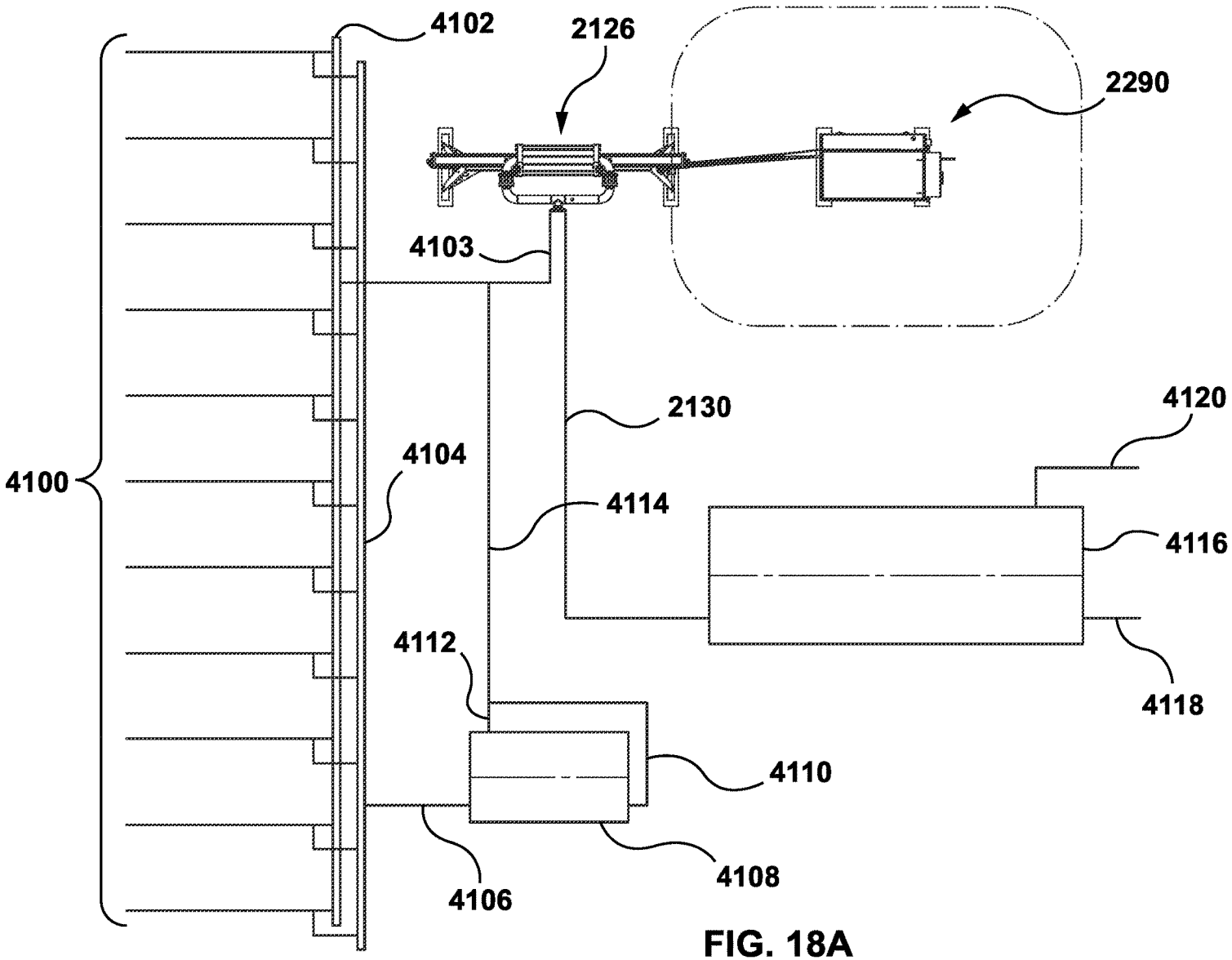
FIG. 18A is a schematic view of a layout of an oil and gas production facility.

An example layout for a production facility utilising multi-phase fluid pump system 2126 is depicted in FIG. 18A. A plurality of oil and gas producing wells 4100 arranged in parallel with each other, which may be operable to feed into a common group header pipe 4102, where their contents are combined. Periodically fluid from a selected well from oil and gas producing wells 4100 can be diverted into test header 4104, which is in fluid communication with test separator 4108. Test separator 4108 may be used to determine the production rates of oil, gas and water for a selected well, whilst also allowing the evaluation of any separation issue that may be occurring. Gas and liquids exit the test separator 4108 from piping 4110 and 4112 respectively and are recombined in piping 4114. The fluid in piping 4114 further combines with the fluid exiting the group header 4102 in input supply pipe 4103, which feeds into multi-phase fluid pump system 2126. Pumped fluid may exit multi-phase fluid pump system 2126 through delivery piping 2130, which is in fluid communication with group separator 4116. Group separator 4116 is used to separate the gas and liquid components. Gas may exit through piping 4120 to a gas sales line (not shown) and fluid may exit through piping 4118 to a pipeline or tank battery (not shown).

Figure 18B:
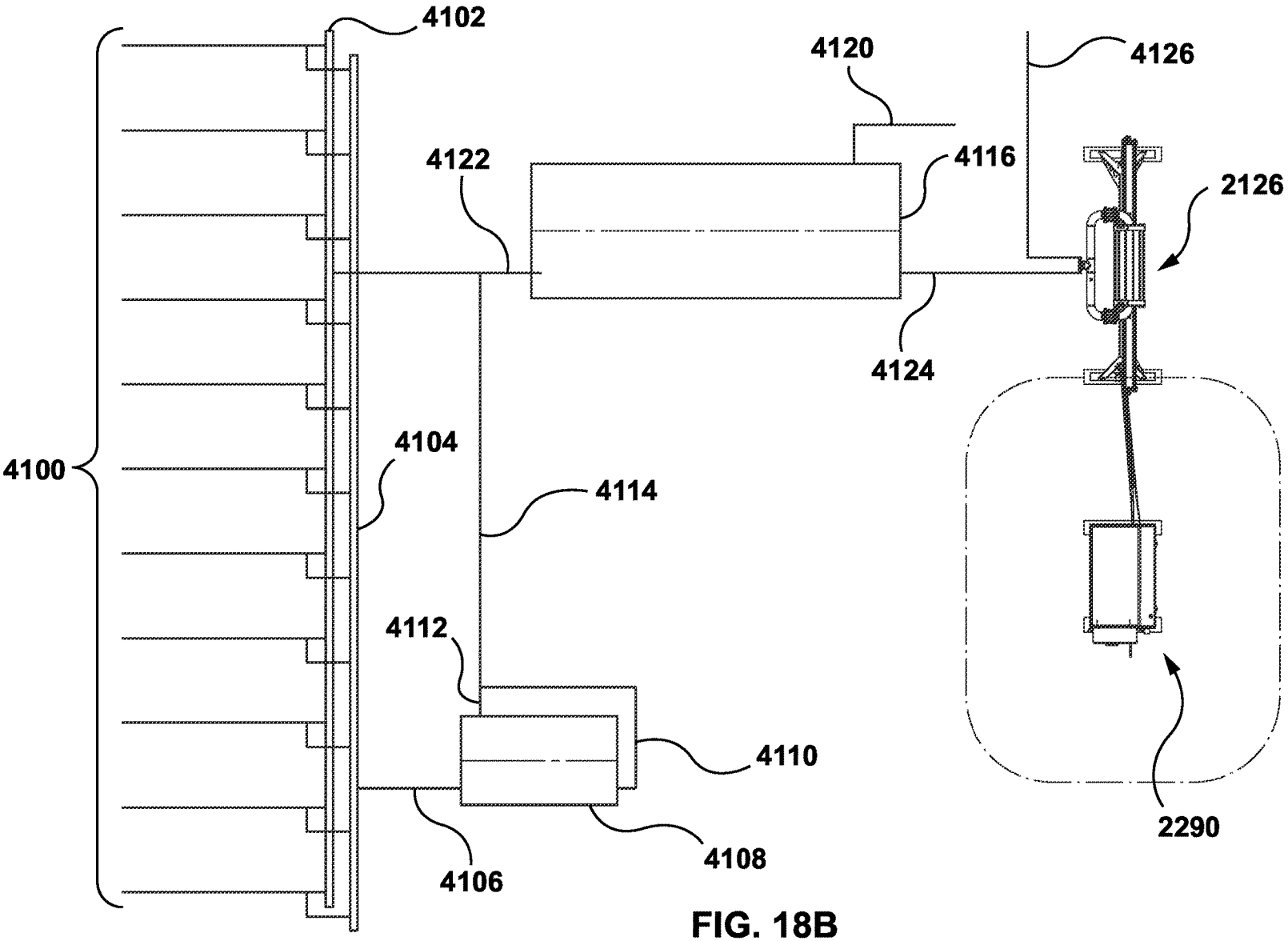
FIG. 18B is a schematic view of a layout of an oil and gas production facility.

FIG. 18B depicts an alternative layout for the above described production facility where the combined contents from group header 4102 and piping 4114 are carried to group separator 4116 through piping 4122. Multi-phase fluid pump system 2126 is positioned after group separator 4116 to receive fluid exiting into input supply pipe 4124. Fluid exits pump 2126 through piping 4126, travelling to a pipeline or tank battery (not shown).

Returning to the configuration of multi-phase pump 2126 and its components, and with particular reference to FIGS. 20A-C and 22, multi-phase pump 2150 may have first and second, one-way acting, hydraulic cylinders 2152*a*, 2152*b* positioned at opposite ends (on opposed sides) of pump 2150. Cylinders 2152*a*, 2152*b* are each configured to provide a driving force that acts in an opposite direction to each other, both acting inwardly towards each other and towards a pump cylinder 2180. Thus, positioned generally inwardly between hydraulic cylinders 2152*a*, 2152*b* is fluid pump cylinder 2180. Pump cylinder 2180 may be divided into two fluid pump chamber sections 2181*a*, 2181*b* by a pump piston 2182. In this way, fluid in fluid pump chamber sections 2181*a*, 2181*b*, may be alternately pumped, by alternating, inwardly directed driving forces of the hydraulic cylinders 2152*a*, 2152*b* driving the reciprocal movement of pump piston 2182 and its piston pump rod 2194. Pump rod 2194 may be formed in two sections—pump rod sections 2194*a*, 2194*b*—which may each be interconnected (such as with a threaded connection) at inwards ends to each other and to pump piston 2182.

Pump cylinder 2180, fluid pump chamber sections 2181*a*, 2181*b*, and hydraulic cylinders 2152*a*, 2152*b* may all have generally circular cross-sections although alternately shaped cross sections are possible in some embodiments.

Hydraulic cylinder 2152*a* may have a hydraulic cylinder base 2183*a* at an outer end thereof. A first hydraulic fluid chamber 2186*a* may thus be formed between a cylinder barrel/tubular wall 2187*a*, hydraulic cylinder base 2183*a* and hydraulic piston 2154*a*. Hydraulic cylinder base 2183*a* may have a hydraulic input/output fluid connector 2184*a* that is adapted for connection to hydraulic fluid communication line such as hydraulic communication line 2166*a* (see FIG. 28). Thus, hydraulic fluid can be communicated into and out of first hydraulic fluid chamber 2186*a*.

At the opposite end of pump system 2150, may be a similar arrangement. Hydraulic cylinder 2152*b* has a hydraulic cylinder base 2183*b* at an outer end thereof. A second hydraulic fluid chamber 2186*b* may thus be formed between a cylinder barrel/tubular wall 2187*b*, hydraulic cylinder base 2183*b* and hydraulic piston 2154*b*. Hydraulic cylinder base 2183*b* may have an input/output fluid connector 2184*b* that is adapted for connection to a hydraulic fluid communication line such as hydraulic communication line 2166*b* (FIG. 28). Thus, hydraulic fluid can also be communicated into and out of second hydraulic fluid chamber 2186*b*.

In embodiments such as illustrated in FIG. 28, the driving fluid connectors (such as connectors 2184*a*, 2184*b*) may each connect to a single hydraulic fluid line (such as lines 2166*a*, 2166*b*) that may, depending upon the operational configuration of the system, either be communicating hydraulic fluid to, or communicating hydraulic fluid away from, each of hydraulic fluid chamber 2186*a* and hydraulic fluid chamber 2186*b*, respectively. However, other configurations for communicating hydraulic fluid to and from hydraulic fluid chambers 2186*a*, 2186*b* are possible.

Figure 20A:
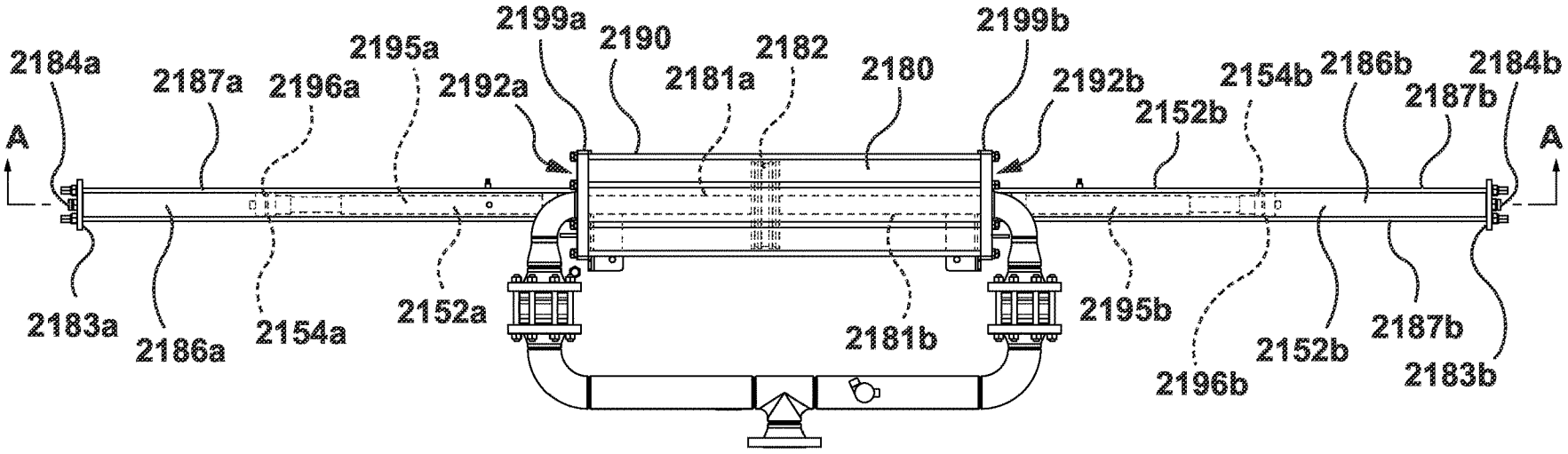
FIG. 20A is a top, partially transparent, plan view of the pump in isolation from the pump system of FIGS. 19A-C.
Figure 20B:
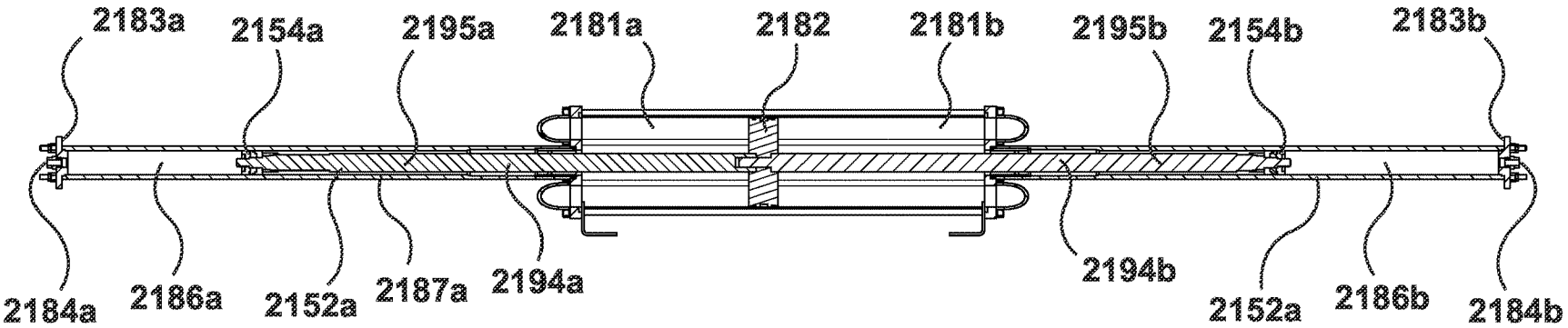
FIG. 20B is a cross sectional, rear elevation view of the pump of FIG. 20A taken as section A-A.
Figure 20C:
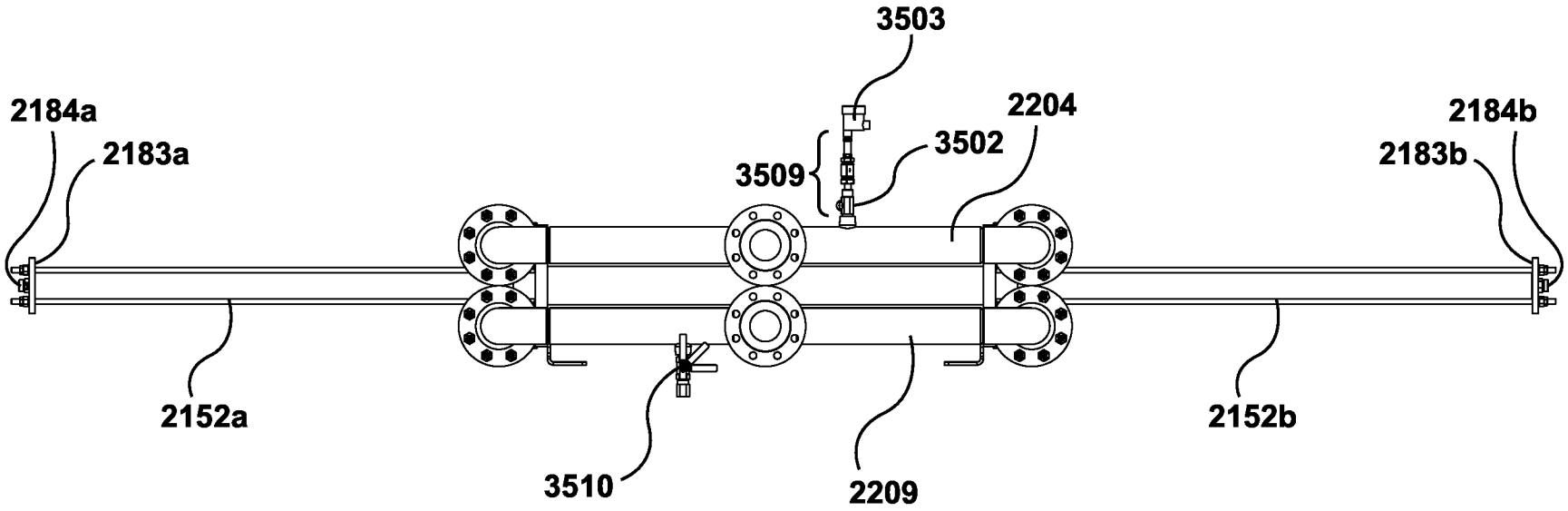
FIG. 20C is a front elevational view of the pump of FIG. 20A.
Figure 21A:
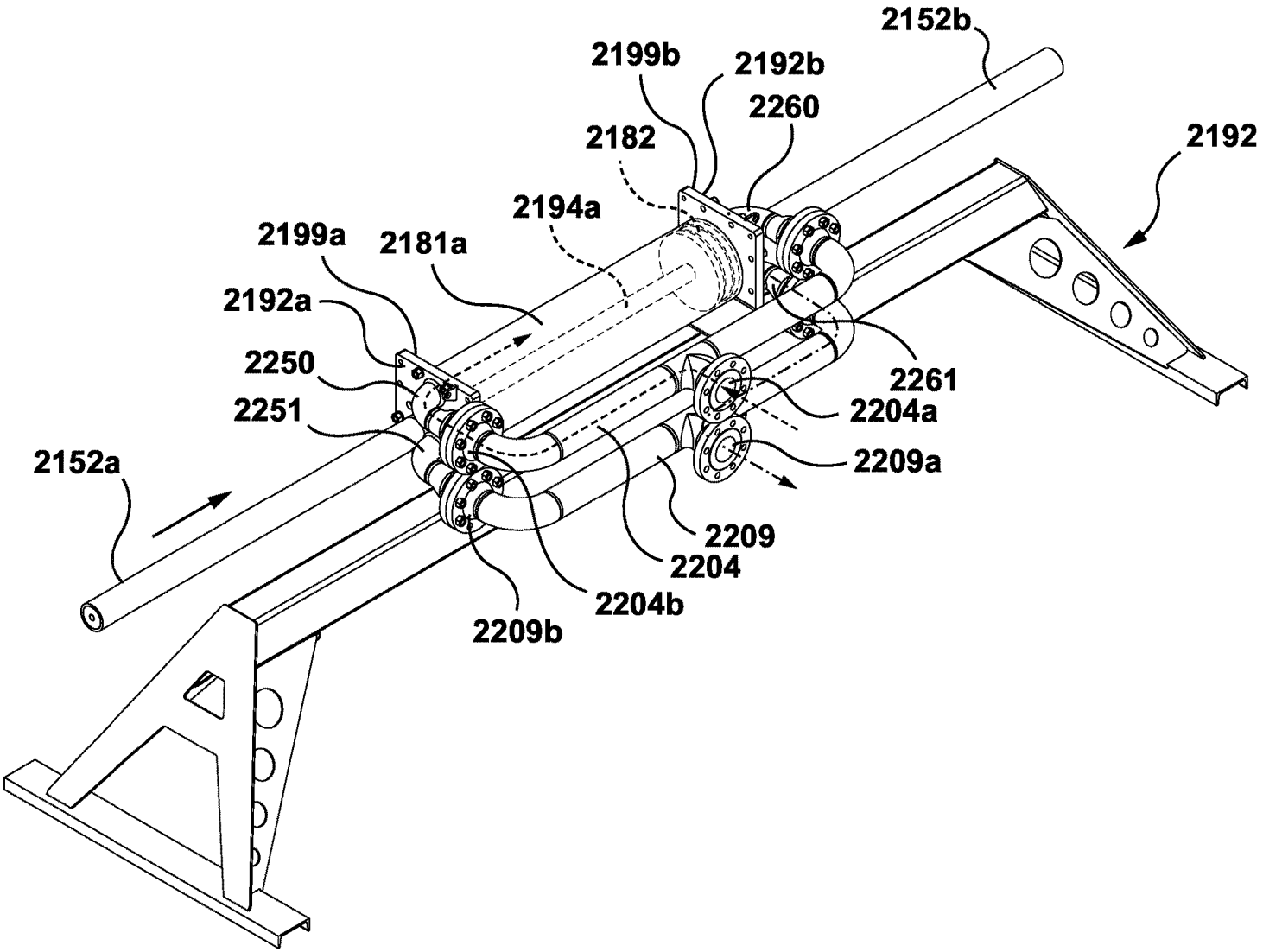
FIGS. 21A-C are front perspective, partially transparent views of part of the multi-phase pump system, showing the pump of FIG. 20A in different stages of operation.

With particular reference to FIGS. 20A, and 21A as indicated above, pump cylinder 2180 is located generally between the two hydraulic cylinders 2152*a*, 2152*b*. Pump cylinder 2180 may be divided into the two adjacent fluid pump chamber sections 2181*a*, 2181*b* by pump piston 2182. First fluid pump chamber section 2181*a* may thus be defined by the interior surface of the cylinder barrel/tubular wall 2190, a surface of pump piston 2182 and the inward facing surface of head plate 2199*a* of first cylinder head 2192*a*. The second fluid pump chamber section 2181*b* may thus be defined by the interior surface of cylinder barrel/tubular wall 2190, an opposite surface of pump piston 2182 and the inward facing surface of head plate 2199*b* of second cylinder head 2192*b* and formed on the opposite side of pump piston 2182 to first fluid pump chamber section 2181*a*.

The components forming hydraulic cylinders 2152*a*, 2152*b* and fluid pump cylinder 2180 may be made from any one or more suitable materials. By way of example, barrel 2190 of fluid pump cylinder 2180 may be formed from chrome plated steel; the barrel of hydraulic cylinders 2152*a*, 2152*b*, may be made from a suitable steel; pump piston 2182 may be made from T6061 aluminum or steel; the hydraulic pistons 2154*a*, 2154*b* may be made generally from ductile iron; and piston rod sections 2194*a*, 2194*b* may be made from induction hardened chrome plated steel.

By way of example only the outer diameter of hydraulic pistons 2154*a*, 2154*b* may range from 3.5 to 10 inches, or more, and be selected dependent upon the required output/discharge pressures and output flow rates to be produced by fluid pump 2150 and a diameter is suitable to maintain a desired pressure of hydraulic fluid in the hydraulic fluid chambers 2186*a*, 2186*b* (for example—a maximum pressure of about 2800 psi.)

The outer diameter of the pump piston 2182 and corresponding inner surface of pump cylinder barrel 2190 may for example, range from 12 to 48 inches or possibly more or less, and will vary widely depending upon the required volume to be pumped, and expected make-up of the fluid to be pumped over time (eg. the overall expected liquid/gas ratio over an extended period of time).

In one embodiment, hydraulic pistons 2154*a*, 2154*b* have an outer cross-sectional diameter of 7 inches; piston rod sections 2194*a*, 2194*b* each have an outer cross-sectional diameter of 3.5 inches and pump piston 2182 has an outer cross-section diameter of 22 inches. In some embodiments, fluid pump cylinder 2180 has a suitable length of about 50 inches to provide a stroke length of about 49.5 inches. This may correspond to a pump volume of about 741 $in^2$, capable of pumping about 159 gallons of fluid per stroke. When driven by a 280 cc hydraulic pump, with an input fluid supply pressure of 100 psi, an output discharge pressure of about 350 psi may be generated corresponding to a differential pressure of about 250 psi.

Figure 22:
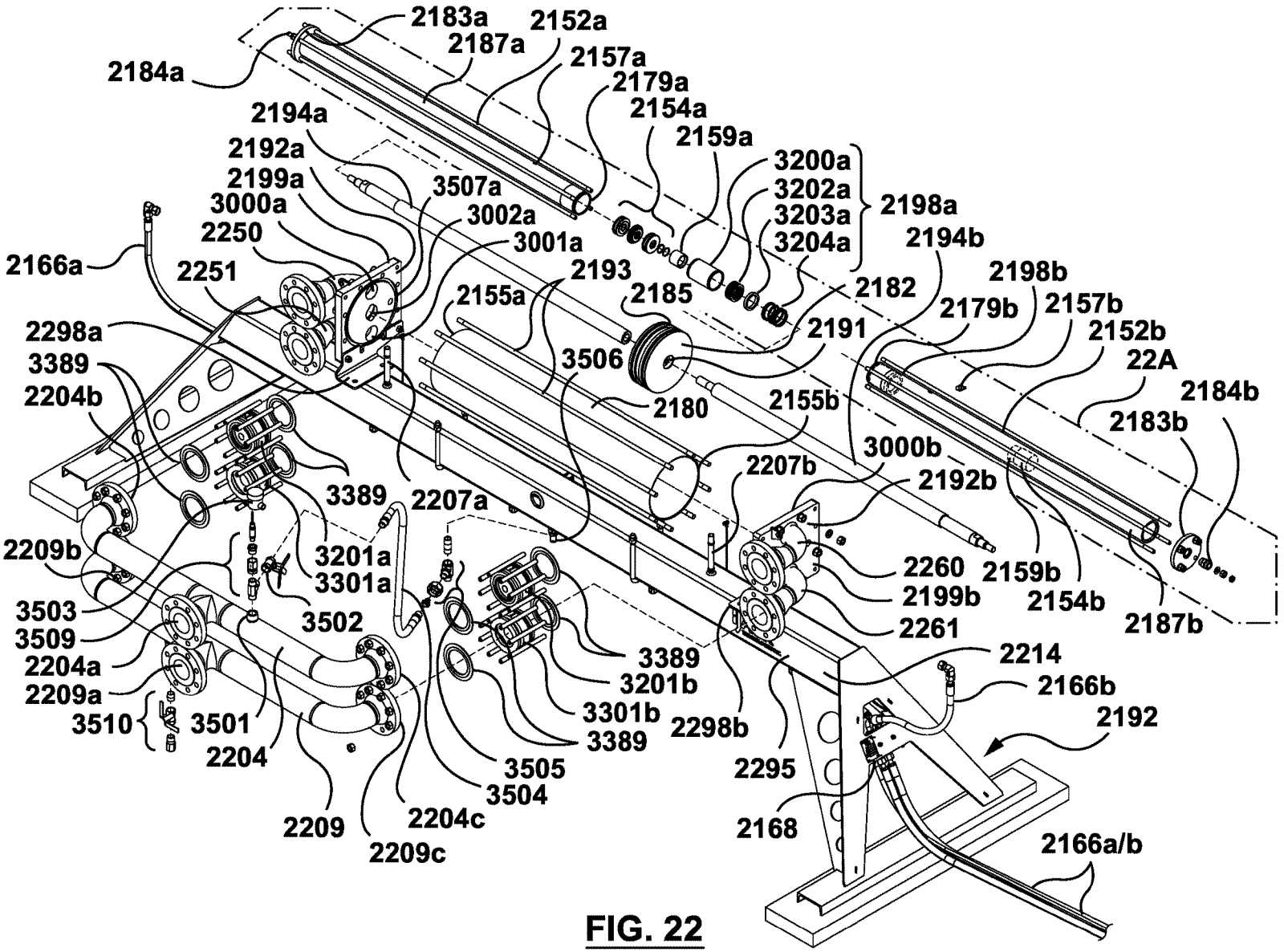
FIG. 22 is a partially exploded, front perspective view of part of the multi-phase pump system of FIG. 19A.
Figure 22A:
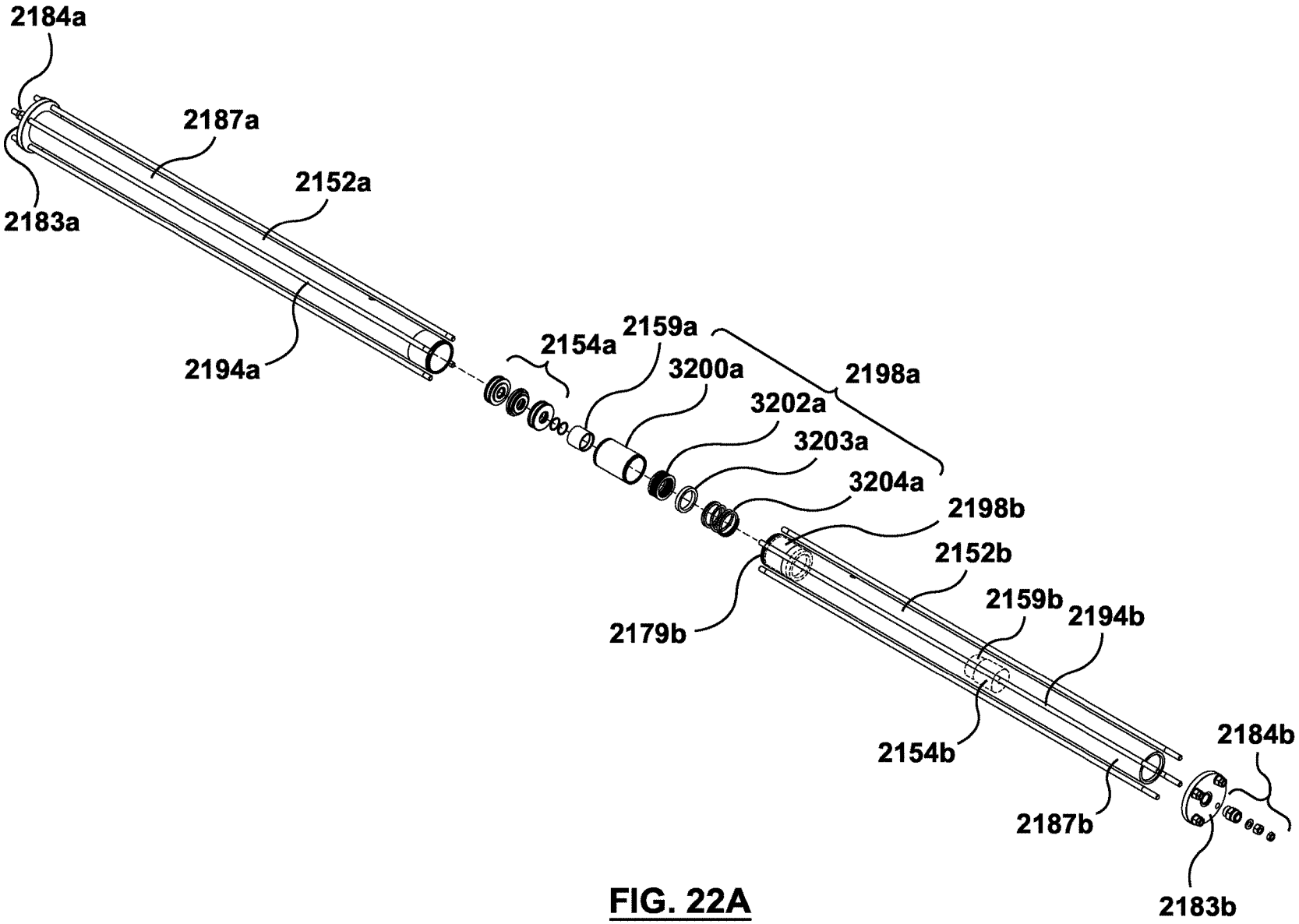
FIG. 22A is an enlarged view of area identified as "22A" in FIG. 22.
Figure 22B:
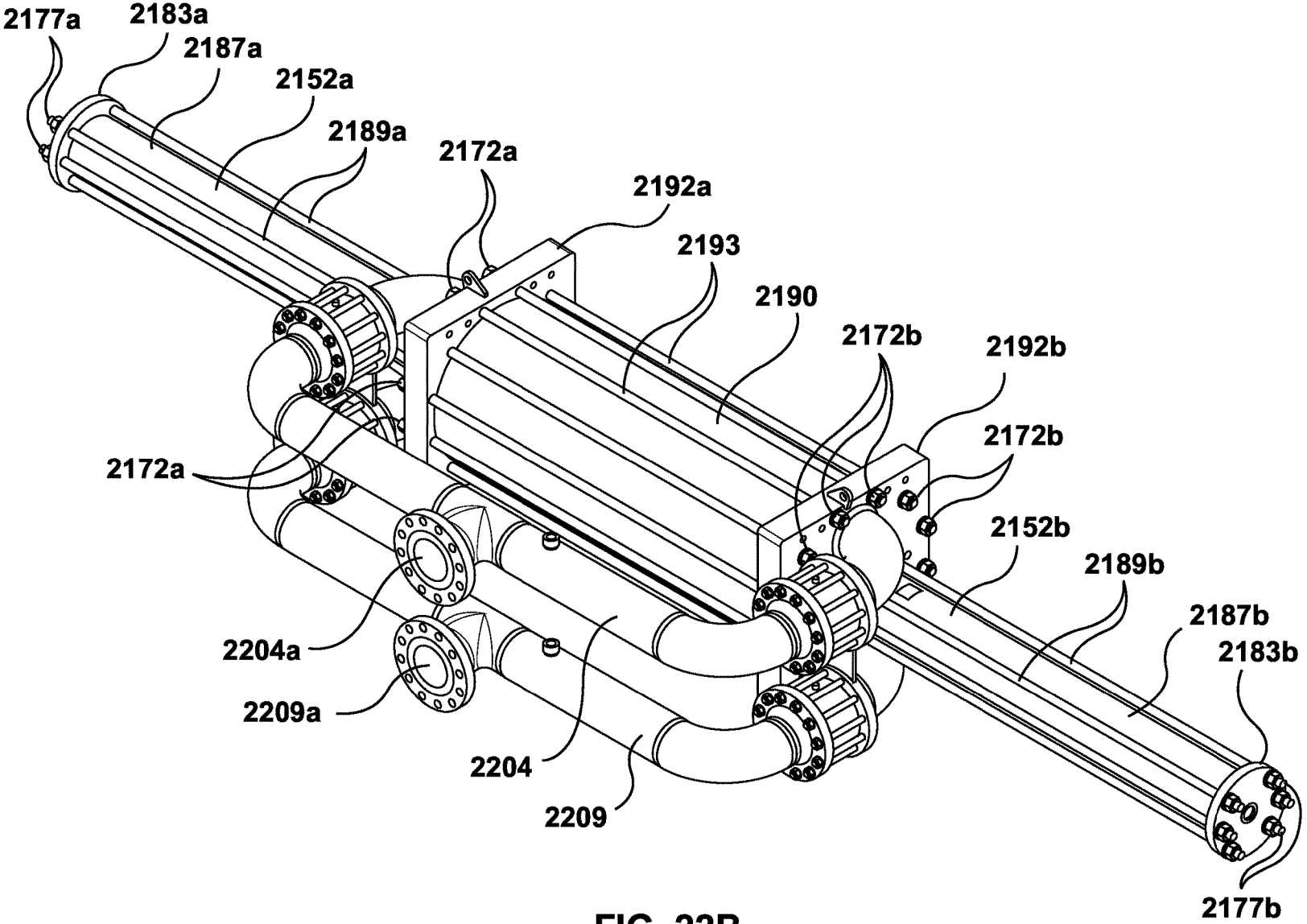
FIG. 22B is a perspective view of the pump of FIG. 20A.
Figure 22C:
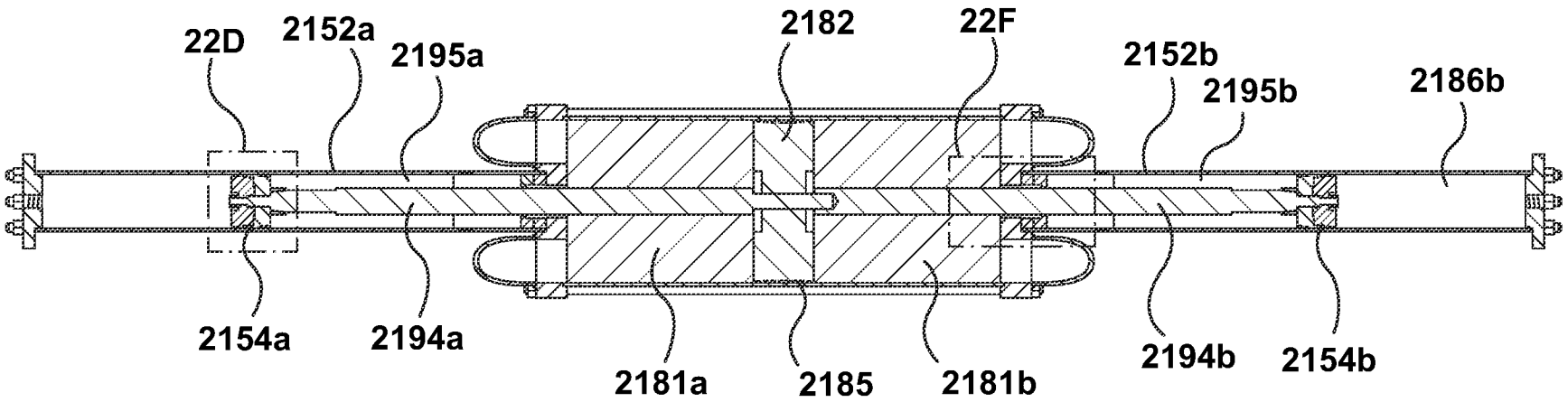
FIG. 22C is a cross-sectional, top elevation view of part of the multi-phase pump system of FIG. 22B.

Importantly, hydraulic pistons 2154*a*, 2154*b* also include seal devices 2196*a*, 2196*b* (see in particular FIGS. 22, 22D and 22E) respectively at their outer circumferential surface areas to provide suitable liquid, gas and solid material seals with the inner wall surfaces of respective hydraulic cylinder barrels 2187*a*, 2187*b* respectively. These seal devices 2196*a*, 2196*b*, substantially provide a barrier to/prevent or inhibit movement of hydraulic fluid out of hydraulic fluid chambers 2186*a*, 2186*b* into buffer chambers 2195*a*, 2195*b* respectively, during operation of fluid pump 2150 and also provide a barrier to/prevent or at least inhibit the migration of any gas, liquid and solids that may be in respective adjacent buffer chambers 2195*a*, 2195*b* (as described further hereinafter) into hydraulic fluid chambers 2186*a*, 2186*b*.

Hydraulic piston seal devices 2196*a*, 2196*b* (FIG. 20A and FIG. 22A) may include a plurality of polytetrafluoroethylene (PTFE) (e.g. Teflon™) wear rings and may also include hydrogenated nitrile butadiene rubber (HNBR) energizers/energizing rings for the seal rings.

Figure 22D:
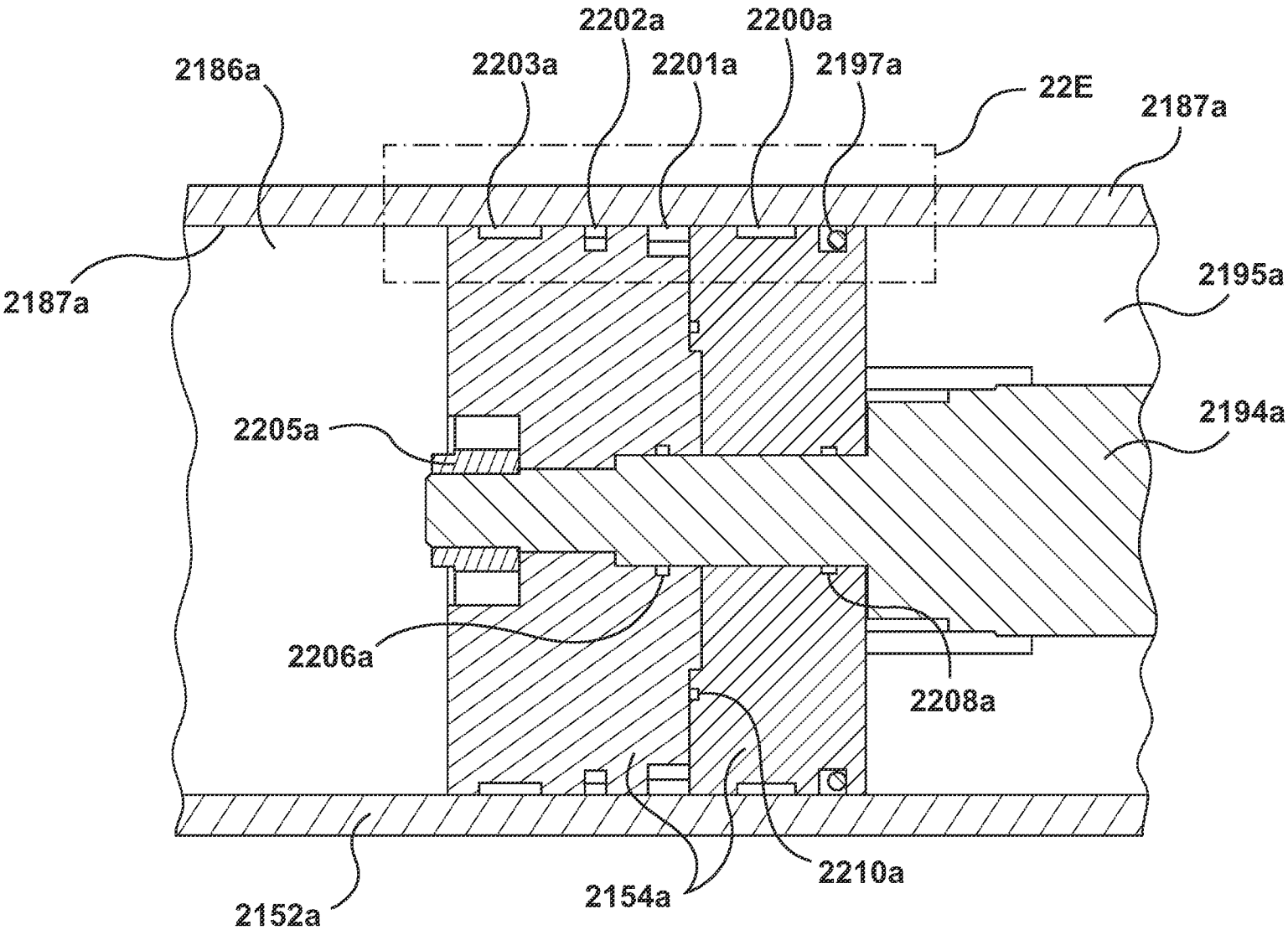
FIG. 22D is an enlarged view of area identified as "22D" in FIG. 22C.
Figure 22E:
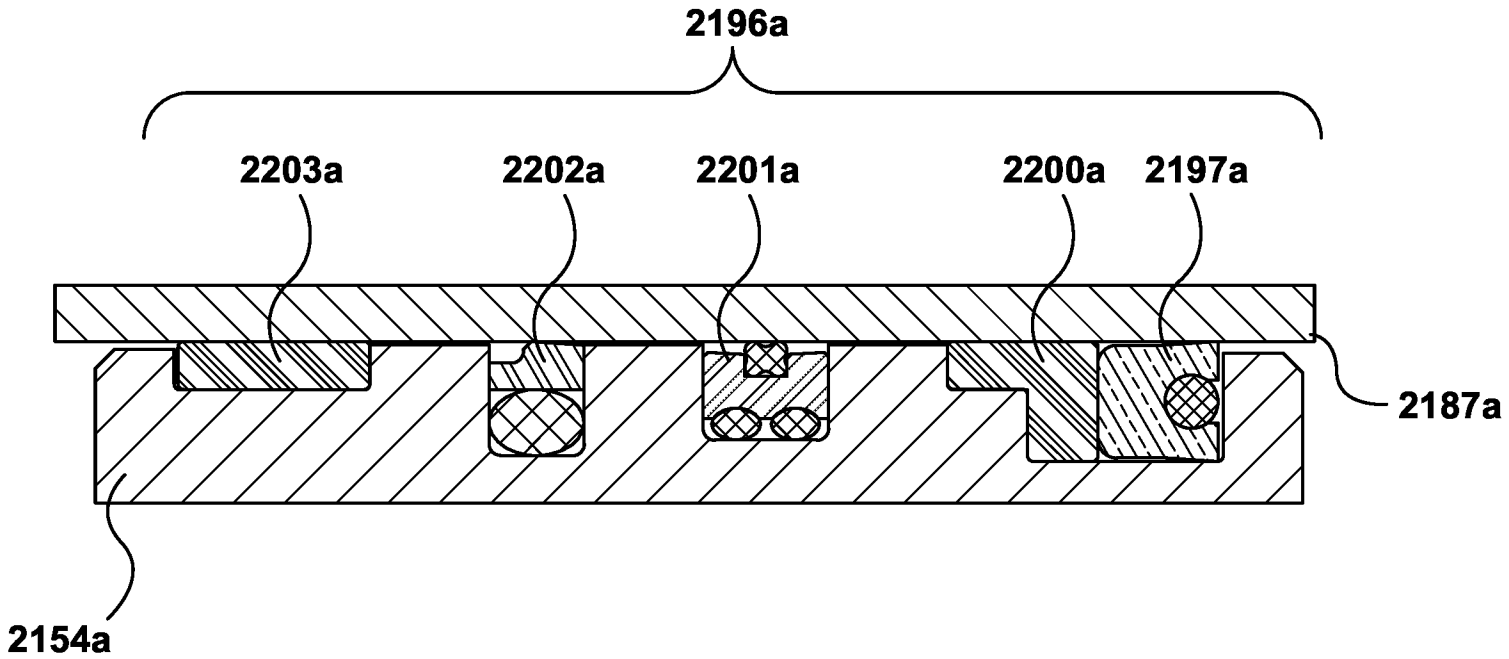
FIG. 22E is an enlarged view of area identified as "22E" in FIG. 22D.

With reference to FIG. 22D, hydraulic piston seal device 2196*a* may comprise a scraper seal device 2197*a*, a first wear ring 2200*a*, a first seal 2201*a*, a second seal 2202*a* and a second wear ring 2203*a*. First seal 2201*a* and second seal 2202*a* may be located longitudinally between first and second wear rings 2200*a* and 2203*a* Likewise, hydraulic piston seal device 2196*b* for hydraulic piston 2154*b* may comprise a scraper seal device 2197*b*, a first wear ring 2200*b*, a first seal 2201*b*, a second seal 2202*b* and a second wear ring 2203*b*. First seal 2201*b* and second seal 2202*b* may be located longitudinally between first and second wear rings 2200*b* and 2203*b*.

Scraper seal devices 2197*a*, 2197*b* which are located proximate the buffer chamber sides of hydraulic pistons 2154*a*, 2154*b* respectively, function to scrape the surfaces to remove residue from the surfaces of buffer chambers 2195*a*, 2195*b* to maintain the material within the buffer chambers 2195*a*, 2195*b*, thus preventing migration of such residue to hydraulic fluid chambers 2186*a*, 2186*b*. Scraper seal devices 2197*a*, 2197*b* may be made from a suitable material such as polyester and may include an embedded/underlying H-NBR energizer element to maintain engagement between the surface of pistons 2154*a*, 2154*b* and the cylinder wall interior surfaces of barrels 2187*a*, 2187*b*. First and second wear rings 2200*a*, 2200*b*, 2203*a*, 2203*b* may be made from a suitable material such as PTFE. First ring seals 2201*a*, 2201*b* may comprise a plurality of HNBR O-rings and x-rings with a PTFE-carbon-graphite facing material. Second ring seals 2202*a*, 2202*b* may comprise a graphite surface facing material with an underlying HNBR O-ring energiser.

Mounting nuts such as mounting nut 2205*a*, may be threadably secured to the opposite ends of each of piston rod sections 2194*a*, 2194*b* and may function to secure the respective hydraulic pistons 2154*a*, 2154*b* onto the end of piston rod sections 2194*a*, 2194*b* (see FIG. 22D).

With reference to FIG. 22D, O-rings 2206*a* and 2208*a* may be provided to provide a seal between piston rod section 2194*a* and hydraulic piston 2154*a*. O-ring 2210*a* may also be located within hydraulic piston 2154*a*. Similarly, O-rings 2206*b* and 2208*b* may be provided to provide a seal between piston rod section 2194*b* and hydraulic piston 2154*b*. O-ring 2210*b* may also be located within hydraulic piston 2154*b*.

O-rings 2206*a*, 2208*a*, 2210*a*, 2206*b*, 2208*b*, 2210*b*, in combination with seal devices 2196*a*, 2196*b*, function to substantially prevent or inhibit movement of hydraulic fluid out of hydraulic fluid chambers 2186*a*, 2186*b* into buffer chambers 2195*a*, 2195*b* respectively, during operation of fluid pump 2150 and also prevent or at least inhibit the migration of any gas, liquid and solids that may be in respective adjacent buffer chambers 2195*a*, 2195*b* into hydraulic fluid chambers 2186*a*, 2186*b*.

Pump piston 2182 may also include piston seal devices 2185 (FIGS. 22 and 22C) that may comprise grooves and sealing rings retained therein, at its outer circumferential surfaces to provide a seal with the inner wall surface of pump cylinder barrel 2190 to substantially prevent or inhibit movement of fluid such as various mixtures/ratios of natural gas, oil, water, and possibly additional components associated with the natural gas and oil, between fluid pump chamber sections 2181*a*, 2181*b*. Piston seal devices 2185 may also assist in maintaining pressure differences between the adjacent fluid pump chamber sections 2181*a*, 2181*b*, during operation of fluid pump 2150.

Figure 22F:
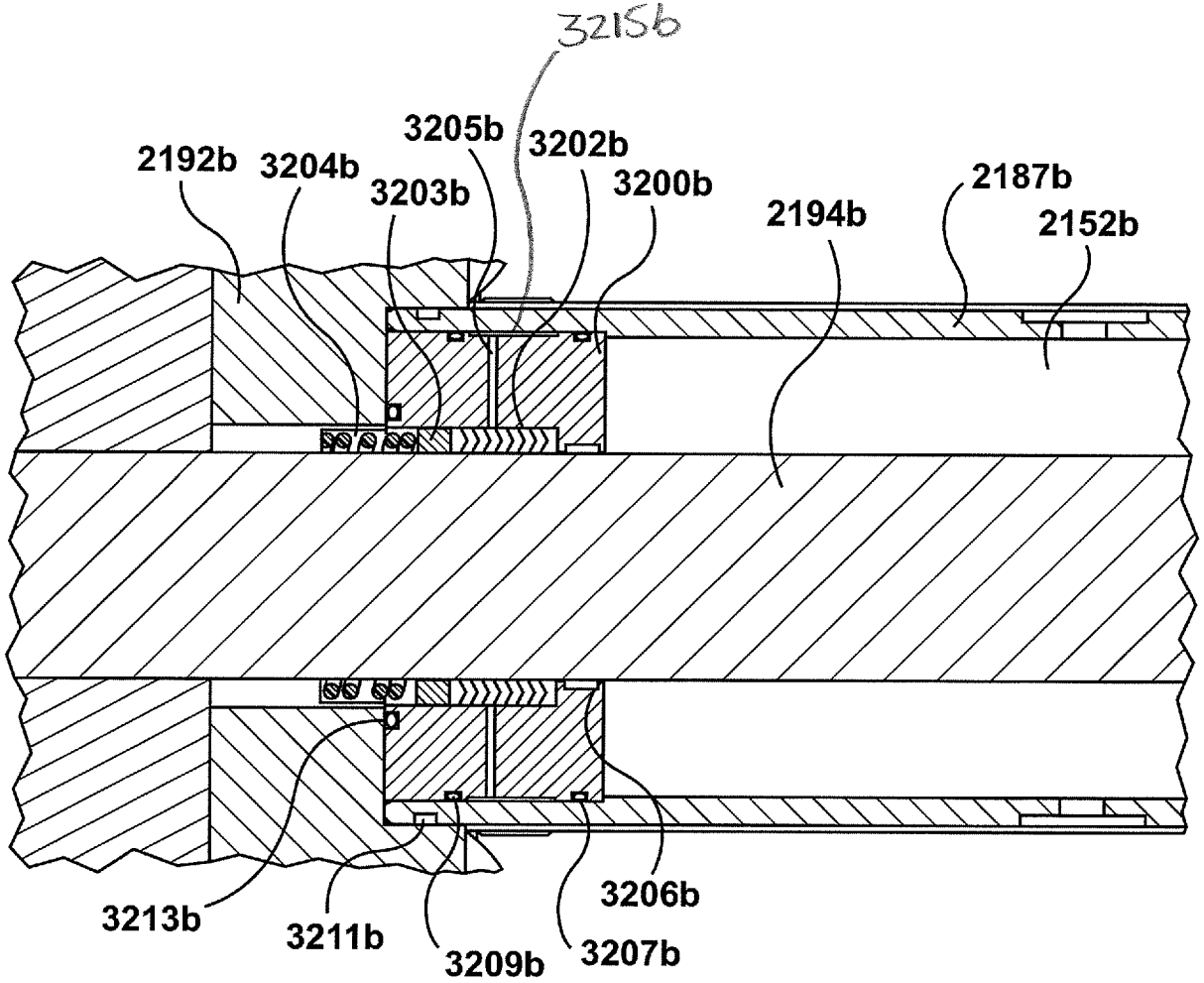
FIG. 22F is an enlarged view of area identified as "22F" in FIG. 220.
Figure 22G:
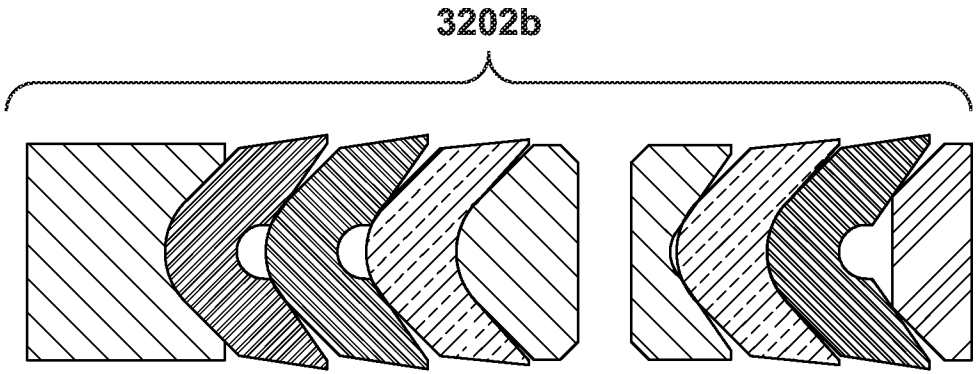
FIG. 22G is a cross sectional view of part of the pump of FIG. 22F.
Figure 22H:
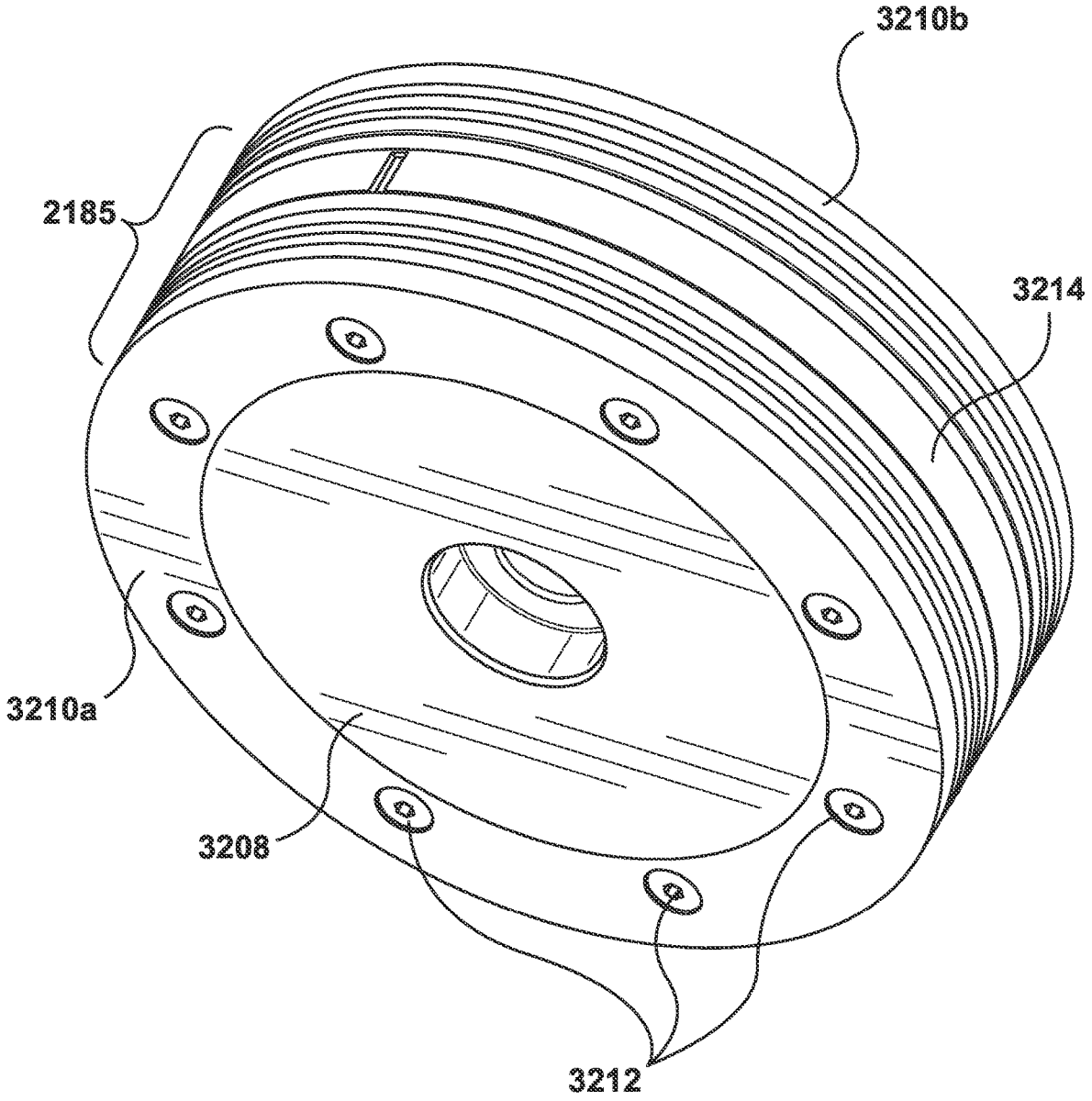
FIG. 22H is a perspective view of a part of the multi-phase pump system of FIG. 22C.

An embodiment of pump piston 2182 is shown in FIG. 22H. Piston seal devices 2185, which will be described in more detail below, may be located on the outer curved surface of a piston hub 3208 and may be retained by rings 3210*a*, 3210*b*, which may in turn be held in position by a retaining method such as bolts 3212 which are received in threaded openings in an outward facing surface of piston hub 3208. Piston hub 3208 may be made of any suitable material, such as aluminium. Steel rings 3210*a*, 3210*b* may be made of any suitable material, such as steel.

Figure 22I:
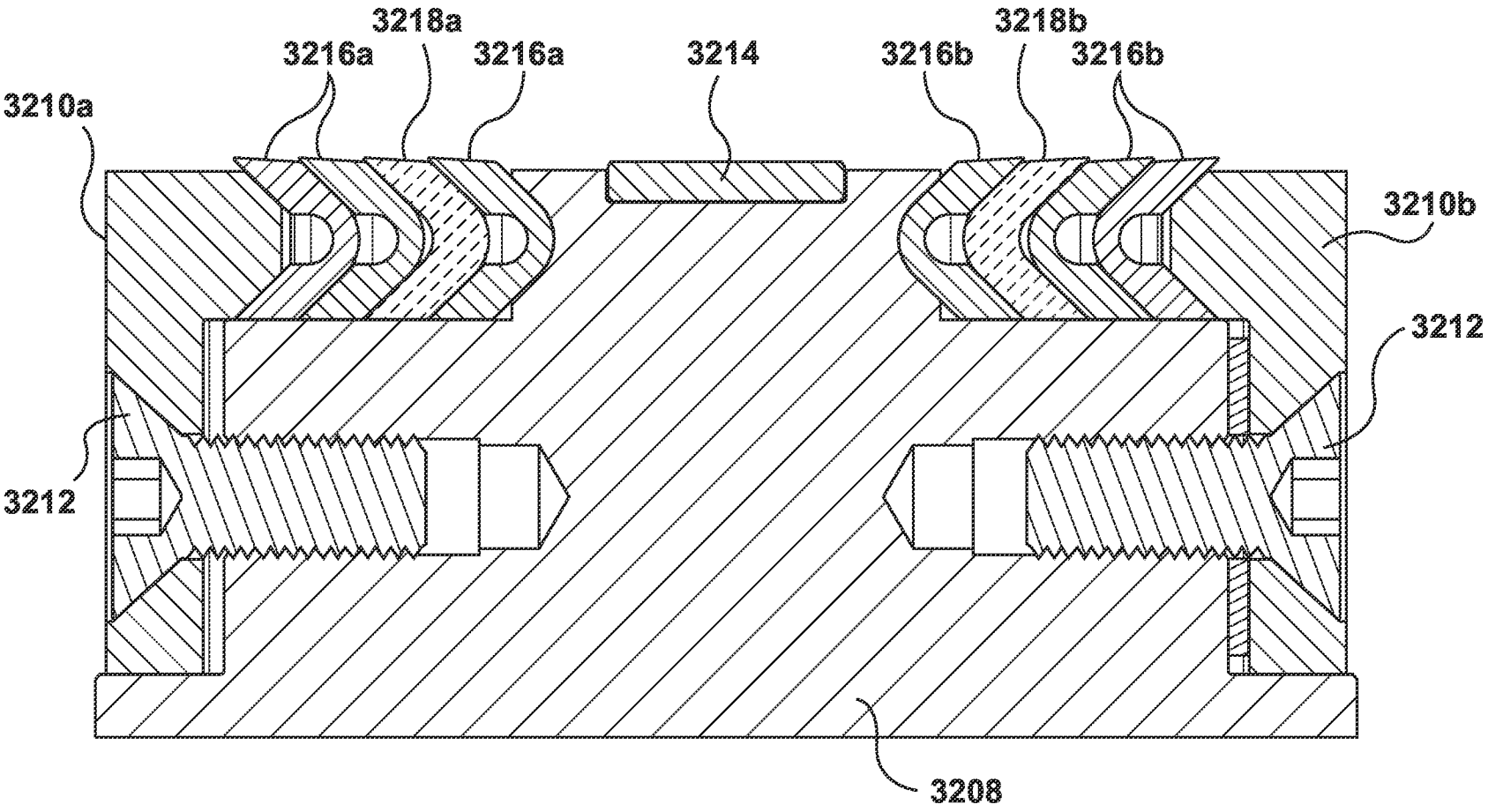
FIG. 22I is a correctional view of the part shown in FIG. 22H.

Turning to FIG. 22I, piston seal devices 2185 are shown in greater detail. A Teflon/bronze composite wear ring 3214 may be retained in a circumferential groove in piston hub 3208. On an outer circumferential edge section of piston hub 3208, held in place by steel ring 3210*a*, may be a plurality of fabric/rubber composite seals 3216*a* and rubber/brass scraper seal 3218*a*. Similarly, located on the opposite circumferential edge section of piston hub 3208 there may be, held in place by steel ring 3210*b*, a plurality of fabric/rubber composite seals 3216*b* and rubber/brass scraper seal 3218*b*.

Bolts 3212 may be adjusted to increase or decrease the compressive force applied to seals 3216*a*, 3216*b*, 3218*a*, 3218*b* by steel rings 3210*a*, 3210*b*. This may ensure a good seal with the inner wall surface of pump cylinder barrel 2190 to substantially prevent or inhibit movement of fluid such as mixtures of natural gas, oil and any additional components associated with the natural gas and oil, between fluid pump chamber sections 2181*a*, 2181*b*.

Figure 22J:
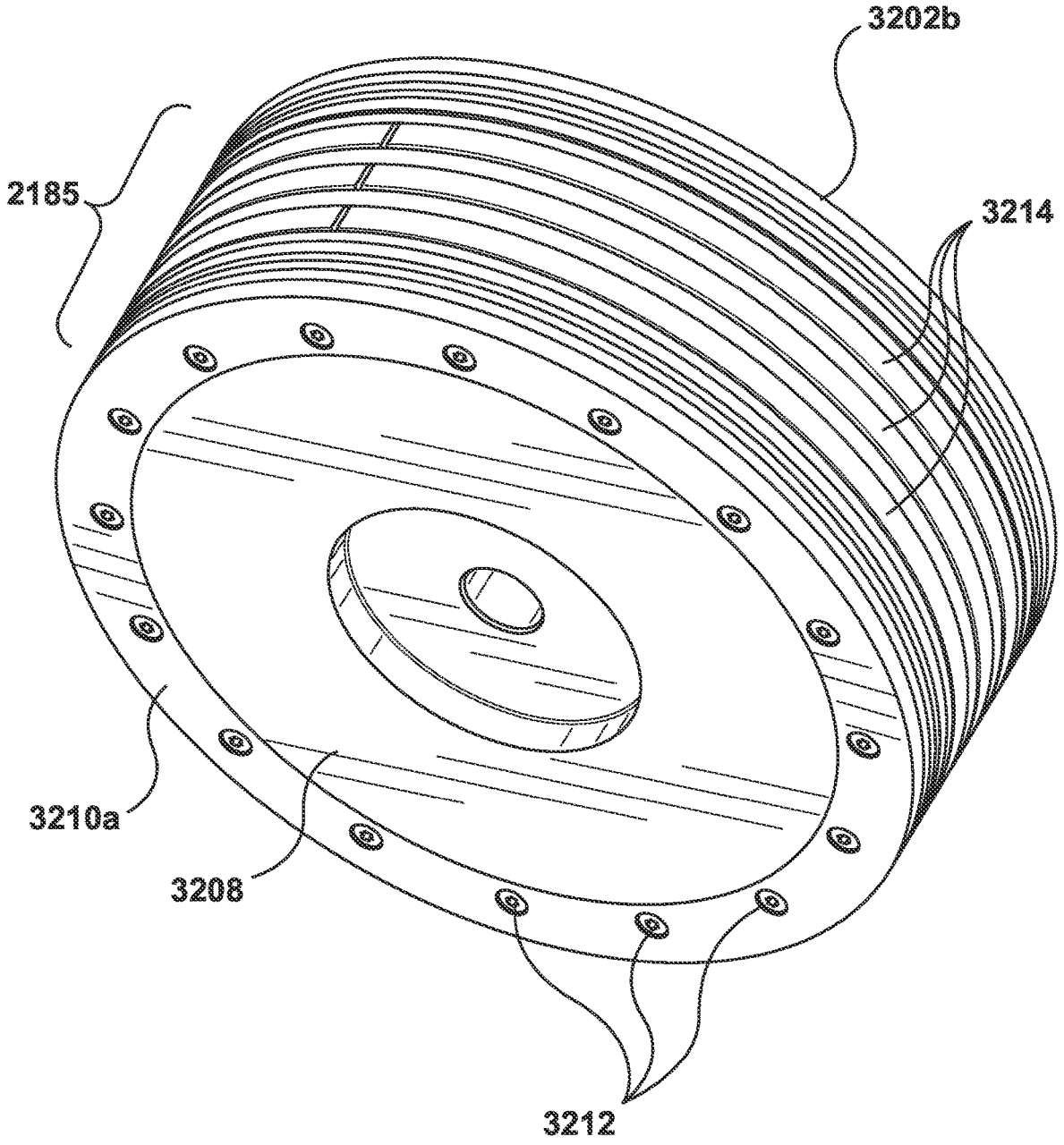
FIG. 22J is a perspective view of a part of the multi-phase pump system of FIG. 22C.
Figure 22K:
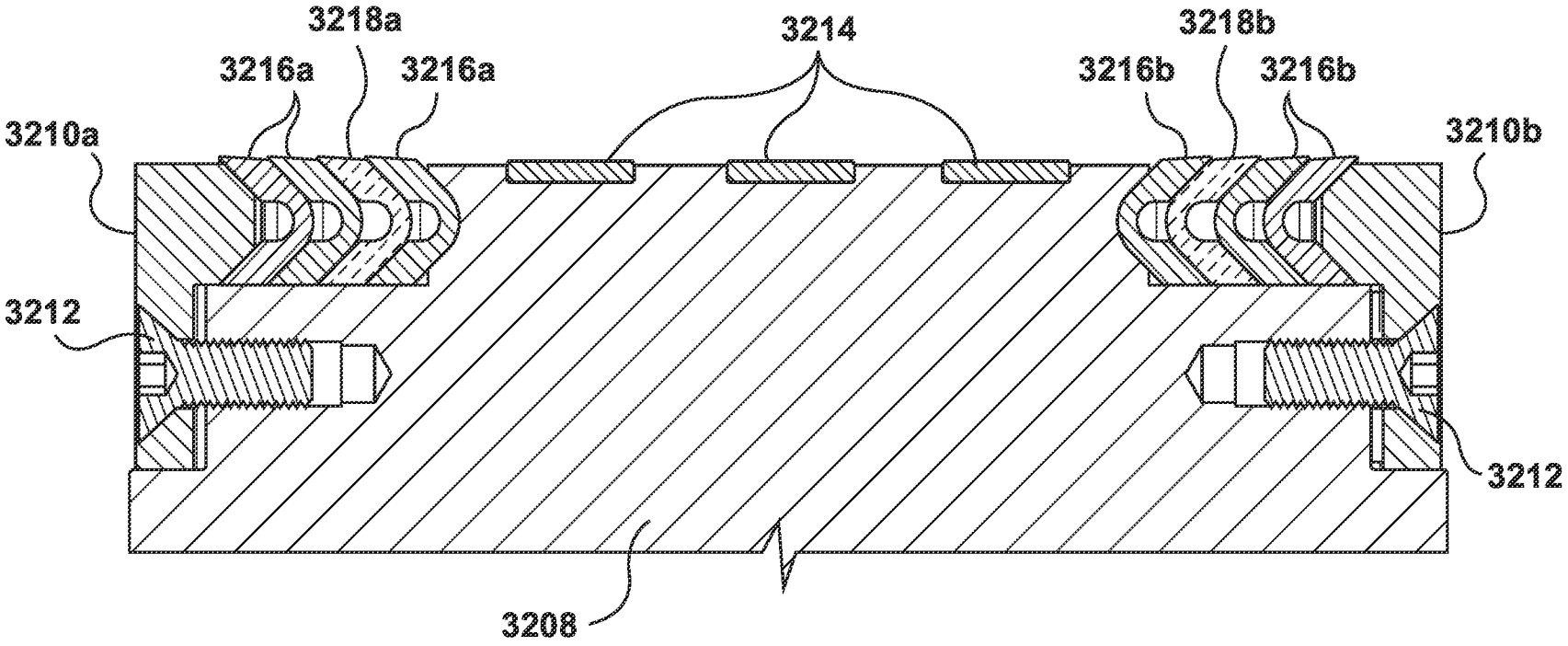
FIG. 22K is a correctional view of the part shown in FIG. 22J.

The embodiment represented in FIGS. 22H and 22I depict a pump piston 2182 with an outside diameter of 12 inches. In another embodiment pump piston 2182 may have a diameter of 22 inches (FIGS. 22J and 22K). Whilst the location of components for piston seal devices 2185 are substantially the same in this embodiment, additional Teflon/bronze composite wear rings 3214 may be retained in corresponding circumferential grooves in piston hub 3208, sandwiched between outer seals 3216*a*, 3218*a*, on one longitudinal side of piston hub 3208, and outer seals 3216*b*, 3218*b* on the opposite longitudinal side of piston hub 3208.

As noted above, hydraulic pistons 2154*a*, 2154*b* may be formed at or proximate opposed outer ends of respective piston rod sections 2194*a*, 2194*b*. Piston rod sections 2194*a*, 2194*b* may pass through respective fluid pump chamber sections 2181*a*, 2181*b* and pass through a sealed central axial opening 2191 through pump piston 2182 and be configured and adapted so that pump piston 2182 is fixedly and sealably mounted to or at inward ends of piston rod sections 2194*a*, 2194*b*.

Piston rod sections 2194*a*, 2194*b* may also pass through sealed, axially oriented central openings 3002*a*, 3002*b* in respective head plates 2199*a*, 2199*b*, of first cylinder head 2192*a* and second cylinder head 2192*b*, located at opposite ends of pump cylinder barrel 2190. Thus, reciprocating axial/longitudinal movement of interconnected piston rod sections 2194*a*, 2194*b* will result in reciprocating synchronous axial/longitudinal movement of each of hydraulic pistons 2154*a*, 2154*b* in respective hydraulic fluid chambers 2186*a*, 2186*b*, and of fluid piston 2182 within fluid pump chamber sections 2181*a*, 2181*b* of fluid pump cylinder 2180.

Located on the inward side of hydraulic piston 2154*a*, within hydraulic cylinder 2152*a*, between hydraulic fluid chamber 2186*a* and fluid pump chamber section 2181*a*, may be located first buffer chamber 2195*a*. Buffer chamber 2195*a* may be defined by an inner surface of hydraulic piston 2154*a*, the cylindrical inner wall surface of hydraulic cylinder barrel 2187*a*, and the outward facing surface of cylinder head plate 2199*a*.

Similarly, located on the inward side of hydraulic piston 2154*b*, within hydraulic cylinder 2152*b*, between hydraulic fluid chamber 2186*b* and fluid pump chamber section 2181*b*, may be located second buffer chamber 2195*b*. Buffer chamber 2195*b* may be defined by an inner surface of hydraulic piston 2154*b*, the cylindrical inner wall surface of cylinder barrel 2187*b*, and the outward facing surface of cylinder head plate 2199*b*.

As hydraulic pistons 2154*a*, 2154*b* are mounted at opposite ends of piston rod sections 2194*a*, 2194*b*, piston rod sections 2194*a*, 2194*b* also pass through respective buffer chambers 2195*a*, 2195*b*.

Figure 21B:
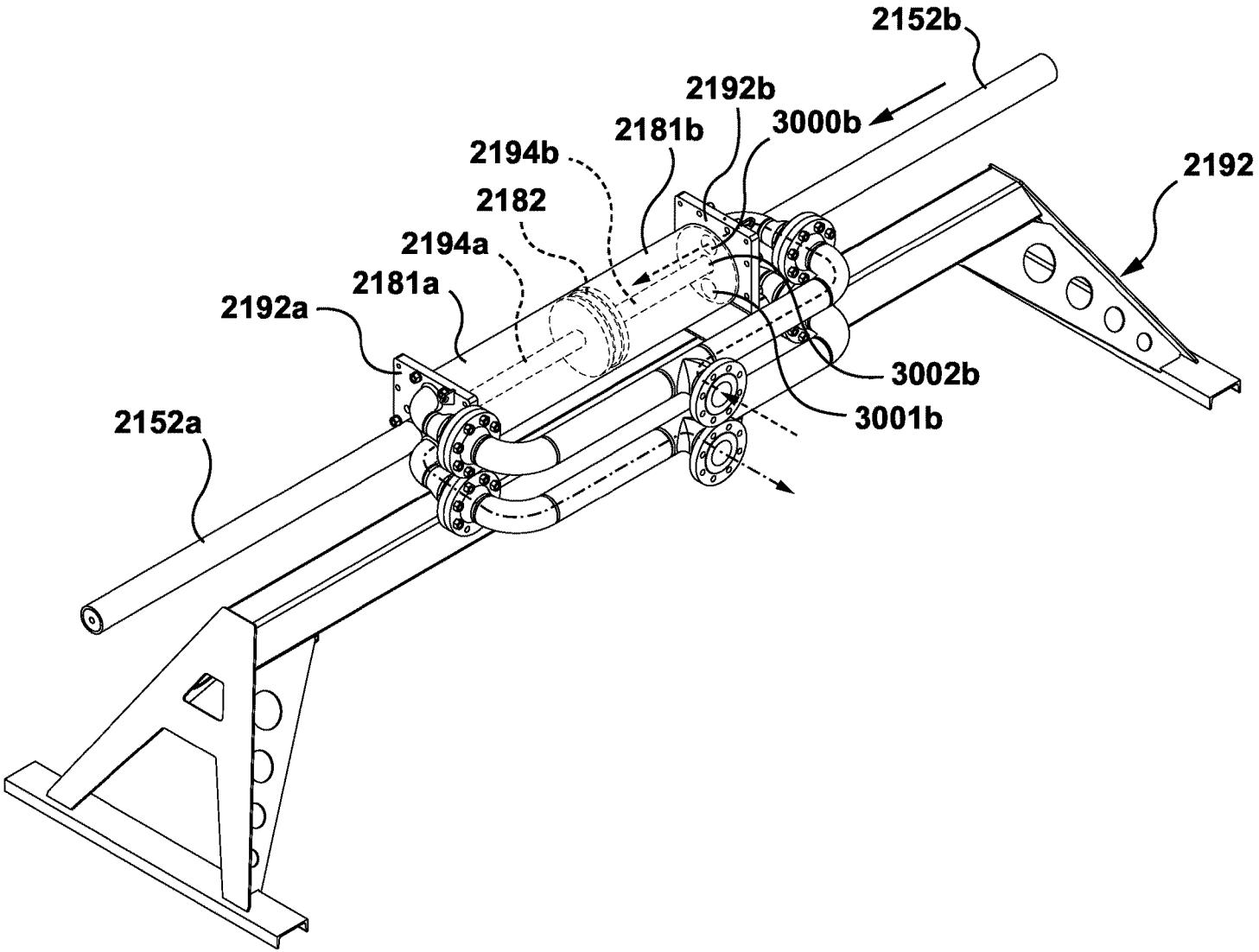

Again with reference to FIGS. 20A-C, FIGS. 21A-C and FIGS. 22, 22A, first cylinder head 2192*a* may have a generally square or rectangular hydraulic cylinder head plate 2199*a* with an upper circular input opening 3000*a*, a lower circular discharge opening 3001*a* and a centrally located piston rod opening 3002*a* (See FIG. 22). Similarly, second cylinder head 2192*b* may have a generally square or rectangular hydraulic cylinder head plate 2199*b*, with an upper circular input opening 3000*b*, as well as a corresponding lower circular discharge opening 3001*b* and a centrally located piston rod opening 3002*b* (FIG. 21B).

A plurality of longitudinally extending tie rods 2189*a* may be positioned circumferentially around the outer surface of hydraulic cylinder barrel 2187*a* (FIGS. 22A, 22B). The first ends of tie rods 2189*a* and the inward end 2179*a* of hydraulic cylinder barrel 2187*a* may be interconnected (such as by welding or having threaded ends received in mating corresponding openings in plate 2199*a*) to the outward facing edge surface of plate 2199*a* of first cylinder head 2192*a* (FIGS. 22 and 22B). Second ends of tie rods 2189*a* may be interconnected to the inward face of hydraulic cylinder base 2183*a* by passing through openings in hydraulic cylinder base 2183*a* and securing them with nuts 2177*a* (FIG. 22B).

Likewise, a plurality of longitudinally extending tie rods 2189*b* may be positioned circumferentially around the outer surface of hydraulic cylinder barrel 2187*b*. The first ends of tie rods 2189*b* and the inward end 2179*b* of hydraulic cylinder barrel 2187*b* may be interconnected (such as by welding or having threaded ends received in mating corresponding openings in plate 2199*b*) to the outward facing edge surface of plate 2199*b* of second cylinder head 2192*b* (FIGS. 22 and 22B). Second ends of tie rods 2189*b* may be interconnected to the inward face of hydraulic cylinder base 2183*b* by passing through openings in hydraulic cylinder base 2183*b* and securing them with nuts 2177*b* (FIG. 22B).

Thus, a gas, liquid and contaminant seal may be provided at the connection of the hydraulic cylinder barrels 2187*a*, 2187*b* and the respective cylinder heads 2192*a*, 2192*b* to prevent leakage from inside the respective chambers, there between. Also, a seal is provided between hydraulic cylinder base 2183*a* and the end wall of hydraulic cylinder barrel 2187*a* to seal the interior of hydraulic fluid chamber 2186*a*. Similarly, a seal is provided between hydraulic cylinder base 2183*b* and the end wall of hydraulic cylinder barrel 2187*b* to seal the interior of hydraulic fluid chamber 2186*b*.

Pump cylinder barrel 2190 may have end 2155*a* interconnected to the inward facing surface cylinder head plate 2199*a* of cylinder head 2192*a*, such as by passing first threaded ends of each of the plurality of tie rods 2193 through openings in head plate 2199*a* of first cylinder head 2192*a* and securing them with nuts 2172*a* (FIG. 22B). Likewise, second threaded ends of tie rods 2193 may be interconnected to the inward facing surface cylinder head plate 2199*b* of cylinder head 2192*b* such as by passing second threaded ends of tie rods 2193 through openings in head plate 2199*b* of first cylinder head 2192*b* and securing them with nuts 2172*b*.

A structure and functionality corresponding to the structure and functionality just described in relation to hydraulic cylinder 2152*a*, buffer chamber 2195*a*, and fluid pump chamber section 2181*a*, may be provided on the opposite side of pump cylinder barrel 2190/fluid piston 2182, in relation to hydraulic cylinder 2152*b*, buffer chamber 2195*b*, and fluid pump chamber section 2181*b*.

Two head sealing O-rings (not shown) may be provided and which may be made from highly saturated nitrile-butadiene rubber (HNBR). One O-ring may be located between a first circular edge groove at end 2155*a* of pump cylinder barrel 2190 and the inward facing surface of head plate 2199*a* of first cylinder head 2192*a*. This O-ring may be retained in a groove in the inward facing surface of the head plate 2199*a*. Similarly, an oppositely positioned O-ring may be located between a second opposite circular edge groove of at the opposite end 2155*b* of pump cylinder barrel 2190 and the inward facing surface of the head plate 2199*b* of second cylinder head 2192*b*. This O-ring may be retained in a groove in the inward facing surface of the head plate 2199*b*. In this way liquid, gas solid seals are provided between fluid pump chamber sections 2181*a*, 2181*b* and their respective head plates 2199*a*, 2199*b* of first and second cylinder heads 2192*a*, 2192*b*.

By securing both threaded opposite ends of each of the plurality of tie rods 2193 (FIGS. 22, 22B) through openings in the head plates 2199*a*, 2199*b* of first and second cylinder heads 2192*a*, 2192*b* and securing them with nuts 2172*a*, 2172*b*, tie rods 2193 will function to tie together the head plates 2199*a*, 2199*b* of first and second cylinder heads 2192*a*, 2192*b* with pump barrel 2190 and the O-rings are securely held there between and providing a sealed connection between cylinder barrel 2190 and head plates 2199*a*, 2199*b* of first and second cylinder heads 2192*a*, 2192*b*.

A particularly challenging area to seal in multi-phase pump is the seal between buffer chamber 2195*a* and fluid pump chamber section 2181*a* on one side, and between buffer chamber 2195*b* and fluid pump chamber section 2181*b*, around the piston rod sections 2194*a*, 2194*b*, having regard to the variations in gas, liquid, or a mixture of gas and liquid, as referenced above, moving into and out of fluid pump chamber sections 2181*a*, 2181*b* during operation.

Seal/wear devices 2198*a*, 2198*b* (FIG. 22), may be provided to provide a seal around piston rod sections 2194*a*, 2194*b* and the central openings 3002*a*, 3002*b* of first and second cylinder heads 2192*a*, 2192*b* to prevent or limit the movement of fluid that may comprise variations in gas, liquid, or a mixture of gas and liquid, as referenced above, out of fluid pump chamber sections 2181*a*, 2181*b* into respective buffer chambers 2195*a*, 2195*b*. These seal devices 2198*a*, 2198*b* may also provide a barrier to/prevent or at least limit/inhibit the movement of other components (such as contaminants, solid materials) that have been transported with fluid from well shaft 2108 into fluid pump chamber sections 2181*a*, 2181*b*, from migrating into respective buffer chambers 2195*a*, 2195*b*.

Seal devices 2198*a*, 2198*b* may be formed in a substantially identical manner and be generally mounted within respective central openings 3002*a*, 3002*b* of first and second cylinder heads 2192*a*, 2192*b* and within the portion of hydraulic cylinder barrels 2187*b* received within first and second cylinder heads 2192*a*, 2192*b*, for example in a manner as shown in FIG. 22F.

Seal device 2198*a* may comprise a pump sealing gland 3200*a*, a pump rod seal 3202*a*, a pump gland follower 3203*a*, a pump rod seal spring 3204*a* and an O-ring 3206*a* (FIG. 22). Similarly, seal device 2198*b* may comprise a corresponding pump sealing gland 3200*b*, pump rod seal 3202*b*, a pump gland follower 3203*b*, a pump rod seal spring 3204*b* and an O-ring 3206*b* (FIGS. 22 and 22F).

Pump sealing glands 3200*a*, 3200*b* may be made from a suitable material such as mild or stainless steel.

As shown in greater detail in FIG. 22F, by way of example in sealing device 2198*b*, the pump rod seal spring 3204*b*, exerts a force upon pump gland follower 3203*b*, which in turn applies pressure to pump rod seal 3202*b*, sealing piston rod sections 2194*b* within central opening 3002*b* and the interior surface of hydraulic cylinder barrel 2187*b* Pump sealing gland 3200*b* may have a channel 3205*b* formed therein, which may hold a suitable grease material that can over time flow from the channel in order to lubricate pump rod seal 3202*b*. Channel 3205*b* in pump sealing gland 3200*b* may be in communication with a space that provides a grease reservoir 3215*b*, which may hold a reservoir of grease to supply pump rod seal 3202*b*. A hole (not shown) may be drilled in hydraulic cylinder barrel 2187*b* to which a grease nipple (not shown) may be attached to the exterior to allow the grease reservoir 3215*b* to be replenished. With reference to FIG. 22G, pump rod seal 3202*b*, may comprise a plurality of v-rings and lantern rings. Pump rod seal 3202*b* components may be made from a combination of materials such as for example, rubber, fabric, brass or a combination thereof.

While in some embodiments, the fluid pressure in fluid pump chamber sections 2181*a*, 2181*b* will remain generally, if not always, above the pressure in the adjacent respective buffer chambers 2195*a*, 2195*b*, the seal/wear devices 2198*a*, 2198*b* may in some situations prevent migration of gas and/or liquid and or contaminants that may be in buffer chambers 2195*a*, 2195*b* from migrating into respective fluid pump chamber sections 2181*a*, 2181*b*. The seal/wear devices 2198*a*, 2198*b* may also assist to guide piston rod sections 2194*a*, 2194*b* and keep piston rod sections 2194*a*, 2194*b* centred in the fluid pump chamber sections 2181*a*, 2181*b* and absorb transverse forces exerted upon piston rod sections 2194*a*, 2194*b*.

With reference to FIG. 22F, additional O-rings may be provided to provide a seal around gland 3200*a*. O-rings 3207*b* and 3209*b* may be located between gland 3200*b* and cylinder barrel 2187*b*. O-ring 3213*b* may provide a seal between gland 3200*b* and second cylinder head 2192*b*. O-ring 3211*b* may provide a seal between cylinder barrel 2187*b* and second cylinder head 2192*b*.

Similarly, O-rings 3207*a* and 3209*a* may be located between gland 3200*a* and cylinder barrel 2187*a* in order to provide a seal between these components. O-ring 3213*a* may provide a seal between gland 3200*a* and first cylinder head 2192*a*. O-ring 3211*a* may provide a seal between cylinder barrel 2187*a* and first cylinder head 2192*a*.

However, even with an effective seal provided by the sealing devices 2198*a*, 2198*b*, it is possible that small amounts of fluid such as oil, natural gas, and/or other components such as hydrogen sulphide, water, may still at least in some circumstances be able to travel past the sealing devices 2198*a*, 2198*b* into respective buffer chambers 2195*a*, 2195*b*. For example, oil may be adhered to the surface of piston rod sections 2194*a*, 2194*b* and during reciprocating movement of piston rod sections 2194*a*, 2194*b*, it may carry such other components from the fluid pump chamber sections 2181*a*, 2181*b* past respective sealing devices 2198*a*, 2198*b*, into an area of respective cylinder barrels 2187*a*, 2187*b* that provide respective buffer chambers 2195*a*, 2195*b*. High temperatures that can occur within fluid pump chamber sections 2181*a*, 2181*b* may increase the risk of contaminants being able to pass seal devices 2198*a*, 2198*b*. However buffer chambers 2195*a*, 2195*b* each provide an area that may tend to hold any contaminants that move from respective fluid pump chamber sections 2181*a*, 2181*b* and prevent or inhibit the movement of such contaminants into the areas of cylinder barrels that contain hydraulic fluid, hydraulic fluid chambers 2186*a*, 2186*b*.

Mounted on and extending within hydraulic cylinder barrel 2187*a* close to first cylinder head 2192*a*, is a proximity sensor 2157*a*. Proximity sensor 2157*a* is operable such that during operation of pump 2150, as hydraulic piston 2154*a* is moving from left to right, just before piston 2154*a* reaches the end of its stroke, proximity sensor 2157*a* will detect the presence of a sensor end flag 2159*a* mounted on hydraulic piston 2154*a* within hydraulic cylinder 2152*a*. Sensor 2157*a* will then send a signal to the controller like controller 200 referenced above, in response to which the controller can take steps to change the operational mode of hydraulic fluid supply system 2160 as depicted in FIG. 28 (in the same manner as is illustrated in FIG. 7 in relation to hydraulic fluid supply system 1160).

Similarly, mounted on and extending within hydraulic cylinder barrel 2187*b* close to first cylinder head 2192*b*, is another proximity sensor 2157*b*. Proximity sensor 2157*b* is operable such that during operation of pump 2150, as hydraulic piston 2154*b* is moving from right to left, just before piston 2154*b* reaches the end of its stroke proximity sensor 2157*b* will detect the presence of a sensor end flag 2159*b* mounted on hydraulic piston 2154*b* within hydraulic cylinder 2152*b*. Sensor 2157*b* will then send a signal to the controller, in response to which the controller can take steps to change the operational mode of hydraulic fluid supply system 2160 as depicted in FIG. 28 (in the same manner as hydraulic fluid supply system 1160 as illustrated in FIG. 7 in relation to hydraulic fluid supply system 1160).

Proximity sensors 2157*a*, 2157*b* may be in communication with the controller and may, in some embodiments, be implemented like proximity sensors 157*a*, 157*b* as described above. Also, as described above, pressure sensors like sensors 1004 may be provided at each of ports P and S of the pump unit to detect the fluid pressures applied by the pump unit to the respective hydraulic pistons 2154*a*, 2154*b*, which can be used to calculate the load pressure applied on fluid piston 2182.

In addition, a temperature sensor like sensor 1006 referenced above may also be provided for controlling the pump unit, like in system 1160'. The temperature sensor can be positioned and configured to detect the temperature of the hydraulic driving fluid in the hydraulic fluid chambers 2186*a*, 2186*b*. The temperature sensor may be placed at any suitable location along the hydraulic fluid loop. For example, in an embodiment, the temperature sensor may be positioned at a fluid port.

Controller 200" may include hardware and software as discussed earlier, including hardware and software configured to receive and process signals from proximity sensors 2157*a*, 2157*b* and for controlling the operation of pump unit, but is modified to also receive signals from pressure sensors 1004 and temperature sensor 1006 and processing these signals, and the signals form the proximity sensors 157*a*, 157*b* (and optionally end of-of-stroke indicators, like end-of-stroke indicators 1002*a*, 1002*b*) as described above for controlling the pump unit.

In a manner as described above in relation to gas compressor 150, also with pump system 2150, it is possible for controller 200" (like controllers 200 and 200') to be programmed in such manner to control the hydraulic fluid supply system in such a manner as to provide for a relatively smooth slowing down, a stop, reversal in direction and speeding up of piston rod sections 2194*a*, 2194*b* along with the hydraulic pistons 2154*a*, 2154*b* and pump piston 2182 as the piston rod sections 2194*a*, 2194*b*, hydraulic pistons 2154*a*, 2154*b* and pump piston 2182 transition between a drive stroke providing movement to the right, to a drive stroke providing the stroke to the left, and back to a stroke providing movement to the right.

When pumping multi-phase fluids, and in particular when pumping fluids that may at least during some periods of operation of pump 2150 contain or encounter a relatively high ratio of liquid to gas, it is desirable during operation to be able to keep the velocity of the hydraulic pistons 2154*a*, 2154*b* (and fluid pump piston 2182 interconnected thereto) in a relatively low range such as for example 5 to 15 ft/second and thus also maintain the pressure developed in each of the fluid pump chambers 2181*a*, 2181*b* to a desired range. Furthermore, it may be desirable to keep the velocity of the hydraulic pistons 2154*a*, 2154*b* within a certain range for the current intake pressure. It is not desirable to allow the pressure in the fluid pump chambers 2181*a*, 2181*b* to spike to a level that is too high for the system to handle. Therefore, controller 200" can be configured to alter the operational mode/configuration of hydraulic fluid supply system 2160 and thus of the fluid pump 2150 (as generally described above in relation to hydraulic fluid supply system 1160). For example, when the ratio of gas/liquid of the fluid being supplied to fluid pump 2150 changes quickly from a low level of gas to fluid, to a high level to gas to fluid, controller 200" can decrease the load being applied by hydraulic fluid supply system 2160 to hydraulic fluid chambers 2186*a*, 2186*b*, by for example altering the operational configuration of hydraulic pump 2174.

Figure 24:
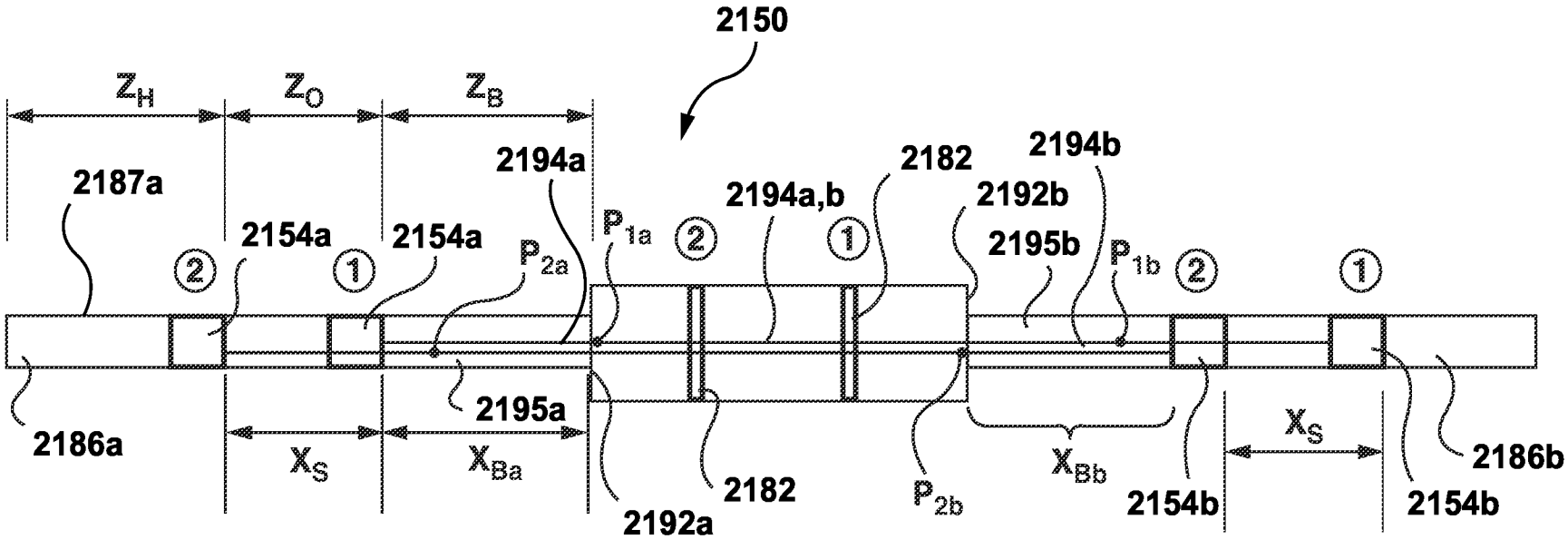
FIG. 24 is s a schematic side view of the pump of FIG. 20A.

In a manner as depicted in FIG. 24 in fluid pump system 2150, hydraulic cylinder barrel 2187*a* may be divided into three zones: (i) a zone ZH dedicated exclusively to holding hydraulic fluid; (ii) a zone ZB dedicated exclusively for the buffer area and (iii) an overlap zone, Zo, that which, depending upon where the hydraulic piston 2154*a* is in the stroke cycle, will vary between an area holding hydraulic fluid and an area providing part of the buffer chamber. Hydraulic cylinder barrel 2187*b* may be divided into a corresponding set of three zones in the same manner with reference to the movement of hydraulic piston 2154*b*.

If the length XBa (which is the length of the cylinder barrel from cylinder head 2192*a* to the inward facing surface of hydraulic piston 2154*a* at its full right position) is greater than the stroke length Xs, then any point P1*a* on piston rod section 2194*a* on the piston rod section 2194*a* that is at least for part of the stroke within fluid pump chamber section 2181*a*, will not move beyond the distance XBa when the pump piston 2182 and the hydraulic piston 2154*a* move from the farthermost right positions of the stroke position (1) to the farthermost left positions of the stroke position (2). Thus, any fluid/materials/contaminants carried on piston rod section 2194*a* starting at P1*a* will not move beyond the area of the hydraulic cylinder barrel 2187*a* that is dedicated to providing buffer chamber 2195*a*. Thus, any such contaminants travelling on piston rod section 2194*a* will be prevented, or at least inhibited, from moving into the zones ZH and Zo of hydraulic cylinder barrel 2187*a* that hold hydraulic fluid. Thus any point P1*a* on piston rod section 2194*a* that passes into the fluid pump chamber section 2181*a* will not pass into an area of the hydraulic cylinder barrel 2187*a* that will encounter hydraulic fluid (i.e. It will not pass into ZH or Zo). Thus, all portions of piston rod section 2194*a* that encounter the contents of fluid pump chamber section 2181*a*, will not be exposed to an area that is directly exposed to hydraulic fluid. Thus cross contamination of fluid and contaminants that may be present with the contents of fluid pump chamber section 2181*a* may be prevented or inhibited from migrating into the hydraulic fluid that is in that areas of hydraulic cylinder barrel 2187*a* adapted for holding hydraulic fluid. It may be appreciated, that since there is an overlap zone, the hydraulic pistons do move from a zone where there should never be anything but hydraulic fluid to a zone which transitions between hydraulic fluid and the contents (e.g. air) of the buffer zone. Therefore, fluid and contaminants on the inner surface wall of the cylinder barrel 2187*a*, 2187*b* in the overlap zone could theoretically get transferred to the edge surface of the piston. However, the presence of buffer zone significantly reduces the level of risk of cross contamination of contaminants into the hydraulic fluid. Also, as described above, scraper seal devices 2197*a*, 2197*b* further reduce the level of risk of cross contamination of contaminants that do pass into buffer chamber 2195 from reaching the hydraulic fluid.

With continuing reference to FIG. 24, it may be appreciated that hydraulic cylinder barrel 2187*b* may also be divided into three zones—like hydraulic cylinder barrel 2187*b*, namely: (i) a zone ZH dedicated exclusively to holding hydraulic fluid; (ii) a zone ZB dedicated exclusively for the buffer area and (iii) an overlap zone Zo that which, depending upon where the device is in the stroke cycle, will vary between an area holding hydraulic fluid and an area providing part of the buffer chamber.

If the length XBb (which is the length of the cylinder barrel from pump cylinder head 2192*b* to the inward facing surface of hydraulic piston 2154*b* at its full left position) is greater than the stroke length Xs, then any point P2*b* on piston rod section 2194*b* that is at least for part of the stroke within fluid pump chamber section 2181*b* will not move beyond the distance XBb when the pump piston 2182 and the hydraulic cylinder 2154*b* move from the farthermost left positions of the stroke (2) to the farthermost right positions of the stroke (1). Any materials/contaminants on piston rod section 2194*b* starting at P2*b* that passes into fluid pump chamber section 2181*b* will be prevented or at least inhibited from moving beyond the area of the hydraulic cylinder barrel 2187*b* that provides buffer chamber 2195*b*. Thus, any such contaminants travelling on piston rod section 2194*b* will be prevented, or at least inhibited, from moving into the zones ZH and Zo of hydraulic cylinder barrel 2187*b* that hold hydraulic fluid. Thus any point P2*b* on piston rod section 2194*b* that passes into the fluid pump chamber section 2181*b* will not pass into an area of the hydraulic cylinder barrel 2187*b* that will encounter hydraulic fluid (i.e. It will not pass into Zh or Zo). Thus, all portions of piston rod section 2194*b* that encounter fluid in the pump chamber section 2181*b*, will not be exposed to an area that is directly exposed to hydraulic fluid. Cross contamination of contaminants that may be present with the fluid in the fluid pump chamber section 2181*b* may be prevented or inhibited from migrating into the hydraulic fluid that is in that areas of hydraulic cylinder barrel 2187*b* adapted for holding hydraulic fluid. Thus, any such contaminants travelling on piston rod section 2194*b* will be prevented or a least inhibited from moving into the area of hydraulic cylinder barrel 2187*b* that in operation, holds hydraulic fluid.

In some embodiments, during operation of fluid pump 2150, buffer chambers 2195*a*, 2195*b* may each be separately open to ambient air, such that air within buffer chamber may be exchanged with the external environment (e.g. air at ambient pressure and temperature). However, it may not desirable for the air in buffer chambers 2195*a*, 2195*b* to be discharged into the environment and possibly other components to be discharged directly into the environment, due to the potential for other components that are not environmentally friendly also being present with the air. Thus a closed system may be desirable such that for example buffer chambers 2195*a*, 2195*b* may be in communication with each such that a substantially constant amount of gas (e.g. such as air) can be shuttled back and forth through communication lines—in a manner like the configuration of communication lines 215*a*, 215*b* in the embodiment of FIG. 7.

Buffer chambers 2195*a* and/or 2195*b* may in some embodiments be adapted to function as a purge region. For example, buffer chambers 2195*a*, 2195*b* may be fluidly interconnected to each other, and may also in some embodiments, be in fluid communication with a common pressurized gas regulator system such as the system 214 in the embodiment of FIG. 7, through gas lines 215*a*, 215*b* respectively. Pressurized gas regulator system may for example maintain a gas at a desired gas pressure within buffer chambers 2195*a*, 2195*b* that is always above the pressure of the fluids, compressed natural gas and/or other gases and fluids that are communicated into and compressed in fluid pump chamber sections 2181*a*, 2181*b* respectively. For example, pressurized gas regulator system may provide a buffer gas such as purified natural gas, air, or purified nitrogen gas, or another inert gas, within buffer chambers 2195*a*, 2195*b*. This may then prevent or substantially restrict fluids and any contaminants contained in fluid pump sections 2181*a*, 2181*b* migrating into buffer chambers 2195*a*, 2195*b*. The high-pressure buffer gas in buffer chambers 2195*a*, 2195*b* may prevent movement of liquids and/or gas (eg. oil and natural gas) and possibly contaminants into the buffer chambers 2195*a*, 2195*b*. Furthermore, if the buffer gas is inert, gas that seeps into the fluid pump chamber sections 2181*a*, 2181*b* will not react with the liquid, natural gas and/or contaminants. This can be particularly beneficial if for example the contaminants include hydrogen sulphide gas which may be present in one or both of fluid pump chamber sections 2181*a*, 2181*b*.

In some embodiments, buffer chamber communication lines like communication lines 215*a*, 215*b* (FIG. 7) may not be in fluid communication with a pressurized gas regulator system (like system 214)—but instead may be interconnected directly with each other to provide a substantially unobstructed communication channel for whatever gas is in buffer chambers 2195*a*, 2195*b*. During operation of fluid pump 2150, as hydraulic pistons 2154*a*, 2154*b* repeatedly move right and then left in unison, as one buffer chamber (e.g. buffer chamber 2195*a*) increases in size, the other buffer chamber (e.g. buffer chamber 2195*b*) will decrease in size. So instead of gas in each buffer chamber 2195*a*, 2195*b* being alternately compressed and then de-compressed, a fixed total volume of gas at a substantially constant pressure may permit gas thereof to shuttle between the buffer chambers 2195*a*, 2195*b* in a buffer chamber circuit.

Also, instead of being directly connected with each other, buffer chambers 2195*a*, 2195*b* may be both in communication with a common holding tank such as a holding tank like tank 1214 (FIG. 7) that may provide a source of gas that may be communicated between buffer chambers 2195*a*, 2195*b*. The gas in the buffer chamber gas circuit may be at ambient pressure in some embodiments and pressurized in other embodiments. The holding tank may in some embodiments also serve as a separation tank whereby any liquids being transferred with the gas in the buffer chamber system can be drained off.

Figure 19C:
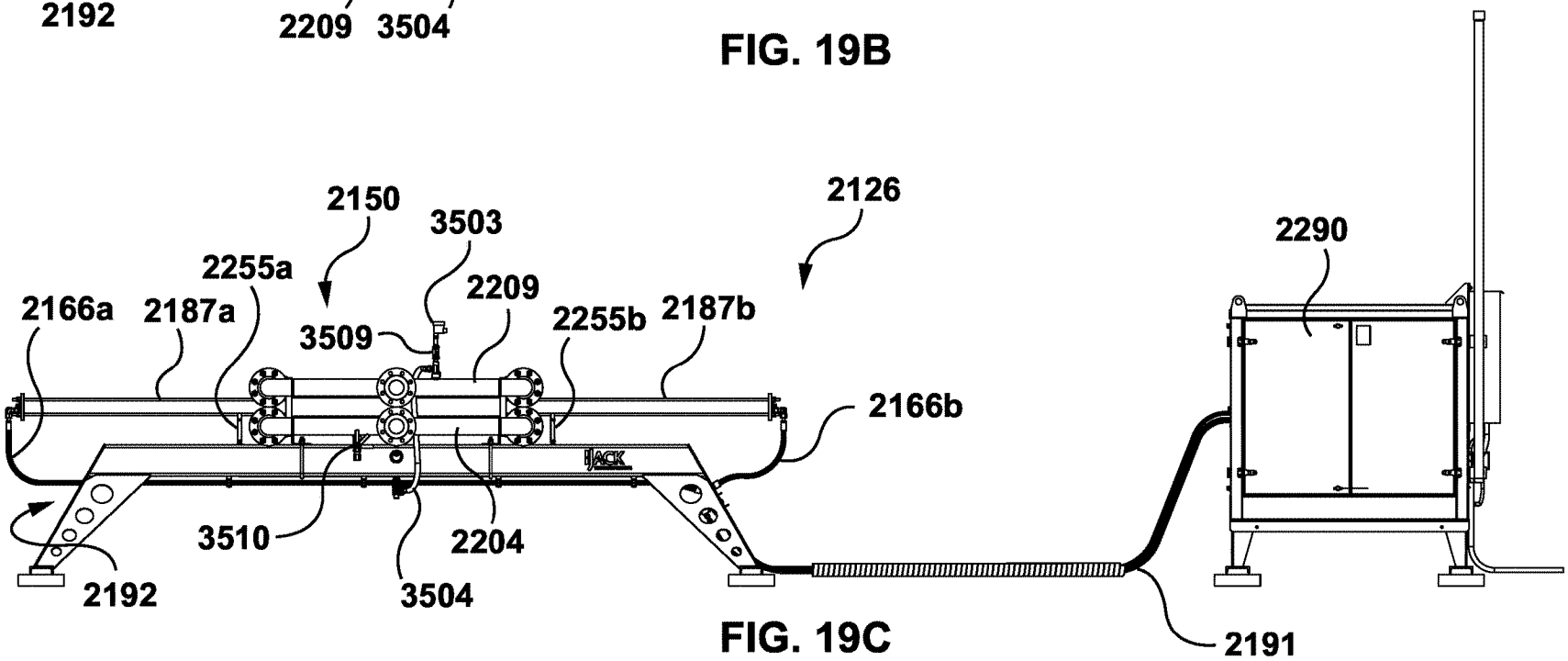
FIG. 19C is a front elevation view of the pump system of FIG. 19A.

With reference to FIGS. 19C, 22 and 28, a drainage port 2255*a* (FIG. 28) for buffer chamber 2195*a* may be provided on an underside surface of hydraulic cylinder barrel 2187*a* in the region of buffer chamber 2195*a* and be connected to a buffer chamber drain hose 2207*a*. A corresponding drainage port 2255*b* (FIG. 28) may be provided for buffer chamber 2195*b* and be connected to another corresponding buffer chamber drain hose 2207*b*. Drainage ports 2255*a*, 2255*b*, and corresponding drainage hoses 2207*a*, 2207*b* may allow drainage of any liquids that may have accumulated in each of buffer chambers 2195*a*, 2195*b* respectively. Such liquids may be able to be drained from buffer chambers 2195*a*, 2195*b* through drainage hoses 2207*a*, 2207*b* that may be connected into a holding tank 2214 which may comprise part of the interior of the support frame 2192 for fluid pump 2150. Holding tank 2214 may have a float switch within (not pictured), activated by a pre-determined fluid level in holding tank 2214, causing multiphase pump system 2126 to cease operation. This may be advantageous if for example, if a seal 2198*a*, 2198*b* were to fail, causing fluid to migrate into buffer chamber 2195*a*, 2195*b*. Fluid would then drain into holding tank 2214, resulting in activation of the float switch and shut down of multiphase pump system 2126 before damage could occur.

With particular reference to FIGS. 22 and 28, a holding tank drain apparatus may be provided to permit drainage of gas and/or liquid from holding tank 2214. This drain apparatus may comprise a lower one-way check valve and fittings 3505 connected to a lower drainage port 3506 from holding tank 2214. A holding tank drain hose 3504 may be connected to check valve and fittings 3505 which interconnects at its outflow end to a manual valve 3502 that itself is also connected to fittings 3509 which are connected to a suction intake port 3501 in an upper region of a suction intake manifold 2204. Also connected to fittings 3509 is a suction pressure sensor/transducer 3503. When it is desired to drain holding tank 2214, an operator may first shut off fluid supply to intake manifold input 2204*a* to prevent fluid flow into manifold 2204 from fluid supply pipe 2134, after which manual valve 3502 may be opened. Suction force developed within suction intake manifold 2204 during operation of pump system 2126 will draw fluid (gas and/or liquid) through one-way valve 3505 into drain hose 3504, through fittings 3509 and into suction intake manifold 2204 for feeding back to one or both of fluid pump chamber sections 2181*a*, 2181*b*. Thereafter, manual valve 3502 may be closed.

Suction pressure sensor/transducer 3503 may be in communication with controller 200" and may provide signals to the controller 200" reflective of the suction pressure level inside suction intake manifold 2204. Controller 200" may utilize this information to control the operation of pump 2150 and modify the speed at which fluid pump piston 2182 is cycled by controlling the operation of the hydraulic pistons 2154*a*, 2154*b* by controlling the operation of the hydraulic fluid supply system 2160. For example, by obtaining an indication of the pressure inside intake manifold 2204 and by knowing the speed of movement of pump piston 2182, controller 200" may be able to derive an estimate of the pressure within fluid pump chambers 2181*a*, 2181*b* during movement of the pump piston 2182 at is moves through a cycle. Additionally, or alternatively, pressure sensors/transducers 3507*a*, 3507*b* (FIG. 22) may be positioned at the inward facing surfaces of respective head plates 2199*a*, 2199*b* within pump chambers 2181*a*, 2181*b*, to provide signals to controller 200" indicative of the actual pressure being developed within each of pump chamber sections 2181*a*, 2181*b*. This can give controller 200" real time indications of the pressure that is actually being developed within pump chamber sections 2181*a*, 2181*b*, so that it may control the movement of hydraulic pistons 2154*a*, 2154*b* to control the pressure within the pump chambers 2181*a*, 2181*b*.

As illustrated in FIGS. 19A-C and 28, multi-phase fluid pump system 2126 may include a cabinet enclosure 2290 for holding components of hydraulic fluid supply system 2160 including a pump unit, a prime mover, a reservoir, filters, a thermal valve device and a cooler, like in the hydraulic fluid supply system 1160 depicted in FIG. 7. The controller 200'" may also be held in cabinet enclosure 2290. One or more electrical cables 2291 may be provided to provide power and communication pathways with the components of multiphase fluid pump system 2126 that are mounted on support frame 2192. Additionally, as indicated above, piping 2134

(FIG. 18) may carry to fluid pump pump 2150 when fluid pump 2150 is mounted on a support frame 2292 to provide a supply of liquid and gas to fluid pump 2150.

Multi-phase fluid pump system 2126 may thus also include a support frame 2192. Support frame 2192 may be generally configured to support fluid pump 2150 in a generally horizontal orientation. Support frame 2192 may include a longitudinally extending hollow tubular beam member 2295 which may be made from any suitable material such as steel or aluminium. Beam member 2295 may be supported proximate each longitudinal end by pairs of support legs 2293*a*, 2293*b* which may be attached to beam member 2295 such as by welding. Pairs of support legs 2293*a*, 2293*b* may be transversely braced by transversely braced support members 2294*a*, 2294*b* respectively that are attached thereto such as by welding. Support legs 2293*a*, 2293*b* and brace members 2294*a*, 2294*b* may also be made from any suitable material such as steel or aluminium.

Mounted to an upper surface of beam member 2295 may be L-shaped, transversely oriented support brackets 2298*a*, 2298*b* that may be appropriately longitudinally spaced from each other (FIG. 22). Support brackets 2298*a*, 2298*b* may be secured to beam member 2295 by a suitable attachment mechanism such as welding. Support bracket 2298*a* may be secured to the head plate 2199*a* of first cylinder head 2192*a* by bolts received through aligned openings in support bracket 2298*a* and the head plate, secured by nuts. Similarly, support bracket 2298*b* may be secured to the head plate 2199*b* of second cylinder head 2192*b* by bolts received through aligned openings in support bracket 2298*b* and the head plate, secured by nuts. In this way, fluid pump 2150 may be securely mounted to and supported by support frame 2292.

Hydraulic fluid communication line 2166*a* may extend from port 2184*a*, to the opposite end of support frame 2294 and may extend under a lower surface of beam member 2295 to meet with hydraulic fluid communication line 2166*b*, where they may are connected to a shuttle valve device 2168, in a configuration like that shown in FIG. 28.

The holding tank 2214 within beam member 2295 may also have an externally accessible tank vent that allows for any gas in the holding tank to be vented out.

In operation of multi-phase fluid pump system 2126, including fluid pump 2150, the reciprocal movement of the hydraulic pistons 2154*a*, 2154*b*, can be driven by a hydraulic fluid supply system 2160 (like hydraulic fluid supply system 1160 or 1160' as described above). The reciprocal movement of hydraulic pistons 2154*a*, 2154*b* will cause the size of the buffer chambers 2195*a*, 2195*b* to grow smaller and larger, with the change in size of the two buffer chambers 2195*a*, 2195*b* being for example 180 degrees out of phase with each other. Thus, as fluid pump piston 2182 driven by hydraulic piston 2154*b* moves from position shown in FIG. 21A to the position shown in FIG. 21B and then to the position shown in FIG. 21C, driven by hydraulic fluid forced into hydraulic fluid chamber 2186*b* (FIG. 19A), some of the gas (e.g. air) in buffer chamber 2195*b* will be forced into gas line(s) that interconnect chambers 2195*a*, 2195*b*, and flow through the holding tank within beam member 2295 towards and into buffer chamber 2195*a*. In the reverse direction, as hydraulic piston 2154*a* moves from position shown in FIG. 21C to the position shown in FIG. 21B and then to the position shown in FIG. 21A, driven by hydraulic fluid forced into hydraulic fluid chamber 2186*a* (FIG. 19A), some of the gas (e.g. air) in buffer chamber 2195*a* will be forced into the gas lines and flow through holding tank towards and into buffer chamber 2195*b*. In this way, the gas in the system of buffer chambers 2195*a*, 2195*b* can be part of a closed loop system, and gas may simply shuttle between the two buffer chambers 2195*a*, 2195*b*, (and optionally through a holding tank) thus preventing contaminants that may move into buffer chambers 2195*a*, 2195*b* from fluid pump chamber sections 2181*a*, 1281*b* respectively, from contaminating the outside environment. Additionally, such a closed loop system can prevent any contaminants in the outside environment from entering the buffer chambers 2195*a*, 2195*b* and thus potentially migrating into the hydraulic fluid chambers 2186*a*, 2186*b* respectively.

Multi-phase fluid pump system 2126 may also include a fluid communication system to allow a fluid comprising a gas, a liquid or a mixture thereof, the ratio of liquid/gas varying over time during operation, to be delivered from fluid supply piping 2134 (FIG. 18) to the two fluid pump chamber sections 2181*a*, 2181*b* of fluid pump 2150, which can then alternately pump the fluid from the fluid pump chamber sections 2181*a*, 2181*b* to fluid delivery piping 2130 for delivery to oil and gas flow line 2132. In some embodiments, gas from the tubing annulus 2107 may be mixed with fluid from the production tubing before entering multiphase pump system 2150 via fluid supply pipe 2134.

With reference to FIGS. 22 and 22B in particular, the fluid communication system that provides fluid to fluid pump 2150, to be pumped by fluid pump 2150, may include suction intake manifold 2204 and pressure discharge manifold 2209. The inside diameter of the fluid channel within manifolds 2204 and 2209 may both be the same size and may be in the range from 4 to 6 inches or greater.

On the fluid intake side of pump 2150, suction intake manifold 2204 may have single manifold input 2204*a*, and two manifold outputs 2204*b* and 2204*c*. A flange associated with output 2204*b* is connected to a flange of pipe connector 2250. Pipe connector 2250, which may have the same interior channel diameter as manifold 2204, may provide fluid communication from output 2204*b* of suction intake manifold 2204 to circular input opening 3000*a* of cylinder head plate 2192*a*. Similarly, a flange associated with output 2204*c* is connected to a flange of pipe connector 2260. Pipe connectors 2260, 2250 which may also have the same interior channel diameter as manifold 2204, may provide fluid communication from output 2204*c* of suction intake manifold 2204 to circular input opening 3000*b* of cylinder head plate 2192*b*.

On the fluid pressure discharge side of pump 2150, pressure discharge manifold 2209 has a single manifold output 2209*a*, and two manifold inputs 2209*b* and 2209*c*. A flange associated input 2209*b* is connected to a flange of pipe connector 2251. Pipe connector 2251, which may have the same interior channel diameter as manifold 2209, may provide fluid communication from circular output opening 3001*a* of cylinder head plate 2192*a* to input 2209*b* of pressure discharge manifold 2209. Similarly, a flange associated with input 2209*c* is connected to a flange of pipe connector 2261. Pipe connector 2261 which may also have the same interior channel diameter as manifold 2209, may provide fluid communication from circular output opening 3001*b* of cylinder head plate 2192*b* to input 2209*c* of pressure discharge manifold 2209.

In some embodiments, all pipe connectors 2250, 2260, 2251, 2261, and suction intake manifold 2204 and pressure discharge manifold 2209, may all have approximately the same interior channel diameter—such as in the range of 4-6 inches or even greater.

With particular reference to FIG. 22, disposed at the connection of the flange of output 2204*c* and the flange of pipe connector 2260 is a one-way pump suction check valve 3201*b*. This check valve 3201*b* ensures that fluid may only be communicated in the direction from output 2204*c* of suction intake manifold 2204 through pipe connector 2250 to circular input opening 3000*b* of cylinder head plate 2192*b*. Similarly disposed at the connection of the flange of output 2204*b* and the flange of pipe connector 2260 is a one-way pump suction check valve 3201*a*. This check valve 3201*a* ensures that fluid may only be communicated in the direction from output 2204*b* of suction intake manifold 2204 through pipe connector 2260 to circular input opening 3000*a* of cylinder head plate 2192*a*.

On the pressure discharge side, disposed at the connection of the flange of input 2209*c* of pressure discharge manifold 2209 and the flange of pipe connector 2261 is a one-way pump discharge check valve 3301*b*. This check valve 3301*b* ensures that fluid may only be communicated in the direction from the circular output opening 3001*b* of cylinder head plate 2192*b* through pipe connector 2261 into the input output 2209*c* of pressure discharge manifold 2209. Similarly disposed at the connection of the flange of input 2209*b* of suction discharge manifold 2209 and the flange of pipe connector 2251 is a one-way pump suction check valve 3301*a*. This check valve 3301*a* ensures that fluid may only be communicated in the direction from circular output opening 3001*a* of cylinder head plate 2192*a* through pipe connector 2251, to input 2209*b* of pressure discharge manifold 2209.

Any suitable check valves may be employed for check valves 3201*a*, 3201*b* and for check valves 3301*a*, 3301*b* such as, by way of example only, the FLOWMATIC Wafer Check Valve Series 888 VFD made by Flowmatic Corporation or ALC Check Valves made by DFT Inc. Suitable sealing rings 3389 may be provided between each of the aforesaid connections of suction intake manifold 2204, pressure discharge manifold 2209, the associated check valves and pipe connectors as described above.

Additionally, with particular reference to FIGS. 22 and 28, a manual check valve and fittings 3510 may be provided in a lower surface port of pressure discharge manifold 2209. Valve 3510 may be operated if it is desired to drain any liquid or gas located in fluid pump cylinder 2180 such as for example if it is desired to conduct maintenance on multiphase fluid pump 2150. An operator may first shut off fluid supply to intake manifold input 2204*a*, to prevent fluid flow into manifold 2204 from fluid supply pipe 2134. Fluid exiting through manifold output 2209*a* may be prevented by shutting a valve in outlet pipe 2130 (not shown), after which manual valve 3502 may be opened. Suction force developed within suction intake manifold 2204 during operation of pump system 2126 will draw air through a vent 3511 (FIG. 28) in holding tank 2214, through one-way valve 3505 into drain hose 3504, through fittings 3509 and into suction intake manifold 2204 for feeding fluid back to one or both of fluid pump chamber sections 2181*a*, 2181*b*. The operation of pump piston 2182 will then cause this fluid to flow into discharge manifold 2209 and that fluid can be drained from valve 3510. This serves to flush out any gases of fluid within the system. Thereafter, manual valve 3502 may be closed. Alternatively, a vacuum source, such as from a vacuum truck, may be connected to valve and fittings 3510 to draw out any fluid in pump 2150 with the pump 2150 not having to be operated during such drainage process.

Alternatively, an operator may first shut off fluid supply entering intake manifold input 2204*a* and shut off fluid exiting through manifold output 2209*a* before connecting a suitable hose to valve 3510. The hose (not shown) may also be connected to a suitable outlet such as group header pipe 4102 in FIG. 18A for draining any liquid or gas in pump 2150 through the operation of pump piston 2182 to return that fluid to the supply side of the system.

With particular reference to FIGS. 21A-C, 22 and 28, in operation of fluid pump 2150, hydraulic pistons 2154*a*, 2154*b* may be driven in reciprocating longitudinal movement such as for example by hydraulic fluid supply system 2160 as described above, thus driving fluid pump piston 2182 as well. The following describes the operation and movement of pump fluid (which may vary over time in its gas/liquid ratio) in pump system 2126.

With hydraulic pistons 2154*a*, 2154*b* and pump piston 2182 in the positions shown in FIG. 21A, pump fluid will be already located in fluid pump chamber section 2181*a*, having been previously drawn into fluid pump chamber section 2181*a* during the previous stroke due to a pressure differential that develops between the outer side of one way valve device 3201*a* and the inner side of valve device 3201*a* as piston 2182 moved from left to right. During that previous stroke, pump fluid (which may at a point in/period of, time be substantially only gas, substantially only liquid, or some liquid/gas mixture) will have been drawn from pipe 2134 into suction intake manifold 2204 through manifold input 2204*a* through pipe connector 2250 and check valve device 3201*a* into fluid pump chamber section 2181*a*, with check valve 3301*a* associated with pipe connector 2251 and pressure discharge manifold 2209 being closed due to the pressure differential between the inner side of check valve device 3301*a* and the outer side of check valve device 3301*a*, as well as the orientation of check valve device 3301*a*, thus allowing fluid pump chamber section 2181*a* to be filled with pump fluid at a lower pressure than the pump fluid on the outside of connector device 2251 in pressure discharge manifold 2209.

Thus, with fluid pump piston 2182 in the position shown in FIG. 21A, and hydraulic pistons 2154*a*, 2154*b* also in the corresponding furthermost right positions, hydraulic cylinder chamber 2186*b* is supplied with pressurized hydraulic fluid in a manner such as is described above, thus driving hydraulic piston 2154*b*, along with piston rod sections 2194*a*, 2194*b*, fluid pump piston 2182 and hydraulic piston 2154*a* attached to piston rod section 2194*a*, from the position shown in FIG. 21A to the position shown in FIG. 21B. As this is occurring, hydraulic fluid in hydraulic cylinder chamber 2186*a* will be forced out of hydraulic fluid chamber 2186*a*, and flow within system 2126 in FIG. 28 in a manner the same as described above in relation to the embodiment of FIG. 7.

As hydraulic piston 2154*b*, along with piston rod sections 2194*a*, 2194*b*, fluid pump piston 2182 and hydraulic piston 2154*a* attached to piston rod section 2194*a*, move from the position shown in FIG. 21A to the position shown in FIG. 21B, fluid will be drawn from fluid supply piping 2134, through pipe connector 2260 and one way valve device 3201*b* and into fluid pump chamber section 2181*b*. Fluid will flow in such a manner because as fluid pump piston 2182 moves to the left as shown in FIGS. 21A to 21B the pressure in fluid pump chamber section 2181*b* will drop, which will create a suction that will cause the fluid in pipe 2134 to flow into suction intake manifold input 2204*a*, through suction intake manifold 2204 through suction intake manifold output 2204*c*, through one way valve device 3201*b*, through pipe connector 2260 and into fluid pump chamber section 2181*b*. Check valve 3301*b* of pipe connector 2261 will be closed due to the pressure differential between the inner side of check valve device 3301*b* and the outer side of check valve device 3301*b*, as well as the orientation of check valve device 3301*b*, thus allowing fluid pump chamber section 2181*b* to be filled with fluid at a lower pressure than the fluid on the outside of connector device 2261 in pressure discharge manifold 2209.

Simultaneously, the movement of pump piston 2182 to the left will compress and cause the fluid that is already present in fluid pump chamber section 2181*a* to flow As the pressure rises in fluid pump chamber section 2181*a*, fluid in suction intake manifold 2294 from fluid supply piping 2134 will not enter fluid pump chamber section 2181*a* due to the pressure differential between fluid in fluid pump chamber section 2181*a* and fluid in suction intake manifold 2204. Additionally, fluid being compressed in fluid pump chamber section 2181*a* will stay in fluid pump chamber section 2181*a* until the pressure therein reaches the threshold level of pressure that is provided by one-way check valve device 3301*a*. During that time, dependent upon the pressure developed in fluid pump chamber section 2181*a*, pump fluid will be allowed to pass out of fluid pump chamber section 2181*a* through connector 2251 and will pass through and out of discharge manifold 2209 and into fluid delivery piping 2130 once the pressure is high enough to activate one way valve device 3301*a*.

At that point, pump fluid will start to exit fluid pump chamber section 2181*a*, pass into pipe connector 2251, flow though valve 3301*a* and into discharge manifold 2209 to be discharged from output 2209*a*. Fluid being compressed in fluid pump chamber section 2181*a* can't flow out of chamber section 2181*a* through pipe connector 2250 because of the orientation of check valve device 3201*a*.

Figure 21C:
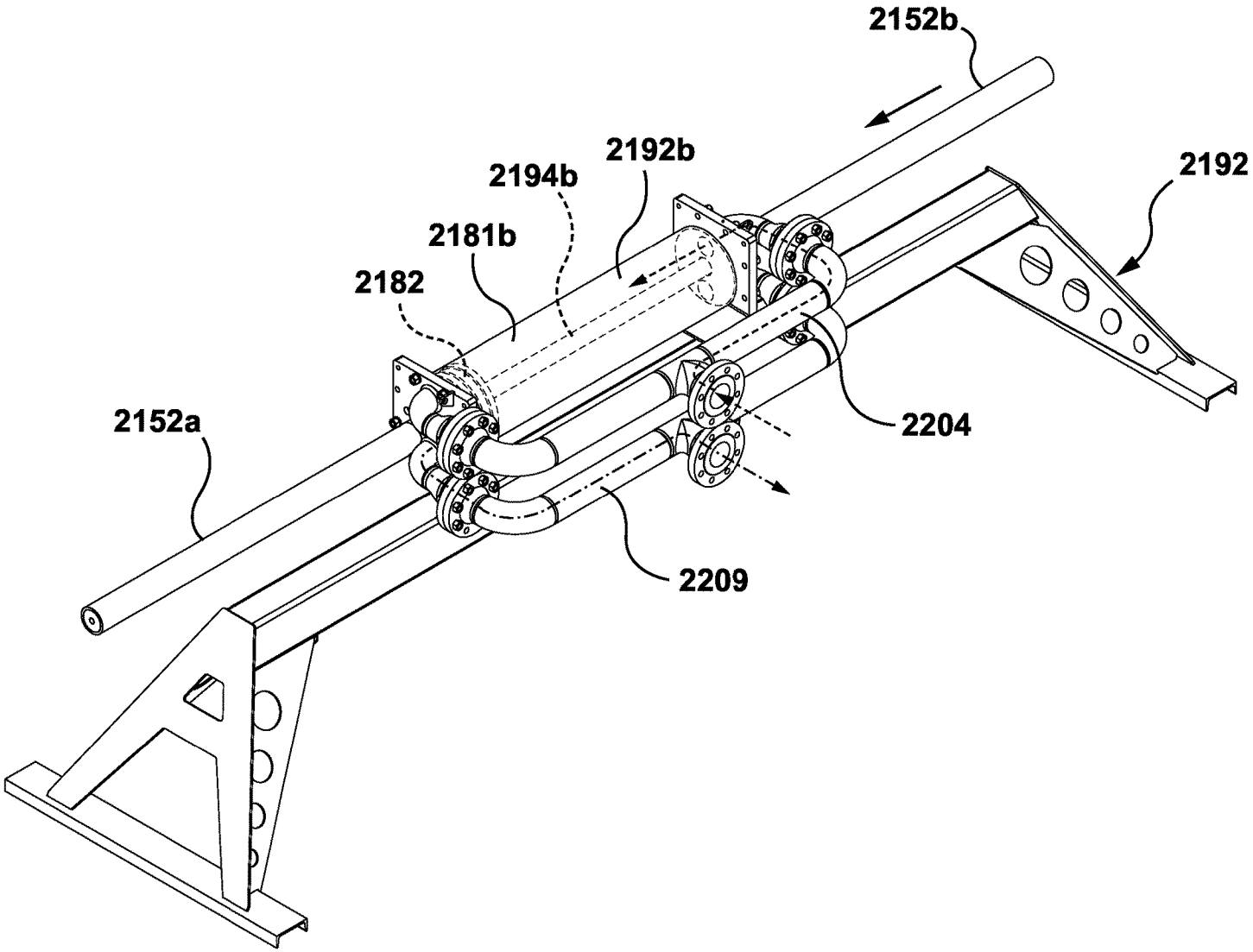

The foregoing movement and compression of pump fluid and movement of hydraulic fluid will continue as the pistons continue to move from the positions shown in FIG. 21B to the position shown in FIG. 21C. During the movement of the hydraulic pistons 2154*a*, 2154*b* and pump piston 2182 from the position shown in FIG. 21A to the position shown in FIG. 21C, controller 200" will monitor the pressure being developed within pump chamber sections 2181*a*, 2181*b*, to ensure that the pressure developed in pump chamber sections 2181*a*, 2181*b* does not exceed a predetermined threshold. If during operation, the pressure developed in either of pump chamber sections 2181*a*, 2181*b* exceeds a predetermined threshold, then controller 200" will respond by reconfiguring fluid supply system 2160, such as reducing the pressure developed within one or both of the respective hydraulic fluid chambers 2186*a*, 2186*b*, to thereby allow the pressure in pump chamber sections 2181*a*, 2181*b*, to drop to a lower acceptable level.

Just before hydraulic piston 2154*b* reaches the position shown in FIG. 21C, proximity sensor 2157*b* will detect the presence of hydraulic piston 2154*b* within hydraulic cylinder 2152*b* at a longitudinal position that is a short distance before the end of the stroke within hydraulic cylinder 2152*b*. Proximity sensor 2157*b* will then send a signal to a controller such as a controller 200" (like controllers 200 or 200'), in response to which controller 200" will change the operational configuration of hydraulic fluid supply system 2160, as described above. This will result in hydraulic piston 2154*b* not being forced or driven any further towards or to the left in hydraulic cylinder 2152*b* than the position shown in FIG. 21C.

Once hydraulic piston 2154*b*, along with piston rod sections 2194*a*, 2194*b*, fluid pump piston 2182 and hydraulic piston 2154*a* attached to piston rod section 2194*a*, are in the position shown in FIG. 21C, fluid will have been drawn from suction intake manifold 2204, through pipe connector 2260 and one way valve device 3201*b* again due to the pressure differential that is developed between fluid pump chamber section 2181*b* and suction intake manifold 2204, so that fluid pump chamber section 2181*b* is filled with fluid from fluid supply piping 2134. Much if not all of the fluid in fluid pump chamber section 2181*a* that has been compressed by the movement of fluid pump piston 2182 from the position shown in FIG. 21A to the position shown in FIG. 21B, will, once compressed sufficiently to exceed the threshold level of valve device 3301*a* have exited fluid pump chamber section 2181*a* and passed pipe connector 2251, and pressure discharge manifold 2209 and exited into fluid delivery piping 2130 (FIG. 18) for delivery to oil and gas pipeline 2132.

Next, multi-phase fluid pump system 2126, including hydraulic fluid supply system 2160 (in a manner like system 1160 described above) is reconfigured for the return drive stroke. As fluid has been drawn into fluid pump chamber section 2181*b* it is ready to be compressed and thereafter pumped out of section 2181*b* by fluid pump piston 2182. With hydraulic pistons 2154*a*, 2154*b* and fluid pump piston 2182 in the positions shown in FIG. 21C, hydraulic cylinder chamber 2186*a* is supplied with pressurized hydraulic fluid by a hydraulic fluid supply system. This movement drives hydraulic piston 2154*a*, along with piston rod sections 2194, fluid pump piston 2182 and hydraulic piston 2154*a* attached to piston rod section 2194*a*, from the position shown in FIG. 21C to the position shown in FIG. 21B. As this is occurring, hydraulic fluid in hydraulic cylinder chamber 2186*b* will be forced out of the hydraulic fluid chamber 2186*a* and may be handled by hydraulic fluid supply system 2160 (like system 1160, 1160' as described above).

As hydraulic piston 2154*a*, along with piston rod sections 2194*a*, 2194*b*, fluid pump piston 2182 and hydraulic piston 2154*b* attached to piston rod section 2194*b*, move from the position shown in FIG. 21C to the position shown in FIG. 21B, fluid (eg. oil, natural gas, etc.) will be drawn from fluid supply piping 2134, and flow through suction intake manifold input 2204*a* and suction intake manifold output 2204*b*, through one way valve device 3201*a* and into fluid pump chamber section 2181*a*, due to the drop in pressure in fluid pump chamber section 2181*a*, relative to the fluid pressure in fluid supply piping 2134 and suction intake manifold 2204. Fluid will have been drawn through pipe connector 2250 and check valve device 3201*a*, into fluid pump chamber section 2181*a*, with check valve 3301*a* of pipe connector 2251 being closed due to the pressure differential between the inner side of check valve device 3301*a* and the outer side of check valve device 3301*a*, as well as the orientation of one way check valve device 3301*a*, thus allowing fluid pump chamber section 2181*a* to be filled with fluid at a lower pressure than the fluid on the outside of connector device 2251 in pressure discharge manifold 2209.

Simultaneously, the movement of fluid pump piston 2182 will compress the fluid that is already present in fluid pump chamber section 2181*b*. As the fluid in fluid pump chamber section 2181*b* is being compressed by the movement of pump piston 2182, once the fluid pressure reaches the threshold level of valve device 3301*b* to be activated, fluid will be able to exit fluid pump chamber section 2181*b* and pass through pipe connector 2261 and through pressure discharge manifold 2209, and exit pressure discharge manifold output 2209*a* into fluid delivery piping 2130 and then pass into main oil/gas output flow line 2132.

The foregoing movement and compression of fluid into and out of fluid pump chamber sections 2181*a*, 2181*b* and of hydraulic fluid into and out of hydraulic fluid chambers 2186*a*, 2186*b* will continue as the pistons continue to move from the positions shown in FIG. 21B to return to the position shown in FIG. 21A. Just before piston 2154*a* reaches the position shown in FIG. 21A, proximity sensor 2157*a* will detect the presence of hydraulic piston 2154*a* within hydraulic cylinder 2152*a* at a longitudinal position that is shortly before the end of the stroke within hydraulic cylinder 2152*a*. Proximity sensor 2157*a* will then send a signal to the controller 200", in response to which the controller will reconfigure the operational mode of hydraulic fluid supply system 2160 (like systems 1160, 1160' as described above). This will result in hydraulic piston 2154*a* not be forced or driven any further towards or to the right than the position shown in FIG. 21A. Once hydraulic pistons 2154*a*, 2154*b*, along with piston rod sections 2194*a*, 2194*b*, and fluid pump piston 2182, are in the position shown in FIG. 21A, fluid will have been drawn through pipe connector 2250 so that fluid pump chamber section 2181*a* is once again filled and the controller 200" will send a signal to the hydraulic fluid supply system 2160 so that fluid pump system 2126 is ready to commence another cycle of operation.

During the return stroke movement of the hydraulic pistons 2154*a*, 2154*b* and pump piston 2182 from the position shown in FIG. 21C to the position shown in FIG. 21A, controller 200" will monitor the pressure being developed within pump chamber sections 2181*a*, 2181*b*, to ensure that the pressure developed in pump chamber sections 2181*a*, 2181*b* does not exceed a predetermined threshold. If during operation, the pressure developed in either of pump chamber sections 2181*a*, 2181*b* exceeds a predetermined threshold, then controller 200" will respond by re-configuring fluid supply system 2160, such as reducing the pressure developed within one or both of the respective hydraulic fluid chambers 2186*a*, 2186*b*, to thereby allow the pressure in pump chamber sections 2181*a*, 2181*b*, to drop to a lower acceptable level.

If at any time during operation, the inlet pressure of fluid in piping 2134, when combined with the increase in pressure being developed by pump 2150, reaches the maximum pressure permitted for piping 2132, controller 200" may also respond to slow down the operation of the pump 2150 in order to prevent over-pressurization and if required, and if necessary, pump 2150 will be stopped to allow to free flow through pump 2150, due to one-way check valves 3301*a*/3301*b* being activated by the pressure of fluid in pump 2150.

It should also be noted that, if the input pressure of fluid entering/being delivered to multiphase pump 2150 from piping 2134 to intake manifold 2204 reaches, and possibly is maintained for a predetermined period of time, at a predetermined excessive value, controller 200" will cause pump 2150 to cease operation. When multiphase pump 2150 is not in operation, the system may operate as a free-flowing fluid system, allowing the flow of fluid through intake manifold 2204, through one or both of fluid pump chambers 2181*a*, 2181*b* of pump 2150, through one-way check valves 3301*a*/3301*b*, then through discharge manifold 2209 and into fluid delivery piping 2130. In this way, there will be no additional increase in pressure imparted to the fluid that is delivered from piping 2134. It should be noted that typically, the pressure capability of main supply piping 2132 is such that fluid delivered by piping 2134 will be typically not at such a high level that supply piping 2132 can't accept the fluid at that pressure, if no increase in pressure is imparted by pump 2150.

Figure 23:
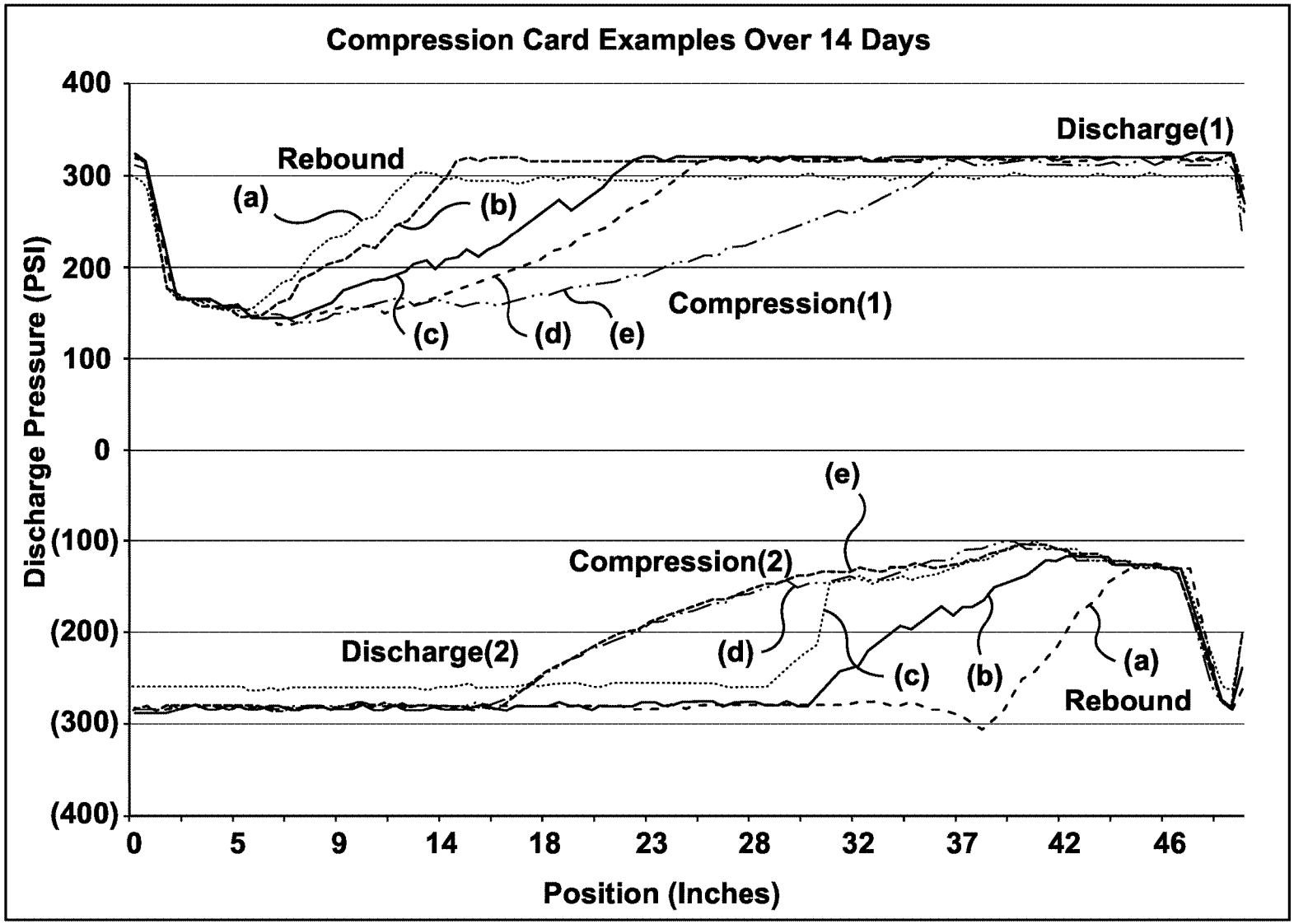
FIG. 23 is a chart showing the discharge pressure as a function of the position of the pump piston during pump cycles when the pump is pumping a range of gas/liquid ratios.

The graph shown in FIG. 23 details representative examples of the compression cycle for multiphase pump system 2126, based on variation of discharge pressure (y axis) at varying positions of pump piston 2182 (x axis). The position of pump piston 2182 in FIG. 21A corresponds to 0 inches on the x-axis of FIG. 23. With reference to FIG. 21A and the top portion of FIG. 23, and as described above, fluid will be already located in fluid pump chamber section 2181*a*, having been previously drawn into fluid pump chamber section 2181*a* during the previous stroke. Hydraulic cylinder 2186*b* is supplied with pressurised hydraulic fluid in a manner as described above, thus driving hydraulic piston 2154*b*, along with piston rod sections 2194*a*, 2194*b*, fluid pump piston 2182 and hydraulic piston 2154*a* attached to piston rod section 2194*a*, from the position shown in FIG. 21A to the position shown in FIG. 21B. As this is occurring, hydraulic fluid in hydraulic cylinder chamber 2186*a* will be forced out of chamber 2186*a*, and flow as described above.

As pump piston 2182 moves from the position shown in FIG. 21A to the position shown in FIG. 21C, fluid in pump chamber section 2181*a* will be compressed, causing the rise in discharge pressure labelled as compression 1 on FIG. 23. Discharge pressure is calculated through measurement of hydraulic pressure on both sides of the hydraulic pump or through direct measurement from pressure sensors/transducers 3507*a*, 3507*b* which may be positioned on respective head plates 2199*a*, 2199*b*. Once the pressure reaches the threshold pressure that is provided by the one-way check valve device 3301*a*, fluid will flow out of fluid pump chamber section 2181 through pipe connector 2251, represented by the area labelled as discharge 1 on FIG. 23. This discharge stage will continue until pump piston 2182 reaches the position shown in FIG. 21C.

As described above, as fluid was compressed and discharged from fluid pump chamber section 2181*a* fluid was simultaneously drawn into fluid pump chamber section 2181*b*. With hydraulic pistons 2154*a*, 2154*b* and fluid pump piston 2182 in the positions shown in FIG. 21C, hydraulic cylinder chamber 2186*a* is supplied with pressurized hydraulic fluid by a hydraulic fluid supply system 2160. This movement drives hydraulic piston 2154*a*, along with piston rod sections 2194, fluid pump piston 2182 and hydraulic piston 2154*a* attached to piston rod section 2194*a*, from the position shown in FIG. 21C to the position shown in FIG. 21A. Referring to FIG. 23, this process causes the fluid in pump chamber section 2181*b* to be compressed, causing the rise in discharge pressure labelled as compression 2 on FIG. 23. Once the pressure reaches the threshold pressure that is provided by the one-way check valve device 3301*b*, fluid will flow out of fluid pump chamber section 2181 through connector 2251, represented by the area labelled as discharge 2 on FIG. 23. This discharge stage will continue until pump piston 2182 reaches the position shown in FIG. 21A. At this point another cycle as described above can begin.

With reference to the compression (1) section of FIG. 23 (which may represent the movement of the pump piston) and as can be viewed on the chart of FIG. 23, the compression cycle/piston stroke represented by line (a) may increase from about 150 psi (representing the intake pressure) to about 300 psi (representing the discharge pressure) over about 8 inches of piston travel. Similarly, the compression cycle/piston stroke represented by line (b) may increase from about 150 psi to about 320 psi over about 9 inches of piston travel, the compression cycle/piston stroke represented by line (c) may increase from about 140 psi to about 320 psi over about 16 inches of piston travel, the compression cycle/piston stroke represented by line (d) may increase from about 140 psi to about 320 psi over about 18 inches of piston travel and the compression cycle/piston stroke represented by line (e) may increase from about 140 psi to about 320 psi over about 30 inches of piston travel. When comparing compression cycles/piston strokes on FIG. 23, the distance travelled by the piston in the fluid pump chamber section to increase the pressure from the intake pressure to the discharge pressure may vary from about 8 inches (line (a) in the compression (1) section of FIG. 23) to about 30 inches (line (b) in the compression (1) section of FIG. 23). Therefore the ratio of the shortest:longest distance travelled by the piston may be about 8:30 (or 1:3.75). Said another way, the distance travelled by the piston in the fluid pump chamber section varies by up to a factor of about 3.75.

Several examples of compression cycles can be seen in FIG. 23, denoted by differing dashed lines. These lines may display a degree of variation between different cycles. This may arise from the varying compressibility of the fluid in pump chamber sections 2181*a* and 2182*b* as the oil/gas ratio supplied to multiphase pump system 2126 varies. Lines (a) to (e) may designate fluid with decreasing oil/gas ratios. For, example, line (a) may have the highest oil/gas ratio—as it does not require as much movement of the pistons to raise the discharge pressure to the level at discharge of the fluid occurs. By contrast, line (e) may have the lowest oil/gas ratio—as it requires relatively more movement of the pistons to raise the discharge pressure to the level at discharge of the fluid occurs. Lines (b) to (d) may represent discharge pressures of gradually lower oil/gas ratios in the fluid being handled by pump system.

During operation of fluid pump 2150 it may be desirable to specifically control the discharge pressure, which corresponds to the pressure developed by the pump in the fluid exiting into fluid delivery piping 2130. In particular, it may be desirable to maintain the discharge pressure within a particular range or not exceeding a predetermined maximum. This may be important to, for example, sustain a desired production rate or to avoid over pressuring pipe 2130 and potentially also oil and gas flow line 2132. In one embodiment, a controller 200" referenced above can estimate the discharge pressure from an algorithm using signals from a sensor or number of sensor readings. These signals may include; intake pressure of the fluid entering fluid pump 2150 from pressure transducer 3503 on intake manifold 2204, speed measurements of hydraulic pistons 2154*a*, 2154*b* calculated from signals from proximity sensors 2157*a*, 2157*b* and sensor end flags 2159*a*, 2159*b*, temperature sensor 1006, pressure sensor 1004 or any number of other sensors as described above.

In another embodiment, discharge pressure can be directly measured in pump chamber sections 2181*a*, 2181*b* from pressure sensors/transducers 3507*a*, 3507*b* as described above. Using the measured or calculated discharge pressure, the controller can adjust the speed of hydraulic pistons 2154*a*, 2154*b*, via hydraulic fluid supply system 2160 to maintain the discharge pressure within a desired range.

During the operation of fluid pump 2150 as described above, any contaminants that may be carried with the fluid received from fluid supply piping 2134 will enter into fluid pump chamber sections 2181*a*, 2181*b*. However, the components of seal devices 2198*a*, 2198*b* as described above, will provide a barrier preventing or at least significantly limiting, the migration of any contaminants out of fluid pump chamber sections 2181*a*, 2181*b*. However, any contaminants that pass seal devices 2198*a*, 2198*b* are likely to be held in respective buffer chambers 2195*a*, 2195*b* and in combination with seal devices of hydraulic pistons 2154*a*, 2154*b* respectively, may prevent contaminants from entering into the respective hydraulic cylinder chambers 2186*a*, 2186*b*. Particularly if buffer chambers 2195*a*, 2195*b* are pressurized, such as with pressurized air or a pressurized inert gas, then this should greatly restrict or inhibit the movement of contaminants in the fluid in fluid pump chamber sections 2181*a*, 2181*b* from migrating into buffer chambers 2195*a*, 2195*b*, thus further protecting the hydraulic fluid in hydraulic cylinder chambers 2186*a*, 2186*b*, It should be noted that in use, fluid pump 2150 may be oriented generally horizontally, generally vertically, or at an angle to both vertical and horizontal directions.

While the fluid pump system 2126 that is illustrated in FIGS. 19 to 28 discloses a single buffer chamber 2195*a*, 2195*b* on each side of the fluid pump 2150 between the fluid pump cylinder 2180 and the hydraulic fluid chambers 2186*a*, 186*b*, in other embodiments more than one buffer chamber may be configured on one or both sides of fluid pump cylinder 2180. Also, the buffer chambers may be pressurized with an inert gas to a pressure that is always greater than the maximum pressure of the fluid in the fluid pump chamber sections 2181*a*, 2181*b* so that if there is any fluid leakage through the piston rod seals, that leakage is directed from the buffer chamber(s) toward the fluid pump chamber sections 2181*a*, 2181*b* and not in the opposite direction. This may ensure that no dangerous gases such as hydrogen sulfide ($H_2S$) are leaked from fluid pump system.

Figure 26:
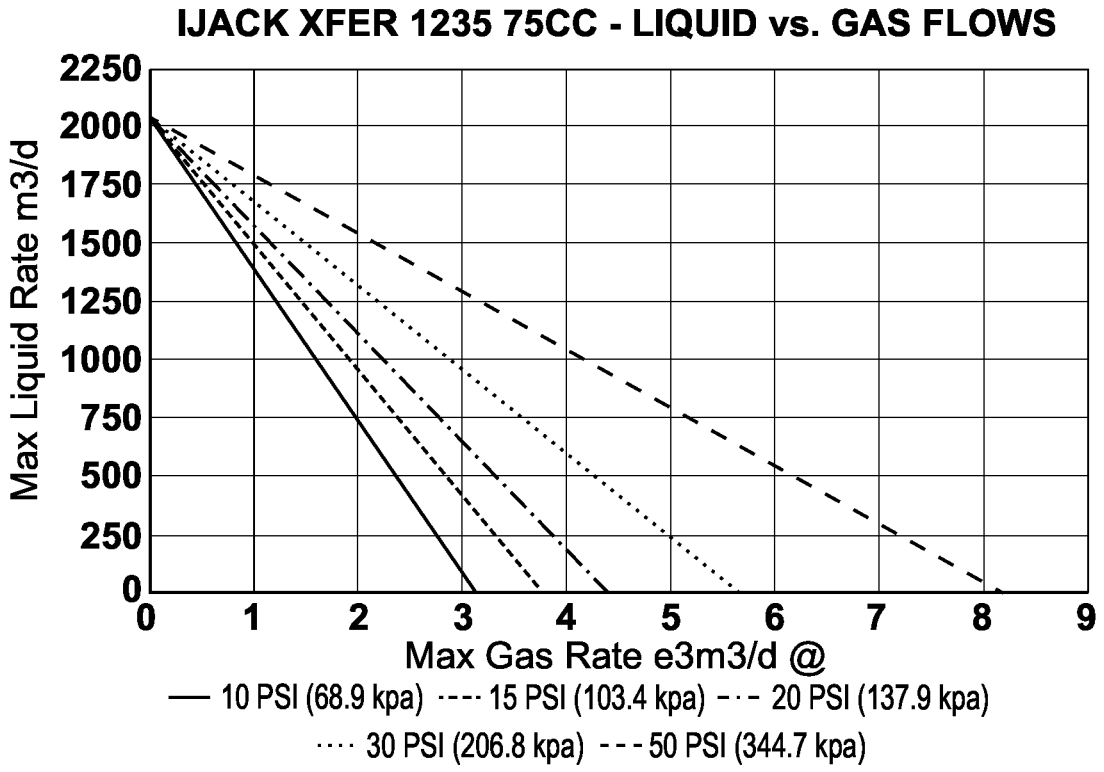
FIG. 26 is a chart showing maximum gas and liquid rates for a first model of the multiphase pump system of 19A.
Figure 27:
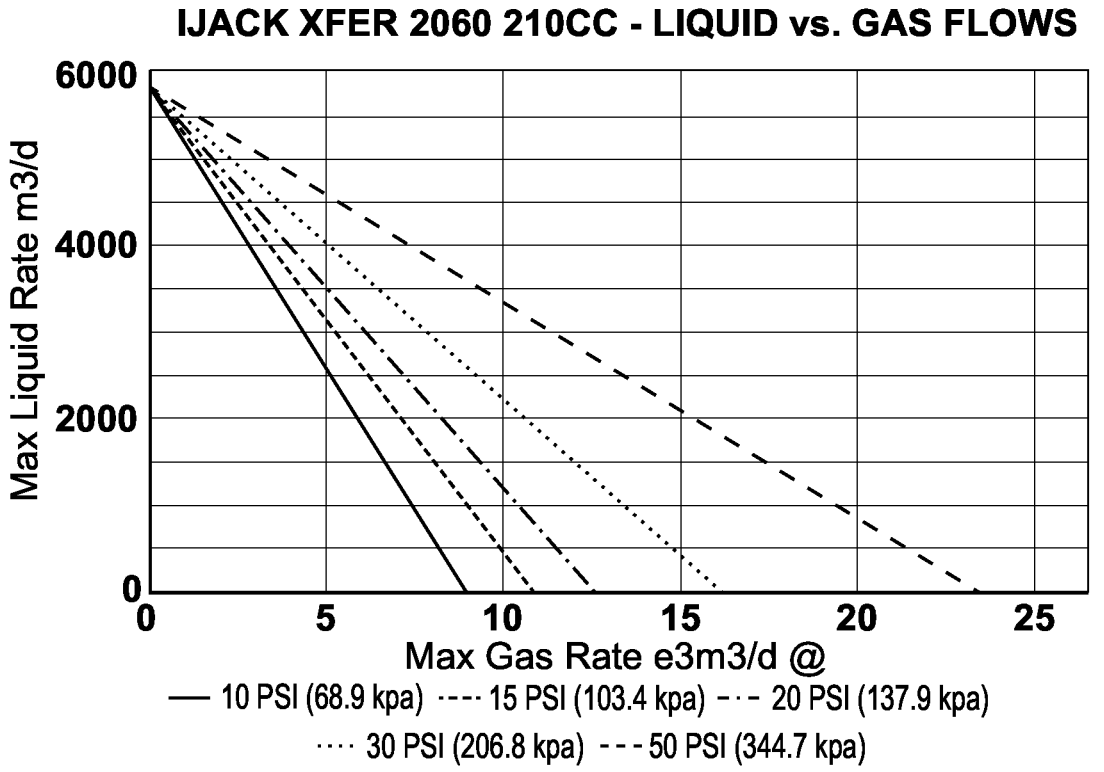
FIG. 27 is a chart showing maximum gas and liquid rates for a second model of the multiphase pump system of 19A.

FIG. 25 shows differential pressure, maximum gas rates and maximum liquid rates for a range of fluid pump 2150 models. Maximum gas rates for desired inlet pressures between 10-50 psi are shown when fluid pump 2150 is pumping 100% gas. Maximum liquid rates are shown when fluid pumps 2150 are pumping 100% liquid FIGS. 26 and 27 depict maximum liquid and gas flow rates at a range of given gas desired inlet pressures between 10-50 psi for two fluid pump 2150 models. As the maximum liquid rate (y-axis) decreases the pump has more capacity to pump gas, therefore the maximum gas rate (x-axis) increases. Maximum liquid rate is generally constant regardless of pressure due to the poor compressibility of liquids. However, due to the greater compressibility of gases, the maximum gas rate is seen to increase with pressure.

Figure 29:
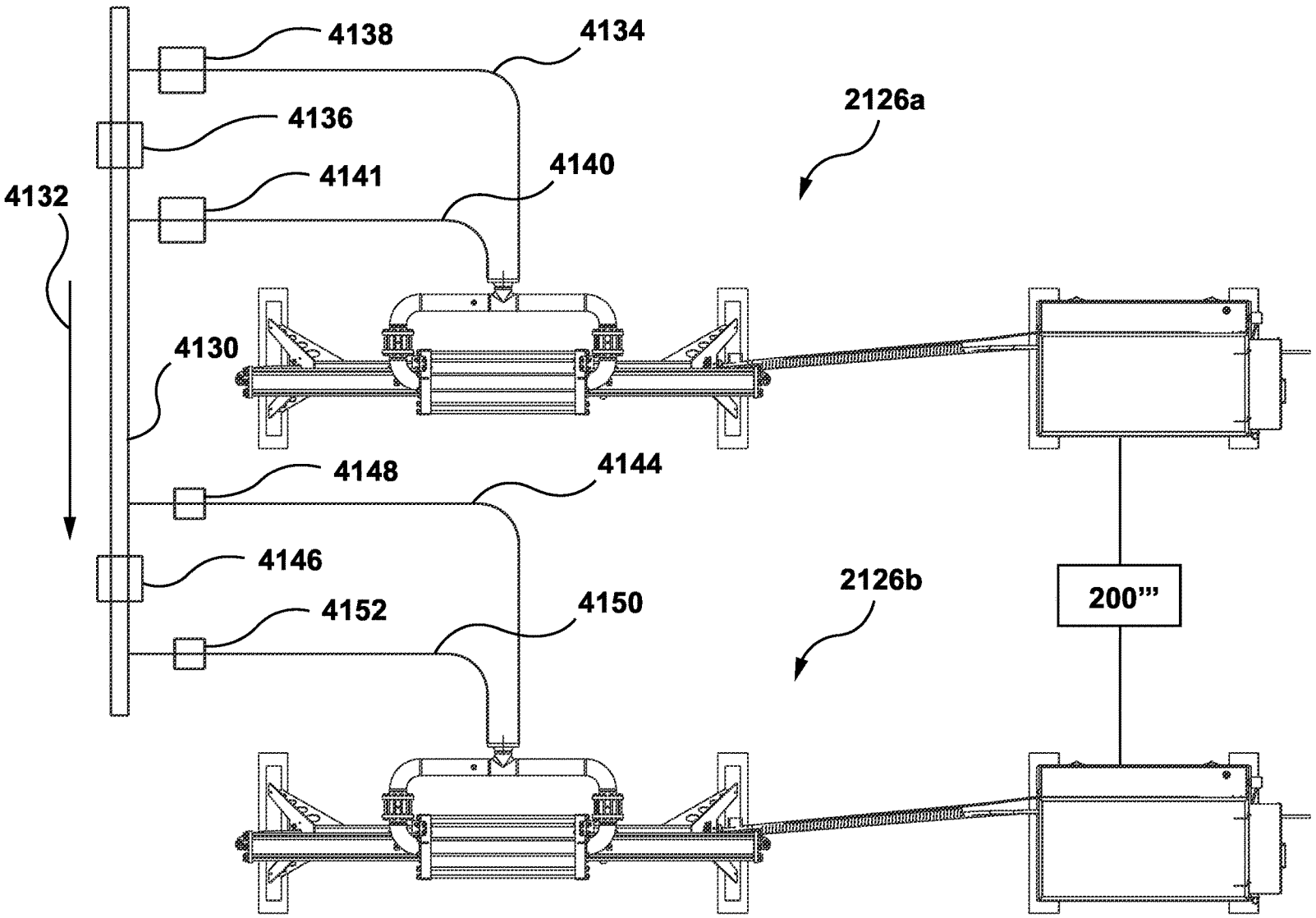
FIG. 29 is a schematic view of a layout of multi-phase pump system.

In another embodiment a plurality of multiphase pump systems 2126*a*, 2126*b* may be connected in series in order provide a pressure boost to multiphase fluid flowing down a flow line. An advantage to this approach is that less energy is required to compress gas in multiple stages. A representative example is depicted in FIG. 29. Fluid from one or more sources, such as in particular from various oil/gas well sites, may flow in flowline 4130 in the direction indicated by arrow 4132. This fluid in flowline 4130 may comprises a mixture of oil/gas—and possibly other fluids—and also possibly contaminants, including solids as referenced above. The fluid may be diverted into a first suction line 4134 by closing first bypass valve 4136 and opening first intake valve 4138. Fluid will flow along first suction line 4134 to a first stage multiphase pump 2126*a*. Fluid exits first stage multiphase pump 2126*a* through first discharge line 4140, flowing through first discharge valve 4142 into flowline 4130. Fluid in discharge line 4140 may have its pressure boosted by a pressure increase to a pressure P1. A further advantage is the flexibility in placement of multiphase pump systems 2126 to allow optimal positioning. For example, it may be beneficial to place a pump 2126 after, rather than before, a restricted area such as a T-connection (not shown) in flowline 4130 to reduce pressure build-up.

Further down flowline 4130 in the direction indicated by arrow 4132, the fluid may be diverted into second stage suction line 4144 by closing second bypass valve 4136 and opening second intake valve 4148. Fluid will flow along second suction line 4144*a* at pressure P2, to a second stage multiphase pump 2126*b*. Fluid then undergoes a second pressure boost and then exits second multiphase pump 2126*b* through second discharge line 4150 and flows at a pressure P2 that is greater than P1, through second discharge valve 4152 into flowline 4130.

In one embodiment, first multiphase pump 2126*a* and second multiphase pump 2126*b* may be of different specifications. For example, first multiphase pump 2126*a* may have hydraulic pistons 2154*a*, 2154*b*, each with a diameter of 7 inches; piston rod sections 2194*a*, 2194*b*, each with a diameter of 3.5 inches and pump piston 2182 with a diameter of 22 inches. First suction line 4134 and first discharge line 4140 may both be 6 inches in diameter. Second multiphase pump 2126*b* may have hydraulic pistons 2154*a*, 2154*b*, each with a diameter of 4.5 inches; piston rod sections 2194*a*, 2194*b*, each with a diameter of 3 inches and pump piston 2182 with a diameter of 12 inches. Second suction line 4144 and second discharge line 4150 may both be 4 inches in diameter.

First and second multiphase pumps 2126*a*, 2126*b* may share a controller 200". It may desirable to set desired inlet and outlet pressures for each pump to maximise efficiency and achieve complementary performance. For example, controller 200" may programme first multiphase pump 2126*a* to target an inlet pressure of 50 psi and an outlet pressure of 250 psi. Second multiphase pump 2126*b* may be programmed to target an inlet pressure of 250 psi and an outlet pressure of 500 psi.

The distance between multiphase pump systems 2126 placed in series on flowline 4130 may vary depending on the application. In the embodiment depicted in FIG. 29, the distance is 350 inches. In other embodiments, the first multiphase pump 2126*a* and second multiphase pump 2126*b* may be spaced apart by many meters or by one or more kilometres along a flowline 4130, thus significantly spacing out the locations along flowline 4130 where pressure boosts take place. Thus, the pressure boost provided by first multiphase pump 2126*a* may have partially, or substantially completely dissipated along flowline 4130 at the location where second multiphase pump 2126*b* is provided to give the fluid another pressure increase.

Multi-phase fluid pump system 2126 may also be employed in other oilfield and other non oilfield environments to transfer multi-phase fluids efficiently and quietly When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Of course, the above described embodiments are intended to be illustrative only and in no way limiting. The described embodiments of carrying out the invention are susceptible to many modifications of form, arrangement of parts, details, and order of operation. The invention, therefore, is intended to encompass all such modifications within its scope.

What is claimed is:

1. An oil and gas producing system comprising:

a multi-phase fluid pump system operable to pump a multi-phase fluid;

an oil and gas well comprising a production tubing in a well bore, said well bore communicating with an oil and gas source, said production tubing having an inside passageway communicating a multi-phase fluid from said oil and gas source directly to said multi-phase fluid pump system, said multi-phase fluid having a gas to liquid ratio that varies over time, including some periods of time when the mixture is substantially only liquid, said multi-phase fluid pump system comprising:

a driving fluid system comprising a first driving fluid cylinder and a second driving fluid cylinder;

said first driving fluid cylinder having a first driving fluid chamber adapted for containing driving fluid therein, and a first driving fluid piston movable within said first driving fluid chamber;

a fluid pump cylinder having a fluid pump chamber having a first section adapted for pressurizing the multi-phase fluid therein and said fluid pump chamber having a second section adjacent said first section also adapted for pressurizing the multi-phase fluid therein, and said fluid pump cylinder having a fluid pump piston movable within said fluid pump chamber and operable to pressurize said multi-phase fluid located within said first section of said fluid pump chamber, and said fluid pump piston operable to pressurize said multi-phase fluid located within said second section of said fluid pump chamber, said second section of said fluid pump chamber being on an opposite side of said fluid pump piston to said first section of said fluid pump chamber in said fluid pump cylinder;

a first buffer chamber located between said first driving fluid chamber and said fluid pump chamber, said first buffer chamber providing a chamber that is sealed by one or more buffer chamber seals;

said first buffer chamber providing a chamber that is operable to inhibit movement of at least one non-driving fluid component accompanying the multi-phase fluid supplied to said first section of said fluid pump chamber, from being communicated from said first section of said fluid pump chamber into said first driving fluid chamber, when in operation, the multi-phase fluid is located within said first section of said fluid pump chamber and is pressurized by said fluid pump piston with said first driving fluid piston being driven by said driving fluid system;

a second driving fluid cylinder having a second driving fluid chamber operable in use for containing driving fluid and a second driving fluid piston movable within said second driving fluid chamber, and wherein said second driving fluid cylinder is located on an opposite side of said fluid pump cylinder as said first driving fluid cylinder;

a second buffer chamber located between said second driving fluid chamber and said fluid pump chamber, said second buffer chamber providing a chamber that is sealed by one or more buffer chamber seals;

said second buffer chamber providing a chamber that is operable to inhibit movement of at least one non-driving fluid component accompanying the multi-phase fluid supplied to said second section of said fluid pump chamber, from being communicated from said second section of said fluid pump chamber into said second driving fluid chamber, when in operation, the multi-phase fluid is located within said second section of said fluid pump chamber and is pressurized by said fluid pump piston, with said second driving fluid piston being driven by said driving fluid system;

said multi-phase fluid pump system operable for communication of a supply of said multi-phase fluid from said oil and gas source through said inside passageway of said production tubing separately to each of said first and second sections of said fluid pump chamber;

wherein said driving fluid comprises hydraulic fluid.

2. The system as claimed in claim 1, wherein said multi-phase fluid pump system is located proximate a well head of said oil and gas well and which receives a varying mixture of oil and gas from said well head.

3. The system as claimed in claim 1, further comprising a piston rod that is fixedly connected to said first driving fluid piston and said fluid pump piston, such that in operation when said driving fluid flows into said first driving fluid chamber, said driving fluid drives said first driving fluid piston such that said first driving fluid piston and said fluid piston move together within said respective first driving fluid chamber and said fluid pump chamber.

4. The system as claimed in claim 3 wherein a volume of said first driving fluid chamber and a volume of said first buffer chamber overlap within said first driving fluid cylinder, and wherein said piston rod extends from said first driving fluid piston through said first buffer chamber into said first section of said fluid pump chamber to said fluid pump piston.

5. The system as claimed in claim 4 wherein during operation, said first buffer chamber varies in length dependent upon the position of said first driving fluid piston in said first driving fluid cylinder and a minimum length of said first buffer chamber is greater than a stroke length of said fluid pump piston, said piston rod and said first driving fluid piston.

6. The system as claimed in claim 5 wherein said first buffer chamber is configured such that in operation, no portion of said piston rod that is received within said fluid pump chamber will be received in a portion of said first driving fluid cylinder that receives said driving fluid.

7. The system as claimed in claim 6 wherein said at least one non-driving fluid component comprises a contaminant.

8. The system as claimed in claim 1, wherein said first buffer chamber is located adjacent to said first driving fluid chamber on one side of said first buffer chamber and said second buffer chamber is located adjacent to said second driving fluid chamber on an opposite side of said second buffer chamber.

9. The system as claimed in claim 8 wherein said first driving fluid chamber and said first buffer chamber are both located within said first driving fluid cylinder, and said second driving fluid chamber and said second buffer chamber are both located within said second driving fluid cylinder.

10. The system as claimed in claim 1, further comprising a casing assembly located between said first buffer chamber and said first section of said fluid pump chamber and wherein said one or more buffer chamber seals comprises one or more seals located at least partially within said casing assembly, said one or more seals located at least partially within said casing assembly being operable to inhibit fluid from migrating from said first section of said fluid pump chamber into said first buffer chamber.

11. The system as claimed in claim 10 wherein said one or more seals located at least partially within said casing assembly are also located at least partially within said first driving fluid cylinder.

12. The system as claimed in claim 10, wherein said one or more seals located at least partially within said casing assembly provide a barrier to liquid, gas and solid materials moving from said fluid pump chamber into said first buffer chamber.

13. The system as claimed in claim 10, wherein said one or more seals located at least partially within said casing assembly is located between said first driving fluid cylinder piston and an inner surface of said first driving fluid cylinder.

14. The system as claimed in claim 12 wherein said one or more seals located at least partially within said casing assembly is located between said first driving fluid cylinder piston and an inner surface of said first driving fluid cylinder and comprises one or more sealing devices operable to provide a barrier to liquid, gas and solid materials moving from the first buffer chamber into the first driving fluid chamber, and provide a barrier to driving fluid moving from said first driving fluid chamber into said first buffer chamber.

15. The system as claimed in claim 12, wherein said one or more seals located at least partially within said casing assembly is located between said first driving fluid cylinder piston and an inner surface of said first driving fluid cylinder and comprise at least one wear ring.

16. The system as claimed in claim 12, wherein said one or more seals located at least partially within said casing assembly is located between said first driving fluid cylinder piston and an inner surface of said first driving fluid cylinder and comprise first and second longitudinally spaced wear rings.

17. The system as claimed in claim 16, further comprising at least one ring seal disposed longitudinally between said first and second longitudinally spaced wear rings.

18. The system as claimed in claim 15, further comprising a scraper seal device located on and extending around said first driving cylinder piston and being operable to remove residue from an inner surface of said first buffer chamber to maintain said residue within said first buffer chamber.

19. The system as claimed in claim 1, wherein said system further comprises a driving fluid supply system operable to supply driving fluid to said first driving fluid chamber to drive said first driving fluid piston and operable to supply driving fluid to said second driving fluid chamber to drive said second driving fluid piston, said driving fluid supply system comprising a pump and a plurality of driving fluid supply lines fluidly connecting said pump with said first and second driving fluid chambers.

20. The system as claimed in claim 19, further comprising a controller comprising a circuit, said controller operable for controlling said driving fluid supply system for controlling the flow of driving fluid to said first and second driving fluid chambers.

21. The system as claimed in claim 20 further comprising a sensor device system operable to provide a signal to said controller indicative of the pressure developed within said first and second sections of said fluid pump chamber, such that said controller is operable to control the driving fluid supply system to control the pressure developed within said first and second driving fluid chambers.

22. The system as claimed in claim 20 wherein said controller is operable to control the driving fluid supply system to control the speed of movement of the fluid pump piston.

23. The system as claimed in claim 1, comprising a controller comprising a circuit, said controller operable for controlling a driving fluid supply system for controlling the flow of driving fluid to said first and second driving fluid chambers.

24. The system as claimed in claim 1, further comprising at least one piston seal device operable to provide a seal between said fluid pump piston and an inner surface of the fluid pump chamber.

25. The system as claimed in claim 24, wherein said at least one piston seal device is operable to maintain pressure differences between the adjacent first and second sections of said fluid pump chamber during operation.

26. The system as claimed in claim 24, wherein said at least one piston seal device is operable to substantially prevent or inhibit movement of fluid comprising varying mixtures/ratios of liquid and gas between the first and second sections of said fluid pump chamber.

27. The system as claimed in claim 24, wherein said at least one sealing device comprises a plurality of grooves and sealing rings retained therein at outer circumferential surfaces of said fluid pump piston operable to provide a seal with an inner wall surface of a pump cylinder barrel.

28. The system as claimed in claim 1, further comprising an intake conduit for communicating said supply of multi-phase fluid from said oil and gas well to said first and second sections of said fluid pump chamber and a discharge conduit for communicating pressurized multiphase fluid from said first and second sections of said fluid pump chamber, wherein said intake conduit and said discharge conduits have a diameter in the range of about 4 inches to about 6 inches.

29. The system as claimed in claim 1, wherein said maximum liquid rate of multi-phase fluid expelled by said fluid pump cylinder is between about 2040 $m^3$/d and about 5820 $m^3$/d.

30. An oil well producing system comprising:

a production tubing having a length extending along a well shaft that extends to an oil bearing formation;

a passageway extending along at least the well shaft, said passageway operable to supply natural gas to a gas supply line, said gas supply line in communication with a fluid pump chamber of a multi-phase fluid pump system;

a pipe connecting said production tubing operable to deliver oil from said oil bearing formation to said fluid pump chamber of said multi-phase fluid pump system;

wherein said multi-phase fluid pump system comprises:

a driving fluid system comprising a first driving fluid cylinder and a second driving fluid cylinder;

said first driving fluid cylinder having a first driving fluid chamber adapted for containing driving fluid therein, and a first driving fluid piston movable within said first driving fluid chamber;

a fluid pump cylinder having said fluid pump chamber having a first section adapted for pressurizing the multi-phase fluid therein and said fluid pump chamber having a second section adjacent said first section also adapted for pressurizing the multi-phase fluid therein, and said fluid pump cylinder having a fluid pump piston movable within said fluid pump chamber and operable to pressurize said multi-phase fluid located within said first section of said fluid pump chamber, and said fluid pump piston operable to pressurize said multi-phase fluid located within said second section of said fluid pump chamber, said second section of said fluid pump chamber being on an opposite side of said fluid pump piston to said first section of said fluid pump chamber in said fluid pump cylinder;

a first buffer chamber located between said first driving fluid chamber and said fluid pump chamber, said first buffer chamber providing a chamber that is sealed by one or more buffer chamber seals;

said first buffer chamber providing a chamber that is operable to inhibit movement of at least one non-driving fluid component accompanying the multi-phase fluid supplied to said first section of said fluid pump chamber, from being communicated from said first section of said fluid pump chamber into said first driving fluid chamber, when in operation, the multi-phase fluid is located within said first section of said fluid pump chamber and is pressurized by said fluid pump piston with said first driving fluid piston being driven by said driving fluid system;

a second driving fluid cylinder having a second driving fluid chamber operable in use for containing driving fluid and a second driving fluid piston movable within said second driving fluid chamber, and wherein said second driving fluid cylinder is located on an opposite side of said fluid pump cylinder as said first driving fluid cylinder;

a second buffer chamber located between said second driving fluid chamber and said fluid pump chamber, said second buffer chamber providing a chamber that is sealed by one or more buffer chamber seals;

said second buffer chamber providing a chamber that is operable to inhibit movement of at least one non-driving fluid component accompanying the multi-phase fluid supplied to said second section of said fluid pump chamber, from being communicated from said second section of said fluid pump chamber into said second driving fluid chamber, when in operation, the multi-phase fluid is located within said second section of said fluid pump chamber and is pressurized by said fluid pump piston, with said second driving fluid piston being driven by said driving fluid system;

said multi-phase fluid pump system operable for communication of a supply of said oil and gas from said oil bearing formation through said production tubing and said pipe, separately to each of said first and second sections of said fluid pump chamber;

wherein said production tubing having an inside passageway communicating said oil and gas from said oil and gas source directly to said multi-phase fluid pump system, said multi-phase fluid having a gas to oil ratio that varies over time, including some periods of time when the mixture is substantially only oil;

wherein said driving fluid comprises hydraulic fluid.

31. A multi-phase fluid pump system operable for use in an oil and gas well system, said system comprising:

driving fluid cylinder having a driving fluid chamber with a varying volume that is adapted for receiving therein, containing and expelling therefrom, a driving fluid, and having a driving fluid piston movable within said driving fluid cylinder to vary the volume of the driving fluid chamber;

a fluid pump cylinder having a fluid pump chamber with a varying volume that is adapted for receiving therein, containing and expelling therefrom, a multi-phase fluid the oil to gas ratio of which varies over time during operation, and further comprising a fluid pump piston movable within said fluid pump cylinder to vary the volume of the fluid pump chamber, said fluid pump piston operable to be driven by said driving fluid piston to pressurize a quantity of fluid located within said fluid pump chamber, said fluid pump system being operable for communication of a supply of multi-phase fluid from an oil and gas well to said fluid pump chamber, the oil to gas ratio of which varies over time during operation;

a buffer chamber located adjacent to said fluid pump chamber, said buffer chamber being sealed by one or more seals from said fluid pump chamber, and in operation of said pump system, said buffer chamber not receiving the multi-phase fluid from said oil and gas well;

said buffer chamber providing a chamber that inhibits movement of at least one non-driving fluid component accompanying the multi-phase fluid supplied to said fluid pump chamber, from being communicated from said fluid pump chamber into said driving fluid chamber, when in operation the multi-phase fluid is located within said fluid pump chamber and is pressurized by said fluid pump piston;

a scraper device located on and extending around an outward facing surface of said driving fluid piston, said scraper device being positioned adjacent an inner surface of said buffer chamber and said scraper device operable during movement of said driving fluid piston within said buffer chamber to remove residue material from said inner surface of said buffer chamber to maintain said residue material within said buffer chamber;

wherein said driving fluid comprises hydraulic fluid.

32. The pump system as claimed in claim 31, wherein during operation, during a first stroke of the fluid pump piston said pressure inside the fluid pump chamber increases by about 150 psi to a discharge pressure as said fluid pump piston moves about 8 inches within said fluid pump cylinder.

33. The pump system as claimed in claim 32, wherein during operation, during a second stroke of the fluid pump piston, said pressure inside the fluid pump chamber increases by about 180 psi as said fluid pump piston moves about 30 inches within said fluid pump cylinder.

34. The pump system as claimed in claim 31, wherein said scraper device is a scraper seal device.

35. The pump system as claimed in claim 34, wherein said scraper seal device comprises an underlying energizer element operable such that said scraper seal device maintains engagement between said outward facing surface of said driving fluid piston and said inner surface of said buffer chamber.

36. A method of pumping a multi-phase fluid from an oil well comprising:

delivering a flow of a multi-phase fluid through a pipe to a first multi-phase fluid pumping system, wherein said multi-phase fluid has a gas/liquid ratio that varies during operation including some periods of time when the mixture is substantially only liquid;

operating said first multi-phase fluid pumping system to increase the pressure of the multi-phase fluid that is delivered thereto;

delivering the flow of pressurized multi-phase fluid from the first multi-phase fluid pumping system to a second multi-phase fluid pumping system;

operating said second multi-phase fluid pumping system to further increase the pressure of the multi-phase fluid that is delivered thereto;

delivering the flow of pressurized multi-phase fluid from the second multi-phase fluid pumping system to a discharge pipe;

wherein the first multi-phase fluid pumping system and the second multi-phase fluid pumping system both comprise a multi-phase pump system that is located above ground surface, and both comprise:

a driving fluid cylinder having a driving fluid chamber with a varying volume that is adapted for receiving therein, containing and expelling therefrom, driving fluid, and having a driving fluid piston movable within said driving fluid cylinder to vary the volume of the driving fluid chamber;

a fluid pump cylinder having a fluid pump chamber with a varying volume that is adapted for receiving therein, containing and expelling therefrom, the multi-phase fluid, the oil to gas ratio of which varies over time during operation, and further comprising a fluid pump piston movable within said fluid pump cylinder to vary the volume of the fluid pump chamber, said fluid pump piston operable to be driven by said driving fluid piston to pressurize a quantity of fluid located within said fluid pump chamber, said fluid pump system being operable for communication of a supply of multi-phase fluid from an oil and gas well to said fluid pump chamber, the oil to gas ratio of which varies over time during operation;

a buffer chamber located adjacent to said fluid pump chamber, said buffer chamber being sealed by one or more seals from said fluid pump chamber, and in operation of said pump system, said buffer chamber not receiving the multi-phase fluid from said oil and gas well;

said buffer chamber providing a chamber that inhibits movement of at least one non-driving fluid component accompanying the multi-phase fluid supplied to said fluid pump chamber, from being communicated from said fluid pump chamber into said driving fluid chamber, when in operation the multi-phase fluid is located within said fluid pump chamber and is pressurized by said fluid pump piston;

wherein said driving fluid comprises hydraulic fluid.

37. The method as claimed in claim 36, wherein said first multi-phase fluid pumping system and said second multi-phase fluid pumping system are arranged in series.

38. A method of pumping a multi-phase fluid from an oil well comprising:

delivering a flow of a multi-phase fluid from a plurality of oil and gas producing oil wells to a common header pipe;

delivering the flow from the common header pipe to a multi-phase fluid pumping system, wherein said multi-phase fluid in the flow has a gas/liquid ratio that varies during operation;

operating said multi-phase fluid pumping system to increase the pressure of the multi-phase fluid that is delivered thereto;

delivering the flow of pressurized multi-phase fluid from the multi-phase fluid pumping system to one or more discharge pipes;

wherein the multi-phase fluid pump system is located above ground surface and comprises:

a driving fluid cylinder having a driving fluid chamber with a varying volume that is adapted for receiving therein, containing and expelling therefrom, driving fluid, and having a driving fluid piston movable within said driving fluid cylinder to vary the volume of the driving fluid chamber;

a fluid pump cylinder having a fluid pump chamber with a varying volume that is adapted for receiving therein, containing and expelling therefrom, the multi-phase fluid, the oil to gas ratio of which varies over time during operation, and further comprising a fluid pump piston movable within said fluid pump cylinder to vary the volume of the fluid pump chamber, said fluid pump piston operable to be driven by said driving fluid piston to pressurize a quantity of the multi-phase fluid located within said fluid pump chamber, said fluid pump system being operable for communication of a supply of the multi-phase fluid from an oil and gas well to said fluid pump chamber, the oil to gas ratio of which varies over time during operation;

a buffer chamber located adjacent to said fluid pump chamber, said buffer chamber being sealed by one or more seals from said fluid pump chamber, and in operation of said pump system, said buffer chamber not receiving the multi-phase fluid from said oil and gas well;

said buffer chamber providing a chamber that inhibits movement of at least one non-driving fluid component accompanying the multi-phase fluid supplied to said fluid pump chamber, from being communicated from said fluid pump chamber into said driving fluid chamber, when in operation the multi-phase fluid is located within said fluid pump chamber and is pressurized by said fluid pump piston;

wherein said driving fluid comprises hydraulic fluid.

39. The method as claimed in claim 38, further comprising:

periodically, diverting fluid from a selected one of said plurality of oil and gas producing wells to a test separator.

40. The method as claimed in claim 39 wherein fluid diverted to the test separator is recombined to flow to the multi-phase fluid pumping station.

41. The method as claimed in claim 40 wherein flow pressurized by said multi-phase fluid pumping system is delivered to a group separator to separate the flow into liquid and gas components.

42. The method as claimed in claim 41 wherein flow from said test separator is delivered to a group separator for separate the flow into liquid and gas components, and thereafter the liquid components are delivered to said multi-phase fluid pumping system.

* * * * *